United States Patent [19]

Legg

[11] 4,156,133

[45] May 22, 1979

[54] REPRODUCTION MACHINE WITH PAPER PATH DETECTION DIAGNOSTICS

[75] Inventor: Ernest L. Legg, Fairport, N.Y.

[73] Assignee: Xerox Corporation, Stamford, Conn.

[21] Appl. No.: 829,026

[22] Filed: Aug. 30, 1977

[51] Int. Cl.[2] ..... G06B 27/06

[52] U.S. Cl. ..... 235/92 SB; 235/92 R; 355/14

[58] Field of Search ..... 235/92 SB, 92 PD, 92 CT, 235/92 T, 92 DP; 355/14

[56] References Cited

U.S. PATENT DOCUMENTS

| | | | |
|---|---|---|---|
| 3,709,485 | 1/1973 | Acquaviva | 235/92 SB |
| 3,893,175 | 7/1975 | Solomon | 235/92 SB |
| 3,984,815 | 10/1976 | Drexler et al. | 235/92 T |
| 4,035,072 | 7/1977 | Deetz et al. | 355/14 |

*Primary Examiner*—Joseph M. Thesz

[57] ABSTRACT

An electrostatographic type copying or reproduction machine incorporating a programmable controller to operate the various machine components in an integrated manner to produce copies is disclosed herein. The controller carries a master program varying machine operating parameters from which an operating program for the specific copy run desired is formed and used to operate the machine components to produce the copies programmed. As an aide to maintain copy quality and machine reliability, the programmable controller includes diagnostic programs for operating the machine components in a different manner. The machine includes a plurality of sensors disposed along the paper path through which sheets of paper are transported to various locations in the machine. As each sheet is detected, the time on a counter is stored in the controller memory. One of the diagnostic programs is utilized to selectively access the times as desired.

9 Claims, 57 Drawing Figures

FROM CLOCK 552
Ø1
Ø2
542
507
510
TO: MEMORY 545,546
ADDRESS
A0
A15
(HOLD A)
(HOLD)
(DBIN)
EN
TO: MEMORY
TO: MEMORY 545,546
508
511
DATA
D0
D7
TO: MEMORY READY 548
(MEMR)
(OUT)
(WO)
(INP)
(MI)
(HALTA)
(STACK)
(INTA)
LATCH REGISTER
Ø1-1
FROM: 552
(SYNC)
(READY)
FROM: MEMORY READY 548
(INT)
(RESET)
(WAIT)
FROM: 550
(INTE)
(WR)
TO: MEMORY 546,545

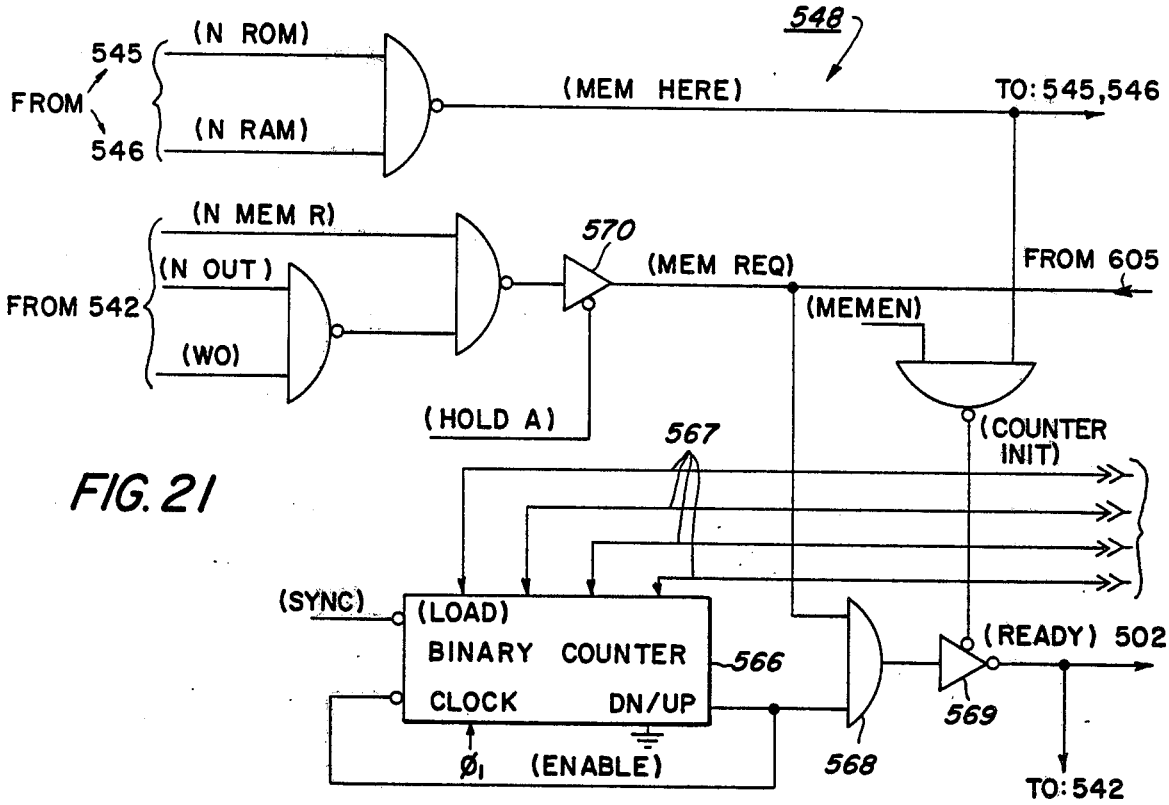
FIG. 21
MEMORY READY
FIG. 24
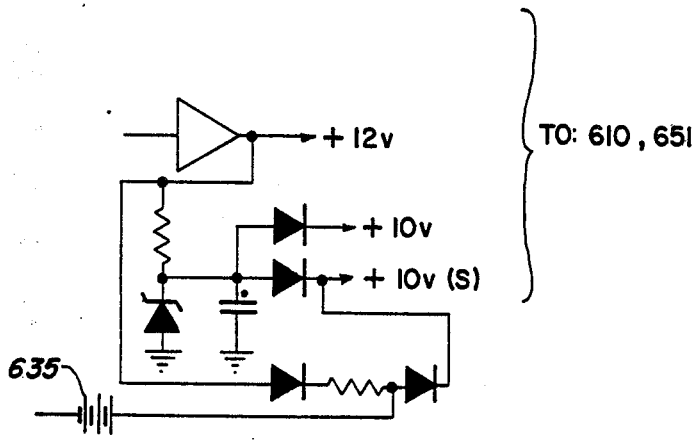

PITCH RESET INTERRUPT ROUTINE

LEGEND:

SR-SHIFT REGISTER
SR@PTR-SHIFT REGISTER POINTER
EV-EVENT
EV@PTR-EVENT POINTER
CNTR-COUNTER
INCRM-INCREMENT

MACHINE INTERRUPT ROUTINE

LEGEND:

PNTR- POINTER
INCRM-INCREMENT
REL-RELATIVE
ADDR-ADDRESS
SR-SHIFT REGISTER
REG-REGISTER
SUBR-SUBROUTINE

REAL TIME INTERRUPT

LEGEND:

PNTR - POINTER
RTC - REAL TIME COUNTER
CNTR - COUNTER
REG - REGISTER

REPRODUCTION MACHINE WITH PAPER PATH DETECTION DIAGNOSTICS

BACKGROUND OF THE INVENTION

This invention relates to electrostatographic xerographic type reproduction machines, and more particularly, to an improved control system for such machines.

The advent of higher speed and more complex copiers and reproduction machines has brought with it a corresponding increase in the complexity in the machine control wiring and logic. While this complexity manifests itself in many ways, perhaps the most onerous involves the inflexibility of the typical control logic/-wiring systems. For as can be appreciated, simple unsophisticated machines with relatively simple control logic and wiring can be altered and modified easily to incorporate changes, retrofits, and the like. Servicing and repair of the control logic is also fairly simple. On the other hand, some modern high speed machines, which often include sorters, a document handler, choice of copy size, multiple paper trays, jam protection and the like have extremely complex logic systems making even the most minor changes and improvements in the control logic difficult, expensive and time consuming. And servicing or repairing the machine control logic may similarly entail substantial difficulty, time and expense.

To mitigate problems of the type alluded to, a programmable controller may be used, enabling changes and improvements in the machine operation to be made through the expediency of reprogramming the controller. However, the control data which operates the machine and which is stored in the controller memory pending use, must be transferred to the various machine components at the proper time and in the correct sequence without unduly interfering with or intruding unnecessarily upon the other essential functions and operations of the controller.

Unfortunately, as the complexity of these high speed reproduction machines increase, so does the potential for malfunctions. The present invention is especially concerned with mitigating downtime by incorporating built-in diagnostic programs in the controller which directs the operation of the machine components. The automatic document handler is an extremely intricate device which must be exactly synchronized with the machine processor. Accordingly, some of these diagnostic programs are directed towards checking the operation of the document handler.

OBJECTS AND SUMMARY OF THE INVENTION

Therefore, it is the primary object of this invention to provide built-in diagnostic capabilities for a reproduction machine under the control of a programmable controller.

It is a further object of this invention to provide a control for the machine document handler that automatically calculates and displays document travel times between selected locations.

These and other objects of this invention are accomplished by providing the machine controller with built-in diagnostic programs which can be accessed by service personnel or, in some instances, by the user. The machine includes a plurality of sensors disposed along the paper path through which sheets of paper are transported to various locations in the machine. As the sheets are detected by the sensors, the time on a counter is stored in the controller memory. One of the diagnostic programs is utilized to selectively access the stored times from the memory. In a preferred embodiment, the document travel times between various locations in the document handler are calculated and displayed.

BRIEF DESCRIPTION OF THE DRAWINGS

Other objects and advantages will be apparent from the ensuing description and drawings in which:

FIG. 21 is a logic schematic of the CPU memory ready;

FIG. 24 is a logic schematic of the nonvolatile memory power supply;

DETAILED DESCRIPTION OF THE PREFERRED EMBODIMENT OF THE INVENTION

Figure 1:
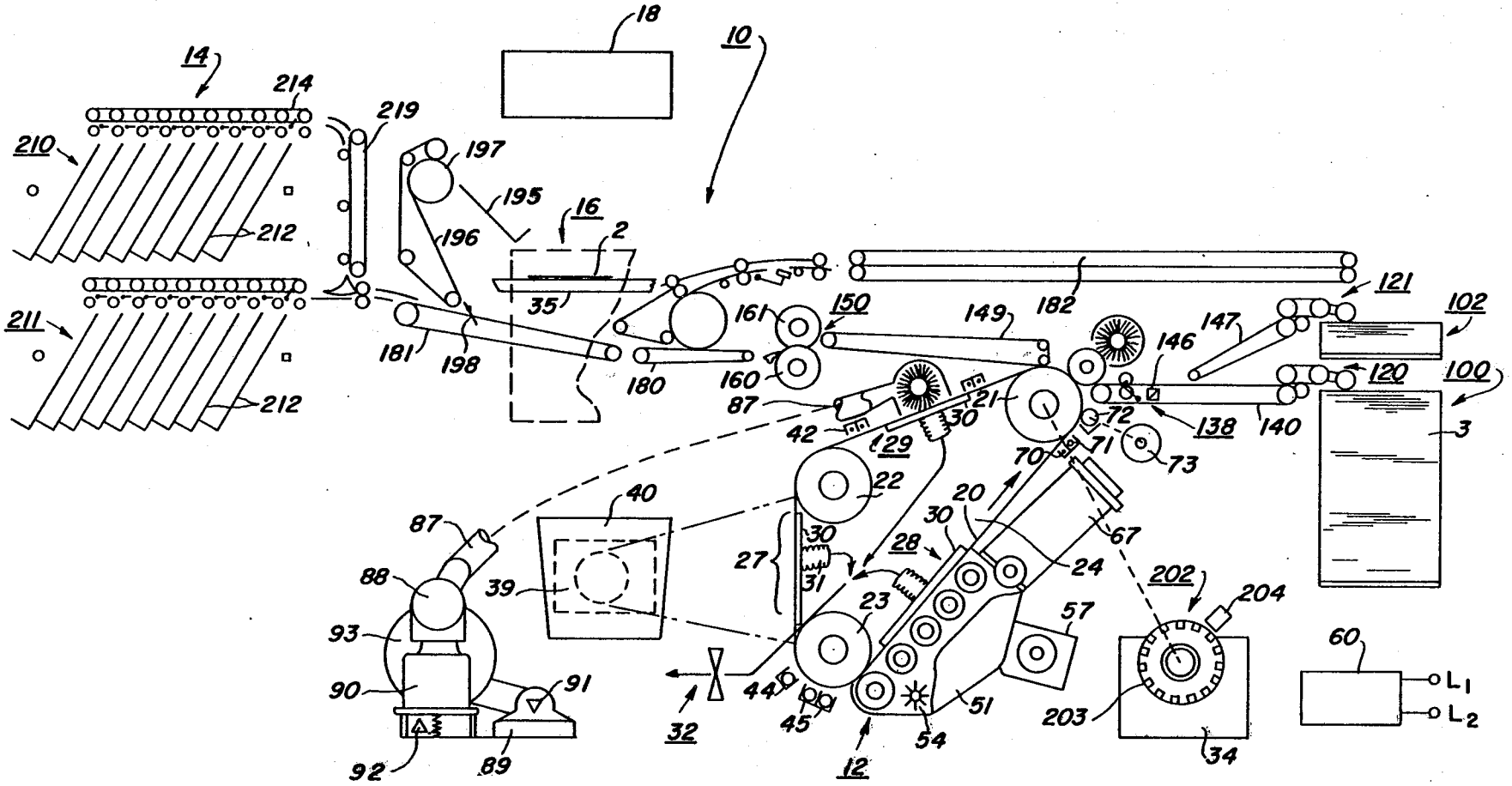
FIG. 1 is a schematic representation of an exemplary reproduction apparatus incorporating the control system of the present invention.
Figure 2:
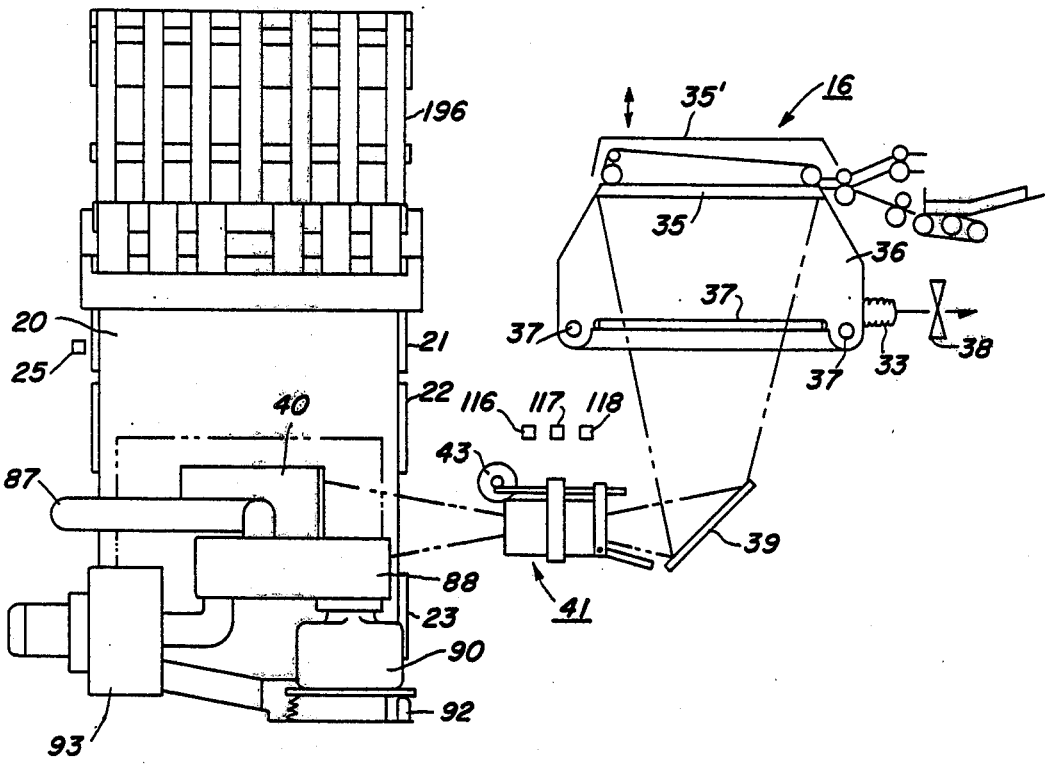
FIG. 2 is a vertical sectional view of the apparatus shown in FIG. 1 along the image plane.
Figure 3:
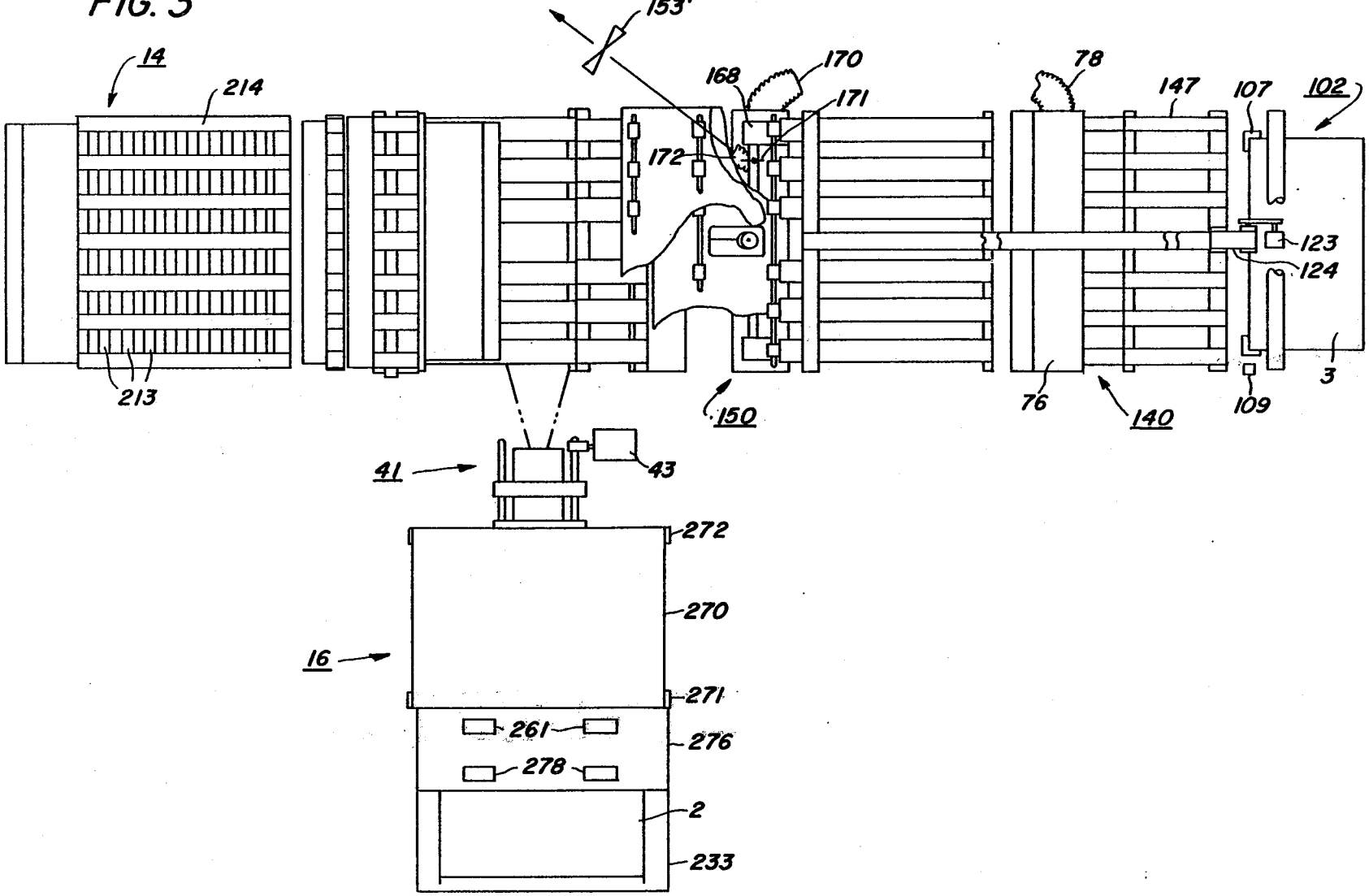
FIG. 3 is a top plane view of the apparatus shown in FIG. 1.

Referring particularly to FIGS. 1–3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combinations thereof may instead by envisioned.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type arrangements wherein webs of photoconductive material may be played in and out of the interior of supporting cylinders.

Figure 4:
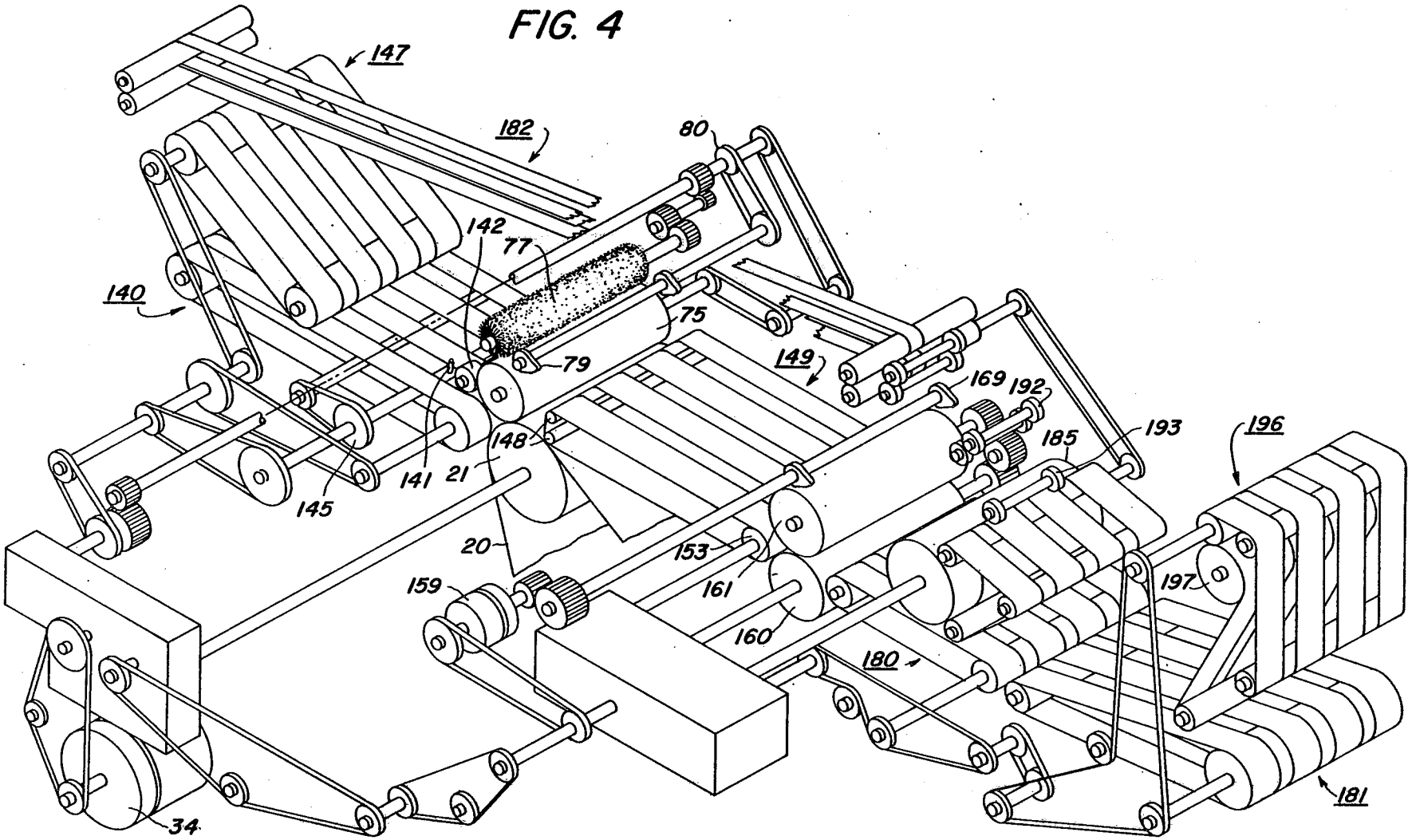
FIG. 4 is an isometric view showing the drive train for the apparatus shown in FIG. 1.

Suitable biasing means (not shown) are provided on subframe 24 to tension the photoreceptor belt 20 and insure movement of belt 20 along a prescribed operating path. Belt tracking switch 25 (shown in FIG. 2) monitors movement of belt 20 from side to side. Belt 20 is supported so as to provide a trio of substantially flat belt runs opposite exposure, developing, and cleaning stations 27, 28, 29 respectfully. To enhance belt flatness at these stations, vacuum platens 30 are provided under belt 20 at each belt run. Conduits 31 communicate vacuum platens 30 with a vacuum pump 32. Photoconductive belt 20 moves in the direction indicated by the solid line arrow, drive thereto being effected through roll 21, which in turn is driven by main drive motor 34, as seen in FIG. 4.

Processor 12 includes a generally rectangular, horizontal transparent platen 35 on which each original 2 to be copied is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover 35′ may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 on operator module 800. (See FIG. 32) Sensors 116, 117, 118 signal the present disposition of lens assembly 41. Exposure of the previously charged belt 20 selectively discharges the photoconductive belt to produce on belt 20 an electrostatic latent image of the original 2. To prepare belt 20 for imaging, belt 20 is uniformly charged to a preselected level by charge corotron 42 upstream of the exposure station 27.

Figure 5:
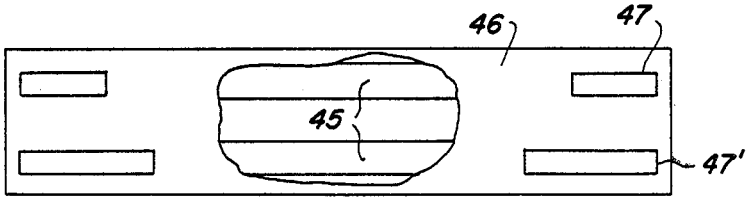
FIG. 5 is an enlarged view showing details of the photoreceptor edge fade-out mechanism for the apparatus shown in FIG. 1.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width of belt 20 to erase (i.e. discharge) areas of belt 20 before the first image, between successive images, and after the last image. Lamps 45, which are referred to herein as edge fadeout lamps, serve to erase areas bordering each side of the images. Referring particularly to FIG. 5, edge fadeout lamps 45, which extend transversely to belt 20, are disposed within a housing 46 having a pair of transversely extending openings 47, 47′ of differing length adjacent each edge of belt 20. By selectively actuating one or the other of the lamps 45, the width of the area bordering the sides of the image that is erased can be controlled.

Figure 6:
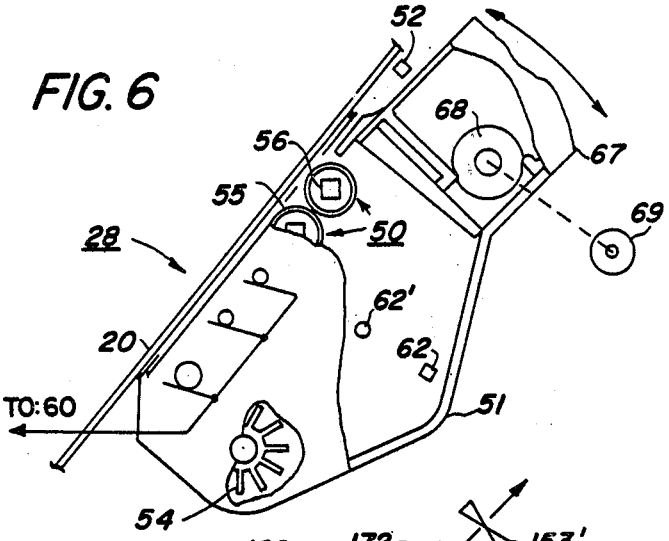
FIG. 6 is an enlarged view showing details of the developing mechanism for the apparatus shown in FIG. 1.
Figure 7:
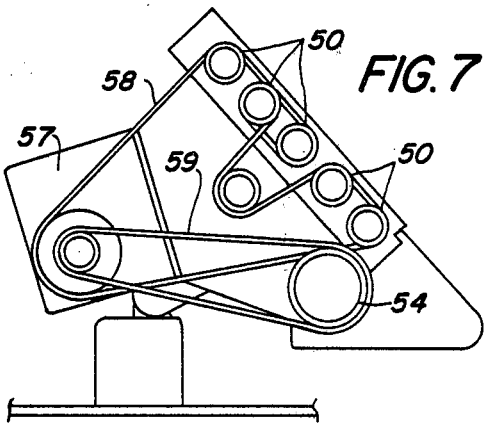
FIG. 7 is an enlarged view showing details of the developing mechanism drive.

Referring to FIGS. 1, 6 and 7, magnetic brush rolls 50 are provided in a developer housing 51 at developing station 28. Housing 51 is pivotally supported adjacent the lower end thereof with interlock switch 52 to sense disposition of housing 51 in operative position adjacent belt 20. The bottom of housing 51 forms a sump within which a supply of developing material is contained. A rotatable auger 54 in the sump area serves to mix the developing material and bring the material into operative relationship with the lowermost of the magnetic brush rolls 50.

As will be understood by those skilled in the art, the electrostatically attractable developing material commonly used in magnetic brush developing apparatus of the type shown comprises a pigmented resinous powder, referred to as toner, and larger granular beads referred to as carrier. To provide the necessary magnetic properties, the carrier is comprised of a magnetizable material such as steel. By virtue of the magnetic fields established by developing rolls 50 and the interrelationship therebetween, a blanket of developing material is formed along the surfaces of developing rolls 50 adjacent the belt 20 and extending from one roll to another. Toner is attracted to the electrostatic latent image from the carrier bristles to produce a visible powder image on the surface of belt 20.

Magnetic brush rolls 50 each comprise a rotatable exterior sleeve 55 with relatively stationary magnet 56 inside. Sleeves 55 are rotated in unison and at substantially the same speed as belt 20 by a developer drive motor 57 through a belt and pulley arrangement 58. A second belt and pulley arrangement 59 drives auger 54.

To regulate development of the latent electrostatic images on belt 20, magnetic brush sleeves 55 are electrically biased. A suitable power supply 60 is provided for this purpose with the amount of bias being regulated by controller 18.

Figure 8:
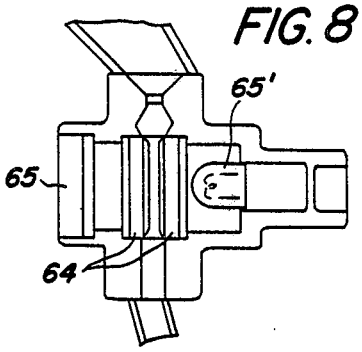
FIG. 8 is an enlarged view showing details of the developability control for the apparatus shown in FIG. 1.
Figure 11:
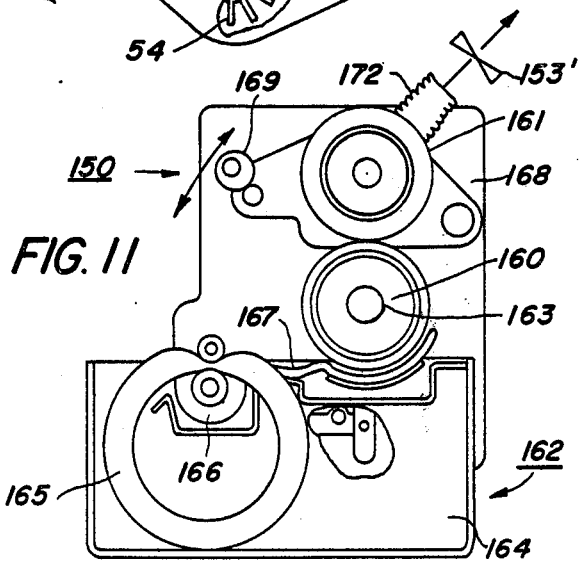
FIG. 11 is an enlarged view showing details of the fuser for the apparatus shown in FIG. 1.

Developing material is returned to the upper portion of developer housing 51 for reuse. A photocell 62 monitors the level of developing material in housing 51 with lamp 62' therefore spaced opposite to the photocell 62. The disclosed machine is also provided with automatic developability control which maintains an optimum proportion of toner-to-carrier material by sensing toner concentration and replenishing toner, as needed. As shown in FIG. 8, the automatic developability control comprises a pair of transparent plates 64 mounted in spaced, parallel arrangement in developer housing 51 such that a portion of the returning developing material passes therebetween. A suitable circuit, not shown, alternately places a charge on the plates 64 to attract toner thereto. Photocell 65 on one side of the plate pair senses the developer material as the material passes therebetween. Lamp 65' on the opposite side of plate pair 64 provides reference illumination. In this arrangement, the returning developing material is alternately attracted and repelled to and from plates 64. The accumulation of toner, i.e. density determines the amount of light transmitted from lamp 65' to photocell 65. Photocell 65 monitors the density of the returning developing material with the signal output therefrom being used by controller 18 to control the amount of fresh or make-up toner to be added to developer housing 51 from toner supply container 67.

To discharge toner from container 67, rotatable dispensing roll 68 is provided in the inlet to developer housing 51. Motor 69 drives roll 68. When fresh toner is required, as determined by the signal from photocell 65, controller 18 actuates motor 69 to turn roll 68 for a timed interval. The rotating roll 68, which is comprised of a relatively porous sponge-like material, carries toner particles thereon into developer housing 51 where it is discharged. Pre-transfer corotron 70 and lamp 71 are provided downstream of magnetic brush rolls 50 to regulate developed image charges before transfer.

A magnetic pick-off roll 72 is rotatably supported opposite belt 20 downstream of pre-transfer lamp 71, roll 72 serving to scavenge leftover carrier from belt 20 preparatory to transfer of the developed image to the copy sheet 3. Motor 73 turns roll 72 in the same direction and at substantially the same speed as belt 20 to prevent scoring or scratching of belt 20. One type of magnetic pick-off roll is shown in U.S. Pat. No. 3,834,804, issued Oct. 10, 1974 to Bhagat et al.

Figure 9:
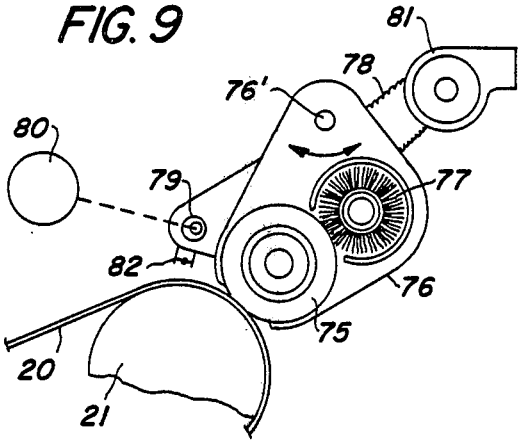
FIG. 9 is an enlarged view showing details of the transfer roll support mechanism for the apparatus shown in FIG. 1.
Figure 12:
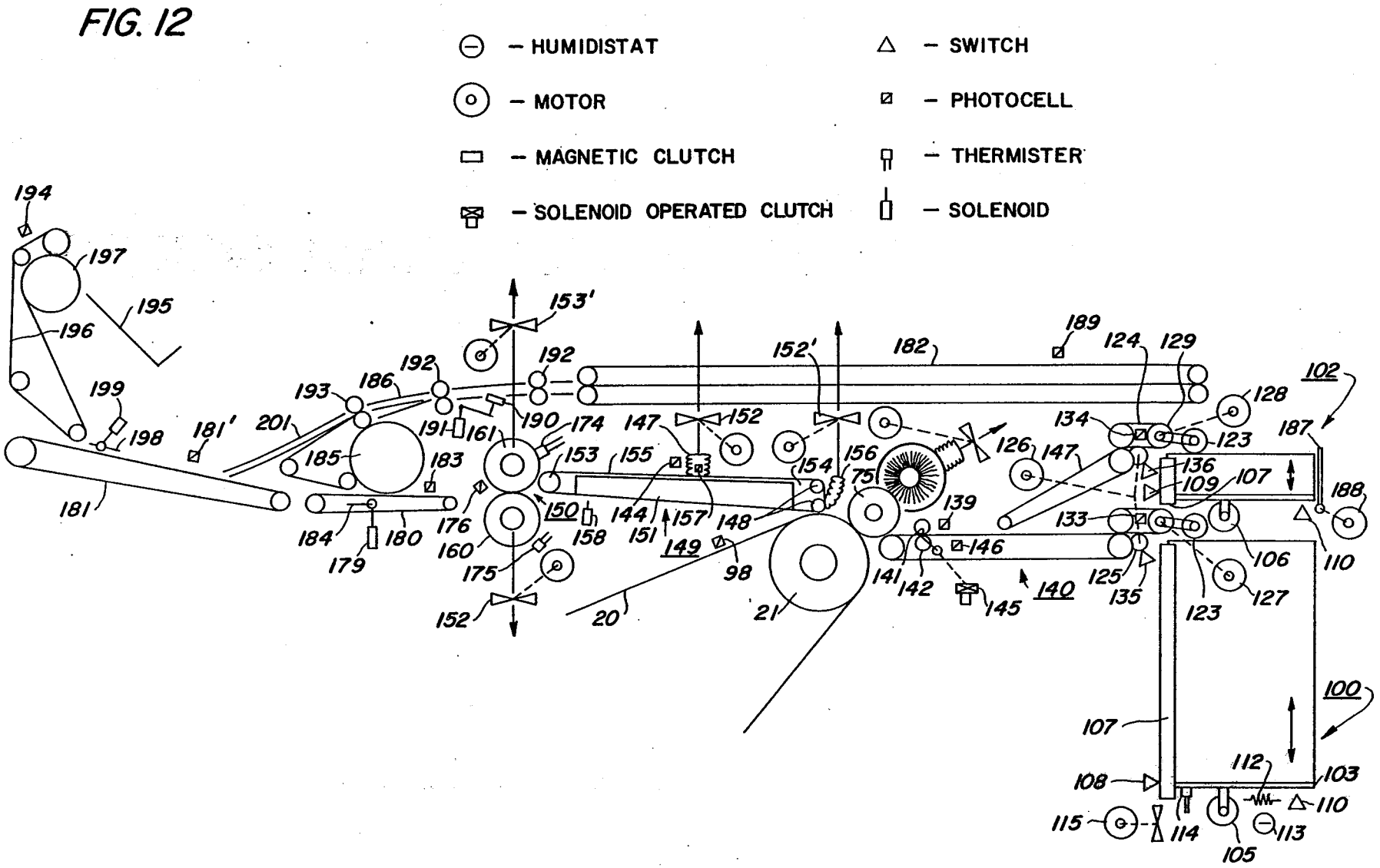
FIG. 12 is a schematic view showing the paper path and sensors of the apparatus shown in FIG. 1.

Referring to FIGS. 4, 9 and 12, to transfer developed images from belt 20 to the copy sheets 3, a transfer roll 75 is provided. Transfer roll 75, which forms part of the copy sheet feed path, is rotatably supported within a transfer roll housing 76 opposite belt support roll 21. Housing 76 is pivotally mounted for swinging movement about axis 76' to permit the transfer roll assembly to be moved into and out of operative relationship with belt 20. A transfer roll cleaning brush 77 is rotatably journalled in transfer roll housing 76 with the brush periphery in contact with transfer roll 75. Transfer roll 75 is driven through contact with belt 20 while cleaning brush 77 is coupled to main drive motor 34. To remove toner, housing 76 is connected through conduit 78 with vacuum pump 81. To facilitate and control transfer of the developed images from belt 20 to the copy sheets 3, a suitable electrical bias is applied to transfer roll 75.

To permit transfer roll 75 to be moved into and out of operative relationship with belt 20, cam 79 is provided in driving contact with transfer roll housing 76. Cam 79 is driven from motor 34 through an electromagnetically operated one revolution clutch 80. Spring means (not shown) serves to maintain housing 76 in driving engagement with cam 79.

To facilitate separation of the copy sheets 3 from belt 20 following transfer of developed images, a detack corotron 82 is provided. Corotron 82 generates a charge designed to neutralize or reduce the charges tending to retain the copy sheet on belt 20. Corotron 82 is supported on transfer roll housing 76 opposite belt 20 and downstream of transfer roll 75.

Figure 10:
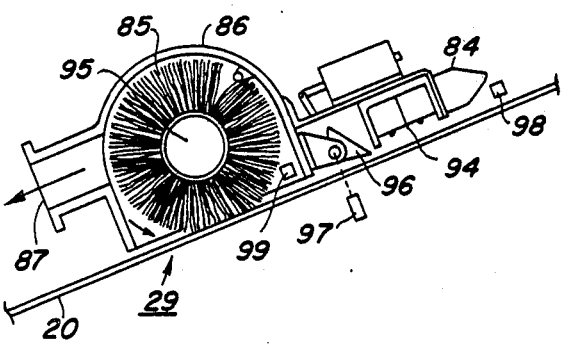
FIG. 10 is an enlarged view showing details of the photoreceptor cleaning mechanism for the apparatus shown in FIG. 1.

Referring to FIGS. 1, 2 and 10, to prepare belt 20 for cleaning, residual charges on belt 20 are removed by discharge lamp 84 and preclean corotron 94. A cleaning brush 85, rotatably supported within an evacuated semicircular shaped brush housing 86 at cleaning station 29, serves to remove residual developer from belt 20. Motor 95 drives brush 85, brush 85 turning in a direction opposite that of belt 20.

Vacuum conduit 87 couples brush housing 86 through a centrifugal type separator 88 with the suction side of vacuum pump 93. A final filter 89 on the outlet of pump 93 traps particles that pass through separator 88. The heavier toner particles separated by separator 88 drop into and are collected in one or more collecting bottles 90. Pressure sensor 91 monitors the condition of final filter 89 while a sensor 92 monitors the amount of toner particles in collecting bottles 90.

To obviate the danger of copy sheets remaining on belt 20 and becoming entangled with the belt cleaning mechanism, a deflector 96 is provided upstream of cleaning brush 85. Deflector 96, which is pivotally supported on the brush housing 86, is operated by solenoid 97. In the normal or off position, deflector 96 is spaced from belt 20 (the solid line position shown in the drawings). Energization of solenoid 97 pivots deflector 96 downwardly to bring the deflector leading edge into close proximity to belt 20.

Sensors 98, 99 are provided on each side of deflector 96 for sensing the presence of copy material on belt 20. A signal output from upstream sensor 98 triggers solenoid 97 to pivot deflector 96 into position to intercept the copy sheet on belt 20. The signal from sensor 98 also initiates a system shutdown cycle (mis-strip jam) wherein the various operating components are, within a prescribed interval, brought to a stop. The interval permits any copy sheet present in fuser 150 to be removed, sheet trap solenoid 158 (FIG. 12) having been actuated to prevent the next copy sheet from entering fuser 150 and becoming trapped therein. The signal from sensor 99, indicating failure of deflector 96 to intercept or remove the copy sheet from belt 20, triggers an immediate or hard stop (sheet on selenium jam) of the processor. In such instances the power to drive motor 34 is interrupted to bring belt 20 and the other components driven therefrom to an immediate stop.

Referring particularly to FIGS. 1 and 12, copy sheets 3 comprise precut paper sheets supplied from either main or auxiliary paper trays 100, 102. Each paper tray has a platform or base 103 for supporting in stack-like fashion a quantity of sheets. The tray platforms 103 are supported for vertical up and down movement by motors 105, 106 being provided to raise and lower the platform. Side guide pairs 107, in each tray 100, 102 delimit the tray side boundaries, the guide pairs being adjustable toward and away from one another in accommodation of different size sheets. Sensors 108, 109 respond to the position of each side guide pair 107, the output of sensors 108, 109 serving to regulate operation of edge fadeout lamps 45 and fuser cooling valve 171 (FIG. 3). Lower limit switches 110 on each tray prevent overtravel of the tray platform in a downward direction.

A heater 112 is provided below the platform 103 of main tray 100 to warm the tray area and enhance feeding of sheets therefrom. Humidstat 113 and thermostat 114 control operation of heater 112 in response to the temperature/humidity conditions of main tray 100. Fan 115 is provided to circulate air within tray 100.

To advance the sheets 3 from either main or auxiliary tray 100, 102, main and auxiliary sheet feeders 120, 121 are provided. Feeders 120, 121 each include a nudger roll 123 to engage and advance the topmost sheet in the paper tray forward into the nip formed by a feed belt 124 and retard roll 125. Retard rolls 125, which are driven at an extremely low speed by motor 126, cooperate with feed belts 124 to restrict feeding of sheets from trays 100, 102 to one sheet at a time.

Feed belts 124 are driven by main and auxiliary sheet feed motors 127, 128 respectively. Nudger rolls 123 are supported for pivotal movement about the axis of feed belt drive shaft 129 with drive to the nudger rolls taken from drive shaft 129. Stack height sensors 133, 134 are provided for the main and auxiliary trays, the pivoting nudger rolls 123 serving to operate sensors 133, 134 in response to the sheet stack height. Main and auxiliary tray misfeed sensors 135, 136 are provided at the tray outlets.

Main transport 140 extends from main paper tray 100 to a point slightly upstream of the nip formed by photoconductive belt 20 and transfer roll 75. Transport 140 is driven from main motor 34. To register sheets 3 with the images developed on belt 20, sheet register fingers 141 are provided, fingers 141 being arranged to move into and out of the path of the sheets on transport 140 once each revolution (see also FIG. 4). Registration fingers 141 are driven from main motor 34 through electromagnetic clutch 145 (seen in FIG. 4). A timing or reset switch 146 is set once on each revolution of sheet register fingers 141. Sensor 139 monitors transport 140 for jams. Further amplification of sheet register system may be found in U.S. Pat. No. 3,781,004, issued Dec. 25, 1973 to Buddendeck et al.

Pinch roll pair 142 is interspaced between transport belts that comprise main transport 140 on the downstream side of register fingers 141. Pinch roll pair 142 are driven from main motor 34.

Auxiliary transport 147 extends from auxiliary tray 102 to main transport 140 at a point upstream of sheet register fingers 141. Transport 147 is driven from motor 34.

To maintain the sheets in driving contact with the belts of transports 140, 147, suitable guides or retainers (not shown) may be provided along the belt runs.

The image bearing sheets leaving the nip formed by photoconductive belt 20 and transfer roll 75 are picked off by belts 155 of the leading edge of vacuum transport 149. Belts 155, which are perforated for the admission of vacuum therethrough, ride on forward roller pair 148 and rear roll 153. A pair of internal vacuum plenums 151, 154 are provided, the leading plenum 154 cooperating with belts 155 to pick up the sheets leaving the belt/transfer roll nip. Transport 149 conveys the image bearing sheets to fuser 150. Vacuum conduits 147, 156 communicate plenums 151, 154 with vacuum pumps 152, 152'. A pressure sensor 157 monitors operation of vacuum pump 152. Sensor 144 monitors transport 149 for jams.

To prevent the sheet on transport 149 from being carried into fuser 150 in the event of a jam or malfunction, a trap solenoid 158 is provided below transport 149. Energization of solenoid 158 raises the armature thereof into contact with the lower face of plenum 154 to intercept and stop the sheet moving therepast.

Referring particularly to FIGS. 3, 4, 11 and 12, fuser 150 comprises a lower heated fusing roll 160 and upper pressure roll 161. Rolls 160, 161 are supported for rotation in fuser housing 162. The core of fusing roll 160 is hollow for receipt of heating rod 163 therewithin.

Housing 162 includes a sump 164 for holding a quantity of liquid release agent, herein termed oil. Dispensing belt 165, moves through sump 164 to pick up the oil, belt 165 being driven by motor 166. A blanket-like wick 167 carries the oil from belt 165 to the surface of fusing roll 160.

Pressure roll 161 is supported within an upper pivotal section 168 of housing 162. This enables pressure roll 161 to be moved into and out of operative contact fusing roll 160. Cam shaft 169 in fuser housing 162 serves to move housing section 168 and pressure roll 161 into operative relationship with fusing roll 160 against a suitable bias (not shown). Cam shaft 169 is coupled to main motor 34 through an electromagnetically operated one revolution clutch 159.

Fuser housing section 168 is evacuated. For this purpose a conduit 170 couples housing section 168 with vacuum pump 153. The ends of housing section 168 are separated into vacuum compartments opposite the ends of pressure roll 161 thereunder to cool the roll ends where smaller size copy sheets 3 are being processed.

Vacuum valve 171 (FIG. 3) in conduit 172 regulates communication of the vacuum compartments with vacuum pump 153' in response to the size sheets as sensed by side guide sensors 108, 109 in paper trays 100, 102.

Fuser roll 160 is driven from main motor 34. Pressure roll 161 is drivingly coupled to fuser roll 160 for rotation therewith.

Thermostat 174 (FIG. 12) in fuser housing 162 controls operation of heating rod 163 in response to temperature. Temperature sensor 175 protects against fuser over-temperature. To protect against trapping of a sheet in fuser 150 in the event of a jam, sensor 176 is provided.

Following fuser 150, the sheet is carried by post fuser transport 180 to either discharge transport 181 or, where duplex or two sided copies are desired, to return transport 182. Sheet sensor 183 monitors passage of the sheets from fuser 150. Transports 180, 181 are driven from main motor 34. Sensor 181' monitors transport 181 for jams. Suitable retaining means may be provided to retain the sheets on transports 180, 181.

A deflector 184, when extended, directs sheets on transport 180 onto conveyor roll 185 and into chute 186 leading to return transport 182. Solenoid 179, when energized raises deflector 184 into the sheet path. Return transport 182 carries the sheets back to auxiliary tray 102. Sensor 189 monitors transport 182 for jams. Paper stop 187 of tray 102 is supported for oscillating movement. Motor 188 drives stops 187 back and forth tap sheets returned to auxiliary tray 102 into alignment for refeeding.

The sheet trapped in chute 186 by stop 190 is removed by pinch roll pairs 192, 193 and fed out through chute 201 onto discharge transport 181. Stop 190 is pivotally supported for swinging movement into and out of chute 186. Solenoid 191 is provided to move stop 190 selectively into or out of chute 186. Pinch roll pairs 192, 193 serve to draw the sheet trapped in chute 186 by stop 190 and carry the sheet forward onto discharge transport 181. Further description of the inverter mechanism may be found in U.S. Pat. No. 3,856,295, issued Dec. 24, 1974, to John H. Looney.

Output tray 195 receives unsorted copies. Transport 196 a portion of which is wrapped around a turn around roll 197, serves to carry the finished copies to tray 195. Sensor 194 monitors transport 196 for jams. To route copies into output tray 195, a deflector 198 is provided. Deflector solenoid 199, when energized, turns deflector 198 to intercept sheets on conveyor 181 and route the sheets onto conveyor 196.

When output tray 195 is not used, the sheets are carried by conveyor 181 to sorter 14.

SORTER

Figure 13:
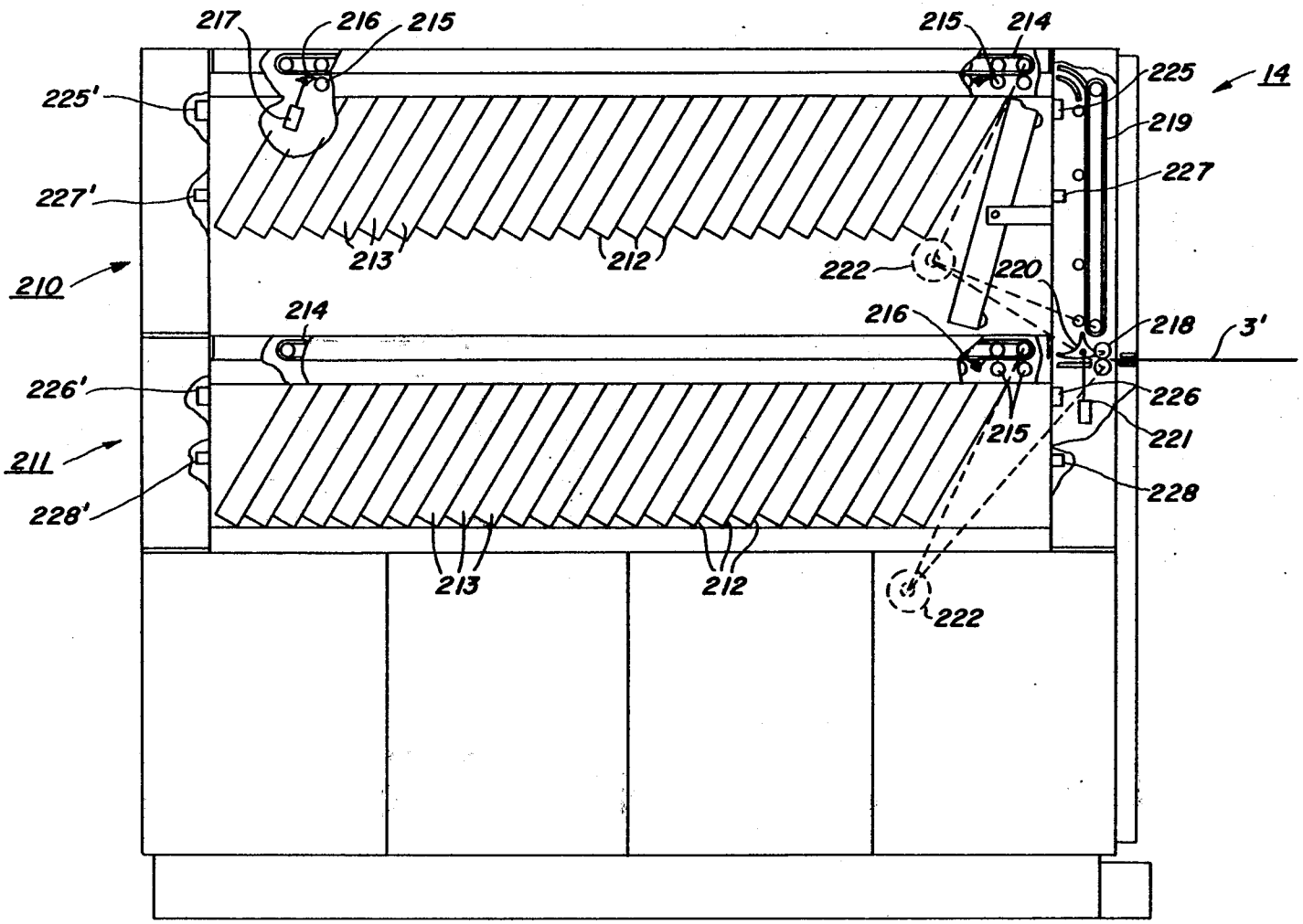
FIG. 13 is an enlarged view showing details of the copy sorter for the apparatus shown in FIG. 1.

Referring particularly to FIG. 13, sorter 14 comprises upper and lower bin arrays 210, 211. Each bin array 210, 211 consists of series of spaced downwardly inclined trays 212, forming a series of individual bins 213 for receipt of finished copies 3'. Conveyors 214 along the top of each bin array, cooperate with idler rolls 215 adjacent the inlet to each bin to transport the copies into juxtaposition with the bins. Individual deflectors 216 at each bin cooperate, when depressed, with the adjoining idler roll 215 to turn the copies into the bin associated therewith. An operating solenoid 217 is provided for each deflector.

A driven roll pair 218 is provided at the inlet to sorter 14. A generally vertical conveyor 219 serves to bring copies 3' to the upper bin array 210. Entrance deflector 220 routes the copies selectively to either the upper or lower bin array 210, 211 respectively. Solenoid 221 operates deflector 220.

Motor 222 is provided to drive the conveyors 214 and 219 of upper bin array 210 and conveyor 214 of lower bin array 211. Roll pair 218 is drivingly coupled to both motor 22.

To detect entry of copies 3' in the individual bins 213, a photoelectric type sensor 225, 226 is provided at one end of each bin array 210, 211 respectively. Sensor lamps 225', 226' are disposed adjacent the other end of the bin array. To detect the presence of copies in the bins 213, a second set of photoelectric type sensors 227, 228 is provided for each bin array, on a level with a tray cutout (not shown). Sensor lamps 227', 228' are disposed opposite sensors 227, 228.

DOCUMENT HANDLER

Figure 14:
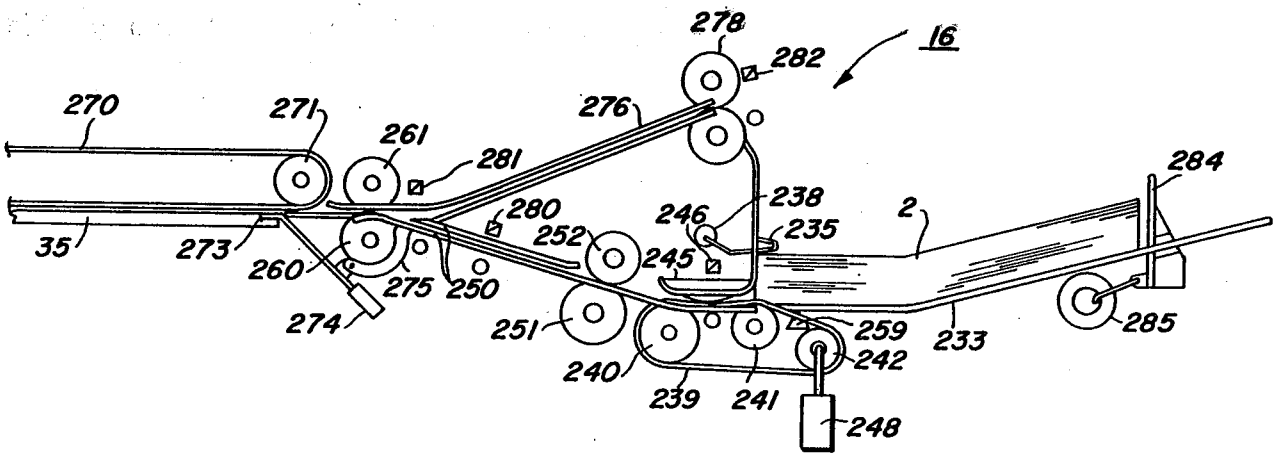
FIG. 14 is a schematic view showing details of the document handler for the apparatus shown in FIG. 1.
Figure 15:
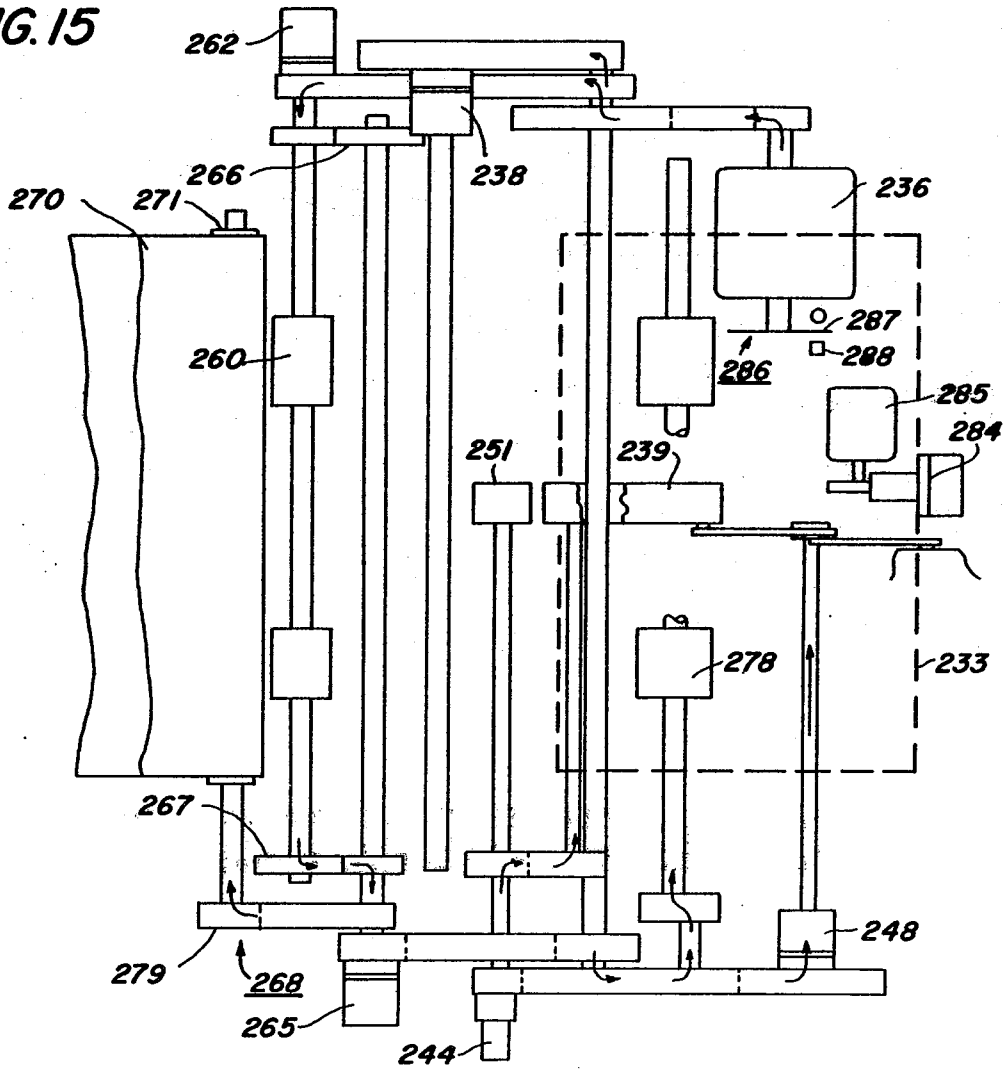
FIG. 15 is a view showing details of the drive mechanism for the document handler shown in FIG. 14.

Referring particularly to FIGS. 14 and 15, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document separation.

A document feed belt 239 is supported on drive and idler rolls 240, 241 and kicker roll 242 under tray 233, tray 233 being suitably apertured to permit the belt surface to project therewithin. Feedbelt 239 is driven by motor 236 through electromagnetic clutch 244. Guide 245, disposed near the discharge end of feed belt 239, cooperates with belt 239 to form a nip between when the documents pass.

A photoelectric type sensor 246 is disposed adjacent the discharge end of belt 239. Sensor 246 responds on failure of a document to feed within a predetermined interval to actuate solenoid 248 to raise kicker roll 242 and increases the surface area of feed belt 239 in contact with the documents. Another sensor 259 located underneath tray 233 provides an output signal when the last document 2 of each set has left the tray 233.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 advance the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233 via return chute 276. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto platen 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276, deflector 275 being raised by solenoid 274 when withdrawing register 273. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

TIMING

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor 34. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Figure 17:
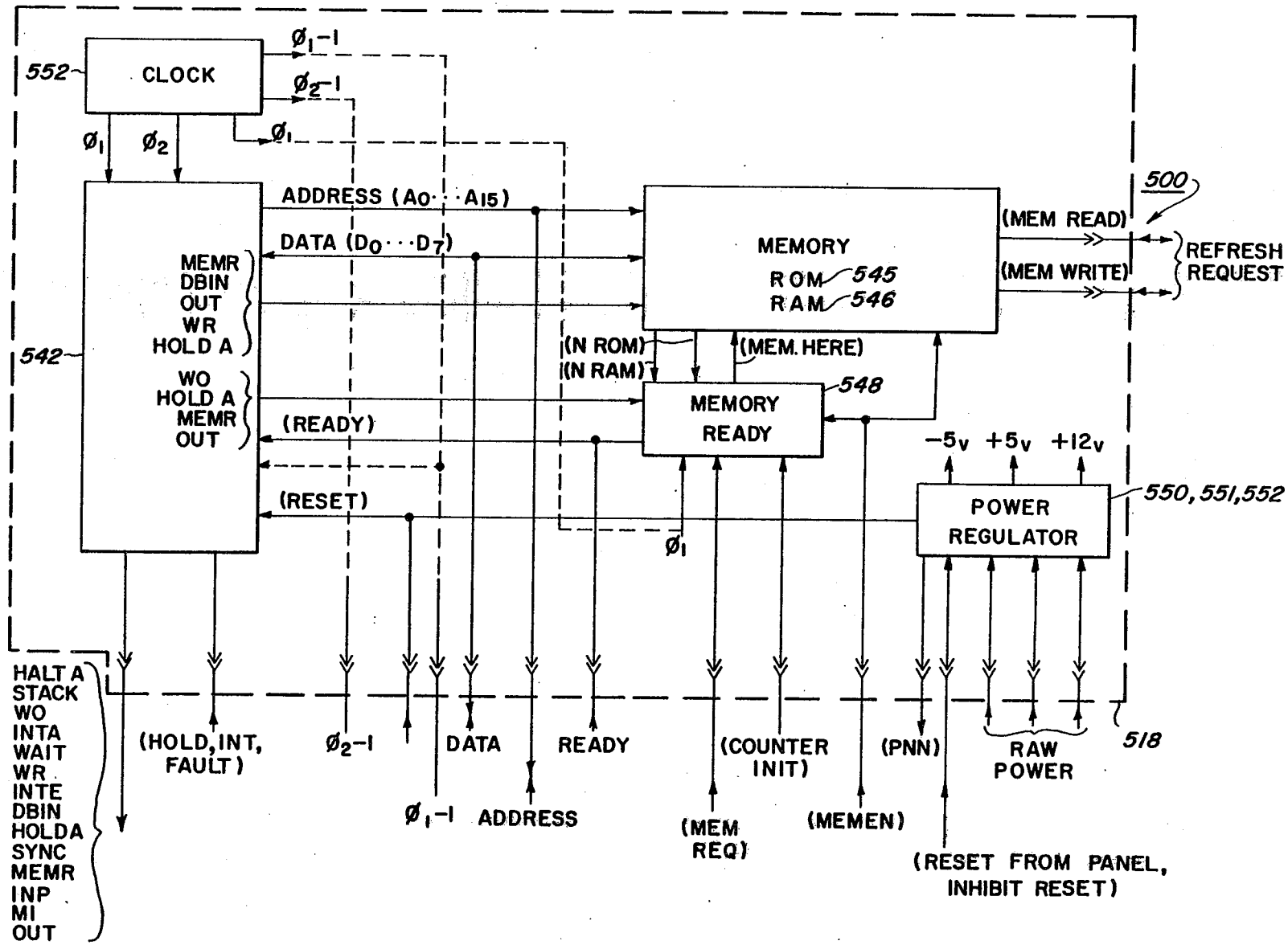
FIG. 17 is a block diagram of the controller CPU.

Referring to FIG. 15, a document handler clock 286 consisting of apertured disc 287 on the output shaft of document handler drive motor 236 and cooperating photoelectric type signal generator 288 is provided. As in the case of machine clock 202, document handler clock 286 produces an output pulse train from which components of the document handler may be synchronized. A real time clock such as clock 552 of FIG. 17, is utilized to control internal operations of the controller 18 as is known in the art.

CONTROLLER

Figure 16:
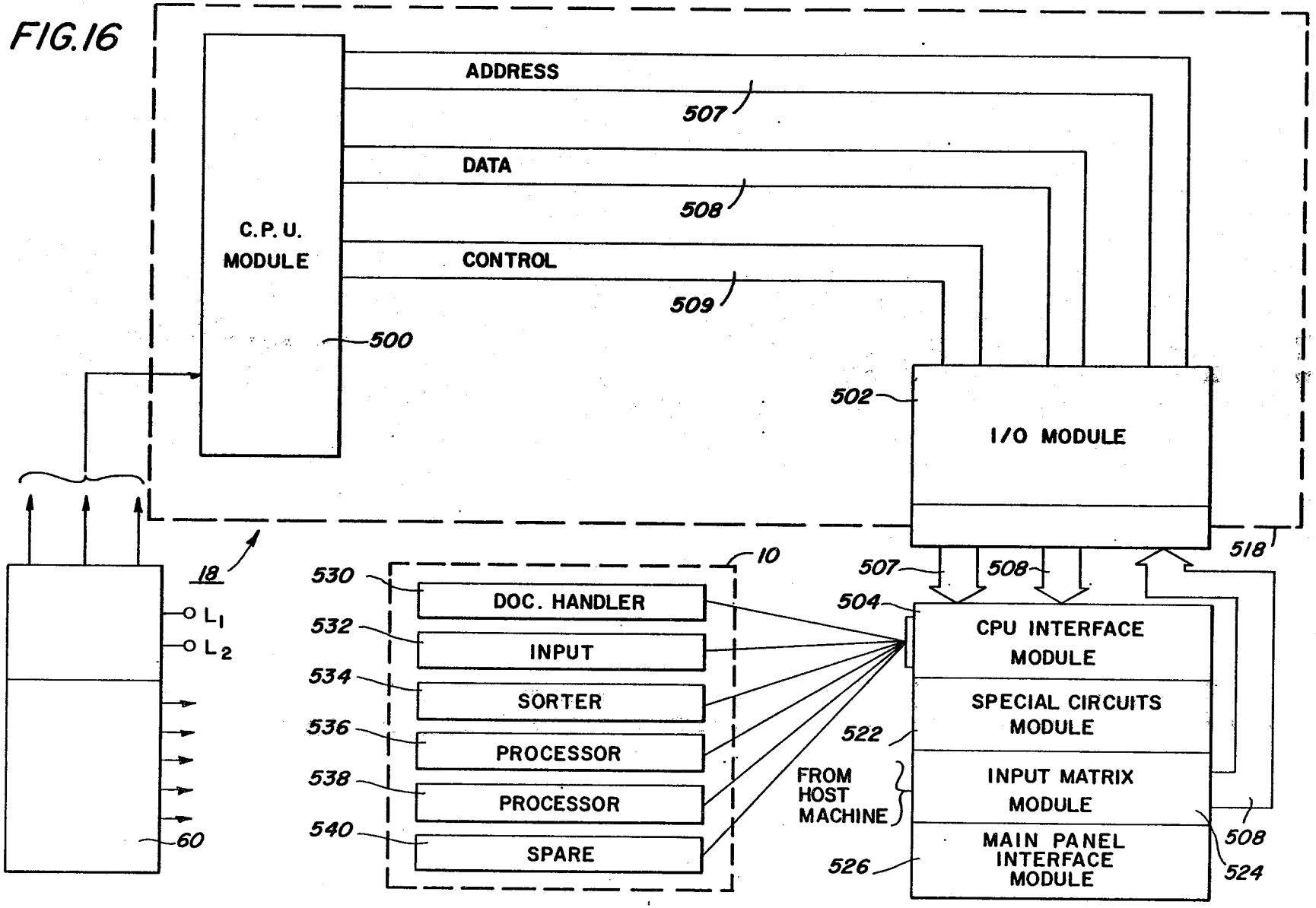
FIG. 16 is a block diagram of the controller for the apparatus shown in FIG. 1.

Referring to FIG. 16, controller 18 includes a Central Processor Unit (CPU) Module 500, Input/Output (I/O) Module 502, and Interface 504. Address, Data and Control Buses 507, 508, 509 respectively operatively couple CPU Module 500 and I/O Module 502. CPU Module 500 I/O Module 502 are disposed within a shield 518 to prevent noise interference.

Interface 504 couples I/O Module 502 with special circuits module 522, input matrix module 524, and main panel interface module 526. Module 504 also couples I/O Module 502 to the operating sections of the machine, namely, document handler section 530, input section 532, sorter section 534 and processor sections 536, 538. A spare section 540, which may be used for monitoring operation of the host machine, or which may be later utilized to control other devices, is provided.

Referring to FIGS. 17, 18(*a*), CPU module 500 comprises a processor 542 such as an Intel 8080 microprocessor manufactured by Intel Corporation, Santa Clara, California, 16 K Read Only Memory (herein ROM) and 2 K Random Access Memory (herein RAM) sections 545, 546, Memory Ready section 548, power regulator section 550, and onboard clock 552. Bipolar tri-state buffers 510, 511 in Address and Data buses 507, 508 disable the bus on a Direct Memory access (DMA) signal (HOLDA) as will appear. While the capacity of memory sections 545, 546 are indicated throughout as being 16 K and 2 K respectively, other memory sizes may be readily contemplated.

Figure 19A:
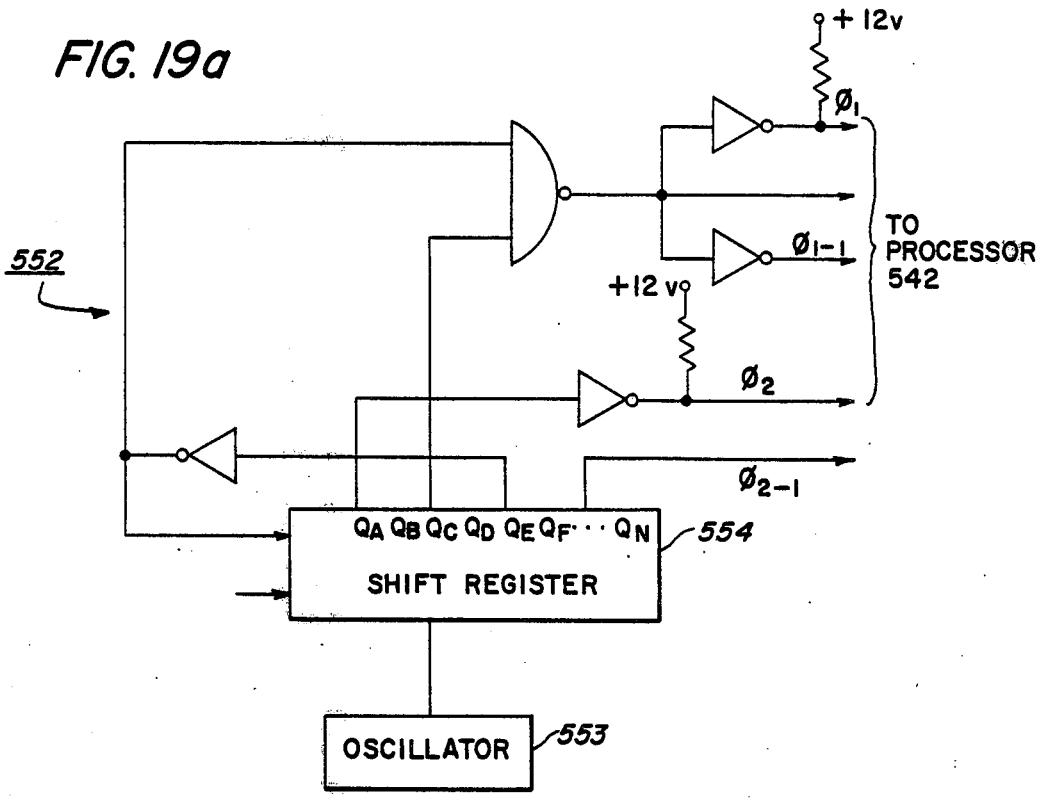
FIG. 19*a* is a logic schematic of the CPU clock.
Figure 19B:
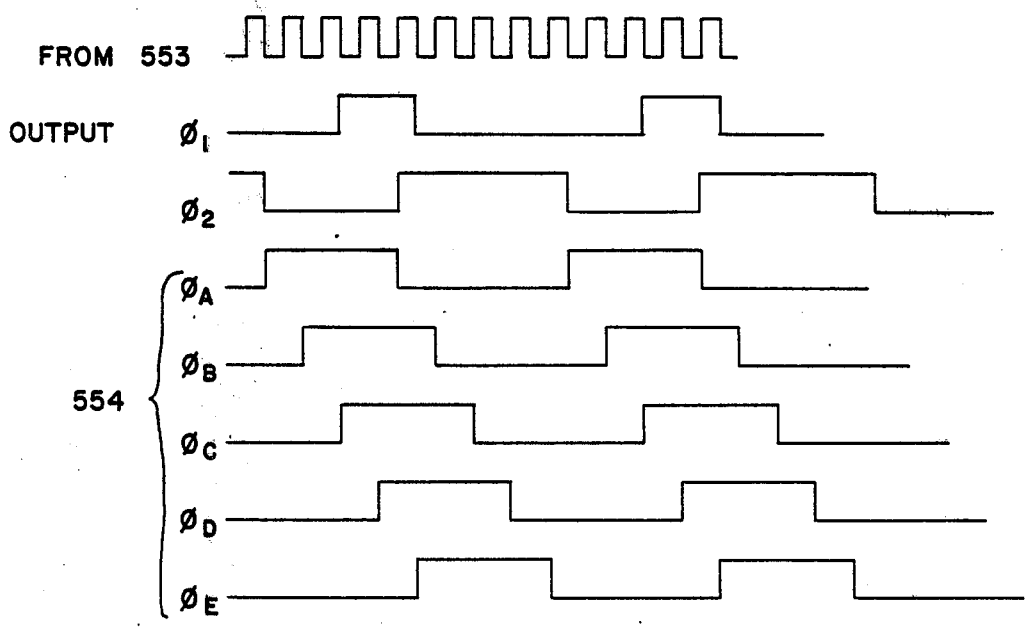
FIG. 19*b* is a chart illustrating the output wave form of the clock shown in FIG. 19*a;*

Referring particularly to FIGS. 19(*a, b*), clock 552 comprises a suitable clock oscillator 553 feeding a multibite (Qa–Qn) shift register 554. Register 554 includes an internal feedback path from one bit to the serial input of register 554. Output signal waveforms $\phi_1$,$\phi_2$,$\phi_{1\text{-}1}$ and $\phi_{2\text{-}1}$ are produced for use by the system.

Figure 20:
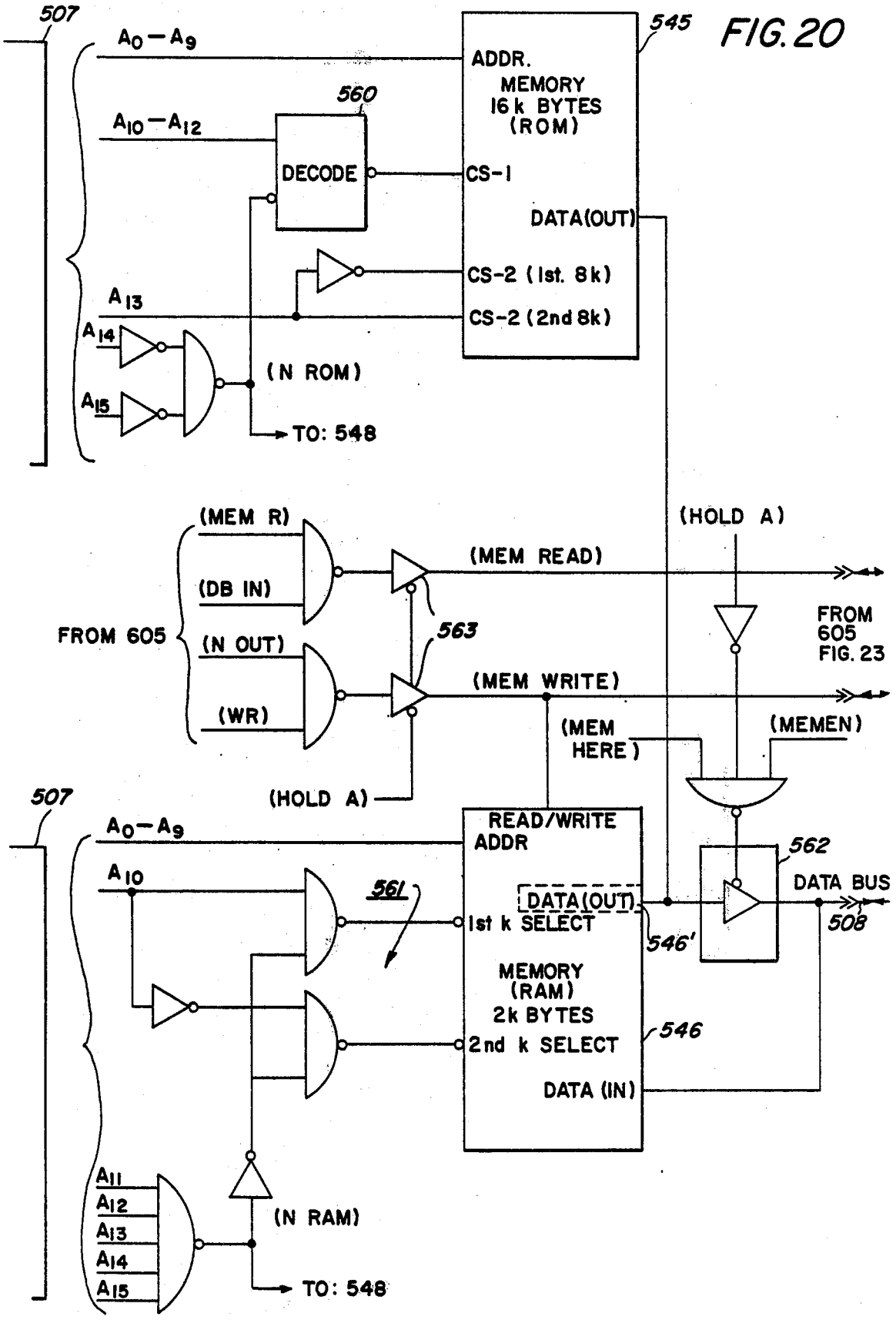
FIG. 20 is a logic schematic of the CPU memory.

Referring to FIG. 20, the memory bytes in ROM section 545 are implemented by address signals (A0–A15) from processor 542, selection being effected by 3 to 8 decode chip 560 controlling chip select 1 (CS-1) and a 1 bit selection (A13) controlling chip select 2 (CS-2). The most significant address bits (A14, A15) select the first 16 K of the total 64 bytes of the addressing space. The memory bytes in RAM section 546 are implemented by Address signals (A0–A15) through selector circuit 561. Address bit A10 serves to select the memory bank while the remaining five most significant bits (A11–A15) select the last 2 K bytes out of the 64 K bytes of addressing space. RAM memory section 546 includes a 40 bit output buffer (DATA OUT) the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 (FIG. 23*b*) to access MEM READ and MEM WRITE control channels directly on a DMA signal (HOLD A) from processor 542 as will appear.

Referring to FIG. 21, memory ready section 548 provides a READY signal to processor 542. A binary counter 566, which is initialized by a SYNC signal ($\phi$,) to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Figure 22A:
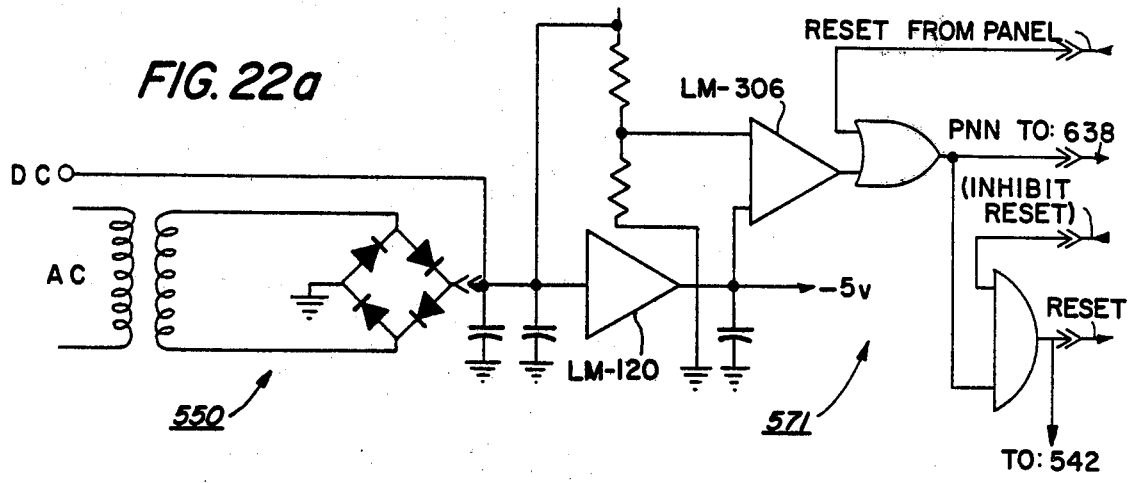
FIGS. 22*a*, 22*b*, 22*c* are logic schematics of the CPU power supply stages.
Figure 22B:
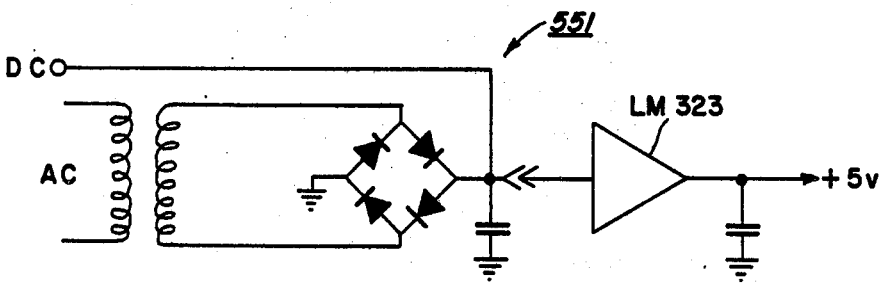
Figure 22C:
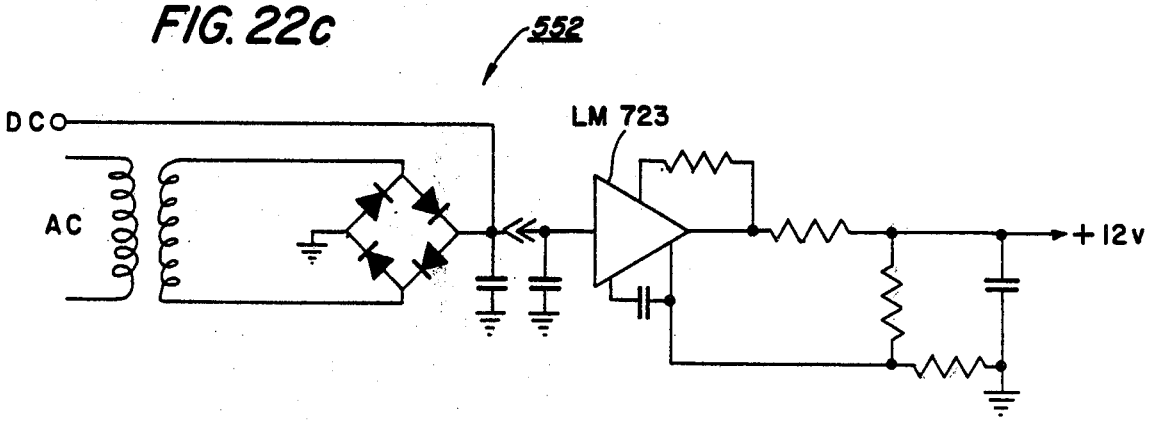

Referring to FIGS. 22(*a, b, c*) and 23*b*, power regulators 550, 551, 552 provide the various voltage levels, i.e. +5 v, +12 v, and −5 v D.C. required by the module 500. Each of the three on board regulators 550, 551, 552 employ filtered D.C. inputs. Power Not Normal (PNN) detection circuitry 571 is provided to reset processor 542 during the power up time. Reset control from the machine service panel (not shown) is also provided via PNN. An enabling signal (INHIBIT RESET) from Memory Control 638 allows completion of a write cycle in Non Volatile (N.V.) Memory 610 of I/O Module 502.

Figure 18A:
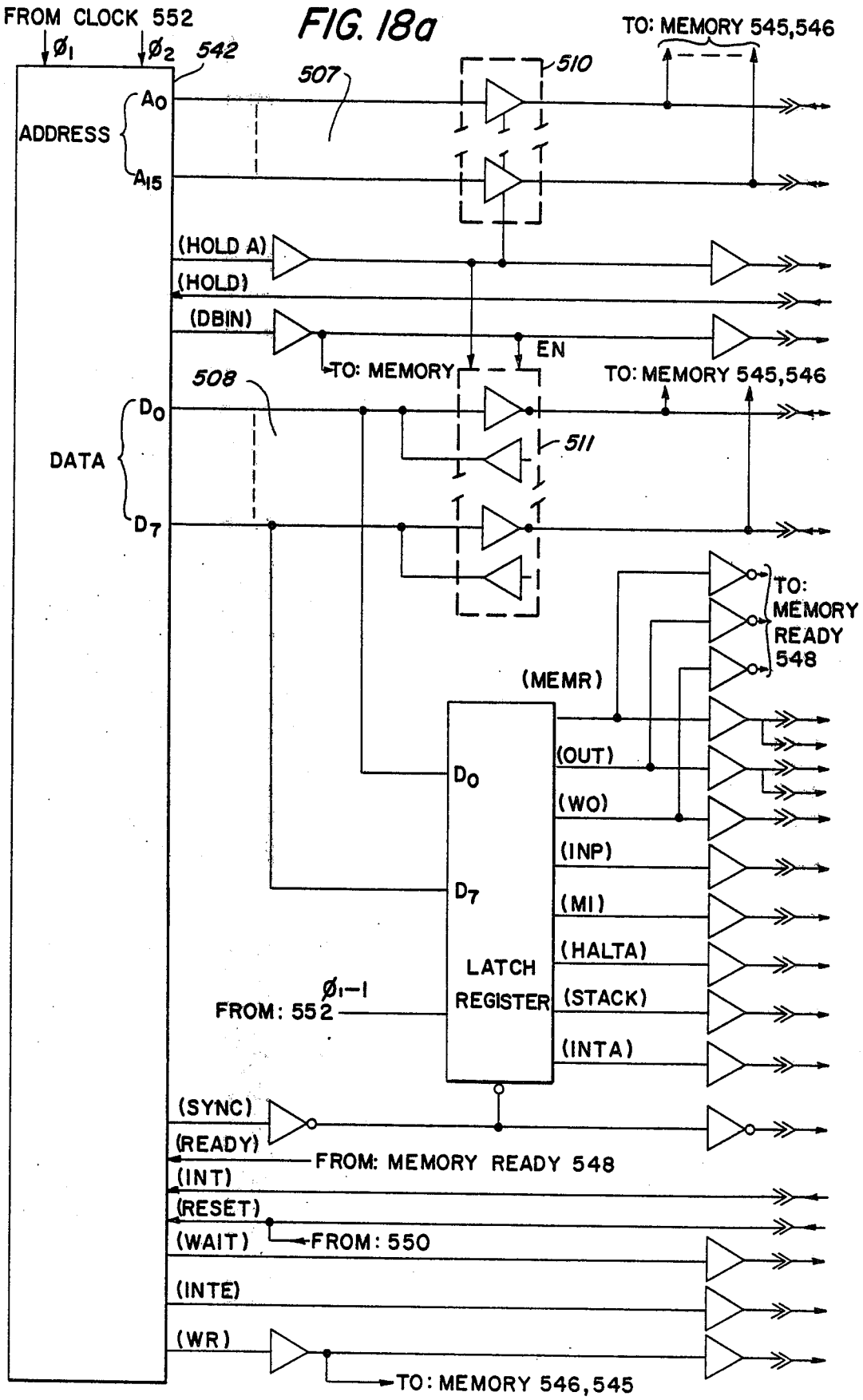
FIG. 18*a* is a block diagram showing the CPU microprocessor input/output connections.
Figure 18B:
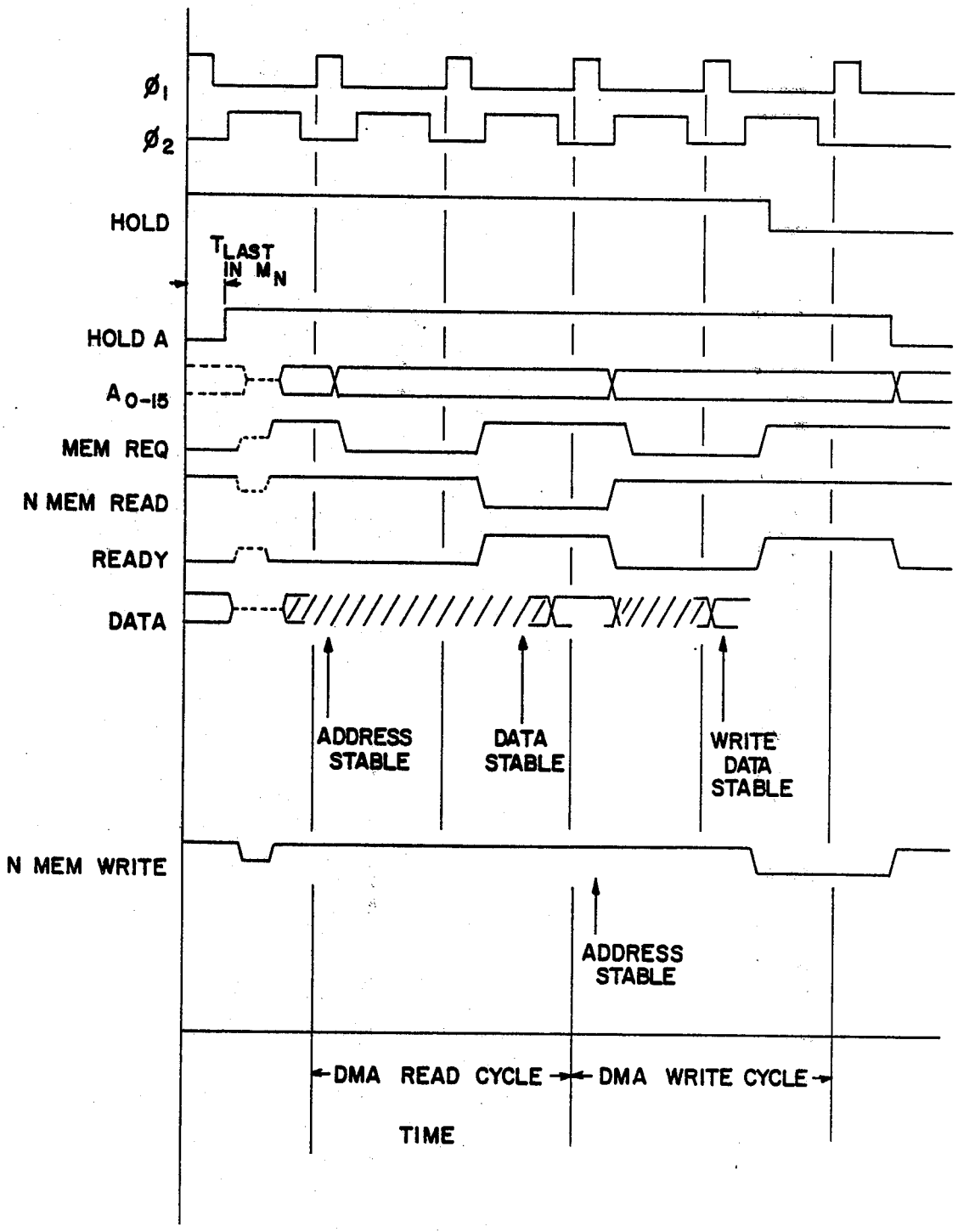
FIG. 18*b* is a timing chart of Direct Memory access (DMA) Read and Write cycles.
Figure 23A:
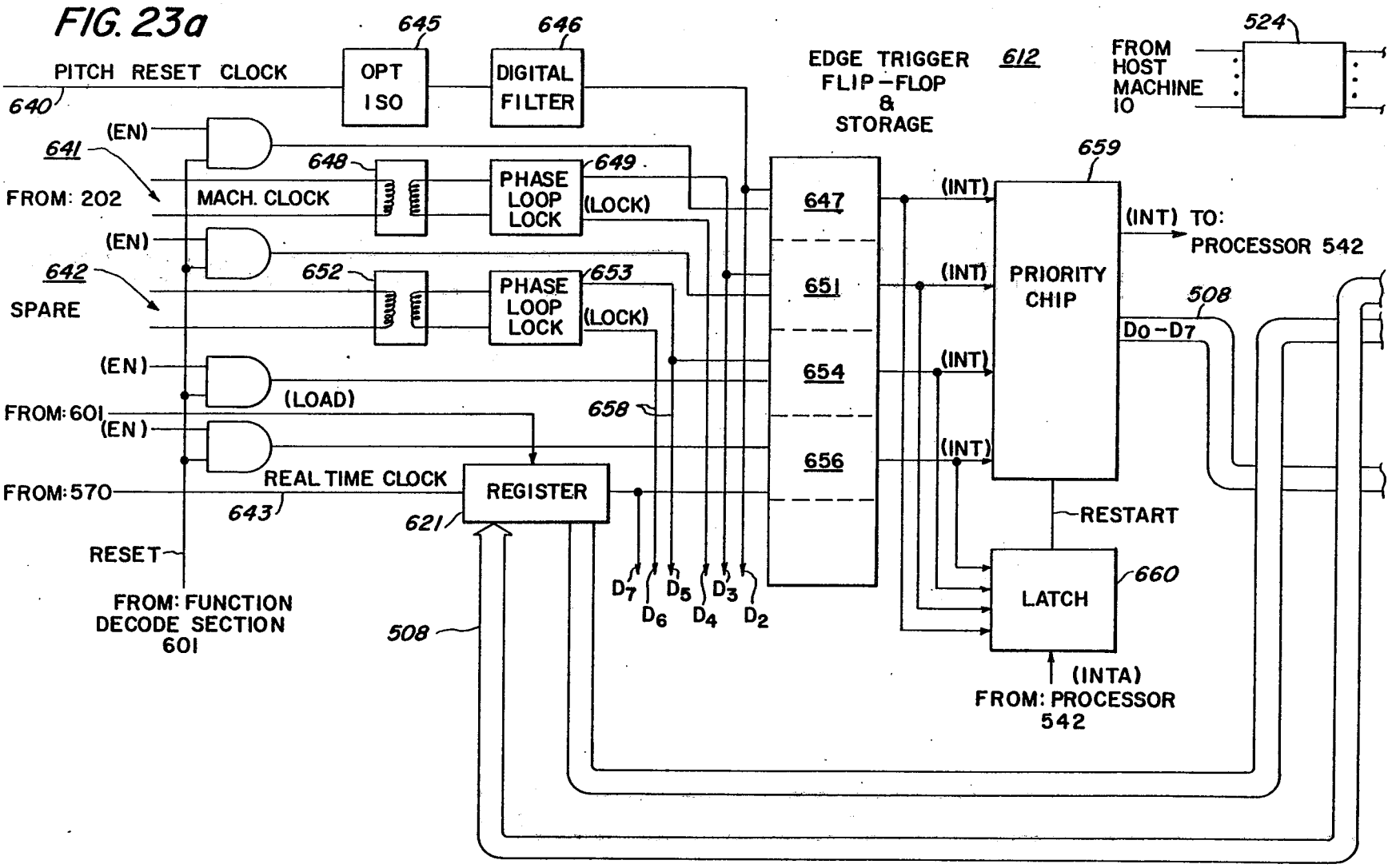
FIGS. 23*a* and 23*b* comprise a block diagram of the controller I/O module.
Figure 23B:
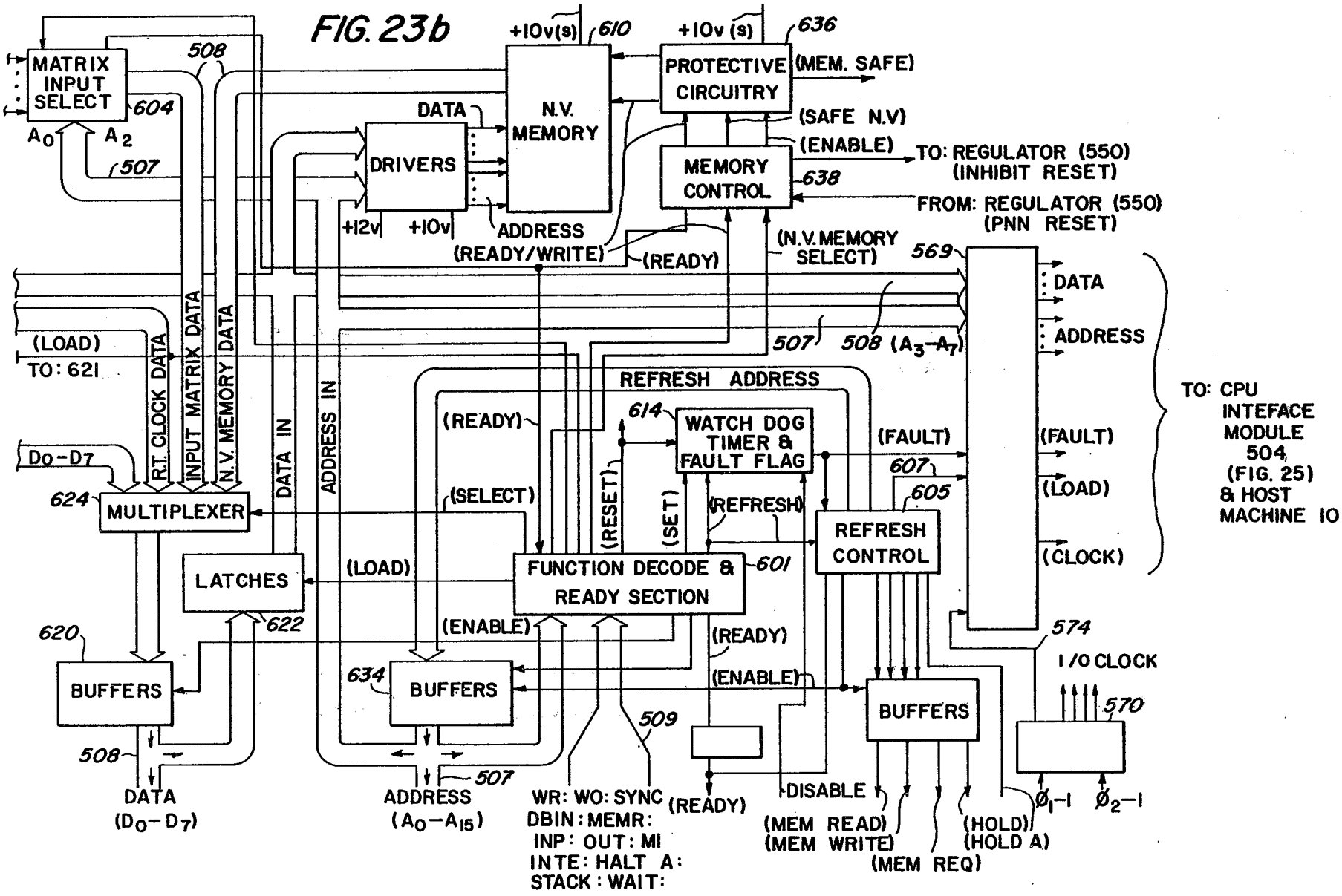

Referring to FIGS. 18*a*, 20, 21, and the DMA timing chart (FIG. 18*b*) data transfer from RAM section 546 to host machine 10 is effected through Direct Memory Access (DMA), as will appear. To initiate DMA, a signal (HOLD) is generated by Refresh Control 605 (FIG. 23*b*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 20, 21) to Refresh Control 605 of I/O Module 502.

Referring to FIGS. 23(*a, b*), I/O Module 502 interfaces with CPU module 500 through bi-directional Address and, Data buses 507, 508 respectively, and Control bus, 509. I/O Module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory access (DMA) by I/O module 502 of RAM section 546.

I/O module 502 includes Matrix Input select 604 (through which inputs from the host machine 10, are received), Refresh Control 605, Nonvolatile (NV) memory 610, Interrupt Control 612 (FIG. 23*a*), Watch dog Timer and failure Flag 614 and clock 570.

A Function Decode Section 601 receives and interprets commands from CPU section 500 by decoding information on address bus 507 along with control signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits A0–A7 to be sent to the host machine 10 for input matrix read operations; (f) commanding operation of Matrix Input Select 604; (g) initiating read or write operation of N.V. memory 610 through Memory Control 638; (h) loading Real Time clock register 621 (FIG. 23*a*) from data bus 508; and (i) resetting the Watch Dog timer and setting the Fault Failure flag 614. In addition, section 601 includes logic to control and synchronize the READY control line to CPU module 500, the READY line being used to advise module 500 when data placed on the Data bus by I/O module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25 m sec) a fault flip flop is set and a signal (FAULT) sent to the host machine 10. The signal (FAULT) also raises the HOLD line (via Refresh Control 605) to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input select 604 which controls receipt of data from host machine 10 has capacity to read up to 32 groups of 8 discrete inputs from host machine 10. Lines $A_3$ through $A_7$ of Address bus 507 are routed to host machine 10 via optical isolator 569 and CPU Interface Module 504 to select the desired group of 8 inputs. The selected inputs from machine 10 are received by matrix 604 via Input Matrix Module 524 (FIG. 28) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from the memory output buffer (DATA OUT) of RAM memory section 546 to host machine 10 at the predetermined clock rate in line 574. Direct Memory access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 (through actuation of tri-state buffers 510, 511 as described) to the high impedance state giving I/O module 502 control thereover. I/O module 502 then sequentially accesses the 32 memory words from output buffer (DATA OUT) of RAM section 546 (REFRESH ADDRESS) and transfers the contents to the host machine 10 via data bus 508 and optical isolator 569. CPU Module 500 is dormant during this period.

On capture of the address and data buses 507, 508, a control signal (LOAD) from Refresh Control 605 together with a clock signal (CLOCK) in line 574 are utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

N.V. memory 610 comprises a predetermined number of bits of nonvolatile memory stored in I/O module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset interrupt and the Machine interrupt, as well as a third clock driven interrupt, the Real Time interrupt.

Referring particularly to FIG. 23(*a*) the highest priority interrupt signal, Pitch reset signal 640, is generated by the signal output of pitch reset clock 138. The clock signal is fed via optical isolator 645 and digital filter 646 to edge trigger flip flop 647.

The second highest priority interrupt signal, machine clock signal 641, is sent directly from machine clock 202 through isolation transformer 648 to a phase locked loop 649. Loop 649, which serves as bandpath filter and signal conditioner, sends a square wave signal to edge trigger flip flop 651. The second signal output (LOCK) serves to indicate whether loop 649 is locked onto a valid signal input or not.

The lowest priority interrupt signal, Real Time Clock signal 643, is generated by register 621. Register 621 which is loaded and stored by memory reference instructions from CPU module 500 is decremented by a clock signal in line 643 which may be derived from I/O Module clock 570. On the register count reaching zero, register 621 sends an interrupt signal to edge trigger flip flop 656. A spare interrupt 642 is also provided.

Setting of one or more of the edge trigger flip flops 647, 651, 654, 656 by the interrupt signals 640, 641, 642, 643 generates a signal (INT) via priority chip 659 to processor 542 of CPU Module 500 (FIG. 18*a*). On acknowledgement, processor 542, issues a signal (INTA) transferring the status of the edge trigger flip flops 647, 651, 654, 656 to a four bit latch 660 to generate an interrupt instruction code (RESTART) onto the data bus 508.

Each interrupt is assigned a unique RESTART instruction code. Should an interrupt of higher priority be triggered, a new interrupt signal (INT) and RESTART instruction code are generated resulting in a nesting of interrupt software routines whenever the interrupt recognition circuitry is enabled within the CPU 500.

Priority chip 659 serves to establish a handling priority in the event of simultaneous interrupt signals in accordance with the priority schedule described.

Once triggered, the edge trigger flip flop 647, 651, 654 or 656 must be reset in order to capture the next occurrence of the interrupt associated therewith. Each interrupt subroutine serves, in addition to performing the functions programmed, to reset the flip flops (through the writing of a coded byte in a uniquely selected address) and to re-enable the interrupt (through execution of a re-enabling instruction). Until re-enabled, initiation of a second interrupt is precluded while the first interrupt is in progress.

Lines 658 permit interrupt status to be interrogated by CPU module 500 on a memory reference instruction.

I/O Module 502 includes a suitable pulse generator or clock 570 for generating the various timing signals required by module 502. Clock 570 is driven by the pulse-like output $\phi_{1\text{-}1}$,$\phi_{2\text{-}1}$ of processor clock 552 (FIG. 19*a*). As described, clock 570 provides a reference clock pulse (in line 574) for synchronizing the output refresh data and is the source of clock pulses (in line 643) for driving Real Time register 621.

Figure 25:
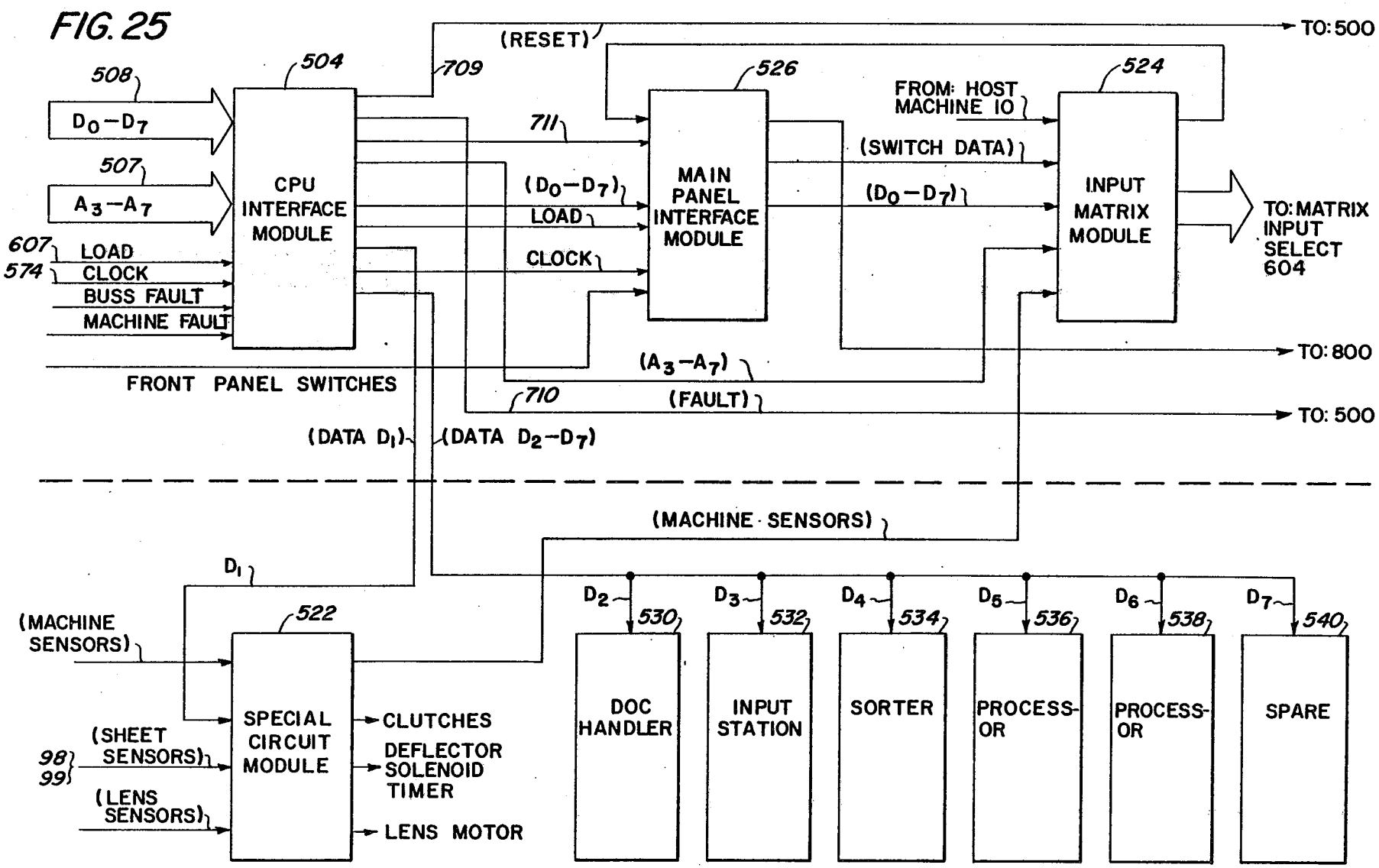
FIG. 25 is a block diagram of the apparatus interface and remote output connections.
Figure 26:
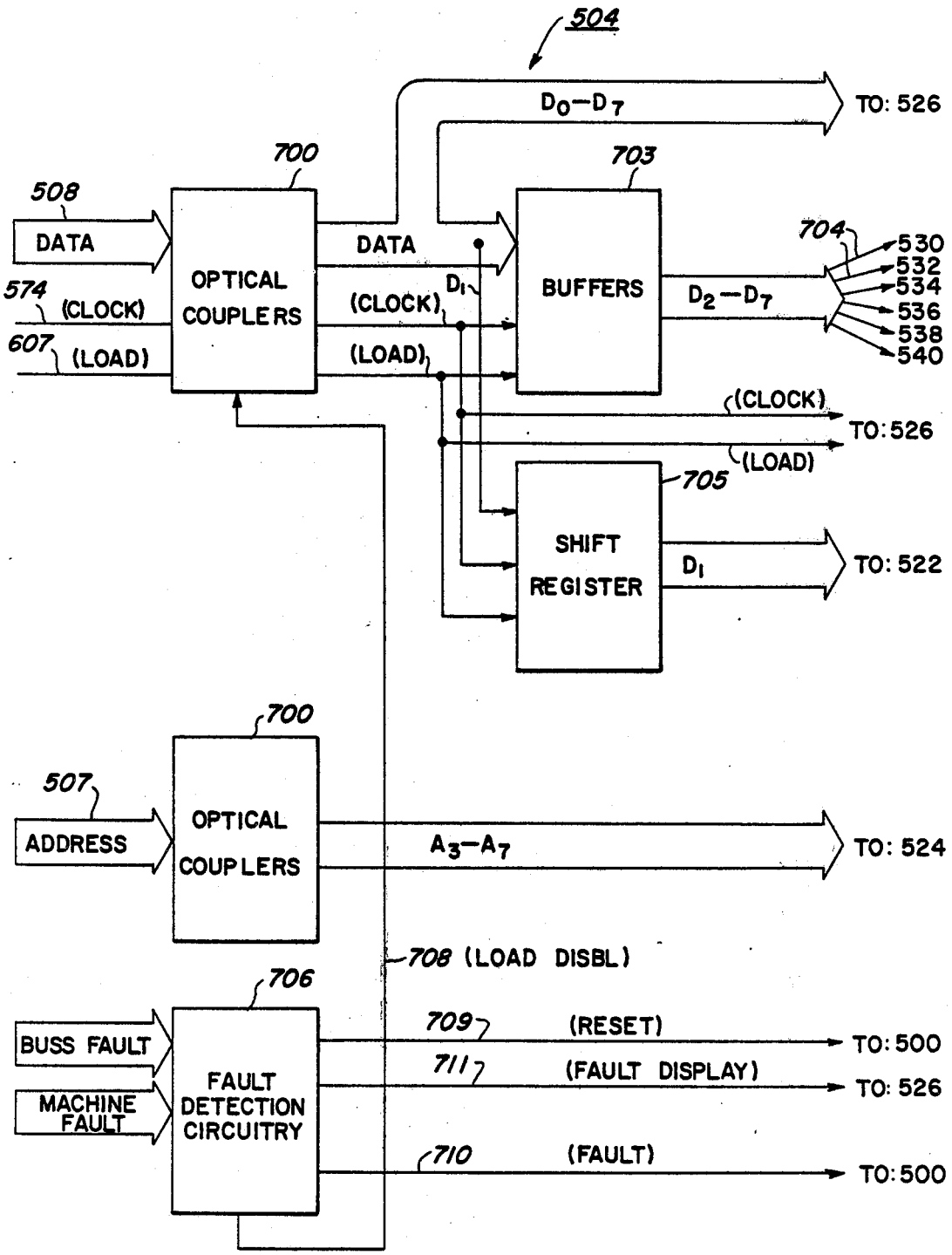
FIG. 26 is a block diagram of the CPU interface module.

CPU interface module 504 interfaces I/O module 502 with the host machine 10 and transmits operating data stored in RAM section 546 to the machine. Referring particularly to FIG. 25 and 26, data and address information are inputted to module 504 through suitable means such as optical type couplers 700 which convert the information to single ended logic levels. Data in bus 508 on a signal from Refresh Control 605 in line 607 (LOAD), is clocked into module 546 at the reference clock rate in line 574 parallel by bit, serial by byte for a preset byte length, with each data bit of each successive byte being clocked into a separate data channel D0–D7. As best seen in FIG. 25, each data channel D0–D7 has an assigned output function with data channel D0 being used for operating the front panel lamps 830 in the digital display, (see FIG. 32), data channel D1 for special circuits module 522, and remaining data channels D2–D7 allocated to the host machine operating sections 530, 532, 534, 536, 538 and 540. Portions of data channels D1–D7 have bits reserved for front panel lamps and digital display.

Since the bit capacity of the data channels D2–D7 is limited, a bit buffer 703 (FIG. 26) is preferably provided to catch any bit overflow in data channels D2–D7.

Inasmuch as the machine output sections 530, 532, 534, 536, 538 and 540 are electrically a long distance away, i.e. remote, from CPU interface module 504, and the environment is electrically "noisy," the data stream in channels D2–D7 is transmitted to remote sections 530, 532, 534, 536, 538 and 540 via a shielded twisted pair 704. By this arrangement, induced noise appears as a differential input to both lines and is rejected. The associated clock signal for the data is also transmitted over line 704 with the line shielded carrying the return signal currents for both data and clock signals.

Data in channel $D_1$ destined for special circuits module 522 is inputted to shift register type storage circuitry 705 for transmittal to module 522. Display data $D_0$–$D_7$ is also inputted to main panel interface module 526. Address information in bus 507 is converted to single ended output by couplers 700 and transmitted to Input Matrix Module 524 to address host machine inputs.

CPU interface module 504 includes fault detector circuitry 706 for monitoring both faults occurring in host machine 10 and faults or failures along the buses, the latter normally comprising a low voltage level or failure in one of the system power lines. Machine faults may comprise a fault in CPU module 500, a belt mistrack signal from sensor 27 (see FIG. 2), opening one of the machine doors or covers as responded to by conventional cover interlock sensors (not shown), a fuser over temperature as detected by sensor 175, etc. In the event of a bus fault, a reset signal (RESET) is generated automatically in line 709 to CPU module 500 (see FIGS. 17 and 18*a*) until the fault is removed. In the event of a machine fault, a signal is generated in line 710 to actuate a suitable relay (not shown) controlling power to all or a portion of host machine 10. A load disabling signal (LOAD DISBL) is inputted to optical couplers 700 via line 708 in the event of a fault in CPU module 500 to DATA receiving terminate input of data to host machine 10. Other fault conditions are monitored by the software background program. In the event of a fault, a signal is generated in line 711 to the digital display on control console 800 (via main panel interface module 526) signifying a fault.

Figure 27:
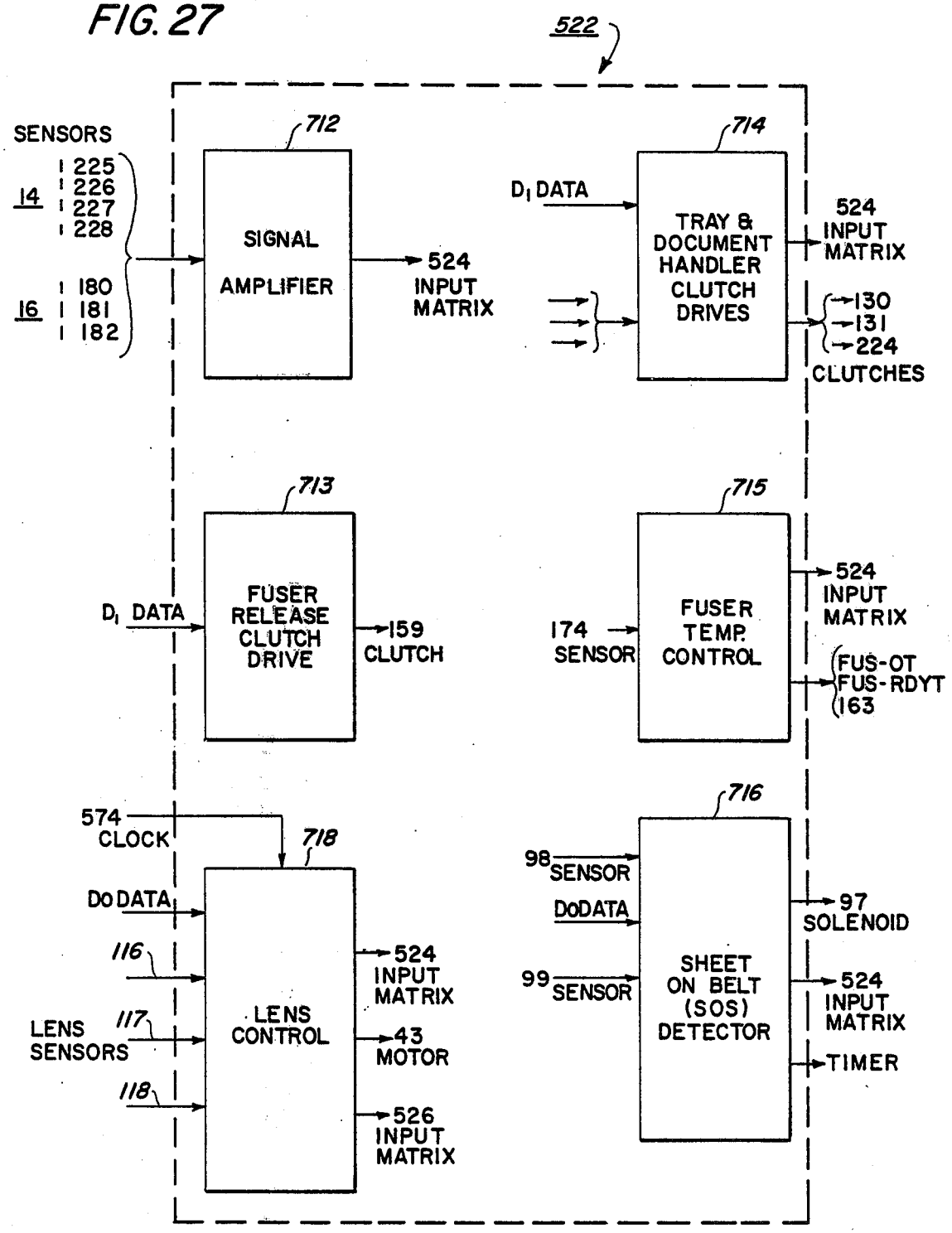
FIG. 27 is a block diagram of the apparatus special circuits module.

Referring particularly to FIGS. 25 and 27, special circuits module 522 comprises a collection of relatively independent circuits for either monitoring operation of and/or driving various elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDYT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a misstrip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensors 116, 117, 118. The signal output of circuitry 718 serves to operate lens drive motor 43 as required to place the optical elements of lens 41 in proper position to effect the image reduction programmed by the operator.

Figure 28:
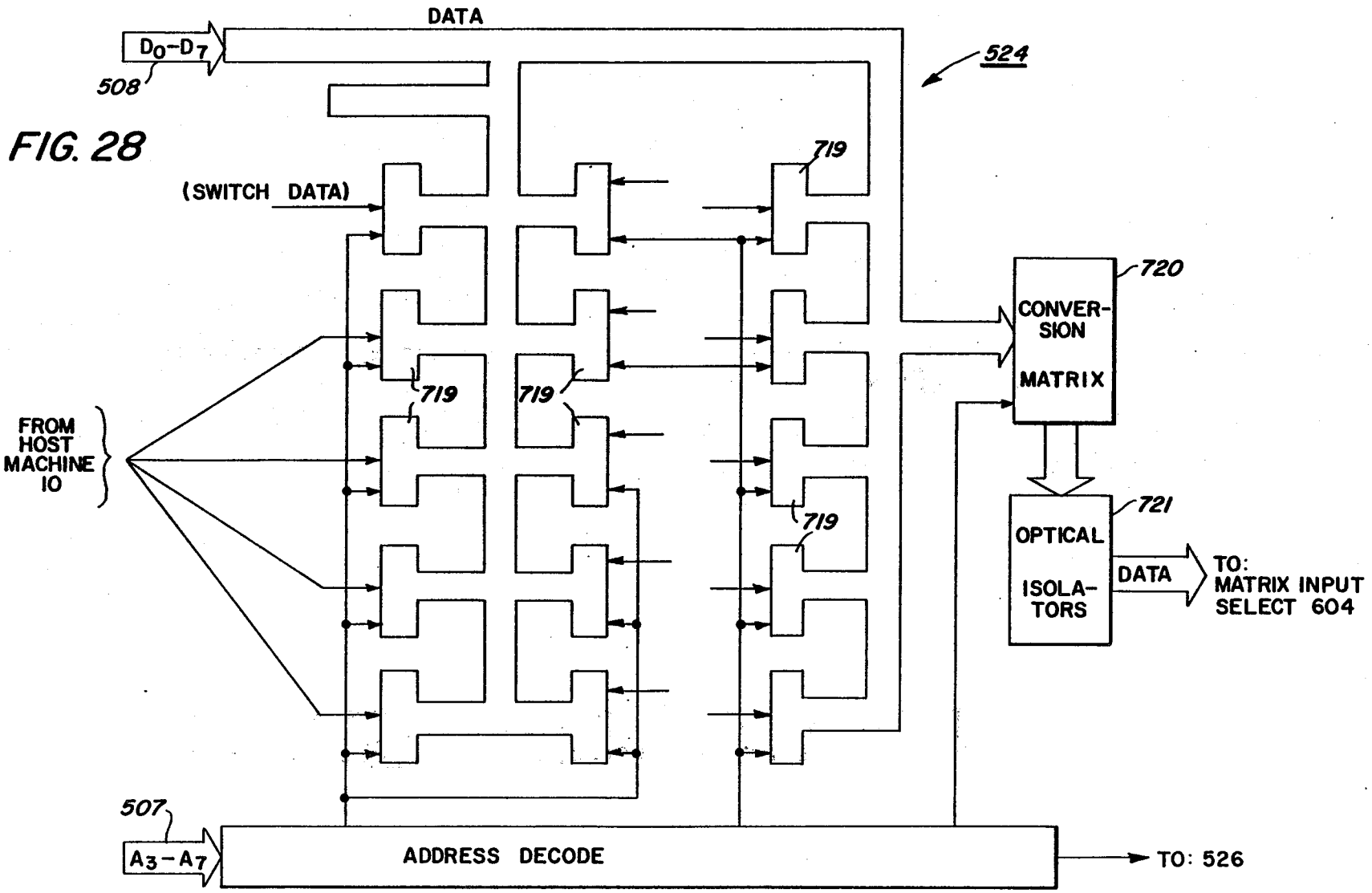
FIG. 28 is a block diagram of the main panel interface module.

Referring to FIG. 28, input matrix module 524 provides analog gates 719 for receiving data from the various host machine sensors and inputs (i.e. sheet sensors 135, 136; pressure sensor 157; etc), and data (SWITCH DATA) from the various switches on Console 800 (FRONT PANEL SWITCHES—FIG. 25) module 524 serving to convert the signal input to a byte oriented output for transmittal to I/O module 502 under control of Input Matrix Select 604 (FIG. 23*b*). The byte output to module 524 is selected by address information inputted on bus 507 and decoded on module 524. Conversion matrix 720, which may comprise a diode array, converts the input logic signals of "0" to logic "1" true. Data from input matrix module 524 is transmitted via optical isolators 721 to Input Matrix Select 604 of I/O module 502 (FIG. 23*b*). From there, the data is transmitted through Multiplexer 624 and buffers 620 to CPU Module 500.

Figure 29:
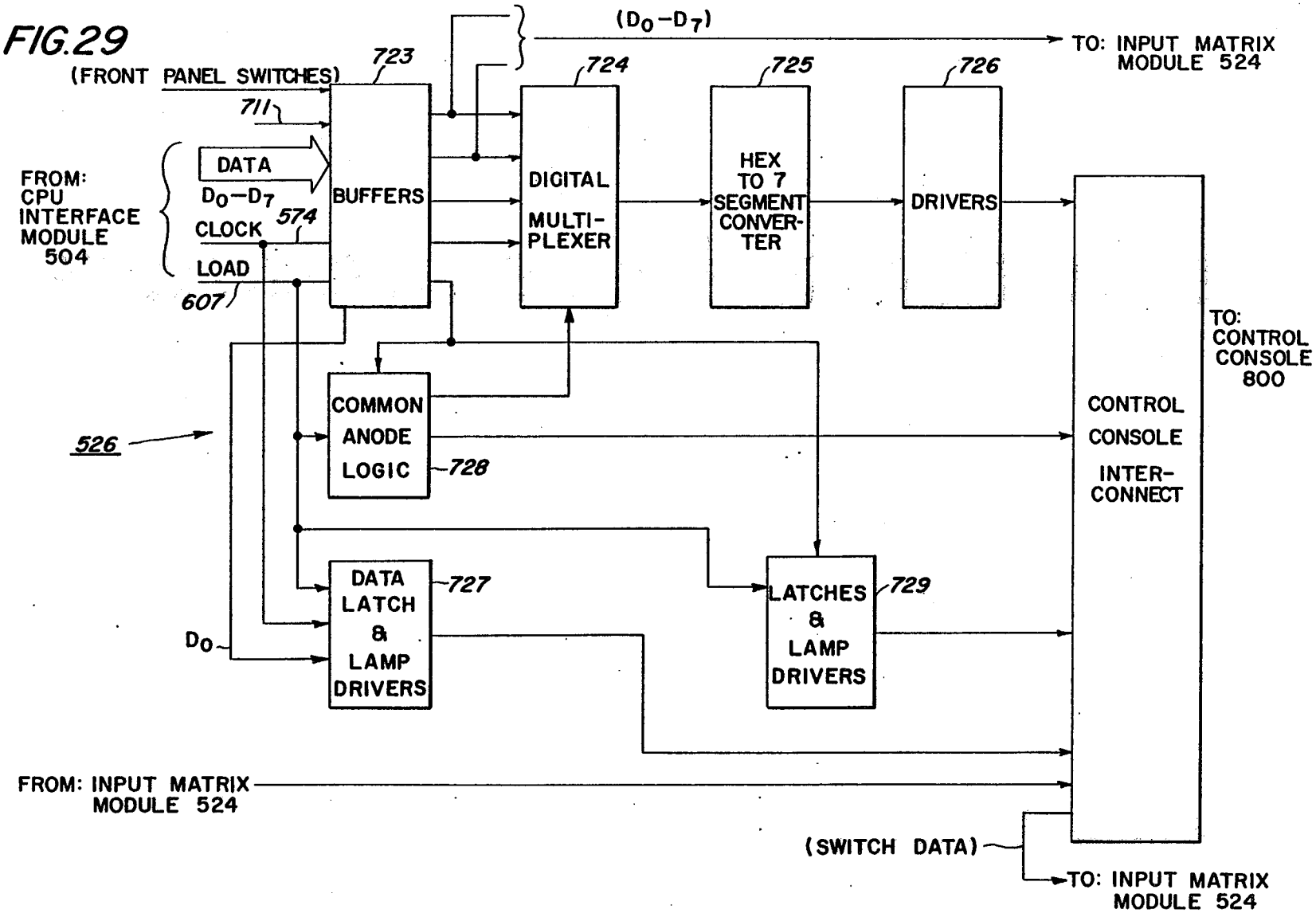
FIG. 29 is a block diagram of the input matrix module.

Referring particularly to FIG. 29, main panel interface module 526 serves as interface between CPU interface module 504 and operator control console 800 for display purposes and as interface between input matrix module 524 and the console switches. As described, data channels D0–D7 have data bits in each channel associated with the control console digital display or lamps. This data is clocked into buffer circuitry 723 and from there, for digital display, data in channels D1–D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard (FRONT PANEL SWITCHES) is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D2, D4, D5, D6, D7 respectively.

Figure 30:
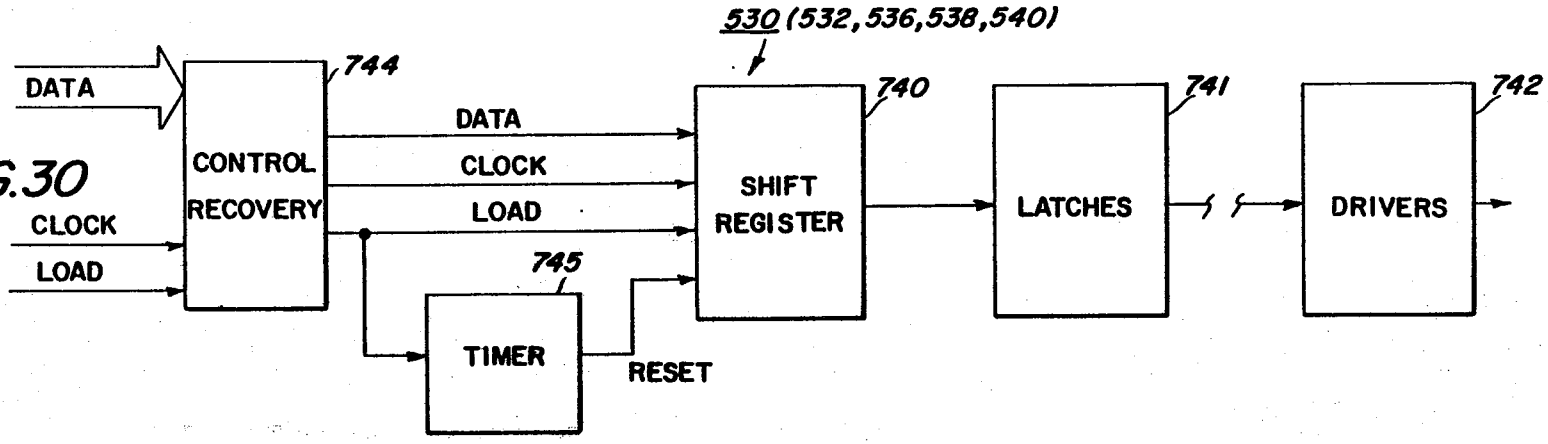
FIG. 30 is a block diagram of a typical remote.

Referring to FIG. 30, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuitry 744, which may comprise an inverting/non-inverting digital comparator pair and output latch is provided.

The LOAD signal serves to lockout input of data to latches 741 while new data is being clocked into shift register 740. Removal of the LOAD signal enables commutation of the fresh data to latches 741. The LOAD signal also serves to start timer 745 which imposes a maximum time limit within which a refresh period (initiated by Refresh Control 605) must occur. If refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Figure 31:
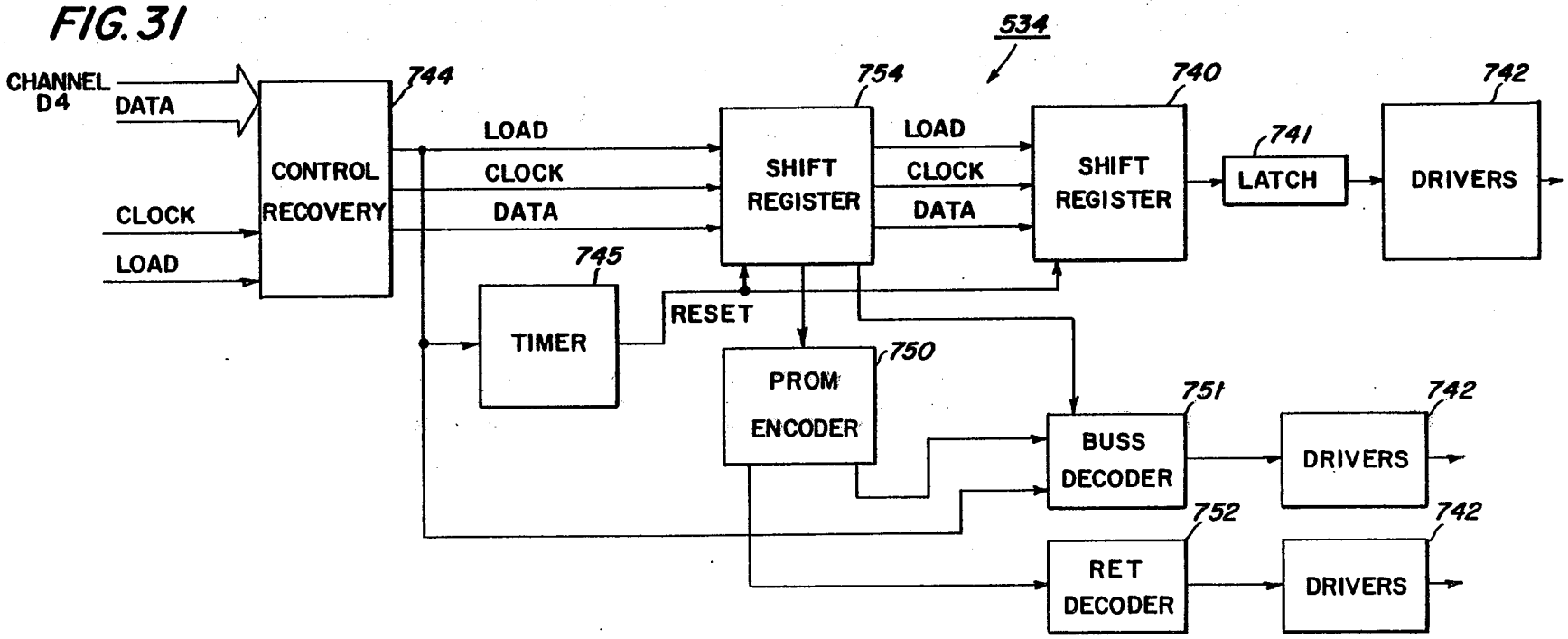
FIG. 31 is a block diagram of the sorter remote.

Referring to FIG. 31 wherein like numbers refer to like parts, to provide capacity for driving the sorter deflector solenoids 221, a decode matrix arrangement consisting of a Prom encoder 750 controlling bus decoder (BUS DECODER) 751 and return decoder, 752 (RET DECODER) is provided. The output of decoders 751, 752 drive the sorter solenoids 221 of upper and lower bin arrays 210, 211 respectively. Data is inputted to encoder 750 by means of shift register 754.

Figure 32:
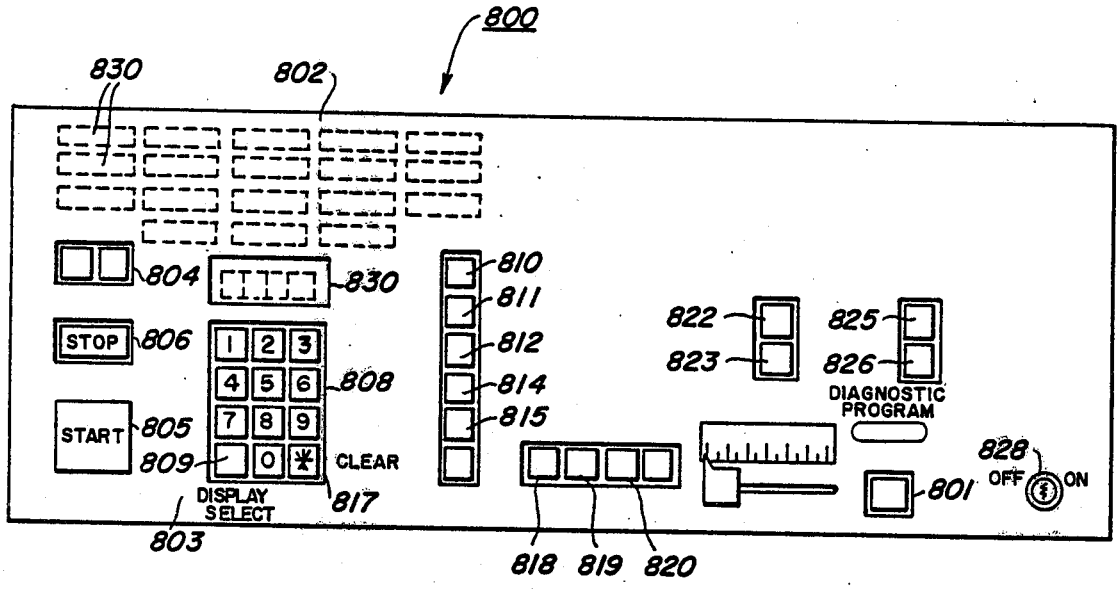
FIG. 32 is a view of the control console for inputting copy run instructions to the apparatus shown in FIG. 1.

Referring now to FIG. 32, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) buttons 805, stop print (STOP) button 806 and keyboard copy quantity selector 808. A series of feature select buttons consisting of auxiliary paper tray button 810, two sided copy button 811, copy lighter button 814, and copy darker button 815, are provided.

Additionally, image size selector buttons 818, 819, 820; multiple or single document select buttons 822, 823 for operation of document handler 16; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, JOB INCOMPLETE and UNLOAD SORTER. Other display information may be envisioned.

MACHINE OPERATION

As will appear, host machine 10 is conveniently divided into a number of operational states. The machine control program is divided into background routines and Foreground routines with operational control normally residing in the Background routine or routines appropriate to the particular machine state then in effect. The output buffer (DATA OUT) of RAM memory section 546 is used to transfer/refresh control data to the various remote locations in host machine 10, control data from both Background and Foreground routines being inputted to RAM memory section 546 for subsequent transmittal to host machine 10. Transmittal/refresh of control data presently in the output buffer (DATA OUT) of section 546 is effected through Direct Memory access (DMA) under the aegis of a Machine Clock interrupt routine.

Foreground routine control data which includes a Run Event Table built in response to the particular copy run or runs programmed, is transferred to output buffer (DATA OUT) of RAM section 546 by means of a multiple prioritized interrupt system wherein the Background routine in process is temporarily interrupted while fresh Foreground routine control data is inputted to buffer 546' following which the interrupted Background routine is resumed.

The operating program for host machine 10 is divided into a collection of foreground tasks, some of which are driven by the several interrupt routines and background or non-interrupt routines. Foreground tasks are tasks that generally require frequent servicing, high speed response, or synchronization with the host machine 10. Background routines are relates to the state of host machine 10, different background routines being performed with different machine states. A single background software control program (STCK) composed of specific sub-programs associated with the principal operating states of host machine 10 is provided. A byte called STATE contains a number indicative of the current operating state of host machine 10. The machine STATES are as follows:

| STATE NO. | MACHINE STATE | CONTROL SUBR. |
|---|---|---|
| 0 | Software Initialize | INIT |
| 1 | System Not Ready | NRDY |
| 2 | System Ready | RDY |
| 3 | Print | PRINT |
| 4 | System Running, Not Print | RUNNPRT |
| 5 | Service | TECHREP |

Figure 33:
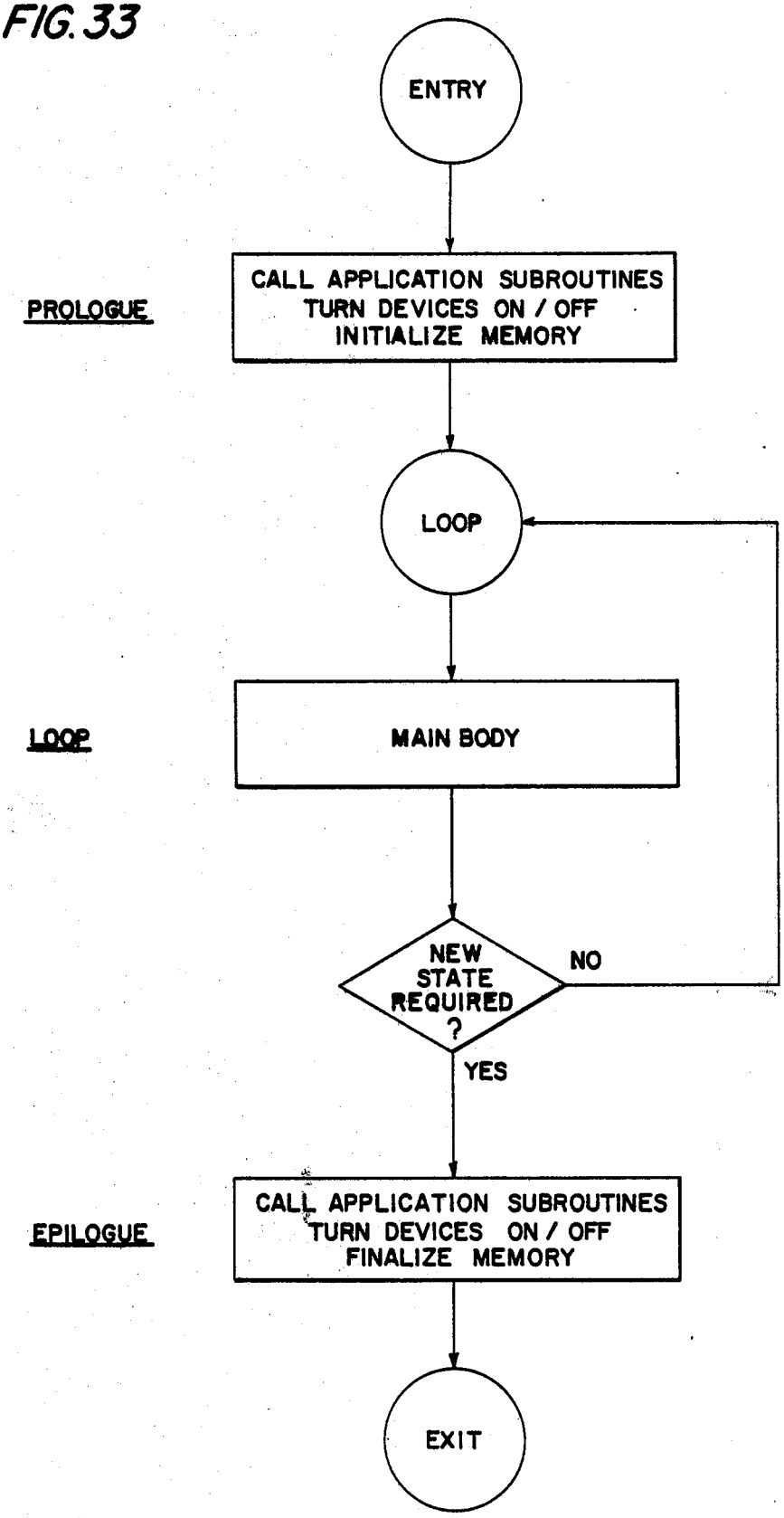
FIG. 33 is a flow chart illustrating a typical machine state.

Referring to FIG. 33, each STATE is normally divided into PROLOGUE, LOOP and EPILOGUE sections. As will be evident from the exemplary program STCK reproduced in TABLE I, entry into a given STATE (PROLOGUE) normally causes a group of operations to be performed, these consisting of operations that are performed once only at the entry into the STATE. For complex operations, a CALL is made to an applications subroutine therefor. Relatively simpler operations (i.e. turning devices on or off, clearing memory, presetting memory, etc.) are done directly.

Once the STATE PROLOGUE is completed, the main body (LOOP) is entered. The program (STCK) remains in this LOOP until a change of STATE request is received and honored. On a change of STATE request, the STATE EPILOGUE is entered wherein a group of operations are performed, following which the STATE moves into the PROLOGUE of the next STATE to be entered.

Figure 34:
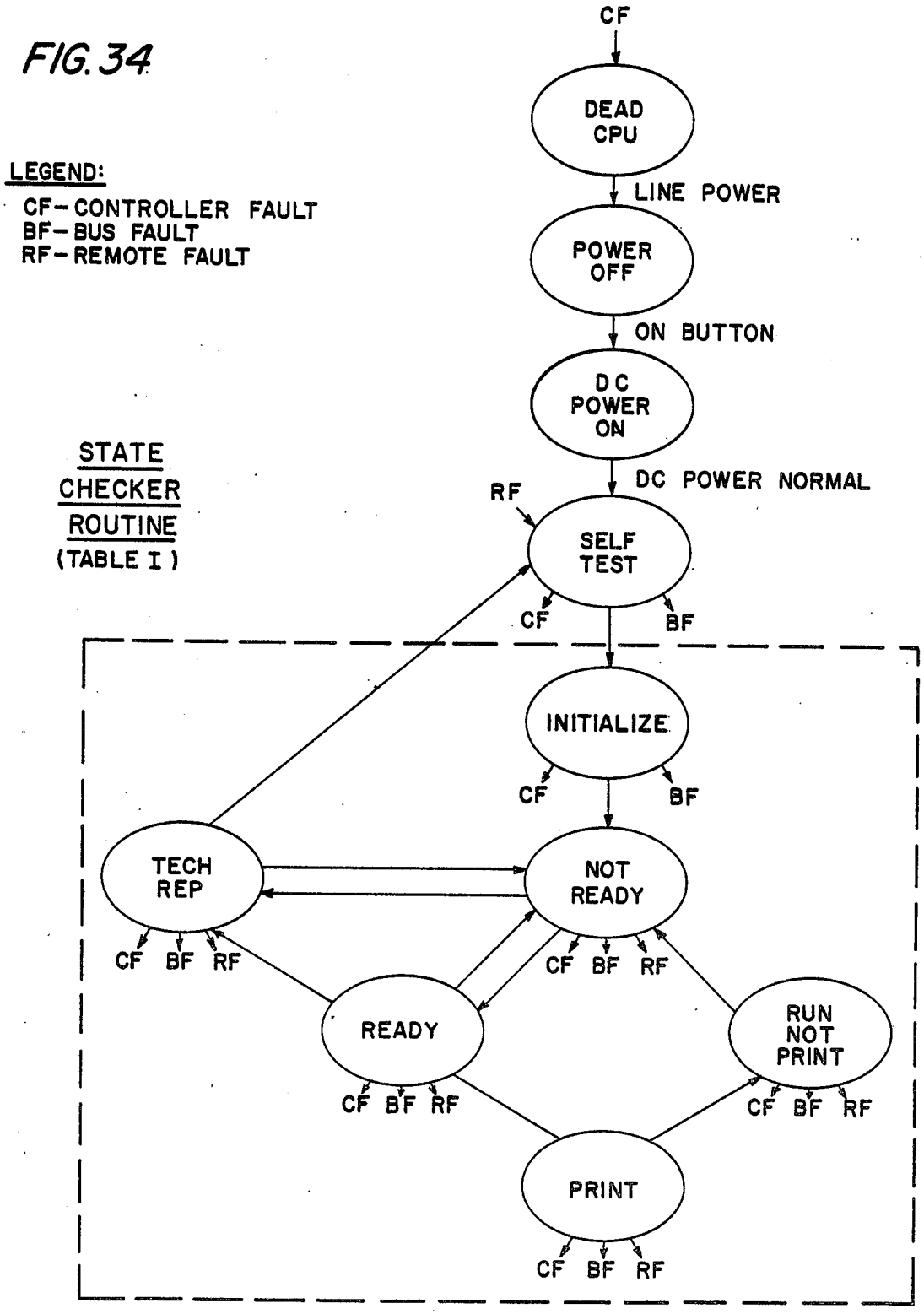
FIG. 34 is a flow chart of the machine state routine.

Referring to FIG. 34 and the exemplary program (STCK) in TABLE I. On actuation of the machine POWER-ON button 804 (FIG. 32), the software Initialize STATE (INIT) is entered. In this STATE, the controller is initialized and a software controlled self test subroutine is entered. If the self test of the controller is successfully passed, the System Not Ready STATE (NRDY) is entered. If not, a fault condition is signaled.

In the System Not Ready STATE (NRDY), background subroutines are entered. These include setting of Ready flags, control registers, timers, and the like; turning on power supplies, the fuser, etc., initializing the Fault Handler, checking for paper jams (left over from a previous run), door and cover interlocks, fuser temperatures, etc. During this period, the WAIT lamp on console 800 is lit and operation of host machine 10 precluded.

When all ready conditions have been checked and found acceptable, the controller moves to the system ready state (RDY). The READY lamp on console 800 is lit and final ready checks made. Host Machine 10 is now ready for operation upon completion of input of a copy run program, loading of one or more originals 2 into document handler 16 (if selected by the operator), and actuation of START PRINT button 805. As will appear hereinafter, the next state is PRINT wherein the particular copy run programmed is carried out.

While the machine is completing a copy run, the controller normally enters the Run Not Print state (RUNNPRT) where the controller calculates the number of copies delivered, resets various flags, stores certain machine event information in the memory, as well as generally conditioning the machine for another copy run, if desired. The controller then returns to the System Not Ready state (NRDY) to recheck for ready conditions prepatory for another copy run, with the same state sequence being repeated until the machine is turned off by actuation of POWER OFF button 804 or a malfunction inspired shutdown is triggered. The last state (TECH REP) is a machine servicing state wherein certain service routines are made available to the machine/repair personnel, i.e. Tech Reps.

Referring particularly to FIG. 32 and Tables II, III, IV, V, VI and VII, the machine operator uses control console 800 to program the machine for the copy run desired. Programming may be done during either the System Not Ready (NRDY) or System Ready (RDY) states, although the machine will not operate during the System Not ready state should START PRINT button 805 be pushed. The copy run includes selecting (using keyboard 808) the number of copies to be made, and such other ancillary program features as may be desired, i.e. use of auxiliary paper tray 102, (push button 810), image size selection (push buttons 818, 819, 820), document handler/sorter selection (push buttons 822, 823, 825, 826), copy density (push buttons 814, 815), duplex or two sided copy button 811, etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table (FIG. 35) comprised of Foreground tasks is built for operating in cooperation with the background tasks the various components of host machine 10 in an integrated manner to produce the copies programmed. The run Event Table is formed by controller 18 through merger of a Fixed Pitch Event Table (TABLE II) (stored in ROM 545 and Non Volatile Memory 610) and a Variable Pitch Event Table (TABLE III) in a fashion appropriate to the parameters of the job selected.

The Fixed Pitch Event Table (TABLE II) is comprised of machine events whose operational timing is fixed during each pitch cycle such as the timing of bias to transfer roll 75, (TRN 2 CURR), actuating toner concentration sensor 65 (ADC ACT), loading roll 161 of fuser 150 (FUS*LOAD), and so forth, irrespective of the particular copy run programmed. The Variable Pitch Table (TABLE III) is comprised of machine events whose operational timing varies with the individual copy run programmed, i.e. timing of pitch fade-out lamp 44 (FO*ONBSE) and timing of flash illumination lamps 37 (FLSH BSE). The variable Pitch Table is built by the Pitch Table Builder (TABLE IV) from the copy run information programmed in by controller 18 (using the machine control program stored in ROM section 545 and Non-Volatile Memory 610), coupled with event address information from ROM section 545, sorted by absolute clock count (via the routine shown in TABLE V), and stored in RAM section 546 (via the routine shown in TABLE VI). The Fixed Pitch Event Table and Variable Pitch Table are merged with the relative clock count differences between Pitch events calculated to form a Run Event Table (TABLE VII).

Figure 35:
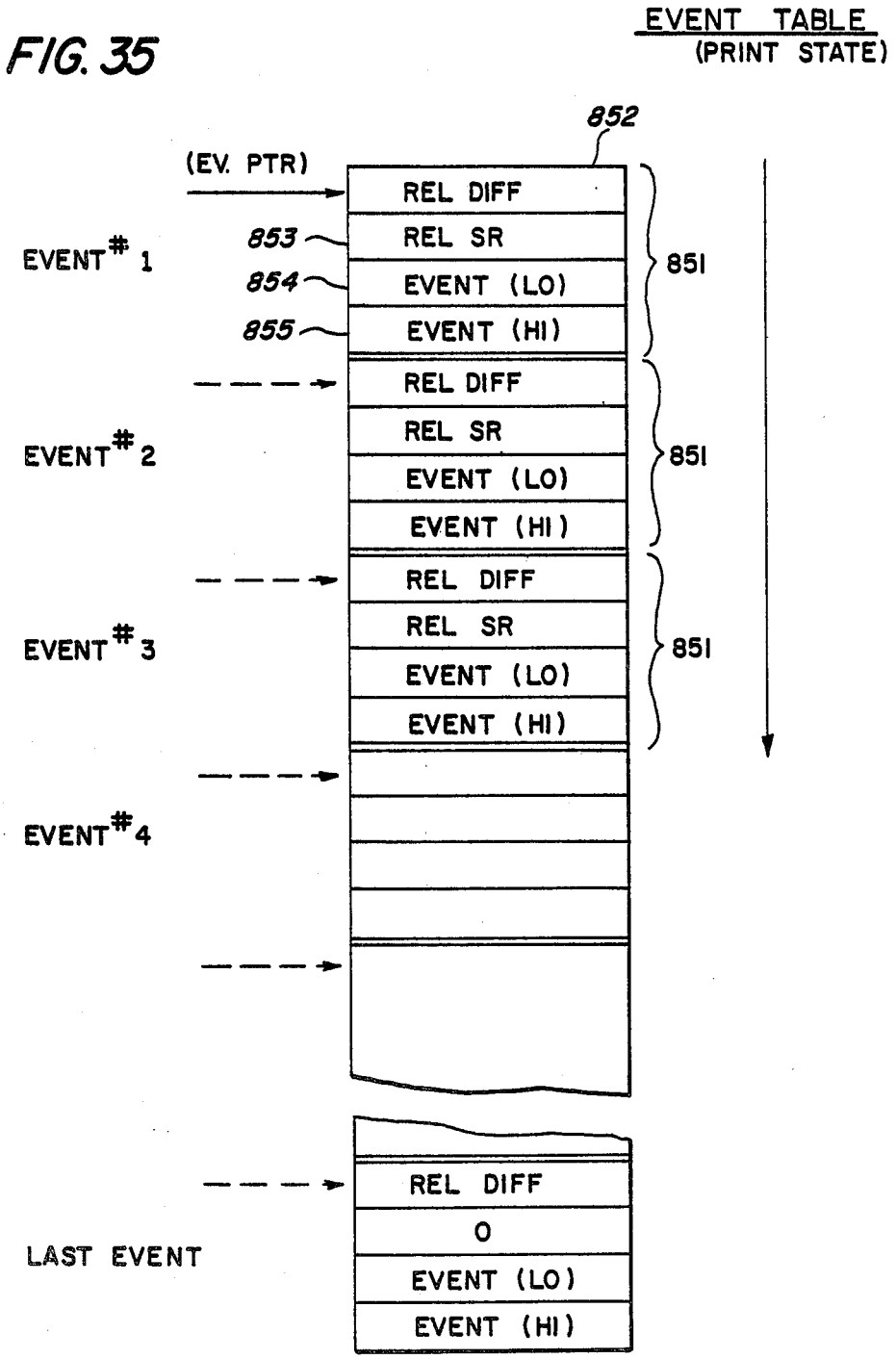
FIG. 35 is a view showing the event table layout.
Figure 36:
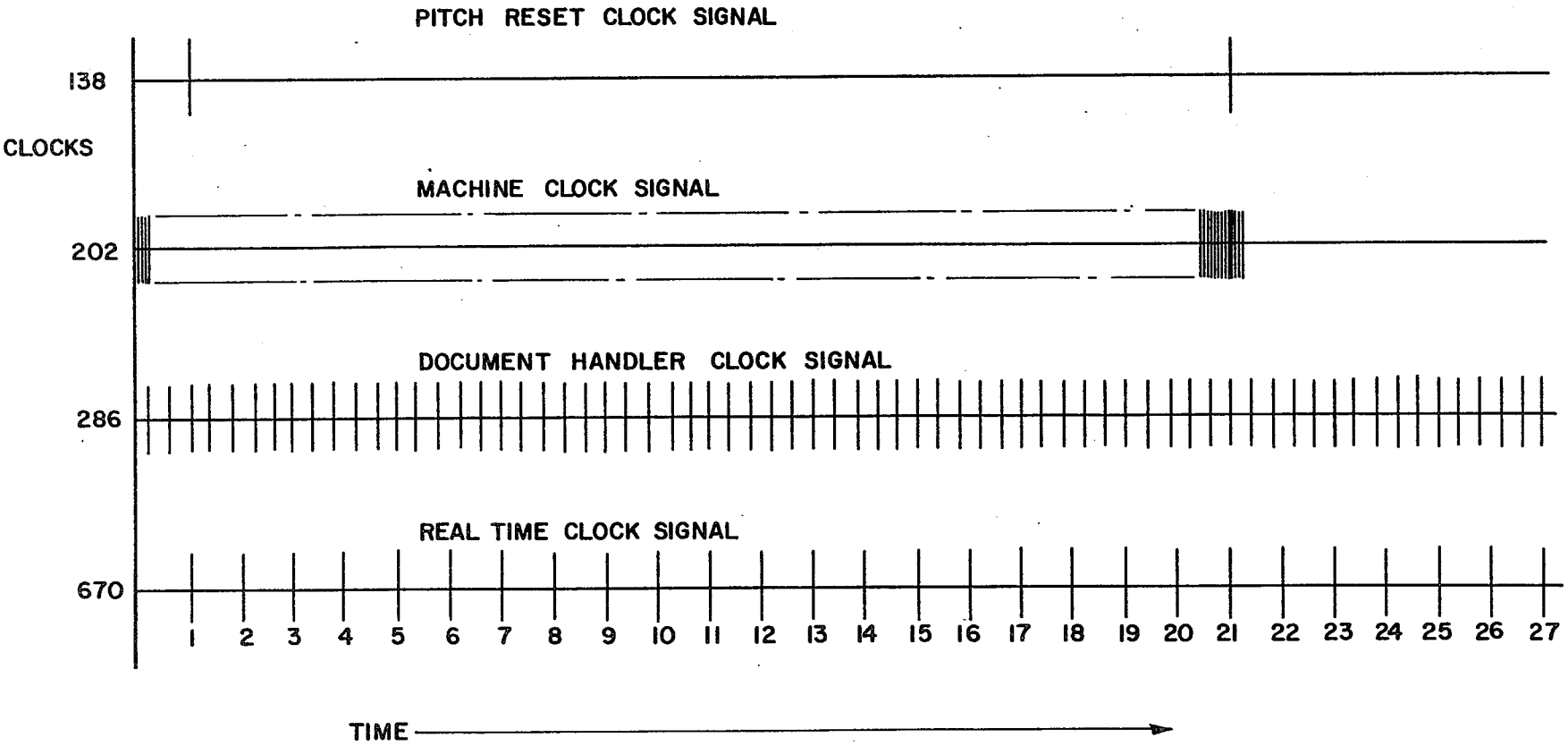
FIG. 36 is a chart illustrating the relative timing sequences of the clock interrupt pulses.
Figure 37:
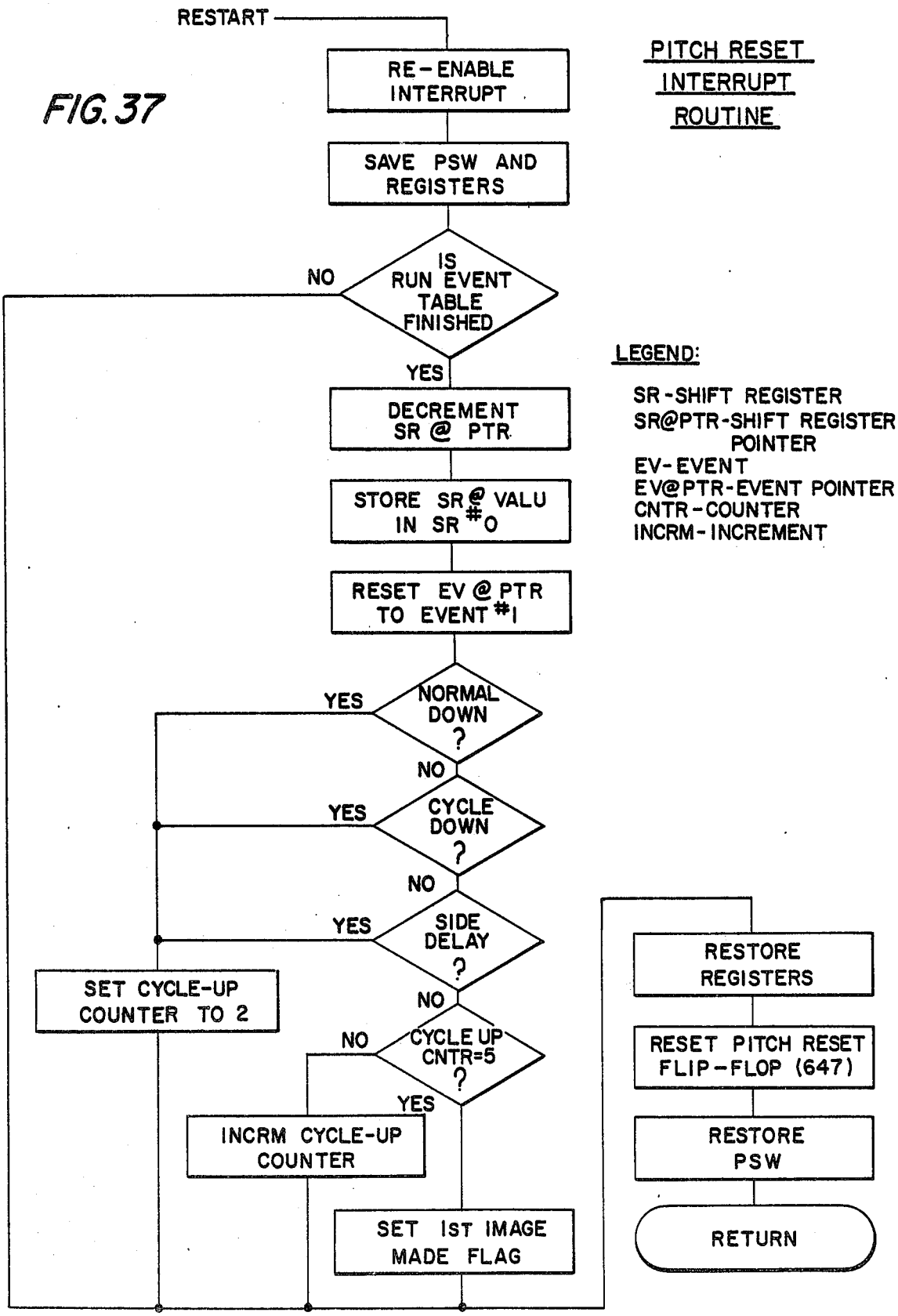
FIG. 37 is a flow charge of the pitch interrupt routine.

Referring particularly to FIG. 35, the Run Event Table consists of successive groups of individual events 851. Each event 851 is comprised of four data blocks, data block 852 containing the number of clock pulses (from machine clock 202) to the next scheduled pitch event (REL DIFF), data block 853 containing the shift register position associated with the event (REL SR), and data blocks 854, 855 (EVENT LO) (EVENT HI) containing the address of the event subroutine.

In machine states other than PRINT, data blocks 852, 853 (REL DIFF) (REL SR) are set to zero. Data blocks 854, 855 hold the address information for the Non-Print state event.

Control Data in the Run Event Table represents a portion of the foreground tasks and is transferred to the output buffer 546' of RAM memory section 546 by the Pitch Reset and Machine Clock interrupt routines. Other control data, representing foreground tasks not in the Run Event Table is transferred to RAM output buffer 546' by the Real Time Clock interrupt routine. Transfer of the remainder of the control data to output buffer 546' is by means of background (non-interrupt) routines.

Transfer of control data from output buffer 546' of RAM memory section 546 to the various locations in host machine 10 is through output Refresh via Direct Memory access (DMA) in response to machine clock interrupt signals as will appear. The interrupt routines are initiated by the respective interrupt signals.

Referring particularly to FIG. 23 and 35–37 and TABLES VII, VIII the interrupt having the highest priority, the Pitch Reset interrupt (signal 640), is operable only during the PRINT state, and occurs once each revolution of sheet register fingers 141 as responded to by sensor 146 of pitch reset clock 138. At each pitch reset interrupt signal, after a determination of priority by Priority Chip 659 in the event of multiple interrupt signals, an interrupt signal (INT) is generated. The acknowledgement signal (INTA) from processor 542 initiates the pitch reset interrupt routine.

On entering the pitch reset routine, the interrupt is re-enabled and the contents of the program working registers stored. A check is made to determine if building of the Run Event Table is finished. Also checks are made to insure that a new shift register schedules have been built and at least 910 clock counts since the last pitch reset have elapsed. If not, an immediate machine shutdown is initiated.

Presuming that the above checks are satisfactory, the shift register pointer (SR PTR), which is the byte variable containing the address of a pre-selected shift register position (SR O), is decremented by one and adjusted for overflow and the shift register contents are updated with a byte variable (SR+VALUV) containing the new shift register value to be shifted in following the pitch reset interrupt. The event pointer (EV*PTR), a two byte variable containing the full address of the next scheduled event, is reset to Event #1. The count in the C register equals the time to the first event.

Machine Cycle Down, Normal Down, and Side One Delay checks are made, and if negative, the count on a cycle up counter (CYC UP CT) is checked. If the count is less than a predetermined control count (i.e. 5), the counter (CYC UP CT) is incremented by one. When the count on the cycle up counter equals the control count, an Image Made Flag is set.

If a Normal Down, Cycle Down, or Side One Delay has been initiated, the cycle up counter (CYC UP CT) is reset to a preset starting count (i.e. 2). The pitch reset interrupt routine is exited with restoration of the working registers and resetting of pitch reset flip flop 647.

The Machine Clock Interrupt routine, which is second in priority, is operative in all operational states of host machine 10. Although nominally driven by machine clock 202, which is operative only during Print state when processor main drive motor 34 is energized, machine clock pulses are also provided by phase locked loop 649 when motor 34 is stopped.

Figure 38:
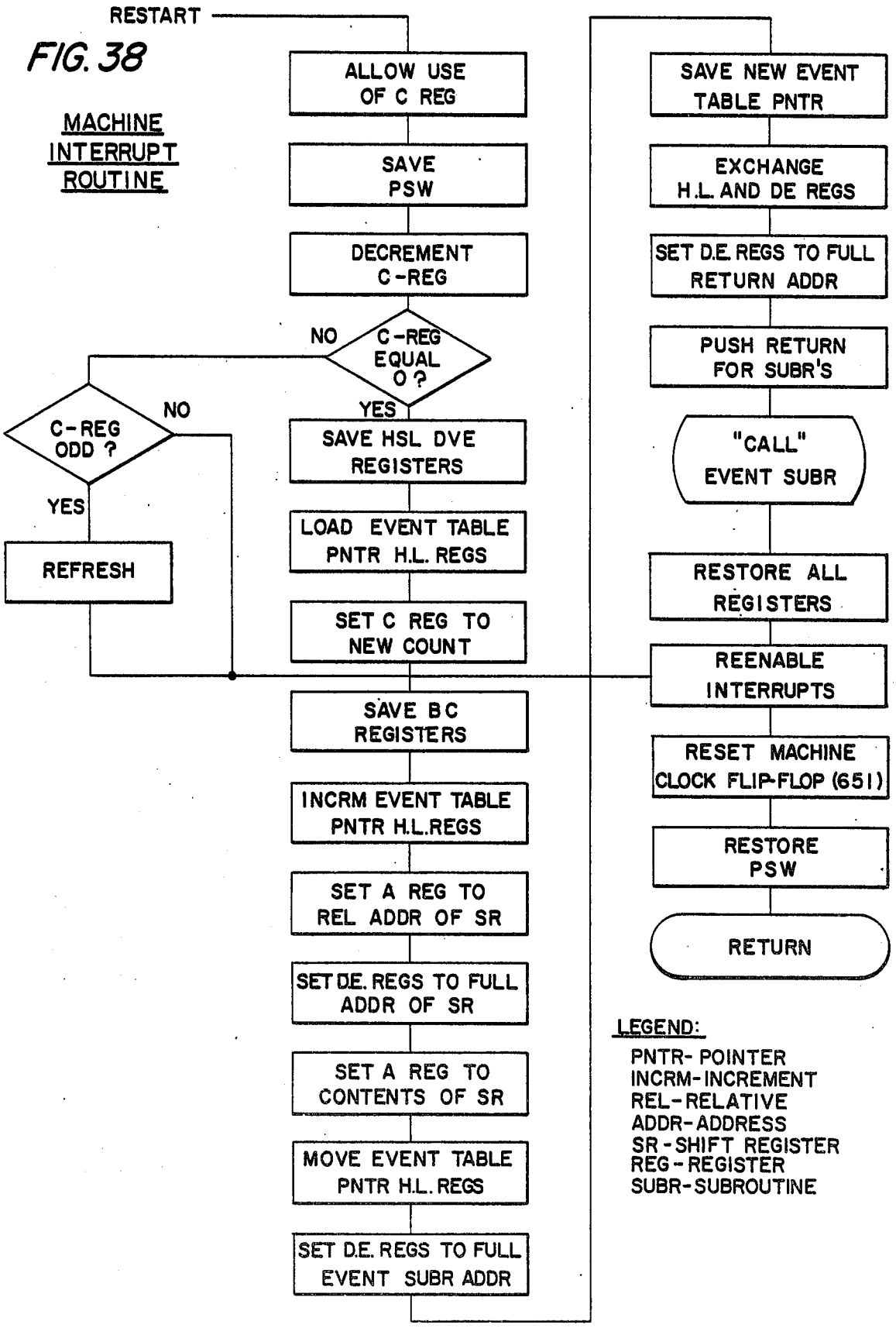
FIG. 38 is a flow chart of the machine clock interrupt routine.

Referring particularly to FIG. 38 and TABLE IX, entry to the Machine Clock interrupt routine there shown is by a signal (INTA) from processor 542 following a machine clock interrupt signal 642 as described earlier. On entry, the event control register (C REG) is obtained and the working register contents stored. The C REG is decremented by one, the register having been previously set to a count corresponding to the next event in the Event Run Table.

The control register (C REG) is checked for zero. If the count is not zero and is an odd number, an output refresh cycle is initiated to effect transfer/refresh of data in RAM output buffer 546' to host machine 10. If the number is even, or following an output refresh, the interrupt system is re-enabled, the machine clock interrupt flip flop 651 is reset and the working registers are restored. Return is then made to the interrupted routine.

If the control register (C REG) count is zero, the Even Pointer (EV*PTR), which identifies the clock count (in data block 852) for the next scheduled event (REL DIFF), is loaded and the control register (C REG) reset to a new count equal to the time to the next event. The Event Pointer (EV*PTR) is incremented to the relative shift register address for the event (REL SR, data block 853), and the shift register address information is set in appropriate shift registers (B, D, E, A registers).

The event Pointer (EV*PTR) is incremented successively to the event subroutine address information (EVENT LO) (EVENT HI) in the Event Run Table, and the address information therefrom loaded into a register pair (D & E registers). The Event Pointer (EV PTR) is incremented to the first data block (REL DIFF) of the next succeeding event in the Run Event Table, saved, and the register pair (H & L registers) that comprise the Event Pointer are loaded with the event subroutine address from the register pair (D & E registers) holding the information. The register pair (D & E registers) are set to the return address for the Event Subroutine. Using the address information, the Event Subroutine is called and the subroutine data transferred to RAM output buffer 546' for transfer to the host machine on the next Output Refresh.

Following this, the Machine Clock interrupt routine is exited as described earlier.

The Output Refresh cycle alluded to earlier functions, when entered, to transfer/refresh data from the output buffer of 546' RAM section 546 to host machine 10. Direct Memory Access (DMA) is used to insure a high data transfer rate.

On a refresh, Refresh Control 605 (see FIG. 23) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546' of RAM section 546 and transfers the contents thereof to host machine 10. Data previously transferred is refreshed.

The Real Time Interrupt, which carries the lowest priority, is active in all machine states. Primarily, the interrupt acts as an interval timer by decrementing a series of timers which in turn serve to control initiation of specialized subroutines used for control and error checking purposes.

Figure 39A:
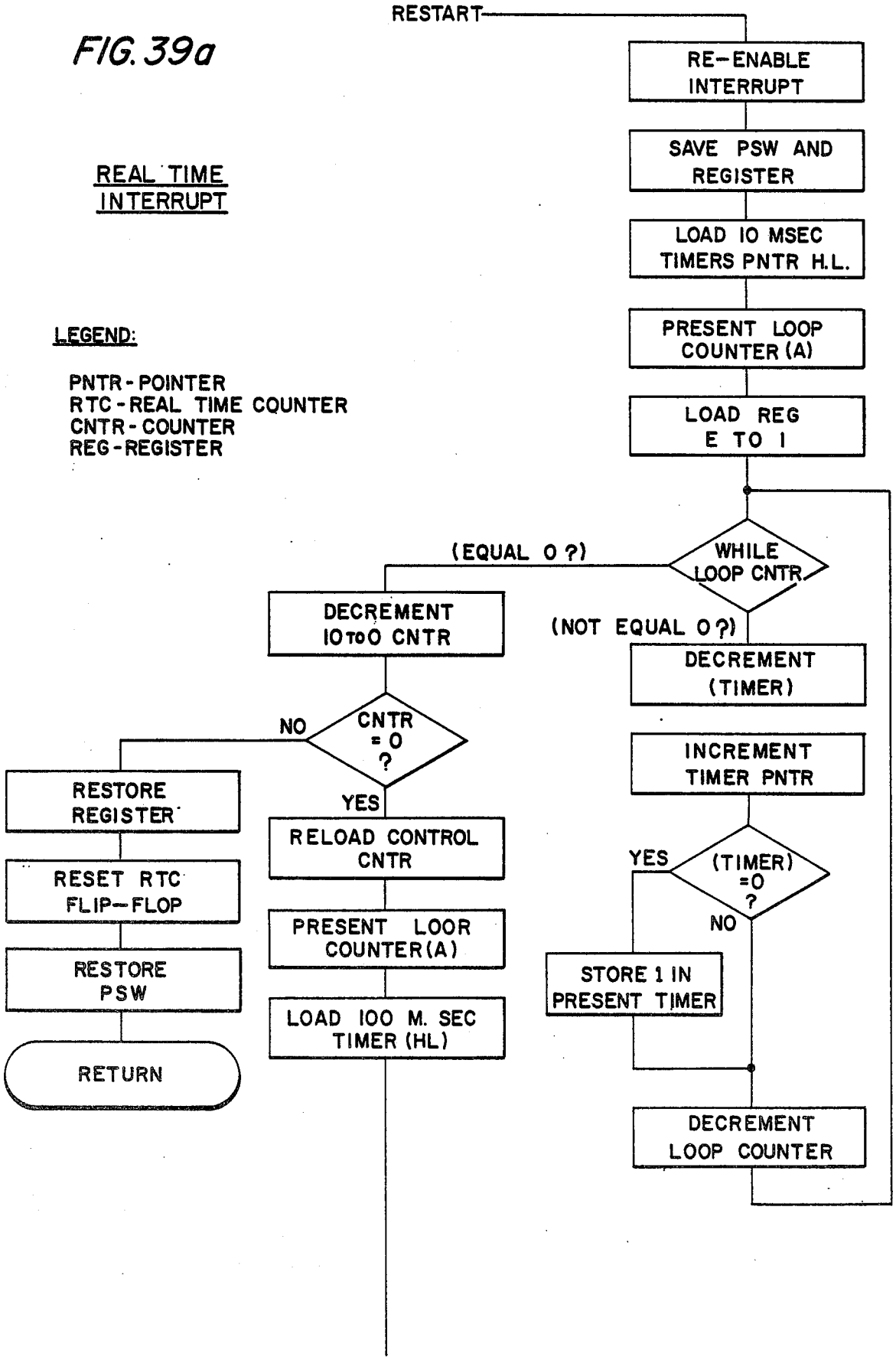
FIGS. 39*a* and 39*b* comprise a flow chart of the real time interrupt routines.
Figure 39B:
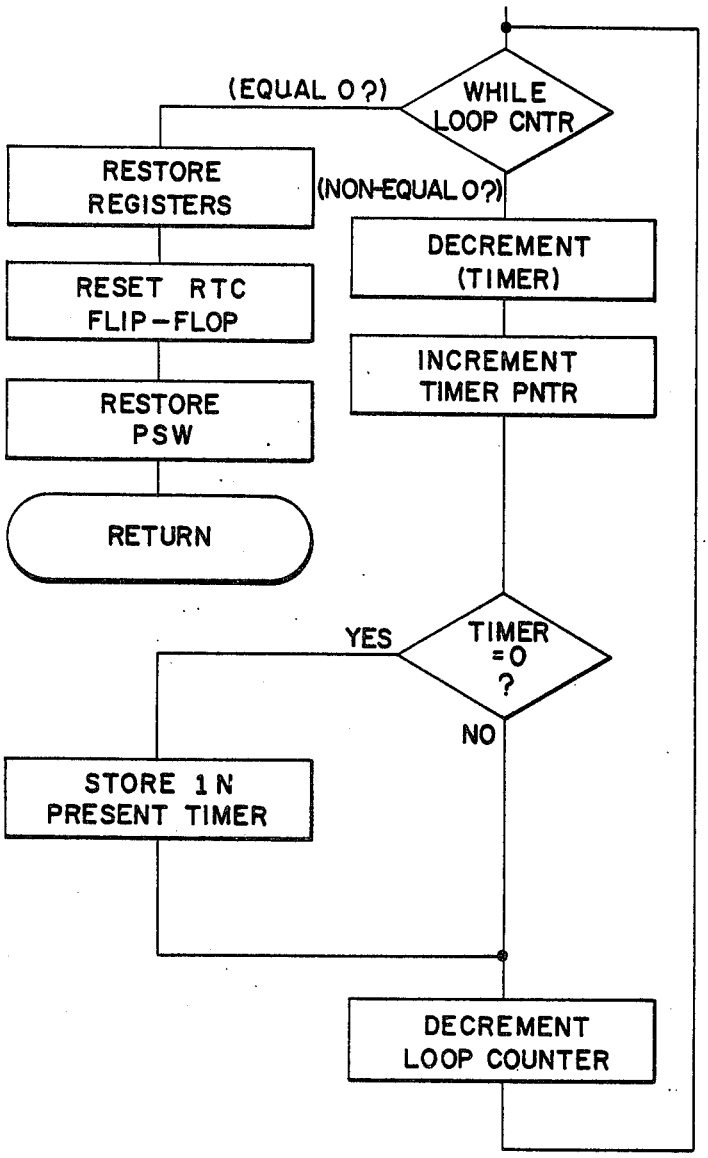

Referring particularly to FIG. 39 and TABLE X, the Real Time interrupt routine is entered in the same manner as the interrupt routines previously described, entry being in response to a specific RESTART instruction code assigned to the Real Time interrupt. On entry, the interrupt is re-enabled and the register contents stored. The timer pointer (PNTR) for the first class of timers (i.e. 10 msec TIMERS) is loaded, and a loop counter identifying the number of timers of this class (i.e. 10 msec TIMERS) preset. A control register (E REG) is loaded and a timer decrementing loop is entered for the first timer. The loop decrements the particular timer, increments the timer pointer (PNTR) to the location of the next timer in this class, checks the timer count, and decrements the loop counter. The decrementing loop routine is repeated for each timer in the class (i.e. 10 msec TIMERS) following which a control counter (CNTR) for the second group of timers (i.e. 100 msec TIMERS) is decremented by one and the count checked.

The control counter (CNTR) is initially set to a count equal to the number of times the first timer interval is divisible into the second timer interval. For example, if the first class of timers are 10 msec timers and the second timer class are 100 msec timers, the control counter (CNTR) is set at 10 initially and decremented on each Real Time interrupt by one down to zero.

If the count on the control counter (CNTR) is not zero, the registers are restored, Real Time interrupt flip flop 856 reset, and the routine exited. If the count on the control counter is zero, the counter is reloaded to the original maximum count (i.e. 10) and a loop is entered decrementing individually the second group of timers (i.e. 100 msec TIMERS). On completion, the routine is exited as described previously.

In the following TABLES:

"@"—is used to indicate flags, counters and subroutine names.

"#"—is used to indicate input signals.

"$"—is used to indicate output signals.

":"—is used to indicate macro instructions, system subroutines, system flags, and data, etc.

For further explanation of the mnemonics and particular instructions utilized by the following routines, the reader is directed to Intel Corporation's Programming Manual for the 8080 Microcomputer System.

TABLE I

```
99      *NAR
100     *
101     *       I N I T I A L I Z E   S T A T E
102     *
103     *       INIT: SUBROUTINE
104     *
105     *       INITIALIZE STATE- EXECUTED AFTER EACH START OR RESTART.  SETS
106     *       ALL POINTERS, FLAGS, AND DATA TO INITIAL VALUES REQUIRED TO
107     *       START EXECUTION OF ANY CONTROL ALGORITHMS.  ALWAYS EXITS TO
108     *       'NOT READY' STATE.

110     *       EPILOG
```

```
05 00000   3E0A    A   INIT:  MVI     A,10                      INITIALIZE TO 10
05 00002   3252FD  N          STA     DIVD:10                   INITIALIZE TO 10
05 00005   32B5FC  N          STA     SLOWTOGL                  H&L= ADDR OF STBY EVENT TABLE
05 00008   211907  N          LXI     H,EV@STBY:                SAVE FOR MACH CLK ROUTINE
05 0000B   2264FD  N          SHLD    EV@PTR:                   INIT INSTRUMENTATION REMOTE
05 0000E   21FFFF  A          LXI     H,X'FFFF'                   ADDR PNTR TO END OF RAM
05 00011   2272FB  N          SHLD    INS@PTRR                  SET PNTR TO RAM CNTRL TABLE
05 00014   21FFFF  N          LXI     H,ADH@RAMT-1              SAVE PNTR
05 00017   2278FB  N          SHLD    TAB@STRT                  INIT TO UN-BYPASS
05 0001A   3E7F    A          MVI     A,X'7F'                   ALL JAM SWS
05 0001C   32ADFC  N          STA     JAM@BYPS
                         *
                         *    TIMER INITIALIZATION
                         *    MUST BE DONE BEFORE ANY TIMERS CAN BE USED
                         *
05 0001F   211FF9  A          LXI     H,AVAIL:+84X'1F'          SET H&L TO END OF AVAIL: TABLE
05 00022   36FF    A          MVI     M,X'FF'                   STORE X'FF' IN LAST TABLE ADDR
05 00024   3E1F    A          MVI     A,31                      SET A-REG TO VALUE TO BE STORED
                              REPEAT
05 00026   2D      A              DCR     L                     STEP TO NEXT TABLE LOCATION
05 00027   77      A              MOV     M,A                   STORE INITIALIZATION VALUE
05 00028   3D      A              DCR     A                     STEP TO NEXT VALUE
05 00029   C22600  N          UNTIL:  CC,Z,S                    IS INITIALIZATION COMPLETE
05 0002C   2120FE  A          LXI     H,ADR(DATA,TIME:OUT)      TO INITIALIZE TIME:OUT TABLE
05 0002F   225FFD  N          SHLD    INPTR:                    SET IN/OUT POINTERS TO
05 00032   2261FD  N          SHLD    OUTPTR:                   BEGINNING OF TIME:OUT TABLE
                         *
                         *    INITIALIZE SPOOL
                         *    POINTERS
                         *
05 00035   2140FE  A          LXI     H,ADR(DATA,SPL:TBL)       SET PNTRS
05 00038   226AFD  N          SHLD    SPL:IN                    TO START
05 0003B   226CFD  N          SHLD    SPL:OUT                   OF TABLE
                         *
                         *    CHECK IF PAPER WAS PRESENT WHEN POWER WENT DOWN
                         *
05 0003E   3AC9E2  A          RNVNIB  NVOJAM@N                  A = JAM INFO FROM POWER DOWN
05 00041   0F      A          RRC                               SET CARRY TO FOR JAM INFO
05 00042   D25A00  N          IF:     CC,C,S                    WAS THERE PAPER IN FOR AREA
05 00045   47      A              MOV     B,A                   YES, SAVE JAM INFO
05 00046   213CFD  A              SFBIT,P FDR@AJAM,FDR@MJAM     SET FEEDER JAMS
05 00050   3E03    A
05 00052   B6      A
05 00053   77      A
05 00054   3E80    A              SFLG    CLP@REQD              TELL FLT HNDLR CLEARANCE REQD
05 00056   3267F4  A
05 00059   78      A              MOV     A,B                   RESTORE THE A-REG
                              ENDIF
05 0005A   0F      A          RRC
05 0005B   D27100  N          IF:     CC,C,S                    SET CARRY TO IMEDODN:
                         *                                      WAS THERE AN IMEDODN:
05 0005E   2EFF    A              MVI     L,MSK(FBIT,LOPROFLT,JAM2OFLT,JAM3OFLT,JAM4OFLT,
                                           JAM5OFLT,JAM6OFLT,RET1OFLT,RET2OFLT)
                         *                                      SETS ALL JAM FBITS IN REG-L
05 00060   2603    A              MVI     H,MSK(FBIT,SOSOJAM,MISSTRIP)
                         *                                      SETS ADDITIONAL FBITS IN H
05 00062   223BFD  A              SHLD    ADR(FBYT,PAP:1)       MOVE FBITS INTO FBYTES
05 00065   3E80    A              SFLG    CLR@REQD              TELL FLT HNDLR CLEARANCE REQD
05 00067   3267F4  A
05 0006A   2120F9  A              SFBIT,P TSOFUS,TSOXO2         TURN ON UNDEDICATED MAP LAMPS
05 0006D   3E21    A
05 0006F   B6      A
05 00070   77      A
                              ENDIF
05 00071   E60C    A          IF:     XBYT,A,AND,;              IS EITHER SRT JAM FLAG SET
05 00073   CA8A00  N                  MSK(NVBIT,NVOLOWOJ,NVOUPOJ),NZ 'IN NVNIB
05 00076   FE0C    A              IF:     XBYT,A,EQ,;           YES, ARE BOTH SET
05 00078   C28300  N                      MSK(NVBIT,NVOLOWOJ,NVOUPOJ)
05 0007B   3E80    A                SFLG    TWO@ACT             TELL SRT THAT THERE WAS A JAM
05 0007D   3261F4  A
05 00080   C38700  N              ELSE:
05 00083   0F      A                  RRC                       GET NVOLOWOJ TO SIGN BIT &
05 00084   3237F4  A                  IO:READ NVOLOWOJ
                                      MODFLG  LOWOMOD           TELL SRT IF UP OR LOW JAM
05 00087   CD0000  N              ENDIF
                                  CALL    JAMOSET               LET SRT SET JAM FLAGS & LAMPS
05 0008A   3E80    A          ENDIF
05 0008C   328CF7  A          SFLG    SRTORDY                   SIGNAL SRT NOT IN USE (READY)
05 0008F   3287F7  A
05 00092   326BF4  A          MODFLG  PROGORDY                  SET PROG ROUTINE READY
05 00095   3EF2    A          MODFLG  2SDOENAB                  ALLOW SELECTION OF DUPLEX MODE
05 00097   3200E6  A          MVI     A,X'F2'                   RE-ENABLE
05 0009A   FB      A          STA     RSINTFF:                  INTERRUPT
05 0009B   CD0000  N          EI                                SYSTEM
05 0009E   02      A          SOBIT,S NPFO$ON,24V$SPL           PFO OFF (INVT'D) & 24V ON
05 0009F   E480    A
05 00A1    EE80    A
05 00A3    CD0000  N          STIMR   FLTODLY,25000,FLTOCHK     START LENS FAULT TIMER
05 00A6    12      A
05 00A7    FA      A
05 00A8    0000    N
05 00AA    CD0000  N          CALL    DOC@CLP                   INITIALIZE DOC#NUM TO 1      (1)
05 00AD    327AFC  N          STA     CF@DIGIT                  ENABLE '0' IN QTY FLASHED    (2)
05 00B0    3E08    A          MVI     A,MSK(FBIT,POPORS)        TELL FLT ASSUME
05 00B2    3286FC  N          STA     XPOPREV                   BRUSH HOUSE OPN
05 00B5    3E02    A          MVI     A,:NRDY                   INIT STCK
```

```
05 00087   3254FD   N        STA     :STATE:                    SYNCRONIZED BACKGROUND
05 0008A   3253FD   N        STA     STATE:                              CONTROL LOOP
05 0008D   CD3702   N        CALL    NRDY:PRL                 INIT CONTROL TO NOT-READY STATE

                     ***********************************************************************
                     *                                                                     *
                     *   S Y C R O N I Z E D   B A C K G R O U N D   C O N T R O L   L O O P S   *
                     *                                                                     *
                     ***********************************************************************

                     *      PRIORTIES:
                     *              FIRST     10MS TIME OUT REQUESTS
                     *              SECOND    10MS CALLS
                     *              THIRD     SPOOLED CALLS
                     *              FOURTH    20MS CALLS
                     *              FIFTH     100MS CALLS
                     *              SIXTH     100MS TIME OUT REQUESTS

05 000C0   2151FD   A        LXI     H,ADR(DATA,SB:RQST)          SET MEM PNTR TO SB BYTE
                             REPEAT                               LOOP-3 FROM HLT ON ALL INTER'S
                                 REPEAT                           LOOP-2 BACK AFTER EACH 100MS
                                     REPEAT                       LOOP-1 BACK AFTER EACH 20MS
05 000C3   7E       A                MOV     A,M                  A* SYNC BKGND REQUESTS FROM RTC
05 000C4   07       A                ID:READ SB:RQST
05 000C5   D2F700   N                RLC                          TEST FOR 10MS
                                     IF:     CC,C,S                          SB REQUEST
                     *
                     *                                            TIMER SERVICE REQUESTS
                     *                                             CALLS TIMED OUT TIMER SUBRS
                     *                                             USING WRAP AROUND TABLE AND
                     *                                             IN/OUT PNTRS - RTCI SETS
                     *                                             INPTR: & ENTERS CALL ADDR
05 000C8   3A5FFD   N                    WHILE:   XBYT,INPTR:,NE,OUTPTR: ARE PNTRS AT SAME TABL
05 000CB   2161FD   N
05 000CE   BE       A
05 000CF   CAE500   N
05 000D2   6E       A                        MOV     L,M          SET L-REG TO ADDR(L) IN TABLE
05 000D3   26FE     A                        MVI     H,HADR(DATA,TIME:OUT) MEM PNTR NOW SET TO
05 000D5   5E       A                        MOV     E,M                MOVE CALL ADDR(L) TO E
05 000D6   23       A                        INX     H                 STEP TO NEXT TABLE BYTE
05 000D7   56       A                        MOV     D,M               MOVE CALL ADDR(H) TO D
05 000D8   23       A                        INX     H                 STEP TO NEXT TABLE BYTE
05 000D9   7D       A                        MOV     A,L          PREPARE TO UPDATE PNTR
                                             ID:READ TIME:OUT     DYNAMIC TABLE CONTAINING ADDRS
                                             MODBYT  A,AND,)      ADJUST FOR END OF TABLE
                                                     TIME:MSK
05 000DA   E62F     A                        STA     ADR(DATA,OUTPTR:) PNTR TO ADDR OF LAST SE
05 000DC   3261FD   A                        CALL    DE:IND       DO TIMEOUT CALL
05 000DF   CD0000   N                    ENDWHILE                 YES, ALL TIME OUTS SERVICED
05 000E2   C3C800   N                                             END TIMER SECTION
                     *                   LHLD    10:CALLS         GET PROPER 10MS CALL TABLE
05 000E5   2A55FD   N                    CALL    HL:IND           DO 10MS CALLS
05 000E8   CD0000   N                    LXI     H,ADR(DATA,SB:RQST) SET MEM PNTR TO SB BYTE
05 000EB   2151FD   A                    DI
05 000EE   F3       A                    MODBYT  M,AND, 10:RQST REMOVE 10MS REQUEST
05 000EF   7E       A
05 000F0   E67F     A
05 000F2   77       A
                                         ID:ALTR SB:RQST
05 000F3   FB       A                    EI                       (WATCH OUT FOR UNPRINTABLE NOT)
05 000F4   C31501   N                ELSE:                        DO ANY SPOOLED ROUTINES
05 000F7   3A6AFD   N                    IF:     XBYT,SPL:IN,NE,SPL:OUT
05 000FA   216CFD   N
05 000FD   BE       A
05 000FE   CA1101   N
05 00101   6E       A                        MOV     L,M
05 00102   26FE     A                        MVI     H,HADR(DATA,SPL:TBL)
05 00104   5E       A                        MOV     E,M
05 00105   23       A                        INX     H
05 00106   56       A                        MOV     D,M
05 00107   23       A                        INX     H
05 00108   7D       A                        MOV     A,L
05 00109   E64F     A                        MODBYT  A,AND,SPL:MSK
05 0010B   326CFD   A                        STA     ADR(DATA,SPL:OUT)
05 0010E   CD0000   N                        CALL    DE:IND
                                         ENDIF
05 00111   2151FD   A                    LXI     H,ADR(DATA,SB:RQST)
05 00114   7E       A                    MOV     A,M
                                     ENDIF
                                     ID:READ SB:RQST
05 00115   07       A                 RLC
05 00116   07       A                 RLC                          TEST FOR 20MS
05 00117   D24201   N                 IF:     CC,C,S                          SB REQUEST
05 0011A   2A59FD   N                     LHLD    20PNTR           SET MEM PTR TO CALL IN 20MS TAB
05 0011D   5E       A                     MOV     E,M              MOVE CALL ADDR(L) TO E
05 0011E   23       A                     INX     H                STEP MEM PTR TO ADDR(H)
05 0011F   7E       A                     IF:     XBYT,M,EQ,X'FF' IS POINTER AT END OF TABLE
05 00120   FEFF     A
05 00122   C23701   N
05 00125   2A57FD   N                         LHLD    20:PNTR      YES, SET MOVING POINTER
05 00128   2259FD   N                         SHLD    20PNTR            BACK TO BEGINNING OF TABLE
05 0012B   2151FD   A                         LXI     H,ADR(DATA,SB:RQST)      SET MEM PNTR TO
05 0012E   F3       A                         DI
05 0012F   7E       A                         MODBYT  M,AND, 20:RQST REMOVE 20MS REQUEST
05 00130   E6BF     A
05 00132   77       A
                                              ID:ALTR SB:RQST
05 00133   FB       A                         EI
05 00134   C34201   N                     ELSE:
05 00137   56       A                         MOV     D,M      NO, MOVE CALL ADDR(H) TO D
05 00138   23       A                         INX     H            STEP TO NEXT CALL IN TABLE
05 00139   2259FD   N                         SHLD    20PNTR       SAVE FOR NEXT LOOP-1
05 0013C   CD0000   N                         CALL    DE:IND
```

```
285   05 0013F   2151FD   A                    LXI      H,ADR(DATA,SB:RQST) SET MEM PNTR TO SB BY
286                                          ENDIF
287                                       ENDIF
288   05 00142   7E       A              UNTIL:   XBYT,M,AND,20:RQST,Z  MORE 20MS CALLS TO DO  (LOOP-1)
      05 00143   E640     A
      05 00145   C2C300   N
289                                      ID:READ   SB:RQST
290   05 00148   7E       A              IF:       XBYT,M,AND,100:ROST,NZ TEST FOR 100MS SB REQUEST
      05 00149   E620     A
      05 0014B   CA9E01   N
291                                         ID:READ   SB:RQST
292   05 0014E   2A5DFD   N                 LHLD      100PNTR          SET MEM PNTR TO CALL IN 100 TAB
293   05 00151   5E       A                 MOV       E,M              MOVE CALL ADDR(L) TO E
294   05 00152   23       A                 INX       H                STEP MEM PNTR TO ADDR(H)
295   05 00153   7E       A                 IF:       XBYT,M,EQ,X'FF'  IS PNTR AT END OF TABLE
      05 00154   FEFF     A
      05 00156   C29301   N
296   05 00159   2A5BFD   N                    LHLD      100:PNTR      YES, SET MOVING PNTR BACK
297   05 0015C   225DFD   N                    SHLD      100PNTR            TO BEGINNING OF TABLE
298                                 *
299                                 *                                 100MS TIMER SERVICE
300                                 *                                  DECREMENTS TIMERS AND CALLS
301                                 *                                  SUBROUTINE REQUESTED WHEN
302                                 *                                  TIMER TIMES OUT
303                                 *                                  USES 3 TABLES ON 3 CONSECUTIVE
304                                 *                                  RAM PAGES -100:CNT W/TIMER
305                                 *                                            -100:LS W/ADDR(L)
306                                 *                                            -100:LS W/ADDR(H)
307                                 *                                  ADDR IS FOR REQSTED SUBR
308                                 *
309   05 0015F   2130FA   N                    LXI       H,100:CNT     STARTING ADDR OF 100MS TIMERS
310   05 00162   1614     A                    MVI       D,100:TMAX    D-REG SET TO QTY OF 100MS TMRS
312                                 *                                 CONDITIONAL HOLD OF 100MS TMRS
314   05 00164   3A45FD   A                    IF:       FBIT,STDBOPNO,T IS STAND-BY RELAY OPEN
      05 00167   E640     A
      05 00169   CA6E01   N
315
316   05 0016C   1611     A                        MVI       D,100:TMAX; YES, HOLD SPECIFIED NUMBER
317                                                -HOLDTMRS            OF TIMERS
318                                 *                    ENDIF
319
320   05 0016E   7E       A                    REPEAT                   LOOP TO DECR & SERVICE TIMEOUTS
      05 0016F   A7       A                        IF:       VBYT,M,NZ IS TIMER ACTIVE
      05 00170   CA8201   N
321   05 00173   35       A                              DCR       M     DECR TIMER
322   05 00174   C28201   N                              IF:       CC,Z,S HAS TIMER TIMED OUT
323   05 00177   D5       A                                  PUSH      D     SAVE # TIMERS TO SERVICE
324   05 00178   E5       A                                  PUSH      H     SAVE ADDR OF CURRENT TIMER
325   05 00179   24       A                                  INR       H     STEP TO NEXT RAM PAGE
326   05 0017A   5E       A                                  MOV       E,M   MOVE CALL ADDR(L) TO E
327   05 0017B   24       A                                  INR       H     STEP TO NEXT RAM PAGE
328   05 0017C   56       A                                  MOV       D,M   MOVE CALL ADDR(H) TO D
329   05 0017D   CD0000   N                                  CALL      DE:IND
330   05 00180   E1       A                                  POP       H     RECALL ADDR OF CURRENT TMR
331   05 00181   D1       A                                  POP       D     RECALL NUMBER OF TIMERS
332                                 *                                        YET TO BE SERVICED
333                                                      ENDIF
334
335   05 00182   23       A                        ENDIF
336   05 00183   15       A                        INX       H          STEP TO NEXT TIMER ADDR
337   05 00184   C26E01   N                        DCR       D          DECR NUMBER OF 100MS TIMERS
338                                 *                    UNTIL:    CC,Z,S        HAVE ALL TIMERS BEEN SERVICED
339   05 00187   2151FD   A                                                   END 100MS TIMER SECTION
340   05 0018A   F3       A                    LXI       H,ADR(DATA,SB:RQST) SET MEM PNTR TO SB BYTE
341   05 0018B   7E       A                    DI
      05 0018C   E6DF     A                    MADBYT    M,AND, 100:RQST REMOVE 100MS REQUEST
      05 0018E   77       A
342                                          ID:ALTR   SB:RQST
343   05 0018F   FB       A                    EI
344   05 00190   C39E01   N                 ELSE:
345   05 00193   56       A                    MOV       D,M            NO, MOVE CALL ADDR(H) TO D
346   05 00194   23       A                    INX       H                  STEP PNTR TO NEXT CALL
347   05 00195   225DFD   N                    SHLD      100PNTR            SAVE FOR NEXT LOOP-2
348   05 00198   CD0000   N                     CALL      DE:IND
349   05 0019B   2151FD   A                     LXI       H,ADR(DATA,SB:RQST) SET MEM PNTR TO SB BYTE
350                                          ENDIF
351                                       ENDIF
352   05 0019E   7E       A           UNTIL:    VBYT,M,Z                  MORE SB CALLS TO DO  (LOOP-2)
      05 0019F   A7       A
      05 001A0   C2C300   N
353                                      ID:READ   SB:RQST
354   05 001A3   76       A              HLT                              COOL IT UNTIL INTERRUPT RESTART
355   05 001A4   CAC300   N          UNTIL:    CC,Z,C                     WAS INTERRUPT RTC  (LOOP-3)
356   05 001A7   F3       A          DI                                   ONLY KIDDING BEFORE, BUT THIS
357   05 001A8   76       A          HLT                                   TIME REALLY STOP (ABORT)
359                                 *
360                                 *  SUBR TO SET CALL TABLE POINTERS
361                                 *  CALLED BY EACH STATE PROLOG
362                                 *
363                                 *  POSITION SB:TABLE POINTER
364                                 *
```

```
05 001A9   3A53FD   N   SB:PNTRS LDA     STATE:                      WHAT STATE IS WANTED
05 001AC   110600   A            LXI     D,X'06'                     LOAD D&E WITH SKIP NUMBER
05 001AF   21D501   N            LXI     H,SB:TABLE-X'06'            H&L=6'<' TABLE ADDR
                                 REPEAT
05 001B2   19       A                DAD     D                       SKIP THREE WORDS
05 001B3   3D       A                DCR     A                       DECR STATE LOOP COUNTER
05 001B4   F2B201   N            UNTIL:  CC,S,S                      IS POINTER AT CORRECT STATE
                                 *
                                 *       TRANSFER ADDRS TO VARIABLE SB POINTERS
                                 *
05 001B7   1155FD   N            LXI     D,10:CALLS                  SET D&E TO FIRST OF SB PNTRS
05 001BA   0602     A            MVI     B,2                         LOAD 10:CALLS
05 001BC   CDCE01   N            CALL    MV:WORDS                                  & 20:PNTR
05 001BF   2B       A            DCX     H                           ADJUST 'FROM' PNTR
05 001C0   2B       A            DCX     H                                          BACK 1 WORD
05 001C1   0602     A            MVI     B,2                         LOAD 20PNTR
05 001C3   CDCE01   N            CALL    MV:WORDS                                & 100:PNTR
05 001C6   2B       A            DCX     H                           ADJUST 'FROM' PNTR
05 001C7   2B       A            DCX     H                                          BACK 1 WORD
05 001C8   CDCC01   N            CALL    MV:WORD                     LOAD 100PNTR
                                 ID:ALTR 10:CALLS,20:PNTR,20PNTR,:   DATA WORDS MODIFIED
                                         100:PNTR,100PNTR              BY THIS SUBR
05 001CB   C9       A            RET
                                 *NAR
                                 *
                                 *       MV:WORD/MV:WORDS SUBROUTINES
                                 *
                                 *       SUBR TO TRANSFER WORDS (2BYTES) FROM MEMORY POINTED TO BY <H&L>
                                 *        TO MEMORY POINTED TO BY <D&E>. CALL MV:WORD FOR 1 TRANSFER,
                                 *        AND CALL MV:WORDS (WITH B-REG # WORDS TO TRANSFER) FOR
                                 *        MULTIPLE TRANSFERS. USES ALL BUT C-REG.
                                 *
05 001CC   0601     A   MV:WORD  MVI     B,1                         B= # WORDS TO BE MOVED
                        MV:WORDS REPEAT
05 001CE   7E       A                MOV     A,M                     A= 1ST 'FROM' BYTE
05 001CF   12       A                STAX    D                       STORE IN 1ST 'TO' LOCATION
05 001D0   23       A                INX     H                       ADVANCE 'FROM'
05 001D1   13       A                INX     D                                  AND 'TO' PNTRS
05 001D2   7E       A                MOV     A,M                     A= 2ND 'FROM' BYTE
05 001D3   12       A                STAX    D                       STORE IN 2ND 'TO' LOCATION
05 001D4   23       A                INX     H                       ADVANCE 'FROM'
05 001D5   13       A                INX     D                                  AND 'TO' PNTRS
05 001D6   05       A                DCR     B                       DECRM # OF WORDS CNTR
05 001D7   C2CE01   N            UNTIL:  CC,Z,S                      LOOP UNTIL ALL WORDS TRANSFERRD
05 001DA   C9       A            RET
                                 *
                                 *       TABLE OF SB CALL POINTERS
                                 *       FOR EACH STATE
                                 *
05 001DB   0906     N   SB:TABLE DW      COMP10
05 001DD   0A06     N            DW      COMP20
05 001DF   1206     N            DW      COMP100
05 001E1   B105     N            DW      TREP10
05 001E3   B505     N            DW      TREP20
05 001E5   C305     N            DW      TREP100
05 001E7   4202     N            DW      NRDY10
05 001E9   4602     N            DW      NRDY20
05 001EB   5202     N            DW      NRDY100
05 001ED   AF02     N            DW      RDY10
05 001EF   B302     N            DW      RDY20
05 001F1   BF02     N            DW      RDY100
05 001F3   A803     N            DW      PRNT10
05 001F5   B203     N            DW      PRNT20
05 001F7   C803     N            DW      PRNT100
05 001F9   1905     N            DW      RUNN10
05 001FB   1D05     N            DW      RUNN20
05 001FD   2F05     N            DW      RUNN100
                                 *
                                 *       SUBR TO DO EPILOGS & PROLOGS LAST CALL IN EVERY 100MS TABLE
                                 *
05 001FF   2153FD   A   STAT:CHG LXI     H,ADR(DATA,STATE:)          A= PRESENT STATE # IF UNCHANGED
05 00202   7E       A            MOV     A,M                          OR NEXT STATE IF CHANGED
05 00203   23       A            INX     H                           H&L= ADDR 'FORMER STATE' GLOBAL
05 00204   BE       A            IF:     XBYT,A,NE,M                 HAS THERE BEEN A STATE CHANGE
   05 00205   CA3602   N
                                    ID:READ  STATE:,:STATE:
05 00208   46       A               MOV     B,M                     YES, B= FORMER STATE
05 00209   77       A               MOV     M,A                     UPDATE 'FORMER' TO 'PRESENT'
                                    ID:ALTR  :STATE:
05 0020A   78       A               CASE:   VBYT,B                  DO EPILOG FOR FORMER STATE
   05 0020B   111F02   N
   05 0020E   FE06     A
   05 00210   CD0000   N
05 00213   1806     N                  C,0     COMP:EPL             COMPONENT CONTROL STATE
05 00215   DB05     N                  C,1     TREP:EPL             TECH REP STATE
05 00217   7A02     N                  C,2     NRDY:EPL             NOT-READY STATE
05 00219   E302     N                  C,3     RDY:EPL              READY STATE
05 0021B   E603     N                  C,4     PRNT:EPL             PRINT STATE
05 0021D   4105     N                  C,5     RUNN:EPL             SYSTEM RUNNING, NOT PRINT STATE
                                    ENDCASE
05 0021F   3A53FD   N               CASE:   VBYT,STATE:             DO PROLOG FOR PRESENT STATE
   05 00222   113602   N
   05 00225   FE06     A
   05 00227   CD0000   N
05 0022A   FF05     N                  C,0     COMP:PRL             COMPONENT CONTROL STATE
05 0022C   A505     N                  C,1     TREP:PRL             TECH REP STATE
05 0022E   3702     N                  C,2     NRDY:PRL             NOT-READY STATE
05 00230   A602     N                  C,3     RDY:PRL              READY STATE
05 00232   1603     N                  C,4     PRNT:PRL             PRINT STATE
05 00234   0B05     N                  C,5     RUNN:PRL             SYSTEM RUNNING, NOT PRINT STATE
                                    ENDCASE
                                 ENDIF
05 00236   C9       A            RET                                 RETURN TO 100 MSEC SYNC BKGND
```

```
463                                 *NAR
464                                 *
465                                 *        N O T   R E A D Y   S T A T E
466                                 *
467                                 *        NOT READY STATE- EXECUTES AFTER INITIALIZE UNTIL ALL READY CONDITIONS
468                                 *        ARE MET.  THIS STATE CAN ALSO BE ENTERED FROM 'RUN NOT PRINT','READY'
469                                 *        AND 'TECH REP'.  CONTROL EXITS TO EITHER 'READY' OR 'TECH REP' STATES.

471                                 *        PROLOG

473   05 00237   CDA901   N   NRDY:PRL CALL     SB:PNTRS                        SYNC BKG PNTRS TO NEW STATE
474   05 0023A   CD0000   N           STIMR    INSTOTMR,1000,NEXTOFLT          UPDATES INST FLT CODE IN STBY
      05 0023D   49       A
      05 0023E   64       A
      05 0023F   0000     N
475   05 00241   C9       A           RET

477                                 *        CALLS FOR NOT READY 10 MS SYN BACKGROUND

479   05 00242   CD0000   N   NRDY10  CALL     ADHOCTRL
480   05 00245   C9       A           RET

482                                 *        CALLS FOR NOT READY 20 MS SYN BACKGROUND

484   05 00246   0000     N   NRDY20  DW       NRDYOSWS
485   05 00248   0000     N           DW       MNOELVPS
486   05 0024A   0000     N           DW       DSPLOCTL
487   05 0024C   0000     N           DW       LMPOCTRL
488   05 0024E   0000     N           DW       INSTRU
489   05 00250   FFFF     A           DW       X'FFFF'                         END OF TABLE

491                                 *        CALLS FOR NOT READY 100 MS SYN BACKGROUND

493   05 00252   0000     N   NRDY100 DW       NRILKOCK
494   05 00254   0000     N           DW       REDOBGND
495   05 00256   0000     N           DW       DVLODUMP
496   05 00258   0000     N           DW       RECAPER
497   05 0025A   0000     N           DW       BINOCHK                         1
498   05 0025C   0000     N           DW       MINIPHS1                        2
499   05 0025E   0000     N           DW       BILOJMPO
500   05 00260   0000     N           DW       FUSOROUT
501   05 00262   0000     N           DW       FLTO100                         1
502   05 00264   0000     N           DW       FLTOCTRL                        2
503   05 00266   0000     N           DW       FLTOCLRN                        3
504   05 00268   0000     N           DW       PROG2SJM
505   05 0026A   0000     N           DW       2SDOSTPY
506   05 0026C   0000     N           DW       XMMOSTPY
507   05 0026E   0000     N           DW       JAMORST
508   05 00270   0000     N           DW       KEYOCNTR
509   05 00272   0000     N           DW       TSTOLPA
510   05 00274   8402     N           DW       NRDY:CHG                        TEST IF OK TO
511   05 00276   FF01     N           DW       STAT:CHG                                      LEAVE NOT READY
512   05 00278   FFFF     A           DW       X'FFFF'                         END OF TABLE

514                                 *        EPILOG

516   05 0027A   CD0000   N   NRDY:EPL CSBIT,S  WAITO                           INSURE WAIT OFF AT NRDY EXIT
      05 0027D   E9FE     A
517   05 0027F   AF       A           CFLG     STRT:PRT                        DIS-ABLE TRANSFER TO 'PRINT'
      05 00280   325BF4   A
518   05 00283   C9       A           RET

520                                 *
521                                 *        SUBR FOR 'NOT-READY' 100MS SYNC BKGND
522                                 *         TESTS FOR CHANGE TO 'READY' OR 'TREP REP'
523                                 *
524   05 00284   CDDF05   N   NRDY:CHG CALL     TREP:CHG                        TEST FOR STATE CHANGE TO :TREP
525   05 00287   7E       A           IF:      XBYT,M,NE,:TREP                 DID IT CHANGE TO :TREP STATE
      05 00288   FE01     A
      05 0028A   CA9302   N
526                                                ID:READ   STATE:
527   05 0028D   CD9402   N                        CALL      RDYTEST:          TEST ALL 'READY' FLAGS
528   05 00290   CD0803   N                        CALL      NRDY:RDY          MOVE TO EITHER :NRDY OR :RDY
529                                           ENDIF
530   05 00293   C9       A           RET

532                                 *
533                                 *        SUBR TO TEST ALL 'READY' FLAGS IN A LOOP
534                                 *
535   05 00294   2184F7   A   RDYTEST: LXI      H,RDYFLGS:                      HL= START ADDR OF READY FLAGS
536   05 00297   0609     A           MVI      B,RDYFNUM:                      B= # OF READY FLAGS TO CHK
537                                           REPEAT
538   05 00299   7E       A                        MOV       A,M               A= <PRESENT READY FLAG>
539   05 0029A   07       A                        RLC                         SET C IF FLAG SET (READY)
540   05 0029B   DAA002   N                        IF:       CC,C,C            IS PRESENT FLAG INDICATING RDY
541   05 0029E   0601     A                            MVI       B,1           NO, DON'T TEST ANY FURTHER
542                                                ENDIF
543   05 002A0   23       A                        INX       H                 MOVE TO NEXT FLAG LOCATION
544   05 002A1   05       A                        DCR       B                 DECRM LOOP CNTR (# READY FLAGS)
545   05 002A2   C29902   N           UNTIL:   CC,Z,S                        LOOP UNTIL ALL FLAGS CHKED
546                                           ID:READ   LENSORDY,ELVORDY,FUSORDY,;   FLAGS READ
547                                                     PROGORDY,ILCKORDY,XMMORDY,;
548                                                     FLTORDY,ADHONMOV,SRTORDY
549   05 002A5   C9       A           RET                                     RETURN
551                                 *NAR
552                                 *
553                                 *        R E A D Y   S T A T E
554                                 *
555                                 *        READY STATE- EXECUTES WHEN MACHINE IS READY TO GO INTO PRINT STATE.
556                                 *        CONTROL CAN GO BACK TO 'NOT READY' OR GO TO 'TECH REP' IF REQUIRED.
```

```
558                                 *       PROLOG

560   05 002A6   CD0000   N   RDY:PRL  SOBIT,S    READY$
      05 002A9   E701     A
561   05 002AB   CDA901   N            CALL       SB:PNTRS                    SYNC BKG PNTRS TO NEW STATE
562   05 002AE   C9       A            RET
564                                 *       CALLS FOR READY 10MS SYN BACKGROUND

566   05 002AF   CD0000   N   RDY10    CALL       ADH@CTRL
567   05 002B2   C9       A            RET

569                                 *       CALLS FOR READY 20MS SYN BACKGROUND

571   05 002B3   0000     N   RDY20    DW         RDY@SWS
572   05 002B5   0000     N            DW         MN@ELV@S
573   05 002B7   0000     N            DW         DSPL@CTL
574   05 002B9   0000     N            DW         LMP@CTRL
575   05 002BB   0000     N            DW         INSTRU
576   05 002BD   FFFF     A            DW         X'FFFF'                     END OF TABLE

578                                 *       CALLS FOR READY 100MS SYN BACKGROUND

580   05 002BF   0000     N   RDY100   DW         RIN@CHK                     1
581   05 002C1   0000     N            DW         MINIPHS1                    2
582   05 002C3   0000     N            DW         RIL@JMPB
583   05 002C5   0000     N            DW         OVL@DUMP
584   05 002C7   0000     N            DW         RECAPER
585   05 002C9   0000     N            DW         FUS@RDUT
586   05 002CB   0000     N            DW         FLT@100
587   05 002CD   0000     N            DW         FLT@CTRL                    1
588   05 002CF   0000     N            DW         NRILK@CK                    2
589   05 002D1   0000     N            DW         RED@BGND
590   05 002D3   0000     N            DW         2SD@STPY
591   05 002D5   0000     N            DW         XMM@STPY
592   05 002D7   0000     N            DW         JAM@RST
593   05 002D9   0000     N            DW         KEY@CNTR
594   05 002DB   0000     N            DW         TST@LP4
595   05 002DD   E9C2     N            DW         RDY:CHG                     TEST IF OK TO
596   05 002DF   FFC1     N            DW         STAT:CHG                                  LEAVE READY
597   05 002E1   FFFF     A            DW         X'FFFF'                     END OF TABLE

599                                 *       EPILOG

601   05 002E3   CD0000   N   RDY:EPL  COBIT,S    READY$
      05 002E6   E7FE     A
602   05 002E8   C9       A            RET

604                                 *       CHANGE OF STATE ROUTINES

606                                 *
607                                 *       SUBR FOR 'READY' 100MS SYNC BKGND
608                                 *        TESTS FOR CHANGE TO 'NOT-READY' OR 'TECH REP'
609                                 *
610   05 002E9   CDDF05   N   RDY:CHG  CALL       TREP:CHG                    TEST FOR STATE CHANGE TO :TREP
611   05 002EC   7E       A            IF:        XBYT,M,NE,:TREP             DID IT CHANGE TO :TREP STATE
      05 002ED   FE01     A
      05 002EF   CA0A03   N
612                                      ID:READ    STATE:
613   05 002F2   CD9402   N              CALL       RDYTEST:                    TEST ALL 'READY' FLAGS
614   05 002F5   CD0B03   N              CALL       NRDY:RDY                    MOVE TO EITHER :NRDY OR :RDY
615   05 002F8   3A58F4   A              IF:        FLG,STRT:PRT,T              IS START PRINT REQUESTED
      05 002FB   07       A
      05 002FC   D20A03   N
616   05 002FF   2153FD   A                 LXI        H,ADR(DATA,STATE:)       SET MEM PNTR
617   05 00302   7E       A                 IF:        XBYT,M,EQ,:RDY           OK TO GO TO PRINT
      05 00303   FE03     A
      05 00305   C20A03   N
618                                          ID:READ    STATE:
619   05 00308   3604     A                  MVI        M,:PRNT                  CHG TO PRT STATE
620                                          ID:ALTR    STATE:
621                                       ENDIF
622                                    ENDIF
623                                 ENDIF
624   05 0030A   C9       A            RET

626                                 *
627                                 *       SUBR TO USE INFO FROM 'RDYTEST' AND EXECUTE THE PROPER CHANGE OF STATE
628                                 *
629   05 0030B   2153FD   A   NRDY:RDY LXI        H,ADR(DATA,STATE:)          SET MEM PNTR
630   05 0030E   3603     A            MVI        M,:RDY                      ASSUME GOING TO 'READY' STATE
631                                    ID:ALTR    STATE:
632   05 00310   DA1503   N            IF:        CC,C,C                      ARE ALL 'READY' FLAGS SET
633   05 00313   3602     A              MVI        M,:NRDY                   NO, MOVE TO 'NOT-READY' STATE
634                                      ID:ALTR    STATE:
635                                 ENDIF
636   05 00315   C9       A            RET
638                                 *NAR
639                                 *
640                                 *       P R I N T    S T A T E
641                                 *
642                                 *       PRINT STATE- EXECUTES WHILE MACHINE IS PRODUCING COPIES.
643                                 *       ENTERED FROM 'READY' AND EXITS TO 'RUN NOT PRINT'.

645                                 *       PROLOG

647   05 00316   2160FE   N   PRNT:PRL CLR:MEM   16,SHIFTREG                  CLEAR SHIFT REGISTER
      05 00319   0610     A
      05 0031B   CD0000   N
648   05 0031E   3E60     A            MVI        A,LADR(DATA,SHIFTREG)       FORCE SHIFT REG TO START AT
649   05 00320   3263FD   A            STA        ADR(DATA,SROPTR:)            BEGINNING OF SHIFTREG TABLE
650                                    CLR:MEM    SD1@DLY-TIME@DN:+1,)        CLEAR THE FOLLOWING FLAGS
651   05 00323   21A7F4   A                       ADR(FLG,TIME@DN:)
      05 00326   0609     A
      05 00328   CD0000   N
```

```
652                                          ID:CLR    TIME@DN!,IMED@DN!,;
653                                                    CYCL@DN!,NORM@DN!,OWIK!OUT,;
654                                                    IMGMADF!,SD1@TIMO,SD1@DLY
655   05 0032B   3E80    A                   SFLG      910@DONE                      ALLOW FIRST PITCH RESET
      05 0032D   326FF4  A
656   05 00330   AF      A                   XRA       A
657   05 00331   3266FD  N                   STA       CYCUPCT!                      INIT CYCLE-UP CNTR TO 0
658   05 00334   3269FD  N                   STA       SR@VALU!                      INIT 'NEW SR VALUE' TO 0
659   05 00337   325DFA  N                   STA       PLL@INFO                      INIT PLL SHUTDOWN CONTROL TO 0
660   05 0033A   3268FD  N                   STA       SMPL@CT!                      INIT SAMPLE COPY CNTR TO 0
661   05 0033D   3E03    A                   MVI       A,3
662   05 0033F   3267FD  N                   STA       NOIMGCT!                      INIT 'NO IMAGE CNTR' TO 3
663   05 00342   CD0000  N                   CALL      SRSK                          SHIFT REG SCHEDULER (INIT SR#0)
664   05 00345   CD0000  N                   CALL      TIM@MOD                       CALC SHIFTED IMAGE VALUES   (1)
665   05 00348   CD0000  N                   STIMR     935!TMR,810,RETURN!           SET 'OVER-RUN EVENT' TIMER  (2)
      05 0034B   22      A
      05 0034C   51      A
      05 0034D   0000    N
666   05 0034F   CD0000  N                   CALL      TBLD@PRT                      BUILD NEW PITCH TABLE       (3)
667   05 00352   CD0000  N                   SOBIT,S   PRNT$RLY,PR$COOL              PRINT RELAY & COOLING FAN ON
      05 00355   02      A
      05 00356   EA08    A
      05 00358   F608    A
668   05 0035A   AF      A                   CTIMR     PR@COOL                       CLEAR COOLING FAN TIMER
      05 0035B   3232FA  N
669   05 0035E   CD0000  N                   COBIT,S   NPF0$ON                       TURN OFF PF0 (INVERTED DRIVER)
      05 00361   E47F    A
670   05 00363   3A80F4  A                   IF!       FLG,ADH@SELC,T
      05 00366   07      A
      05 00367   D27003  N
671   05 0036A   CD0000  N                       CALL      ADH@MOTN
672   05 0036D   C37503  N                   ELSE!
673   05 00370   3E80    A                       SFLG      ADH@WTEN
      05 00372   320CF4  A
674                                          ENDIF
675   05 00375   CD0000  N                   CALL      TRN@BOD
676   05 00378   CD0000  N                   CALL      PAPSSIZE                      CHK PAPER WIDTH FOR FUSER   (1)
677   05 0037B   CD0000  N                   CALL      EDGE@FA                       CHK WHICH EDGE FADE OUT     (2)
678   05 0037E   CD0000  N                   CALL      PAP@PPL3
679   05 00381   CD0000  N                   CALL      PROG@UP                       PROG INITIALIZATION SUBR
680   05 00384   CD0000  N                   CALL      PROG@UP!
681   05 00387   CD0000  N                   CALL      FDR@PRT                       CHECK FEEDER SELECTION
682   05 0038A   CD0000  N                   CALL      BLG@BKPT                      READ BILLING BREAK-POINTS
683   05 0038D   CD0000  N                   CALL      DO@ELV                        CAUSE ELV TO EXECUTE
684   05 00390   3A54F4  A                   IF!       FLG,SRT@SEL,T                 IS SORTER BEING USED
      05 00393   07      A
      05 00394   D29F03  N
685   05 00397   CD0000  N                       CALL      SRT@INIT                  INITIALIZE SORTER JAM DETECT
686                                                MVI       A,MSK(NVBIT,NV@FJAM,;     SETS ALL 4 JAM CONDITIONS
687   05 0039A   3E0F    A                                   NV@IMED,NV@LOW@J,NV@UP@J)
688   05 0039C   C3A403  N                   ELSE!
689   05 0039F   3AC9E2  A                       RNVNIB    NV@JAM@N                  READ SAVED PREVIOUS SRT JAMS
690                                                MODBYT    A,OR,MSK(NVBIT,;          & SET IMED ON & FDR JAM
691   05 003A2   F603    A                                   NV@FJAM,NV@IMED)
692                                          ENDIF
693   05 003A4   32C9E2  A                   WNVNIB    NV@JAM@N                      STORE IN CASE OF PWR DN
694                                          ID:ALTR   NV@FJAM,NV@IMED,NV@LOW@J,;    SEE ABOVE IF!/ELSE!
695                                                    NV@UP@J
696   05 003A7   CDA901  N                   CALL      SB!PNTRS                      SYNC BKG PNTRS TO NEW STATE
697   05 003AA   C9      A                   RET

699                                      *   CALLS FOR PRINT 10 MS SYN BACKGROUND

701   05 003AB   CD0000  N             PRNT10 CALL      ADH@CTRL
702   05 003AE   CDC004  N                   CALL      PRT!IMD
703   05 003B1   C9      A                   RET

705                                      *   CALLS FOR PRINT 20 MS SYN BACKGROUND

707   05 003B2   0000    N             PRNT20 DW        PRT@SWS
708   05 003B4   0000    N                   DW        TON@DIS
709   05 003B6   0000    N                   DW        PAP@TGL3
710   05 003B8   0000    N                   DW        LMP@CTRL
711   05 003BA   0000    N                   DW        FDR@BKFD
712   05 003BC   0000    N                   DW        SORTER@
713   05 003BE   0000    N                   DW        FLV@PRNT
714   05 003C0   0000    N                   DW        SOS@JMDT
715   05 003C2   0000    N                   DW        DSPL@CTL
716   05 003C4   0000    N                   DW        INSTRU
717   05 003C6   FFFF    A                   DW        X'FFFF'                       END OF TABLE

719                                      *   CALLS FOR PRINT 100 MS SYN BACKGROUND

721   05 003C8   0000    N            PRNT100 DW        RILK@CK
722   05 003CA   0000    N                   DW        2SD@RUN
723   05 003CC   0000    N                   DW        LITE@OFF
724   05 003CE   0000    N                   DW        XMM@PRNT
725   05 003D0   0000    N                   DW        FUS@RDUT
726   05 003D2   0000    N                   DW        READY@CK
727   05 003D4   0000    N                   DW        JAM@RST
728   05 003D6   0000    N                   DW        MINIPHS8
729   05 003D8   4F06    N                   DW        SMPL@COPY
730   05 003DA   0000    N                   DW        RXCYCLDN                      STUB IN US IMG
731   05 003DC   0000    N                   DW        KEY@CNTR
732   05 003DE   0000    N                   DW        TST@LP4
733   05 003E0   2C04    N                   DW        PRT!CHG                       TEST IF OK TO
734   05 003E2   FF01    N                   DW        STAT!CHG                                    LEAVE PRINT
735   05 003E4   FFFF    A                   DW        X'FFFF'                       END OF TABLE
737                                      *   EPILOG

739   05 003E6   CD0000  N            PRNT!EPL CALL     AX@EPTY                       (1)
740   05 003E9   CD0000  N                   CALL      FDM@EPL3                      (2)
741   05 003EC   CD0000  N                   CALL      FDA@EPL3                      (3)
742   05 003EF   CD0000  N                   CALL      TRN@EPL3
```

```
743  05 003F2   CD0000  N          CALL      DVL0NRDY
744                                C0BIT,S   FUS$CAPL,FUS$LOAD,ILLM$SPL,;
745  05 003F5   CD0000  N                    EF0$11,EF0$12$5,SMPL$CPY,READY$
     05 003F8   07      A
     05 003F9   E6F7    A
     05 003FB   EDFD    A
     05 003FD   F2F7    A
     05 003FF   ECF7    A
     05 00401   EBF7    A
     05 00403   E2FE    A
     05 00405   E7FE    A
746  05 00407   CD0000  N          S0BIT,S   NPF0$0N                    TURN OFF PF0 (INVERTED DRIVER)
     05 0040A   E480    A
747  05 0040C   AF      A          CFLG      ELV0AUT0                   DISABLE AUTO-TRAY SWITCHING
     05 0040D   3222F4  A
748  05 00410   CD0000  N          CALL      PAP0EPL3
749  05 00413   CD1704  N          CALL      AB0RT
750  05 00416   C9      A          RET

752                           *
753                           *    SUBROUTINE
754                           *

756  05 00417   F3      A  AB0RT   DI                                  TURN OFF INTERRUPT SYSTEM
757  05 00418   AF      A          CFLG      TBLD0FIN                   SIGNAL NEW PITCH TABLE REQ'D
     05 00419   325DF4  A
758  05 0041C   211907  N          LXI       H,EV0STBY!                 ADDR OF STBY EVENT TABLE
759  05 0041F   2264FD  N          SHLD      EV0PTR!                    SAVE FOR MACH CLK ROUTINE
760  05 00422   CD0000  N          C0BIT,S   BTR$LOAD,PRNT$RLY          UN-LOAD BTR & DROP PRINT RELAY
     05 00425   02      A
     05 00426   E17F    A
     05 00428   EAF7    A
761  05 0042A   FB      A          EI
762  05 0042B   C9      A          RET
764  05 0042C   3A66FD  N  PRT!CHG IF!       XBYT,CYCUPCT!,EQ,2         CHECK FOR PROLOG 2 OR CYCLE OUT
     05 0042F   FEC2    A
     05 00431   C23C04  N
765  05 00434   3E80    A              SFLG      PRT$PR02               YES, SET 'PRINT PROLOG 2' FLAG
     05 00436   3271F4  A
766  05 00439   C37004  N          ORIF!     XBYT,A,EQ,3                NO, IS CYCLE UP CNTR=3
     05 0043C   FEC3    A
     05 0043E   C27004  N
767  05 00441   3A71F4  A          ANDIF!    FLG,PRT?PR02,T             YES, AND IS PROLOG 2 FLAG SET
     05 00444   07      A
     05 00445   D27004  N
768  05 00448   AF      A              CFLG      PRT0PR02               YES, DO PROLOG 2 AND CLR FLAG
     05 00449   3271F4  A
769                           *
770                           *    PRINT STATE BACKGROUND- PROLOG 2
771                           *
772  05 0044C   CD0000  N              CALL      PAP0PRL2               RETN XPORT OFF IF NOT SIDE 1
773  05 0044F   CD0000  N              CALL      PROG0UP2
774  05 00452   3AADF4  A              IF!       FLG,IMGMADE!,T         HAS 1ST IMAGE BEEN MADE
     05 00455   07      A
     05 00456   D25C04  N
775  05 00459   CD0000  N                  CALL      PROG0UP            YES, CALL PROG INITIALIZATION
776                                   ENDIF
777  05 0045C   3A57FA  N              IF!       VBYT,MINIBYTE,NZ       IS MINI-PHYSICAL ACTIVE
     05 0045F   A7      A
     05 00460   CA7004  N
778  05 00463   AF      A                  CFLG      DSPL01ST           YES, ENABLE DISPLAY UPDATE
     05 00464   329AF4  A
779  05 00467   3C      A                  INR       A                  DISPLAY QUANTITY
780  05 00468   3250FA  N                  STA       DSPL0ST1            COMPLETE
781  05 0046B   3EC6    A                  MVI       A,6                SET DOCUMENT TOTAL TO
782  05 0046D   326FFA  N                  STA       DOC0TOTL            6 FOR ADH DOCUMENT CHECK
783                                   ENDIF
784                           *    ENDIF

786                           *    END PROLOG2

788                           *
789                           *    BUILD FLAG BYTE
790                           *
791  05 00470   0608    A          MVI       B,8                        NUMBER OF FLAGS REQ'D
792  05 00472   AF      A          XRA       A                          CLEAR A-REG
793  05 00473   57      A          MOV       D,A                        CLEAR D-REG
794  05 00474   21A9F4  A          LXI       H,ADR(FLG,IMED0DN!)        STARTING ADDR OF PRT!CHG FLAGS
795                                REPEAT
796  05 00477   7E      A              MOV       A,M                    LOAD A W/CONTENTS OF FLAG ADDR
797  05 00478   07      A              RLC                              ROTATE FLAG(D7) INTO CARRY
798  05 00479   7A      A              MOV       A,D                    LOAD A W/FLAGS BILT INTO BYTE
799  05 0047A   17      A              RAL                              PUT FLAG IN DO & SHIFT LEFT
800  05 0047B   57      A              MOV       D,A                    SAVE RESULT IN D-REG
801  05 0047C   23      A              INX       H                      STEP TO NEXT FLAG
802  05 0047D   05      A              DCR       B                      DECR NUMBER OF FLAGS REQ'D
803  05 0047E   C27704  N          UNTIL!    CC,Z,S                     LOOP UNTIL ALL FLAGS IN BYTE
804                                !D!READ   IMED0DN!,CYCL0DN!,NORM0DN!,;  FLAGS READ
805                                          QWIK!OUT,IMGMADE!,SD10TIMO,;
806                                          SD10DLY,ADH0SELC
807                           *
808                           *    TEST FOR STATE CHANGE TO !RUNN
809                           *
810  05 00481   3A67FD  N          LDA       NOIMGCT!                   MOV CURRENT NO IMAGE COUNTER
811  05 00484   5F      A          MOV       E,A                        TO THE E-REG
812  05 00485   060E    A          MVI       B,14                       LOOP CNTR FOR STATE CHG TESTS
813  05 00487   21E104  N          LXI       H,CYC!OUT                  TABLE ADDR OF PRT!CHG TESTS
814                                REPEAT
815  05 0048A   7A      A              MOV       A,D                    MOV FLAG BYTE TO THE A-REG
816  05 0048B   A6      A              MODBYT    A,AND,M                MASK FOR DESIRED FLAGS
817  05 0048C   23      A              INX       H                      STEP TO STATUS TEST
818  05 0048D   AE      A              MODBYT    A,XOR,M                TEST FLAG STATUS
819  05 0048E   C29F04  N              IF!       CC,Z,S                 DID TEST PASS
820  05 00491   23      A                  INX       H                  YES, STEP TO NOIMGCT! TEST
821  05 00492   7B      A                  IF!       XBYT,E,GE,M        IS NOIMGCT! AT CORRECT VALUE
```

```
     05 00493   RE      A
     05 00494   DA9E04  N
822  05 00497   3E05    A                 MVI     A,1RUNN      YES, CHANGE STATE
823  05 00499   3253FD  N                 STA     STATE1        TO RUN NOT PRINT
824  05 049C    0601    A                 MVI     B,1          FORCE END OF TESTS (EARLY OUT)
825                                     ENDIF
826  05 049E    2B      A               DCX     H              ADJ PNTR BACK TO NO IMG TEST
827                                 ENDIF
828  05 049F    23      A           INX     H                  STEP OVER NO IMG TEST
829  05 04A0    23      A           INX     H                  STEP TO MASK FOR NEXT TEST
830  05 04A1    05      A           DCR     B                  DECR LOOP COUNTER
831  05 04A2    C28A04  N       UNTIL1  CC,Z,S                 ALL TESTS COMPLETE OR STATE CHG
832                                 *
833  05 04A5    7A      A       MOV     A,D                    MOV FLAG BYTE TO A-REG
834  05 04A6    E662    A       MODBYT  A,AND,D6|D5|D1         MASK AND TEST FOR FLAGS TRUE
835                            ID:READ NORMODN1,CYCLODN1,SD1ODLY FROM ABOVE BYTE BUILD
836  05 04A8    CABF04  N       IF1     CC,Z,C                 ARE ANY FLAGS TRUE
837  05 04AB    2166FD  A           LXI     H,ADR(DATA,CYCUPCT1) PREPARE TO TEST OR MODIFY
838  05 04AE    7E      A           IF1     XBYT,M,GF,3        HAS PROG PUSHED IT TO 0
     05 04AF    FE03    A
     05 04B1    DAB604  N
839                                     ID:READ   CYCUPCT1
840  05 04B4    3602    A               MVI       M,2          NO, FORCE CYCLE-UP MODE AGAIN
841                                     ID:ALTR   CYCUPCT1
842                                 ENDIF
843  05 04B6    CD0000  N           COBIT,S   ILLMOSPL         ILLM SPL OFF DURING DEAD CYCLE
     05 04B9    F2F7    A
844  05 04BB    AF      A           CFLG      SMPLOFLG         CANCEL SAMPLE COPY SEQUENCE
     05 04BC    324CF4  A
845                                 ENDIF
846  05 04BF    C9      A           RET

848                     PRT1IMD IF1     FLGS,IMEDODN1,AND,1    IS IMEDIATE DOWN REQUESTED
849  05 04C0    3AA9F4  A               TBLDOFIN,T             AND HAS PROB BEEN DETECTED
     05 04C3    2150F4  A
     05 04C6    A6      A
     05 04C7    F20004  N
850  05 04CA    CD1704  N           CALL      ARPRT
851  05 04CD    C3E004  N       ORIF1   FLG,TIMEDDN1,T         IF TIMED DWN REQ'D DROP OUT
     05 04D0    3AA7F4  A
     05 04D3    07      A
     05 04D4    D2E004  N
852  05 04D7    21E1FF  A           COBIT     BTRPLOAD         BIAS TRANS ROLL (ASAP)
     05 04DA    3E7F    A
     05 04DC    F3      A
     05 04DD    A6      A
     05 04DE    77      A
     05 04DF    FB      A
853                                 ENDIF
854  05 04E0    C9      A           RET
856                                 *
857                                 *                                  D7 6 5 4 3 2 1 0 (X=DON'T CARE)
858                                 *
859                                 *   TABLE OF FLAG STATUS TESTS
860                                 *    AND NO IMAGE COUNTER VALUES   I C N O I S S A   N C
861                                 *    USED TO DETERMINE IF STATE    M Y O W M D D D   O O
862                                 *    SHOULD CHANGE FROM PRINT TO   E C R I G 1 1 H     U   T N
863                                 *    RUN NOT PRINT                 D L M K M O O O   I N   E U
864                                 *                                  O O O I A T D S   M T   S M
865                                 *                                  D D D O D I L E   A E   T B
866                                 *                                  N N N U E M Y L   G R     E
867                                 *                                  I I I T I O   C   E       R
868  05 04E1    48      A   CYC1OUT DB      D6|D3                  X 1 X X 0 X X X   00      1
869  05 04E2    40      A           DB      D6
870  05 04E3    00      A           DB      0
871  05 04E4    5C      A           DB      D6|D4|D3|D2            X 1 X 0 1 1 X X   16      2
872  05 04E5    4C      A           DB      D6|D3|D2
873  05 04E6    10      A           DB      16
874  05 04E7    5C      A           DB      D6|D4|D3|D2            X 1 X 0 1 0 X X   11      3
875  05 04E8    48      A           DB      D6|D3
876  05 04E9    0B      A           DB      11
877  05 04EA    68      A           DB      D6|D5|D3               X 0 1 X 0 X X X   00      4
878  05 04EB    20      A           DB      D5
879  05 04EC    00      A           DB      0
880  05 04ED    75      A           DB      D6|D5|D4|D2|D0         X 0 0 0 X 1 X 0   36      5
881  05 04EE    04      A           DB      D2
882  05 04EF    24      A           DB      36
883  05 04F0    75      A           DB      D6|D5|D4|D2|D0         X 0 0 0 X 1 X 1   20      6
884  05 04F1    05      A           DB      D2|D0
885  05 04F2    14      A           DB      20
886  05 04F3    7D      A           DB      D6|D5|D4|D3|D2|D0      X 0 1 0 1 1 X 0   36      7
887  05 04F4    2C      A           DB      D5|D3|D2
888  05 04F5    24      A           DB      36
889  05 04F6    7D      A           DB      D6|D5|D4|D3|D2|D0      X 0 1 0 1 1 X 1   20      8
890  05 04F7    2D      A           DB      D5|D3|D2|D0
891  05 04F8    14      A           DB      20
892  05 04F9    75      A           DB      D6|D5|D4|D2|D0         X 0 0 0 X 0 X 0   21      9
893  05 04FA    00      A           DB      0
894  05 04FB    15      A           DB      21
895  05 04FC    7D      A           DB      D6|D5|D4|D3|D2|D0      X 0 1 0 1 0 X 0   21      10
896  05 04FD    28      A           DB      D5|D3
897  05 04FE    15      A           DB      21
898  05 04FF    75      A           DB      D6|D5|D4|D2|D0         X 0 0 0 X 0 X 1   13      11
899  05 00500   01      A           DB      D0
900  05 00501   0D      A           DB      13
901  05 00502   7D      A           DB      D6|D5|D4|D3|D2|D0      X 0 1 0 1 0 X 1   13      12
902  05 00503   29      A           DB      D5|D3|D0
903  05 00504   0D      A           DB      13
904  05 00505   10      A           DB      D4                     X X X 1 X X X X   11      13
905  05 00506   10      A           DB      D4
906  05 00507   0B      A           DB      11
907  05 00508   80      A           DB      D7                     1 X X X X X X X   00      14
908  05 00509   80      A           DB      D7
909  05 0050A   00      A           DB      0
```

```
912                                  *NAR
913                                  *
914                                  *        R U N   N O T   P R I N T   S T A T E
915                                  *
916                                  *        RUN NOT PRINT- EXECUTES WHILE MACHINE IS COMPLETING A COPY RUN.
917                                  *        ENTERED FROM 'PRINT' AND EXITS TO 'NOT READY'.

919                                  *        PROLOG

921  05 0050B   CD0000   N   RUNN1PRL CALL     DOSELV                          CAUSE ELV TO EXECUTE
922  05 0050E   CD0000   N           STIMR     RUNN1TMR,2500,RUNNOCHG          STAY IN RUNN 2.5 SEC
     05 00511   2F       A
     05 00512   FA       A
     05 00513   7505     N
923  05 00515   CDA901   N           CALL      SB1PNTRS                        SYNC BKG PNTRS TO NEW STATE
924  05 00518   C9       A           RET

926                                  *        CALLS FOR RUN NOT PRINT 10 MS SYN BACKGROUND

928  05 00519   CD0000   N   RUNN10  CALL      ADHOCTPL
929  05 0051C   C9       A           RET

931                                  *        CALLS FOR RUN NOT PRINT 20 MS SYN BACKGROUND

933  05 0051D   0000     N   RUNN20  DW        RUNNOSWS
934  05 0051F   0000     N           DW        SORTERS
935  05 00521   0000     N           DW        SOSOJMOT
936  05 00523   0000     N           DW        FLVOPRNT
937  05 00525   0000     N           DW        LMPOCTRL
938  05 00527   0000     N           DW        PAPOTGL4
939  05 00529   0000     N           DW        DSPLOCTL
940  05 0052B   0000     N           DW        INSTRU
941  05 0052D   FFFF     A           DW        X'FFFF'                         END OF TABLE

943                                  *        CALLS FOR RUN NOT PRINT 100 MS SYN BACKGROUND

945  05 0052F   0000     N   RUNN100 DW        JAMORST
946  05 00531   0000     N           DW        RILKOCK
947  05 00533   0000     N           DW        FUSORDUT
948  05 00535   0000     N           DW        2SDORUN
949  05 00537   0000     N           DW        XMMOPRNT
950  05 00539   0000     N           DW        LITEOOFF
951  05 0053B   0000     N           DW        TSTOLP4
952  05 0053D   FF01     N           DW        STAT1CHG                        TEST IF OK TO LEAVE RUN NOT PRT
953  05 0053F   FFFF     A           DW        X'FFFF'                         END OF TABLE

955  05 00541   CD0000   N   RUNN1EPL CALL      DELOCK                          CALC COPIES DELIVERED
956  05 00544   CD0000   N           CALL      PAPOEPL4                        'RUNNPRT' PAPER PATH MOP UP SUB
957  05 00547   CD0000   N           CALL      MOTOOFF                         TURN OFF SORTER MOTORS
958  05 0054A   CD0000   N           CALL      DOSELV                          CAUSE ELV TO EXECUTE
959  05 0054D   AF       A           CFLG      AXFDOFLT                        RESET FOR USE DURING NEXT RUN
     05 0054E   323FF4   A
960  05 00551   2123FC   A           CFBIT,P   TFOXMMO                         STOP BLINKING OF XMM 'OTHER'
     05 00554   3EFE     A
     05 00556   A6       A
     05 00557   77       A
961  05 00558   CD0000   N           CORIT,S   SOS*SMPL
     05 0055B   ECFD     A
962  05 0055D   CD7B05   N           CALL      NVOJAM
963  05 00560   CD0000   N           CALL      RCPOSTPE                        STORE RECAP DATA IN RAM
964  05 00563   CD0000   N           CALL      ADHOMOTF
965  05 00566   3E08     A           MVI       A,8
966  05 00568   3285FA   N           STA       COOLCNT                         SET COUNTER FOR 7 TIMEOUTS
967  05 0056B   CD0000   N           CALL      PROFAN
968  05 0056E   CD0000   N           CALL      FLTOEPL5                        (1)
969  05 00571   CD0000   N           CALL      HISTOFLE                        (2) LOG HISTORY DATA FOR RUN
970  05 00574   C9       A           RET                                       (3)

972  05 00575   2153FD   N   RUNNOCHG LXI      H,STATE1                        SET HEL TO ADDR OF STATE1
973  05 00578   3602     A           MVI       M,INRDY                         CHANGE STATE1 TO NOT READY
974                                  ID1ALTR   STATE1
975  05 0057A   C9       A           RET

977  05 0057B   3A66F4   A   NVOJAM   RFLG      UPOJAM                          LOAD A WITH SRT UPPER JAM FLAG
     05 0057E   07       A
978                                  *                                         & SAVE IT IN THE CARRY BIT
979  05 0057F   3A36F4   A           LDAFLG    LOWOJAM                         LOAD A WITH SRT LOWER JAM FLAG
980  05 00582   17       A           RAL                                       & MOVE CARRY &
981  05 00583   17       A           RAL                                       LOWOJAM INTO THEIR POSITIONS
982  05 00584   07       A           RLC
983  05 00585   07       A           RLC
984                                  MODBYT    A,AND,MSK(NVBIT,)               MASK FOR DESIRED BITS
985  05 00586   E60C     A                     NVOLOWEJ,NVOUPOJ)
986  05 00588   47       A           MOV       B,A                             & SAVE IT IN THE B-REG
987  05 00589   3AA9F4   A           IF1       FLG,IMFDOONI,T                  WAS THERE AN IMED ON CONDITION
     05 0058C   07       A
     05 0058D   D29605   N
988  05 00590   78       A               MOV       A,P                         YES,RESTORE A-REG
989                                     MODBYT    A,OR,MSK(NVBIT,NVOFJAM,)    & SET NV JAM BITS
990  05 00591   F603     A                         NVOIMED)
991  05 00593   C3A105   N           ELSE1
992  05 00596   3A3CFD   A               IF1       FBITS,FDROAJAM,OR,FDROMJAM,T IS EITHER JAM CONDITION TRUE
     05 00599   E60C     A
     05 0059B   CA9F05   N
993  05 0059E   37       A                   STC                               YES,SET CARRY
994                                     ENDIF
995  05 0059F   17       A               RAL                                   ROTATE INTO DO
996  05 005A0   B0       A               MODBYT    A,OR,B                      'OR' IN SRT JAM BITS
997                                  ENDIF
998  05 005A1   32C9E2   A           WNVNIB    NVOJAMPN
999                                  ID1ALTR   NVOFJAM,NVOIMED,NVOLOWOJ,NVOUPOJ
1000 05 005A4   C9       A           RET                                       RETURN TO STATE CHECKER
```

```
1002                                  *NAR
1003                                  *
1004                                  *        T E C H    R E P    S T A T E
1005                                  *
1006                                  *        THE TECH REP STATE IS ENTERED WHEN THE SERVICE KEY IS ON IN
1007                                  *        'NOT READY' & 'READY' STATES. THIS ALLOWS THE TECH REP TO PERFORM SUCH
1008                                  *        TASKS AS ACCESS NON-VOLATILE MEMORY & COMPONENT CONTROL.

1010                                  *
1011                                  *        PROLOG
1012                                  *
1013   05 005A5   CD0000   N   TREP:PRL COBIT,S   WAIT$                        INSURE WAIT OFF AT TREP ENTRANC
       05 005A8   E9FE     A
1014   05 005AA   CD0000   N           CALL      DGNOPRL                       DIAGNOSTIC PROLOG
1015   05 005AD   CDA901   N           CALL      SB:PNTRS                      SYNC BKG PNTRS TO NEW STATE
1016   05 005B0   C9       A           RET


1019                                  *        CALLS FOR TECH REP 10MS SYN BACKGROUND

1021   05 005B1   CD0000   N   TREP10  CALL      ADHOCTRL
1022   05 005B4   C9       A           RET

1024                                  *        CALLS FOR TECH REP 20MS SYN BACKGROUND

1026   05 005B5   0000     N   TREP20  DW        TREPOSWS
1027   05 005B7   0000     N           DW        MNOELVRS
1028   05 005B9   0000     N           DW        LMPOCTRL
1029   05 005BB   0000     N           DW        DSPLOCTL
1030   05 005BD   0000     N           DW        DGNOBKG
1031   05 005BF   0000     N           DW        INSTRU
1032   05 005C1   FFFF     A           DW        X'FFFF'                       END OF TABLE

1034                                  *        CALLS FOR TECH REP 100MS SYN BACKGROUND

1036   05 005C3   0000     N   TREP100 DW        NRILKOCK
1037   05 005C5   0000     N           DW        PSDOSTPY
1038   05 005C7   0000     N           DW        XMMOSTPY
1039   05 005C9   0000     N           DW        REDOBGND
1040   05 005CB   0000     N           DW        RINOCHK
1041   05 005CD   0000     N           DW        JAMORST
1042   05 005CF   0000     N           DW        DVLODUMP
1043   05 005D1   0000     N           DW        FUSORDUT
1044   05 005D3   0000     N           DW        TSTOLP4
1045   05 005D5   DF05     N           DW        TREP:CHG                      TEST IF OK TO
1046   05 005D7   FF01     N           DW        STAT:CHG                                    LEAVE TREP REP
1047   05 005D9   FFFF     A           DW        X'FFFF'                       END OF TABLE

1049                                  *
1050                                  *        EPILOG  (TECH REP STATE)
1051                                  *
1052   05 005DB   CD0000   N   TREP:EPL CALL      DGNOEPL                       DIAGNOSTIC EPILOG
1053   05 005DE   C9       A           RET

1055                                  *        CHANGE OF STATE CHECK

1057   05 005DF   2153FD   A   TREP:CHG LXI       H,ADR(DATA,STATE:)            PREPARE FOR POSSIBLE STATE CHG
1058   05 005E2   7E       A           IF:       XBYT,M,NE,:COMP               DO NOT CHG STATE IF IN COMP
       05 005E3   FE00     A
       05 005E5   CAFE05   N
1059   05 005E8   3A49F4   A               IF:       FLG,SEROACT,T             IF SERVICE KEY IS ON AND IF
       05 005EB   07       A
       05 005EC   D2FC05   N
1060   05 005EF   3A20FC   A               ANDIF:    FBIT,DGNOPRTO,F           IN DIAG PRINT PROGRAM
       05 005F2   E6C2     A
       05 005F4   C2FC05   N
1061   05 005F7   3601     A                   MVI       M,:TREP               CHG TO TREP STATE
1062   05 005F9   C3FE05   N               ELSE:                               IF KEY IS TURNED OFF
1063   05 005FC   3602     A                   MVI       M,INRDY               CHG TO NOT READY STATE
1064                                       ENDIF
1065                                       ID:ALTR   STATE:
1066                                   ENDIF
1067   05 005FE   C9       A           RET
```

TABLE II

```
 96                                   *        FIXED PITCH EVENT TABLE
 97                                   *
 98                                   *        EVENTS MUST BE IN SEQUENTIAL ORDER STARTING
 99                                   *        WITH THE EVENT CLOSES TO PITCH RESET FIRST
100                                   *
101                                   *        THERE CAN BE NO MORE THAN 256 COUNTS BETWEEN EVENTS
102                                   *
103                                   *        FORMAT OF EVENTS FOR EVENT TABLE
104                                   *
105                                   *        EVENT     X,Y,Z
106                                   *        WHERE:
107                                   *        X = ABSOLUTE COUNTS FROM RESET
108                                   *        Y = SHIFT REGISTER NEEDED IN EVENT
109                                   *        Z = EVENT NAME
110                                   *
111                                   *
112                                   *        PITCH EVENTS
113                                   *
```

| | | | | | | |
|---|---|---|---|---|---|---|
| 114 | | | | TABLE | | |
| 115 | 05 0001E | 0200 | A | EVENT | 2,3,TRN2CURR | |
| | 05 00020 | 03 | A | | | |
| | 05 00021 | 0000 | N | | | |
| 116 | 05 00023 | 0300 | A | EVENT | 3,2,ADC@ACT | |
| | 05 00025 | 02 | A | | | |
| | 05 00026 | 0000 | N | | | |
| 117 | 05 00028 | 0400 | A | EVENT | 4,3,FDR5AFLT | |
| | 05 0002A | 03 | A | | | |
| | 05 0002B | 0000 | N | | | |
| 118 | 05 0002D | 0700 | A | EVENT | 7,0,SPLYS@ON | |
| | 05 0002F | 00 | A | | | |
| | 05 00030 | 0000 | N | | | |
| 119 | 05 00032 | 0800 | A | EVENT | 8,2,FDR1AXFD | |
| | 05 00034 | 02 | A | | | |
| | 05 00035 | 0000 | N | | | |
| 120 | 05 00037 | 0A00 | A | EVENT | 10,3,FUS@LOAD | |
| | 05 00039 | 03 | A | | | |
| | 05 0003A | 0000 | N | | | |
| 121 | 05 0003C | 3000 | A | EVENT | 48,8,DECG@INV | DECISION GATE FOR INVTD COPIES |
| | 05 0003E | 08 | A | | | |
| | 05 0003F | 0000 | N | | | |
| 122 | 05 00041 | 3600 | A | EVENT | 54,5,FUS@NTLD | FUSER LOADED TEST |
| | 05 00043 | 05 | A | | | |
| | 05 00044 | 0000 | N | | | |
| 123 | 05 00046 | 5500 | A | EVENT | 85,3,FDR6MFLT | |
| | 05 00048 | 03 | A | | | |
| | 05 00049 | 0000 | N | | | |
| 124 | 05 0004B | 5900 | A | EVENT | 89,2,FDR2MNFD | |
| | 05 0004D | 02 | A | | | |
| | 05 0004E | 0000 | N | | | |
| 125 | 05 00050 | 5D00 | A | EVENT | 93,8,JAM6@NON | PAPER PATH JAM SW PITCH EVENT |
| | 05 00052 | 08 | A | | | |
| | 05 00053 | 0000 | N | | | |
| 126 | 05 00055 | 7600 | A | EVENT | 118,9,JAM5@INV | PAPER PATH JAM SW PITCH EVENT |
| | 05 00057 | 09 | A | | | |
| | 05 00058 | 0000 | N | | | |
| 127 | 05 0005A | 7800 | A | EVENT | 120,0,FSH@OFF | |
| | 05 0005C | 00 | A | | | |
| | 05 0005D | 0000 | N | | | |
| 128 | 05 0005F | 8700 | A | EVENT | 135,0,PROG@HST | PROG HISTORY FILE UPDATE |
| | 05 00061 | 00 | A | | | |
| | 05 00062 | 0000 | N | | | |
| 129 | 05 00064 | 8F00 | A | EVENT | 143,6,JAM4@CHK | PAPER PATH JAM SW PITCH EVENT |
| | 05 00066 | 06 | A | | | |
| | 05 00067 | 0000 | N | | | |
| 130 | 05 00069 | AA00 | A | EVENT | 170,10,RET2@CHK | PAPER PATH JAM SW PITCH EVENT |
| | 05 0006B | 0A | A | | | |
| | 05 0006C | 0000 | N | | | |
| 131 | 05 0006E | CF00 | A | EVENT | 207,3,S@S@CLN | |
| | 05 00070 | 03 | A | | | |
| | 05 00071 | 0000 | N | | | |
| 132 | 05 00073 | D100 | A | EVENT | 209,2,TRN5CURR | |
| | 05 00075 | 02 | A | | | |
| | 05 00076 | 0000 | N | | | |
| 133 | 05 00078 | E300 | A | EVENT | 227,5,JAM3@CHK | PAPER PATH JAM SW PITCH EVENT |
| | 05 0007A | 05 | A | | | |
| | 05 0007B | 0000 | N | | | |
| 134 | 05 0007D | 0901 | A | EVENT | 265,2,FDR3AEDG | ENABLE AUX FOR WT SENSOR |
| | 05 0007F | 02 | A | | | |
| | 05 00080 | 0000 | N | | | |
| 135 | 05 00082 | 0B01 | A | EVENT | 267,4,JAM2@CHK | PAPER PATH JAM SW PITCH EVENT |
| | 05 00084 | 04 | A | | | |
| | 05 00085 | 0000 | N | | | |
| 136 | 05 00087 | 0E01 | A | EVENT | 270,8,RET1@CHK | PAPER PATH JAM SW PITCH EVENT |
| | 05 00089 | 08 | A | | | |
| | 05 0008A | 0000 | N | | | |
| 137 | 05 0008C | 6901 | A | EVENT | 361,3,TRN3DTCK | |
| | 05 0008E | 03 | A | | | |
| | 05 0008F | 0000 | N | | | |
| 138 | 05 00091 | 6C01 | A | EVENT | 364,2,FDR4MEDG | ENABLE MAIN WT SENSOR |
| | 05 00093 | 02 | A | | | |
| | 05 00094 | 0000 | N | | | |
| 139 | 05 00096 | B901 | A | EVENT | 441,9,JAM6@INV | PAPER PATH JAM SW PITCH EVENT |
| | 05 00098 | 09 | A | | | |
| | 05 00099 | 0000 | N | | | |
| 140 | 05 0009B | C201 | A | EVENT | 450,4,FUS@UNLD | |
| | 05 0009D | 04 | A | | | |
| | 05 0009E | 0000 | N | | | |
| 141 | 05 000A0 | C301 | A | EVENT | 451,2,TRN1ROLL | |
| | 05 000A2 | 02 | A | | | |
| | 05 000A3 | 0000 | N | | | |
| 142 | 05 000A5 | F401 | A | EVENT | 500,0,DPM@SMPL | |
| | 05 000A7 | 00 | A | | | |
| | 05 000A8 | 0000 | N | | | |
| 143 | 05 000AA | 0E02 | A | EVENT | 526,3,TRN4DTCK | |
| | 05 000AC | 03 | A | | | |
| | 05 000AD | 0000 | N | | | |
| 144 | 05 000AF | 1B02 | A | EVENT | 539,0,DVLV@OFF | TURN OFF VAR DENS DEVELOPERS |
| | 05 000B1 | 00 | A | | | |
| | 05 000B2 | 0000 | N | | | |
| 145 | 05 000B4 | 5802 | A | EVENT | 600,0,BIL@PLOP | TEST FOR PLATEN OPEN (BLG) |
| | 05 000B6 | 00 | A | | | |
| | 05 000B7 | 0000 | N | | | |
| 146 | 05 000B9 | 7602 | A | EVENT | 630,5,INVTRCTL | INVTR GATE & RETURN CONTROL |
| | 05 000BB | 05 | A | | | |
| | 05 000BC | 0000 | N | | | |
| 147 | 05 000BE | 8A02 | A | EVENT | 650,6,DECG@NON | DECISION GATE FOR NON-INVTD |
| | 05 000C0 | 06 | A | | | |
| | 05 000C1 | 0000 | N | | | |
| 148 | 05 000C3 | 9A02 | A | EVENT | 666,0,JAM@DLY | |
| | 05 000C5 | 00 | A | | | |
| | 05 000C6 | 0000 | N | | | |

```
149  05 000C8   BC02   A        EVENT    700,7,JAM5ØNØN          PAPER PATH JAM SW PITCH EVENT
     05 000CA   07     A
     05 000CB   0000   N
150  05 000CD   2003   A        EVENT    800,0,PRØGMØDE
     05 000CF   00     A
     05 000D0   0000   N
151  05 000D2   2203   A        EVENT    802,0,FSHØENB
     05 000D4   00     A
     05 000D5   0000   N
152  05 000D7   5003   A        EVENT    848,0,DVBØVAR           TURN ØN VARIABLE-BIAS DEVELØPER
     05 000D9   00     A
     05 000DA   0000   N
153  05 000DC   5203   A        EVENT    850,4,SRSKØEV           INIT SRSK & SRT MØTØR
     05 000DE   04     A
     05 000DF   0000   N
154  05 000E1   5403   A        EVENT    852,0,PECØFFEV          TURN ØFF PØST EXP. CØRØTRØN
     05 000E3   00     A
     05 000E4   0000   N
155  05 000E6   8C03   A        EVENT    908,0,PECØNEV           TURN ØN PØST EXP CØRØTRØN
     05 000E8   00     A
     05 000E9   0000   N
156  05 000EB   8EC3   A        EVENT    910,0,910ØEV
     05 000ED   00     A
     05 000EE   0000   N
157  05 000F0   9003   A        EVENT    912,0,DGNØHCNT
     05 000F2   00     A
     05 000F3   0000   N
158  05 000F5   A703   A        EVENT    935,0,ØVERØRUN
     05 000F7   00     A
     05 000F8   0000   N
159                              ENDTABLE
```

TABLE III

```
71                          *
72                          *        VARIABLE PITCH EVENT TABLE
73                          *
74        00000001          FLSHØBSE EQU      1
75        00000019          FØØØNBSE EQU      25
76        00000064          FØØØFFBS EQU      100
77  05 00000   0100   A     RØMØFSH  DW       FLSHØBSE
78  05 00002   00     A              DB       0
79  05 00003   0000   N              DW       FSHØØN
80  05 00005   6400   A     RØMØØFF  DW       FØØØFFBS
81  05 00007   00     A              DB       0
82  05 00008   0000   N              DW       FØØØFF
83  05 0000A   1900   A     RØMØØN   DW       FØØØNBSE
84  05 0000C   00     A              DB       0
85  05 0000D   0000   N              DW       FØØØN
86  05 0000F   0100   A     RØMØFSHS DW       FLSHØBSE
87  05 00011   00     A              DB       0
88  05 00012   0000   N              DW       FSHØØNØS
89  05 00014   6400   A     RØMØØFFS DW       FØØØFFBS
90  05 00016   00     A              DB       0
91  05 00017   0000   N              DW       FØØØFFØS
92  05 00019   1900   A     RØMØØNS  DW       FØØØNBSE
93  05 0001B   00     A              DB       0
94  05 0001C   0000   N              DW       FØØØNØS
95                          *
```

TABLE IV

```
161       00000396          BASEØCNT SET      918                     #CLK CNTS/PITCH
162       0000038E          SAFEØCNT SET      910                     MIN # CLK CNTS/PITCH
163                         *
164                         *        PITCH TABLE BUILDER
165                         *
166                         *        BUILD VARIABLE PITCH EVENT TABLE INTØ RAM
167                         *        FRØM RØM DATA + REDUCTIØN ADJUST & FØ TRIM
168                         *
169  05 000FA   2A0000   N  TBLDØPRT LHLD     RØMØFSH                 H&L= BASE CNT ØF FLASH
170  05 000FD   EB       A           XCHG                            D&E= BASE CNT ØF FLASH
171  05 000FE   2A9AFC   N           LHLD     1FLSHØØN               H&L= RED ADJ
172  05 00101   19       A           DAD      D                      H&L= BASE + ADJ
173  05 00102   2244FC   N           SHLD     RAMØFSH                RAMØFSH = BASE + ADJ
174                         *
175  05 00105   2A0500   N           LHLD     RØMØØFF                H&L= BASE CNT ØF FØ ØFF
176  05 00108   EB       A           XCHG                            D&E= BASE CNT ØF FØ ØFF
177  05 00109   2A9CFC   N           LHLD     1FØØØFF                H&L= RED ADJ + TRIM ADJ
178  05 0010C   19       A           DAD      D                      H&L= BASE + ADJ
179  05 0010D   2249FC   N           SHLD     RAMØØFF                RAMØØFF = BASE + ADJ
180                         *
181  05 00110   2A0A00   N           LHLD     RØMØØN                 H&L= BASE CNT ØF FØ ØN
182  05 00113   EB       A           XCHG                            D&E= BASE CNT ØF FØ ØN
183  05 00114   2A9EFC   N           LHLD     1FØØØN                 H&L= RED ADJ + TRIM ADJ
184  05 00117   19       A           DAD      D                      H&L= BASE + ADJ
185  05 00118   CDEA02   N           CALL     ØNØMØD                 CALL MØD RØUTINE TØ MØD IF<0
186  05 0011B   224EFC   N           SHLD     RAMØØN                 RAMØØN = RESULTS ØF ABØVE
187                         *
```

```
188   05 0011E   3A31F4   A          IF:      FLG,IMG@SFT,T                 IS THERE IMAGE SHIFT
      05 00121   07       A
      05 00122   D25601   N
189   05 00125   3E06     A              MVI      A,6                       YES,# OF VAR EVENTS TO USE = 6
190   05 00127   47       A              MOV      B,A                       SET UP B-REG FOR LOOP CONTROL
191   05 00128   3262FA   N              STA      TBLD@NUM                  STORE # OF VAR EVENTS
192   05 0012B   3D       A              DCR      A                         SET UP # OF TIMES TO GO
193   05 0012C   3263FA   N              STA      TBLD@TMP                  THRU SORT
194                                *
195   05 0012F   2A0F00   N              LHLD     ROM@FSHS                  UPDATE ROM@FSHS TO
196   05 00132   EB       A              XCHG                               INCLUDE RED MODE ADJ + SHIFT
197   05 00133   2AA0FC   N              LHLD     2FLSH@ON                  ADJ AND SAVE FOR THE
198   05 00136   19       A              DAD      D                         IMAGE SHIFT
199   05 00137   2253FC   N              SHLD     RAM@FSHS                  FLASH EVENT
200                                *
201   05 0013A   2A1400   N              LHLD     ROM@OFFS                  UPDATE ROM@OFFS TO INCLUDE
202   05 0013D   EB       A              XCHG                               RED MODE ADJ + TRIM ADJ +
203   05 0013E   2AA2FC   N              LHLD     2F@OFF                    SHIFT ADJ AND SAVE
204   05 00141   19       A              DAD      D                         FOR THE IMAGE SHIFT
205   05 00142   2258FC   N              SHLD     RAM@OFFS                  FADE OUT EVENT
206                                *
207   05 00145   2A1900   N              LHLD     ROM@ONS                   UPDATE ROM@ONS TO INCLUDE
208   05 00148   EB       A              XCHG                               RED MODE ADJ + TRIM ADJ +
209   05 00149   2AA4FC   N              LHLD     2F@ON                     SHIFT ADJ
210   05 0014C   19       A              DAD      D
211   05 0014D   CDEA02   N              CALL     ON@MOD                    CALL MOD ROUTINE TO MOD IF <0
212   05 00150   225DFC   N              SHLD     RAM@ONS                   SAVE THE RESULTS
213                                *
214   05 00153   C36001   N          ELSE:
215   05 00156   3E03     A              MVI      A,3                       IF IMAGE SHIFT NOT SET
216   05 00158   47       A              MOV      B,A                       #OF VAR EVENTS TO USE = 3
217   05 00159   3262FA   N              STA      TBLD@NUM                  SET UP B-REG FOR LOOP CONTROL
218   05 0015C   3D       A              DCR      A                         STORE # OF VAR EVENTS & SETUP
219   05 0015D   3263FA   N              STA      TBLD@TMP                  #OF TIMES TO GO THRU SORT
220                                    ENDIF
221                                *

440                                *
441                                *   SUBROUTINE TO DETERMINE IF MODIFIED FO ON EVENT
442                                *   CLK COUNT IF CLK COUNT RESULTS ARE NEGATIVE OR 0
443                                *
444   05 002EA   7C       A   ON@MOD MOV      A,H                           A= MS PART OF ABS CLK COUNT
445   05 002EB   07       A          RLC                                    CARRY= SIGN OF ABS CLK COUNT
446   05 002EC   D20203   N          IF:      CC,C,S                        IS THE ABS CLK CNT NEG
447   05 002EF   119603   A              LXI      D,BASE@CNT                YES,ADD # CLK COUNTS PER PITCH
448   05 002F2   19       A              DAD      D                         TO NEG #
449   05 002F3   118E03   A              IF:      XWRD,H,GE,SAFE@CNT        IS RESULTS GE SAFE # CLK/PITCH
      05 002F6   CD0000   N
      05 002F9   DAFF02   N
450   05 002FC   210100   A                  LXI      H,1                   YES,MOVE TO TURN ON LATER
451                                        ENDIF
452   05 002FF   C30E03   N          ORIF:    XWRD,H,EQ,0                   IF RESULTS = 0, MOVE LATER IN
      05 00302   110000   A
      05 00305   CD0000   N
      05 00308   C20E03   N
453   05 0030B   210100   A              LXI      H,1                       PITCH BECUASE EVENT MUST BE > 0
454                                    ENDIF
455   05 0030E   C9       A          RET
456                                    END
```

```
CONTROL SECTION SUMMARY: 01 00000   PT 0    02 00000   PT 0    03 00000   PT 0    04 0FFD8   PT 2
                         05 0030F   PT 1
* NO UNDEFINED SYMBOLS
*   ERROR SEVERITY LEVEL: 0
* NO ERROR LINES
```

TABLE V

```
252                                *
253                                *   SORTS VARIABLE RAM EVENT TABLE BY
254                                *   ABS CLK COUNT & LOWEST ENDS IN EVBRAM
255                                *
256                                *   SORTS ONLY 1ST 3 IF NO IMAGE SHIFT, OTHERWISE SORTS ALL 6
257                                *
258   05 0017E   2144FC   N          LXI      H,EVBRAM                      H&L= ADDR OF TOP OF VAR RAM TBL
259   05 00181   3A63FA   N          WHILE:   XBYT,TBLD@TMP,NE,0            TIMES TO GO THRU OUTER LOOP
      05 00184   FE00     A
      05 00186   CAFD01   N
260   05 00189   3253FA   N              STA      INCLPACT                  INTER LOOP CNT=OUTER LOOP CNT
261   05 0018C   3E80     A              SFLG     TBLD@1ST                  SET 1ST FLAG FOR THIS POSITION
      05 0018E   325EF4   A
262   05 00191   2252FB   N              SHLD     FIXADDR                   ADDR OF POSITION TO FULL
263   05 00194   B7       A              ORA      A                         CLEAR Z CONDITION BIT
264   05 00195   CAEF01   N              WHILE:   CC,Z,C
265   05 00198   5E       A                  MOV      E,M                   E= LS PART OF ABS CLK COUNT
266   05 00199   23       A                  INX      H
267   05 0019A   56       A                  MOV      D,M                   D= MS PART OF ABS CLK COUNT
268   05 0019B   D5       A                  PUSH     D                     STORE ABS CLK CNT OF FILL POS
269   05 0019C   3A5EF4   A                  IF:      FLG,TBLD@1ST,T        IS IT 1ST TIME FOR THIS POS
      05 0019F   07       A
      05 001A0   D2AE01   N
270   05 001A3   AF       A                      CFLG     TBLD@1ST          YES, CLEAR ITS FLAG
      05 001A4   325EF4   A
271   05 001A7   23       A                      INX      H                 AND INCREMENT
272   05 001A8   23       A                      INX      H                 POINTER TO LS PART OF
273   05 001A9   23       A                      INX      H                 ABS CLK COUNT OF NEXT
274   05 001AA   23       A                      INX      H                 EVENT
```

```
05 001AB   C3B601   N          ELSE:
05 001AE   2A5CFB   N              LHLD     VAR@ADDR        H&L= ADDR
05 001B1   23       A              INX      H               OF LS PART OF
05 001B2   23       A              INX      H               ABS CLK COUNT TO
05 001B3   23       A              INX      H               COMPARE TO FILL
05 001B4   23       A              INX      H               POSITION
05 001B5   23       A              INX      H
                                ENDIF
05 001B6   225CFB   N           SHLD     VAR@ADDR          STORE POINTER TO COMPARE EVENT
05 001B9   5E       A           MOV      E,M               E= LS PART OF COMPARE ABS CLK
05 001BA   23       A           INX      H
05 001BB   56       A           MOV      D,M               D= MS PART OF COMPARE ABS CLK
05 001BC   E1       A           POP      H                 H&L= ABS CLK COUNT OF FILL POS
05 001BD   EB       A           IF:      XWRD,D,LT,H       IS CLK OF COMPARE < FILL
05 001BE   CD0000   N
05 001C1   D2E501   N
05 001C4   2A5CFB   N              LHLD     VAR@ADDR        YES, SWITCH THE 2 EVENTS
05 001C7   EB       A              XCHG                     D&E= ADDR LOWER CLK VALUE
05 001C8   2A52FB   N              LHLD     FIX@ADDR        H&L= ADDR LARGER CLK VALUE
05 001CB   3EFB     A              MVI      A,-5            INITIALIZE LOOP COUNTER TO 5
05 001CD   3265FA   N              STA      TSW@NUM         WHICH = # OF ITEMS TO MOVE
05 001D0   B7       A              ORA      A               CLEAR Z CONDITION BIT
05 001D1   CAE501   N              WHILE:   CC,Z,C
05 001D4   1A       A                  LDAX     D           A= CONTAINS OF COMPARE EVENT
05 001D5   46       A                  MOV      B,M         B= CONTAINS OF FILL EVENT
05 001D6   77       A                  MOV      M,A         UPDATE FILL POS
05 001D7   78       A                  MOV      A,B         UPDATE COMPARE POS
05 001D8   12       A                  STAX     D           WITH NEW VALUE
05 001D9   13       A                  INX      D           MOVE POINTERS TO
05 001DA   23       A                  INX      H           NEXT ITEM
05 001DB   3A65FA   N                  LDA      TSW@NUM     INC MOVE
05 001DE   3C       A                  INR      A           LOOP CONTROL
05 001DF   3265FA   N                  STA      TSW@NUM     COUNTER
05 001E2   C3D101   N              ENDWHILE
                                ENDIF
05 001E5   2153FA   N           DECBYT    IN@LP@CT          DECRM INNER LOOP CNTR
05 001E8   35       A
05 001E9   2A52FB   N           LHLD      FIX@ADDR          H&L= ADDR OF FILL POSITION
05 001EC   C39501   N        ENDWHILE
05 001EF   110500   A        LXI       D,5                  MOVE H&L TO LOOK AT NEXT EVENT
05 001F2   19       A        DAD       D                    POSITION TO FILL
05 001F3   3A63FA   N        LDA       TBLD@TMP             DECREMENT # OF EVENTS
05 001F6   3D       A        DCR       A                    TO SORT
05 001F7   3263FA   N        STA       TBLD@TMP
05 001FA   C38101   N     ENDWHILE
```

TABLE VI

```
                                *
                                *     MOVE THE SR# & EVENT ADDR FROM ROM TABLE
                                *     TO RAM TABLE.  MOVES ONLY THE FIRST 3 IF
                                *     NO IMAGE SHIFT, OTHERWISE MOVES ALL 6
                                *
05 00160   1144FC   N     LXI       D,RAM@FSH                D&E = ADDR OF RAM TABLE
05 00163   210000   N     LXI       H,ROM@FSH                H&L = ADDR OF POM TABLE
05 00166   B0       A     ORA       B                        CLEAR Z CONDITION BIT
05 00167   CA7E01   N     WHILE:    CC,Z,C
05 00169   23       A        INX       H                     INCREMENT H&L AND D&E
05 0016B   23       A        INX       H                     POINTERS OVER THE
05 0016C   13       A        INX       D                     ABS CLK COUNT
05 0016D   13       A        INX       D
05 0016E   7E       A        MOV       A,M                   LOAD A WITH SR#
05 0016F   12       A        STAX      D                     STORE SR# IN RAM TABLE
05 00170   23       A        INX       H                     MOVE POINTERS TO LS
05 00171   13       A        INX       D                     ADDR OF EVENT
05 00172   7E       A        MOV       A,M                   LOAD A WITH LS ADDR OF EVENT
05 00173   12       A        STAX      D                     & STORE IT IN RAM TABLE
05 00174   23       A        INX       H                     MOVE POINTERS TO MS
05 00175   13       A        INX       D                     ADDR OF EVENT
05 00176   7E       A        MOV       A,M                   MOVE MS ADDR OF EVENT
05 00177   12       A        STAX      D                     TO RAM
05 00178   23       A        INX       H                     MOVES POINTERS TO
05 00179   13       A        INX       D                     LS PART OF ABS CLK COUNT
05 0017A   05       A        DCR       B                     DECREMENT LOOP COUNTER
05 0017B   C36701   N     ENDWHILE
                                *
```

TABLE VII

```
                                *
                                *     MERGE VARIABLE PITCH EVENT TABLE & FIXED EVENT
                                *     TABLE CALCULATING THE REL DIFFERENCE WITH THE
                                *     RESULTS GOING INTO THE RUN EVENT TABLE
                                *
05 001FD   2A44FC   N     LHLD      EV@RAM                   INITIALIZE VAR@CLK TO ABS CLK
05 00200   225EFB   N     SHLD      VAR@CLK                  COUNT OF 1ST VAR PITCH EVENT
05 00203   2144FC   N     LXI       H,EV@RAM                 INITIALIZE VAR@ADDR TO ADDR OF
05 00206   225CFB   N     SHLD      VAR@ADDR                 1ST VAR PITCH EVENT
05 00209   211E00   N     LXI       H,EV@ROM                 INITIALIZE FIX@ADDR TO ADDR OF
05 0020C   2252FB   N     SHLD      FIX@ADDR                 1ST FIXED PITCH EVENT
05 0020F   3E80     A     SFLG      TBLD@1ST                 NOTES 1ST EVENT TO RUN TABLE
05 00211   325EF4   A
05 00214   3E2C     A     MVI       A,TABLENUM               INITIALIZE TSW@NUM TO # OF
05 00216   3265FA   N     STA       TSW@NUM                  EVENTS IN FIXED PITCH TABLE
05 00219   2A1E00   N     LHLD      EV@ROM                   INITIALIZE D&E WITH ABS CLOCK
```

```
05 0021C   EB        A        XCHG                                  COUNT OF 1ST FIXED EVENT
05 0021D   AF        A        CFLG     VAR@DONE                     FLAG DENOTES VAR EVENTS
05 0021E   3259F4    A
05 00221   3A59F4    A        WHILE:   FLG,VAR@DONE,F               WHILE THERE ARE MORE VAR EVENTS
05 00224   07        A
05 00225   DA6F02    N
05 00228   2A5EFB    N            IF:      XWRD,VAR@CLK,LE,D        IS VAR CLK CNT <= FIXED CLK CNT
05 0022B   CD0000    N
05 0022E   DA3402    N
05 00231   C25902    N
05 00234   2A5CFB    N                LHLD     VAR@ADDR             YES, H&L= VAR EVENT ADDR
05 00237   CD9302    N                CALL     TBLD@UPD             PLACE VAR EVENT AT END RUN TBL
05 0023A   3A62FA    N                LDA      TBLD@NUM             DECREMENT # OF
05 0023D   3D        A                DCR      A                    VARIABLE EVENTS LEFT
05 0023E   3262FA    N                STA      TBLD@NUM             TO MERGE
05 00241   C24C02    N                IF:      CC,Z,S               DID TBLD@NUM GO TO 0
05 00244   3E80      A                    SFLG     VAR@DONE         YES,DENOTE NO MORE VAR EVENTS
05 00246   3259F4    A
05 00249   C35602    N                ELSE:
05 0024C   225CFB    N                    SHLD     VAR@ADDR         STORE ADDR OF NEXT VAR EVENT
05 0024F   5E        A                    MOV      E,M              UPDATE VAR@CLK TO
05 00250   23        A                    INX      H                VALUE OF ABS CLK COUNT
05 00251   56        A                    MOV      D,M              OF PRESENT VARIABLE
05 00252   EB        A                    XCHG                      EVENT
05 00253   225EFB    N                    SHLD     VAR@CLK
                                      ENDIF
05 00256   C36602    N            ELSE:                             IF FIXED TABLE CLK COUNT IS
05 00259   2A52FB    N                LHLD     FIX@ADDR             LESS THEN VAR TABLE UPDATE THE
05 0025C   CD9302    N                CALL     TBLD@UPD             RUN TABLE WITH THAT EVENT
05 0025F   2252FB    N                SHLD     FIX@ADDR             UPDATE TO NEXT FIXED EVENT
05 00262   2165FA    N                LXI      H,TSW@NUM            DECREMENT # OF FIXED EVENTS
05 00265   35        A                DCR      M                    LEFT
                                      ENDIF
05 00266   2A52FB    N            LHLD     FIX@ADDR
05 00269   5E        A            MOV      E,M                  UPDATE D&L TO =
05 0026A   23        A            INX      H                    ABS CLK CNT VALUE
05 0026B   56        A            MOV      D,M                  OF PRESENT FIXED TABLE
05 0026C   C32102    N        ENDWHILE
05 0026F   3EFF      A        MVI      A,X'FF'                  CLEAR Z CONDITION
05 00271   B7        A        ORA      A                        BIT FOR LOOP
05 00272   2A52FB    N        LHLD     FIX@ADDR                 NO MORE VAR EVENTS, USE FIXED
05 00275   CA8402    N        WHILE:   CC,Z,C                   DONE WITH FIXED TABLE
05 00278   CD9302    N            CALL     TBLD@UPD             NO,UPDATE RUN TABLE
05 0027B   EB        A            XCHG                          SAVE H&L IN D&E
05 0027C   2165FA    N            LXI      H,TSW@NUM            DECREMENT # OF FIXED
05 0027F   35        A            DCR      M                    EVENTS LEFT
05 00280   EB        A            XCHG                          RESTORE H&L
05 00281   C37502    N        ENDWHILE
05 00284   2A58FB    N        LHLD     P@TBL@A                  H&L=ADDR OF LAST MS ADDR IN RUN
05 00287   2B        A        DCX      H                        MOVE H&L POINTER BACK TO POINT
05 00288   2B        A        DCX      H                        AT THE BEGINNING OF THE LAST
05 00289   2B        A        DCX      H                        EVENT (OVER@RUN) & STORE IT
05 0028A   2264FD    N        SHLD     EV@PTR:                  FOR MACH CLK INTERRUPT HANDLER
05 0028D   3E80      A        SFLG     TBLD@FIN                 DENOTES PITCH TABLE IS COMPLETE
05 0028F   325DF4    A
05 00292   C9        A        RET

                          *
                          *   SUBROUTINE TO CALCULATE REL DIFFERENCE BETWEEN
                          *   2 EVENTS & MOVE REST OF TABLE TO RUN TABLE
                          *
05 00293   3A5EF4    A  TBLD@UPD IF:      FLG,TBLD@1ST,T           THIS IS THE FIRST EVENT
05 00296   07        A
05 00297   D2AF02    N
05 0029A   AF        A            CFLG     TBLD@1ST                 YES, CLR FLAG TO KEEP OUT
05 0029B   325EF4    A
05 0029E   7E        A            MOV      A,M                      A= LS OF 1ST EVENT ABS CLK CNT
05 0029F   3251FA    N            STA      EV@1@TIM                 USED AT PITCH RESET
05 002A2   5F        A            MOV      E,A                      E=LS OF 1ST EVENT ABS CLK CNT
05 002A3   23        A            INX      H                        H&L=ADDR OF MS ABS CLK CNT
05 002A4   56        A            MOV      D,M                      D=MS OF 1ST EVENT ABS CLK CNT
05 002A5   EB        A            XCHG                              D&E= ADDR OF MS ABS CLK CNT
05 002A6   2256FB    N            SHLD     LCLK@CNT                 STORE ABS CLK OF 1ST EVENT
05 002A9   21E8FE    N            LXI      H,EV@BASE:               H&L = ADDR OF RUN TABLE
05 002AC   C3D802    N        ELSE:
05 002AF   5E        A            MOV      E,M                      E=LS CLK CNT OF NEW EVENT
05 002B0   23        A            INX      H                        H&L= ADDR OF MS ABS CLK CNT
05 002B1   56        A            MOV      D,M                      D=MS CLK CNT OF NEW EVENT
05 002B2   E5        A            PUSH     H                        SAVE ADDR OF MS ABS CLK CNT
05 002B3   2A56FB    N            IF:      XWRD,LCLK@CNT,GE,D       IS LAST CLK CNT GE NEW CLK CNT
05 002B6   CD0000    N
05 002B9   DAC502    N
05 002BC   23        A                INX      H                    H&L= LAST CLK CNT + 1
05 002BD   2256FB    N                SHLD     LCLK@CNT             STORE IT FOR NEXT TIME
05 002C0   3E01      A                MVI      A,1                  PUT THIS EVENT AT THE NEXT CLK
05 002C2   C3CC02    N            ELSE:
05 002C5   45        A                MOV      B,L                  B=LS CLK CNT OF LAST EVENT
05 002C6   EB        A                XCHG                          H&L=ABS CLK CNT OF NEW EVENT
05 002C7   2256FB    N                SHLD     LCLK@CNT             STORE IT FOR THE NEXT TIME
05 002CA   7D        A                MOV      A,L                  A=LS CLK CNT OF NEW EVENT
05 002CB   90        A                SUB      B                    FIND DIFF (ONLY NEED LS IF CLK
                                      ENDIF                         CNTS BETWEEN EVENTS <256)
05 002CC   D1        A            POP      D                        D&E=ADDR OF MS OF CLK OF NEW EV
05 002CD   2A58FB    N            LHLD     P@TBL@A                  H&L= ADDR OF END OF LAST RUN EV
05 002D0   2B        A            DCX      H                        MOVE H&L POINTER
05 002D1   2B        A            DCX      H                        TO REL DIFF OF LAST
05 002D2   2B        A            DCX      H                        EVENT IN RUN TABLE
05 002D3   77        A            MOV      M,A                      MOVE REL DIFF TO RUN TABLE
05 002D4   23        A            INX      H                        INCREMENT RUN TABLE
05 002D5   23        A            INX      H                        POINTER OVER LAST
05 002D6   23        A            INX      H                        EVENT
05 002D7   23        A            INX      H
```

```
422                                          ENDIF
423   05 002D8   23        A                 INX     H                    H&L= ADDR OF SR# IN RUN TABLE
424   05 002D9   13        A                 INX     D                    D&E= ADDR OF SR#
425   05 002DA   1A        A                 LDAX    D                    MOVE SR# FROM TABLE TO
426   05 002DB   77        A                 MOV     M,A                  RUN TABLE
427   05 002DC   23        A                 INX     H                    MOVE POINTERS TO LS 8 BITS
428   05 002DD   13        A                 INX     D                    OF EVENT ADDR
429   05 002DE   1A        A                 LDAX    D                    MOVE LS 8 BITS OF ADDR
430   05 002DF   77        A                 MOV     M,A
431   05 002E0   23        A                 INX     H                    MOVES POINTER TO MS 8 BITS
432   05 002E1   13        A                 INX     D                    OF EVENT ADDR
433   05 002E2   1A        A                 LDAX    D                    MOVES MS 8 BITS OF ADDR
434   05 002E3   77        A                 MOV     M,A
435   05 002E4   2258FB    N                 SHLD    POTBL0A              STORE ADDR OF RUN TABLE
436   05 002E7   13        A                 INX     D                    POINTER TO LS 8 BITS OF CLK CNT
437   05 002E8   EB        A                 XCHG                         H&L= ADDR OF LS 8 BITS OF CLK
438   05 002E9   C9        A                 RET

440
441                                  *       SUBROUTINE TO DETERMINE IF MODIFIED FO ON EVENT
442                                  *       CLK COUNT IF CLK COUNT RESULTS ARE NEGATIVE OR 0
443                                  *
444   05 002EA   7C        A        ONOMOD   MOV     A,H                  A= MS PART OF ABS CLK COUNT
445   05 002EB   07        A                 RLC                          CARRY= SIGN OF ABS CLK COUNT
446   05 002EC   D20203    N                 IF:     CC,C,S               IS THE ABS CLK CNT NEG
447   05 002EF   119603    A                     LXI     D,BASE0CNT       YES,ADD # CLK COUNTS PER PITCH
448   05 002F2   19        A                     DAD     D                TO NEG #
449   05 002F3   118E03    A                     IF:     XWRD,H,GE,SAFE0CNT  IS RESULTS GE SAFE # CLK/PITCH
      05 002F6   CD0000    N
      05 002F9   DAFF02    N
450   05 002FC   210100    A                         LXI     H,1          YES,MOVE TO TURN ON LATER
451                                              ENDIF
452   05 002FF   C30E03    N                 ORIF:   XWRD,H,EQ,0          IF RESULTS = 0, MOVE LATER IN
      05 00302   110000    A
      05 00305   CD0000    N
      05 00308   C20E03    N
453   05 0030B   210100    A                     LXI     H,1              PITCH BECUASE EVENT MUST BE > 0
454                                          ENDIF
455   05 0030E   C9        A                 RET
456                                          END

CONTROL SECTION SUMMARY: 01 00000   PT 0    02 00000   PT 0    03 00000   PT 0    04 0FFD8   PT 2
                         05 0030F   PT 1
* NO UNDEFINED SYMBOLS
*    ERROR SEVERITY LEVEL: 0
* NO ERROR LINES
```

TABLE VIII

```
219                                  *
220                                  * PITCH RESET INTERRUPT HANDLER
221                                  *

223   06 000F9   FB        A        RSET:   EI                           RE-ENABLE INTERRUPTS
224   06 000FA   F5        A                PUSH    PSW                  SAVE A-REG & CONDITION BITS
225   06 000FB   3A5DF4    A                IF:     FLG,TBLD0FIN,T       IS PITCH TABLE BUILD FINISHED
      06 000FE   07        A
      06 000FF   D26201    N
226   06 00102   E5        A                    PUSH    H                SAVE H&L
227                                           IF:     FLGS,SR0D0NE,;   YES, IS THERE A NEW SR VALUE
228   06 00103   3A4DF4    A                            AND,910D0NE,T    YES, DID 910 EVENT GET DONE
      06 00106   216FF4    A
      06 00109   A6        A
      06 0010A   F25501    N
229   06 0010D   AF        A                        CFLG    910D0NE      YES, RESET & MACH CLK TIMING OK
      06 0010E   326FF4    A
230   06 00111   324DF4    A                        MODFLG  SR0D0NE      CLR FLAG UNTIL NEXT SR EVENT
231   06 00114   2163FD    A                        LXI     H,ADR(DATA,SR0PTR!)  LOAD RELATIVE
232   06 00117   7E        A                        MOV     A,M                  PNTR TO SR #0
233   06 00118   C60F      A                        MODBYT  A,ADD,15     MOVE PNTR BACK
234   06 0011A   E66F      A                        MODBYT  A,AND,SR0ADJ!                BY 1 (CIRCULAR)
235   06 0011C   77        A                        MOV     M,A          SAVE NEW REL SR PNTR IN SR0PTR!
236   06 0011D   26FE      A                        MVI     H,HADR(DATA,SHIFTREG) H&L= ABS ADDR
237   06 0011F   6F        A                        MOV     L,A                  OF SR #0
238   06 00120   3A69FD    A                        LDA     ADR(DATA,SR0VALU!)   A= NEW SR VALUE FROM SRSK
239   06 00123   77        A                        MOV     M,A          UPDATE CONTENTS OF SR#0
240   06 00124   3A51FA    A                        LDA     ADR(DATA,EV0TIM)     INIT MCLK!CNT
241   06 00127   326EFD    A                        STA     ADR(DATA,MCLK!CNT)   TO 1ST EVENT TIME
242   06 0012A   21E8FE    A                        LXI     H,ADR(DATA,EV0BASE!) INIT EV0PTR!
243   06 0012D   2264FD    A                        SHLD    ADR(DATA,EV0PTR!)    TO 1ST EVENT ADDR
244                                                IF:     FLGS,NORM0DN!,;  IS NORMAL SHUTDOWN REQUESTED
245                                                        AND,CYCL0DN!,;   NO, IS CYCLE-DOWN REQUESTED
246   06 00130   3AABF4    A                               AND,SD10DLY,F    NO, IS PROC DEAD CYCLING
      06 00133   21AAF4    A
      06 00136   B6        A
      06 00137   21AFF4    A
      06 0013A   B6        A
      06 0013B   FA5201    N
247   06 0013E   2166FD    A                            LXI     H,ADR(DATA,CYCUPCT!) NO, LOAD CYCLE-UP CNTR
248   06 00141   7E        A                            IF:     XBYT,M,NE,5  IS PROC IN CYCLE-UP MODE
      06 00142   FE05      A
      06 00144   CA5201    N
249   06 00147   FE04      A                                IF:     XBYT,A,EQ,4  YES, IS IT RDY TO MAKE 1ST IMG
      06 00149   C25101    N
250   06 0014C   3E80      A                                    SFLG    IMGMADE!  YES, SIGNAL 1ST IMAGE MADE
      06 0014E   32ADF4    A
251                                                        ENDIF
252   06 00151   34        A                            INR     M            INCRM CYCLE-UP CNTR (UNTIL= 5)
253                                                    ENDIF
254                                                ENDIF
```

```
06 00152   C36101   N          ELSE:                          NEW SR VALUE NOT AVAILABLE
06 00155   3E80     A              SFLG      IMEDSDN!        REQUEST AN IMED SHUTDOWN
06 00157   32A9F4   A
06 0015A   2132FD   A              SFBIT,P   EOPRDFLT        SIGNAL EARLY PITCH RESET FAULT
06 0015D   3E40     A
06 0015F   B6       A
06 00160   77       A
                               ENDIF
06 00161   E1       A          POP       H                   RESTORE H&L
                           ENDIF
06 00162   3EFE     A      MVI       A,RSETFF!               RESET PITCH RESET
06 00164   3200E6   A      STA       ADR(EQU,RSINTFF!)                    INT FLIP-FLOP
06 00167   F1       A      POP       PSW                     RESTORE A-REG & CONDITION BITS
06 00168   C9       A      RET                               RETURN TO INTERRUPTED ROUTINE
```

TABLE IX

```
                       *
                       * MACHINE CLOCK INTERRUPT HANDLER
                       *

06 0002B                  ORIGIN    X'38'                     INTERRUPT TRAP CELL LOCATION

06 00038   F5       A  MCLK!  PUSH      PSW                   SAVE A-REG & CONDITION CODES
06 00039   3A6EFD   A        LDA       ADR(DATA,MCLK!CNT)    IS THERE
06 0003C   3D       A        DCR       A                              A PITCH
06 0003D   C26600   N        IF!       CC,Z,S                                EVENT TO DO
06 00040   E5       A            PUSH      H                 YES, SAVE
06 00041   D5       A            PUSH      D                          ALL REMAINING
06 00042   C5       A            PUSH      B                                      REGS
06 00043   2A64FD   A            LHLD      ADR(DATA,EVOPTR!) H&L= 1ST LOC OF NEXT PE TO DO
06 00046   7E       A            MOV       A,M               SAVE RELATIVE DIFFERENTIAL TO
06 00047   326EFD   A            STA       ADR(DATA,MCLK!CNT)  NEXT EVENT (# CLOCK COUNTS)
06 0004A   23       A            INX       H                 MOVE PNTR TO REL SR IN TABLE
06 0004B   3A63FD   A            LDA       ADR(DATA,SROPTR!) LOAD REL POSITION OF SR #0
06 0004E   86       A            MODBYT    A,ADD,M           C= LS PORTION OF ADDR OF THE
06 0004F   E66F     A            MODBYT    A,AND,SROADJ!      REQUESTED SHIFT REGISTER
06 00051   4F       A            MOV       C,A                POSITION (FOR USE WITHIN PE)
06 00052   06FE     A            MVI       B,HADR(SHIFTREG)  B&C= ADDR REQUESTED SR POSITION
06 00054   0A       A            LDAX      B                 A= <REQUESTED SR POSITION>
06 00055   23       A            INX       H                 E= LS PORTION OF ADDR OF THE
06 00056   5E       A            MOV       E,M                REQUESTED PITCH EVENT
06 00057   23       A            INX       H                 D= MS PORTION OF ADDR OF THE
06 00058   56       A            MOV       D,M                REQUESTED PITCH EVENT
06 00059   23       A            INX       H                 SAVE PNTR TO
06 0005A   2264FD   A            SHLD      ADR(DATA,EVOPTR!)                NEXT PITCH EVENT
06 0005D   CD0000   N            CALL      DE!IND            VECTOR TO REQUESTED PITCH EVENT
06 00060   C1       A            POP       B                 RESTORE
06 00061   D1       A            POP       D                          SAVED
06 00062   E1       A            POP       H                                REGISTERS
06 00063   C37000   N        ELSE!
06 00066   326EFD   A            STA       ADR(DATA,MCLK!CNT)  NO PE; SAVE DECRM'D 'MCLK!CNT'
06 00069   0F       A            RRC                           IS IT TIME FOR
06 0006A   D27000   N            IF!       CC,C,S                                A REFRESH
06 0006D   3202E6   A                REFRESH                   YES, REFRESH RFMOTES (1 MSEC)
                                 ENDIF
                           ENDIF
06 00070   FB       A      EI                                  RE-ENABLE INTERRUPT SYSTEM
06 00071   3EFD     A      MVI       A,MCLKFF!                 RESET MCLK
06 00073   3200E6   A      STA       ADR(EQU,RSINTFF!)                INTERRUPT FLIP-FLOP
06 00076   F1       A      POP       PSW                       RESTORE A-REG & CONDITION CODES
06 00077   C9       A      RET                                 RETURN TO INTERRUPTED ROUTINE
```

TABLE X

```
                       *
                       * REAL TIME CLOCK INTERRUPT HANDLER
                       *

06 00081   FB       A  RTC!   EI                              RE-ENABLE INTERRUPTS
06 00082   F5       A        PUSH      PSW                   SAVE A-REG & CONDITION BITS
06 00083   3EF7     A        MVI       A,RTCFF!              RESET RTC
06 00085   3200E6   A        STA       ADR(EQU,RSINTFF!)                INTERRUPT FLIP-FLOP
06 00088   D5       A        PUSH      D                     SAVE D&E REGS
06 00089   E5       A        PUSH      H                     SAVE H&L REGS
06 0008A   C5       A        PUSH      B                     SAVE 'B' REGISTER
                       *
06 0008B   2150FD   N        DECBYT    GLB!TIMR              DECREMENT THE CLOCK CELL
06 0008E   35       A
06 0008F   7E       A        MOV       A,M                   A = <GLB!TIMR>  ( 0 TO 255 )
06 00090   23       A        INX       H                     MEM. PTR. TO SR!ROST BYTE
06 00091   E601     A        IF:       XBYT,A,AND,X'01',NZ   IS IT 20 MSEC TIME YET
06 00093   CA9D00   N
06 00096   7E       A            MODBYT    M,OR,10!ROST!20!ROST   YES - BOTH 10 AND 20 BKGD
06 00097   F6C0     A
06 00099   77       A
06 0009A   C3A100   N        ELSE:
06 0009D   7E       A            MODBYT    M,OR,10!ROST      NO - 10 BKGD ONLY
06 0009E   F680     A
06 000A0   77       A
                                 ,
                                 ENDIF
06 000A1   23       A        INX       H                     MEM. PTR. TO DIVD!10 CNTR
06 000A2   35       A        DCR       M                     DECREMENT 10 TO 0 COUNTER
06 000A3   C2AD00   N        IF!       CC,Z,S                HAS 100 MSEC PASSED
```

```
162   06 000A6   360A    A          MVI     M,10                YES - RESET THE 10 TO 0 COUNTER
163   06 000A8   28      A          DCX     H                   MEM. PTR. BACK TO SB:ROST
164   06 000A9   7E      A          MODBYT  M,OR,100:RQST       ADD 100 BKGD TP REQUEST BYTE
      06 000AA   F620    A
      06 000AC   77      A
165                                ENDIF
166                                REPEAT                       NOW CHECK FOR TIME OUTS
167   06 000AD   2150FD  N          LXI     H,GLB:TIMR          LOAD 'B' WITH QUANTITY TO LOOK
168   06 000B0   46      A          MOV     B,M                 FOR (CLOCK CELL VALUE)
169   06 000B1   16FB    A          MVI     D,COUNT:            SET 'D' FOR TABLE TO SEARCH
170   06 000B3   CD0000  N          CALL    FIND:LOC            GO LOOK IN ACTIVE LIST
171   06 000B6   CAF000  N          IF:     CC,Z,C              HAS A MATCH BEEN FOUND
172   06 000B9   E5      A              PUSH    H               YES - SAVE LOCATION ON STACK
173   06 000BA   26FC    A              MVI     H,ID:           SEGWAY MEM PTR TO ID: TABLE
174   06 000BC   5E      A              MOV     E,M             NOW ASSEMBLE
175   06 000BD   1600    A              MVI     D,0             ADDRESS OF TIMER
176   06 000BF   21C8F4  A              LXI     H,TMR:FLGS      FLAG INTO THE
177   06 000C2   19      A              DAD     D               MEMORY POINTER
178   06 000C3   0600    A              MVI     B,0             GET SET TO CLEAR THE FLAG
179   06 000C5   F3      A              DI                      NO INTERRUPTIONS NOW, PLEASE
180   06 000C6   7E      A              MOV     A,M             GET FLAG
181   06 000C7   07      A              RLC                     INTO THE CARRY BIT
182   06 000C8   D2EC00  N              IF:     CC,C,S          IS FLAG SET
183   06 000CB   70      A                  MOV     M,B         YES - RESET AND NOW
184   06 000CC   FB      A                  EI                  EVERYBODY CAN INTERRUPT AGAIN
185   06 000CD   E1      A                  POP     H           LOCATION FROM STACK TO MEM PTR
186   06 000CE   26FD    A                  MVI     H,LS:ADDR   SEGWAY MEM PTR TO LS: TABLE
187   06 000D0   5E      A                  MOV     E,M         GET LS TIME-OUT ADDRESS
188   06 000D1   24      A                  INR     H           SEGWAY MEM PTR TO MS: TABLE
189   06 000D2   56      A                  MOV     D,M         GET MS TIME-OUT ADDRESS
190   06 000D3   45      A                  MOV     B,L         LOCATION TO 'B' TEMPORARILY
191   06 000D4   2A5FFD  N                  LHLD    INPTR:      STUFF TIME-OUT ADDRESS INTO
192   06 000D7   73      A                  MOV     M,E         INTO TABLE OF TIME-OUT
193   06 000D8   23      A                  INX     H           ADDRESSES THAT IS CHECKED
194   06 000D9   72      A                  MOV     M,D         FOR ENTRIES EVERY 10 MSECONDS
195   06 000DA   23      A                  INX     H           BY THE STATE CHECKER
196   06 000DB   7D      A                  MODBYT  L,AND,TIME:MSK  FORCE A CIRCULAR TABLE
      06 000DC   E62F    A
      06 000DE   6F      A
197   06 000DF   225FFD  N                  SHLD    INPTR:      SAVE NEW ADDRESS LOCATION
198   06 000E2   58      A                  MOV     E,B         LOCATION BACK TO 'E'
199   06 000E3   CD0000  N                  CALL    DEACTIV:    TAKE OUT OF ACTIVE TIMER LIST
200   06 000E6   CD0000  N                  CALL    PUT:        AND MAKE LOCATION AVAILABLE
201   06 000E9   C3EE00  N              ELSE:                   * * * FLAG IS NOT SET SO
202   06 000EC   FB      A                  EI                      LET INTERRUPTIONS OCCUR
203   06 000ED   E1      A                  POP     H               MAKE THE STACK RIGHT AND
204                                       ENDIF                   FORCE NON-ZERO CONDITION TO
205   06 000EE   F601    A              MODBYT  A,OR,1              STAY IN UNTIL LOOP
206                                   ENDIF                       * * * NO MATCH - RTC COMPLETE
207   06 000F0   C2AD00  N          UNTIL:  CC,Z,S                WILL FALL THROUGH THIS CRACK
208                                #
209   06 000F3   E1      A          POP     H                     RESTORE THE
210   06 000F4   44      A          MOV     B,H                   'B' REGISTER
211   06 000F5   E1      A          POP     H                     RESTORE H&L REGS
212   06 000F6   D1      A          POP     D                     RESTORE D&E REGS
213   06 000F7   F1      A          POP     PSW                   RESTORE A-REG & CONDITION CODES
214   06 000F8   C9      A          RET                           RETURN TO 'FLOAT' BACKGROUND
215                                #
```

TABLE XI

```
151                                ***********************************************************************
152                                * COMMON SWITCH SCAN SUBR-  ENTER WITH SWITCH BYTE IN A-REG (FROM BIT OR BYTE  *
153                                *   FILTERING SUBROUTINES), ADDR OF PRIOR SWITCH CONDITION BYTE IN MEMORY (H&L *
154                                *   REGS), AND E-REG SET TO SWITCH BYTE (AND 'CASE:' GROUP) NUMBER (5 TO 0).   *
155                                ***********************************************************************

157   05 0007D   47      A   SWS@SCAN MOV     B,A                 B= LATEST 'READ' DATA
158   05 0007E   7E      A          MOV     A,M                 A= PRIOR 'READ' DATA
159   05 0007F   70      A          MOV     M,B                 UPDATE 'PRIOR' TO 'LATEST'
160   05 00080   A8      A          MODBYT  A,XOR,B             A= 1 WHERE SWS JUST CHANGED
161   05 00081   A0      A          IF:     XBYT,A,AND,B,NZ     WERE ANY SWS JUST PUSHED
      05 00082   CA5501  N
162   05 00085   26FF    A              MVI     H,X'FF'         YES, INIT BIT POSITION CNTR
163                                     REPEAT                  LOOP 'UNTIL' NO BITS= 1 IN BYTE
164   05 00087   24      A                  INR     H           H= POSITION OF SW (D0 TO D7)
165   05 00088   17      A                  RAL                 PUT SW INFO INTO 'C' BIT
166   05 00089   D25101  N                  IF:     CC,C,S      HAS THIS SW JUST BEEN PUSHED
167   05 0008C   F5      A                      PUSH    PSW     YES, SAVE
168   05 0008D   D5      A                      PUSH    D               REGS OVER
169   05 0008E   E5      A                      PUSH    H                       'CASE:'
170   05 0008F   78      A                      MOV     A,E     RELOAD 'BYTE #' CNTR
171   05 00090   E61F    A                      ANI     X'1F'   ELLIM.POSS.OF POSITIVE #
172   05 00092   07      A                      RLC             MULTIPLE
173   05 00093   07      A                      RLC                     A-REG
174   05 00094   07      A                      RLC                             BY 8
175   05 00095   84      A                      CASE:   XBYT,A,ADD,H  USE BYTE # & BIT # AS A PNTR
      05 00096   114E01  N
      05 00099   FE58    A
      05 0009B   CD0000  N

177                                ***********************************************************
178                                * ACTIVE SWITCHES FOR STAND-BY (NOT READY & READY STATES)  *
179                                ***********************************************************
180   05 0009E   0000    N                      C,00    DIGIT@IN      DIGIT 1
181   05 000A0   0000    N                      C,01    DIGIT@IN      DIGIT 2
182   05 000A2   0000    N                      C,02    DIGIT@IN      DIGIT 3
183   05 000A4   0000    N                      C,03    DIGIT@IN      DIGIT 4
```

```
05 000A6   0000   N                    C/04   DIGIT@IN     DIGIT 5
05 000A8   0000   N                    C/05   DIGIT@IN     DIGIT 6
05 000AA   0000   N                    C/06   DIGIT@IN     DIGIT 7
05 000AC   0000   N                    C/07   DIGIT@IN     DIGIT 8
                  *
05 000AE   0000   N                    C/08   DIGIT@IN     DIGIT 9
05 000B0   0000   N                    C/09   KYBD@0       DIGIT 0
05 000B2   0000   N                    C/10   RECALL@
05 000B4   0000   N                    C/11   @CLEAR       CLEAR
05 000B6   0000   N                    C/12   IMAG@SFT     IMAGE SHIFT
05 000B8   9301   N                    C/13   SPARE
05 000BA   0000   N                    C/14   STRT@PRT     START PRINT
05 000BC   0000   N                    C/15   STOP@PRT     STOP PRINT
                  *
05 000BE   0000   N                    C/16   VAR@DENS     VARIABLE DENSITY
05 000C0   0000   N                    C/17   AX@TRAY      AUX TRAY
05 000C2   9301   N                    C/18   SPARE
05 000C4   9301   N                    C/19   SPARE
05 000C6   9301   N                    C/20   SPARE
05 000C8   0000   N                    C/21   PEC@ON       PASTE UP SUPPRESSION
05 000CA   0000   N                    C/22   2SD@CPY      2 SIDED COPY
05 000CC   9301   N                    C/23   SPARE
                  *
05 000CE   9401   N                    C/24   RX
05 000D0   9401   N                    C/25   RX
05 000D2   9401   N                    C/26   RX
05 000D4   9401   N                    C/27   RX
05 000D6   0000   N                    C/28   98@REDN      98% REDUCTION
05 000D8   0000   N                    C/29   74@REDN      74% REDUCTION
05 000DA   0000   N                    C/30   65@REDN      65% REDUCTION
05 000DC   0000   N                    C/31   RX@ZOOM      RANK ZOOM LENS
                  *
05 000DE   0000   N                    C/32   ADH@JREC     ADH JOB RECOVERY
05 000E0   0000   N                    C/33   ADH@MULT     ADH MULTIPLE FEED
05 000E2   0000   N                    C/34   ADH@SGNL     ADH SINGLE FEED
05 000E4   9401   N                    C/35   RX
05 000E6   0000   N                    C/36   SRT@JOBS     SORTER JOB SUPPLEMENT
05 000E8   0000   N                    C/37   SRT@SETS     SORTER SETS
05 000EA   0000   N                    C/38   SRT@STKS     SORTER STACKS
05 000EC   9301   N                    C/39   SPARE
                  *
05 000EE   9301   N                    C/40   SPARE
05 000F0   9301   N                    C/41   SPARE
05 000F2   9301   N                    C/42   SPARE
05 000F4   9301   N                    C/43   SPARE
05 000F6   0000   N                    C/44   SERVICE      TECH REP KEY SWITCH
05 000F8   0000   N                    C/45   FAULT@CD     DISPLAY FAULT CODE
05 000FA   0000   N                    C/46   LVDGNPRG     LEAVE DIAGNOSTIC PROGRAM
05 000FC   9301   N                    C/47   SPARE

                  ********************************
                  * ACTIVE SWITCHES FOR PRINT STATE *
                  ********************************
05 000FE   0000   N                    C/48   RECALL@      RECALL QUANTITY
05 00100   0000   N                    C/49   ADH@PMUL     ADH MULTIPLE FEED
05 00102   0000   N                    C/50   ADH@PSIN     ADH SINGLE FEED
05 00104   9301   N                    C/51   SPARE
05 00106   0000   N                    C/52   SMPL@CPY     SAMPLE COPY (START PRINT)
05 00108   0000   N                    C/53   PRT@STOP     STOP PRINT
05 0010A   0000   N                    C/54   CNTR@RST     DIAGNOSTIC COUNTER RESET
05 0010C   0000   N                    C/55   AX@PRNT      AUX TRAY
                  ***********************************************************
                  * ACTIVE SWITCHES FOR TECH REP (NOT READY,READY STATES)   *
                  ***********************************************************
05 0010E   0000   N                    C/56   DIGIT@TR     DIGIT 1
05 00110   0000   N                    C/57   DIGIT@TR     DIGIT 2
05 00112   0000   N                    C/58   DIGIT@TR     DIGIT 3
05 00114   0000   N                    C/59   DIGIT@TR     DIGIT 4
05 00116   0000   N                    C/60   DIGIT@TR     DIGIT 5
05 00118   0000   N                    C/61   DIGIT@TR     DIGIT 6
05 0011A   0000   N                    C/62   DIGIT@TR     DIGIT 7
05 0011C   0000   N                    C/63   DIGIT@TR     DIGIT 8
                  *
05 0011E   0000   N                    C/64   DIGIT@TR     DIGIT 9
05 00120   0000   N                    C/65   KYBD@OTR     DIGIT 0
05 00122   0000   N                    C/66   DRECALL@
05 00124   0000   N                    C/67   DCLEAR@
05 00126   0000   N                    C/68   SERVICE      TECH REP KEY SWITCH
05 00128   0000   N                    C/69   DIAG@PRG     DIAGNOSTIC PROGRAM
05 0012A   0000   N                    C/70   STRT@DG      START PRINT
05 0012C   0000   N                    C/71   STOP@DG      STOP PRINT
                  ***********************************************************
                  *  ACTIVE SWITCHES FOR MINI PHYSICAL (NOT READY & READY STATE)  *
                  ***********************************************************
05 0012E   0000   N                    C/72   MINI@MIS     MISFEED CLEAR
05 00130   0000   N                    C/73   RECALL@      RECALL QUANTITY
05 00132   9301   N                    C/74   SPARE
05 00134   0000   N                    C/75   FAULT@CD     DISPLAY FAULT CODE
05 00136   0000   N                    C/76   LVDGNPRG     LEAVE DIAGNOSTIC PROGRAM
05 00138   0000   N                    C/77   MINI@PRT     MINI PHYSICAL AT PRINT
05 0013A   0000   N                    C/78   STOP@PRT     STOP PRINT
05 0013C   0000   N                    C/79   ADH@JREC     ADH JOB RECOVERY
                  ***********************************************************
                  * ACTIVE SWITCHES FOR MINI PHYSICAL (PRINT STATE & RUNNOT PRINT STATE) *
                  ***********************************************************
05 0013E   9301   N                    C/80   SPARE
05 00140   9301   N                    C/81   SPARE
05 00142   0000   N                    C/82   RECALL@      RECALL QUANTITY
05 00144   9301   N                    C/83   SPARE
05 00146   9301   N                    C/84   SPARE
05 00148   9301   N                    C/85   SPARE
05 0014A   9301   N                    C/86   SPARE
```

```
05 0014C   0000     N                          C,87      PRTØSTØP      STØP PRINT
                                            ENDCASE
05 0014E   E1       A                        PØP       H               RESTØRE
05 0014F   D1       A                        PØP       D                       SAVED
05 00150   F1       A                        PØP       PSW                           REGS
                                        ENDIF
05 00151   B7       A                UNTIL!    XBYT,A,ØR,A,Z            END WHEN NØ BITS IN THIS BYTE
05 00152   C28700   N
                                    ENDIF
05 00155   C9       A               RET                                RETURN TØ STDBY ØR PRINT BKGND
```

TABLE XII

```
                                *
                                * RØUTINE CALLED BY SWITCH SCAN WHEN DIAGNØSTIC PRØGRAM BUTTØN IS PUSHED
                                * IN NØN TECH REP STATES
                                *
05 001F4   3A4EFA   N   LVDGNPRG IF!        VBYT,DGNØNUM,NZ            IS THERE AN ACTIVE DGN PRØGRAM
05 001F7   A7       A
05 001F8   CA0102   N
05 001FB   CD2703   N            CALL       DGNØABT                    ABØRT ØPERATING DGN PRG
05 001FE   C30602   N           ELSE!
05 00201   3E80     A            SFLG       SERØACT                    SIGNAL STCK TØ GØ TØ TECH-REP
05 00203   3249F4   A
                                ENDIF
05 00206   C9       A           RET
                                *
                                *       RØUTINE CALLED WHEN SERVICE KEY IS TURNED 'ØN'
                                *
05 00207   CD0000   N   SERVICE STIMR      KEYØREL,250,KEYØØFF        LØØK FØR KEY RFLEASE
05 0020A   45       A
05 0020B   19       A
05 0020C   2A02     N
05 0020E   3A1BF4   A           IF!        FLG,DGNØERR,T              IS THERE ERRØR PENDING
05 00211   07       A
05 00212   D22902   N
05 00215   3A4EFA   N           ANDIF!     VBYT,DGNØNUM,Z             WAS IT A PRØGRAM # ENTRY ERRØR
05 00218   A7       A
05 00219   C22902   N
05 0021C   3A4FFA   N            LDA       DGØSAV
05 0021F   326DFC   N            STA       DGØDIGIT                   PUT DISPLAY BACK
05 00222   AF       A            CFLG      DGNØERR                    CANCEL ERRØR
05 00223   321BF4   A
05 00226   CD4101   N            CALL      DIAGØPRG                   GIVE NUMBER RETRY FØR VALID
                                *                                      ENTRY
                                ENDIF
05 00229   C9       A           RET
                                *
                                *       RØUTINE CALLED TØ LØØK FØR KEY TURN ØFF
                                *
05 0022A   2E28     A   KEYØØFF IF!        IBIT,SERVICE#,T
05 0022C   CD0000   N
05 0022F   D23C02   N
05 00232   CD0000   N            STIMR     KEYØREL,250,KEYØØFF        KEY STILL ØN
05 00235   45       A
05 00236   19       A
05 00237   2A02     N
05 00239   C35E02   N           ØRIF!      VBYT,DGNØNUM,NZ            IS DGN PRØGRAM ACTIVE
05 0023C   3A4EFA   N
05 0023F   A7       A
05 00240   CA5E02   N
05 00243   CD7103   N            CALL      NVTBØCK
05 00246   CA5E02   N            IF!       CC,Z,C                     CLEAR IF NØT DISCLØSED
05 00249   3A53FD   N                IF!       XBYT,STATE!,LT,!PRNT   IS IT A RUNNING STATE
05 0024C   FE04     A
05 0024E   D25702   N
05 00251   CD2703   N                    CALL      DGNØABT            YES ABØRT DIAGNØSTIC PRØGRAM
05 00254   C35E02   N                ELSE!
05 00257   CD0000   N                    STIMR     KEYØREL,250,KEYØØFF KEEP LØØKING AT KEY RELEASE
05 0025A   45       A
05 0025C   2A02     N
                                *                                      UNTIL MACHINE STØPS
                                    ENDIF
                                ENDIF
                                ENDIF
05 0025E   C9       A           RET
                                *
                                *       RØUTINE CALLED IN TECH-REP STATE PRØLØGUE
                                *
05 0025F   CDCB02   N   DGNØPRL CALL      DSPLØDC                     PUT DC-- IN DISPLAY
05 00262   3E80     A           SFLG      DSPLØDGN                    USE DIAGNØSTIC DISPLAY
05 00264   321FF4   A
05 00267   3A63FC   N           LDA       PREVØIN+1
05 0026A   F604     A           ØRI       X'04'                       INHIBIT IMMEDIATE CALL TØ
05 0026C   3263FC   N           STA       PREVØIN+1                   DIAGØPRG
05 0026F   C9       A           RET
                                *
```

TABLE XIII

```
                                *
                                *
                                * RØUTINE CALLED BY SWITCH SCAN WHEN DIAGNØSTIC PRØGRAM BUTTØN IS PUSHED
                                * IN TECH REP STATE ØNLY
                                *
05 00141   3A4EFA   N   DIAGØPRG IF!        VBYT,DGNØNUM,NZ            IS DGN PRØGRAM ACTIVE
05 00144   A7       A
05 00145   CA7A01   N
```

```
278  05 00148  3A53FD  N          IF1      XBYT,STATE1,EQ,1COMP        IS IT COMP CTRL STATE
     05 0014B  FE00    A
     05 0014D  C25601  N
279  05 00150  CD0000  N              CALL     COMP1CHG                TELL STATE CK TO GO TO TRP
280  05 00153  C37701  N          ELSE1
281  05 00156  CD0000  N              CTIMR    DSPLOTIM                CLEAR DIAG PRG 20,21,22 TIMER
     05 00159  4A      A
282  05 0015A  AF      A                XRA      A
283  05 0015B  326EFB  N                STA      FALTOPTR                SET UP FOR RESTART OF PRG. 20
284  05 0015E  3A4EFA  N                IF1      XBYT,DGNONUM,NE,DGNPRG29 DIAG 29 NOT ACTIVE
     05 00161  FE10    A
     05 00163  CA7101  N
285  05 00166  3A4EFA  N                ANDIF1   XBYT,DGNONUM,NE,DGNPRG28 DIAG 28 NOT ACTIVE
     05 00169  FE0F    A
     05 0016B  CA7101  N
286  05 0016E  C37401  N                ELSE1                            CLEAN UP OPERATING ADH DIAGNOST
287  05 00171  CD0000  N                    CALL     ADH29EPL            ABORT ADH SKEW TEST
288                                     ENDIF
289  05 00174  CDCB02  N                CALL     DSPLODC                 PUT DC-- IN DISPLAY
290                                 ENDIF
291  05 00177  C3F301  N         ORIF1    FLG,DGNOERR,T                 IF ERROR IS PENDING
     05 0017A  3A1BF4  A
     05 0017D  07      A
     05 0017E  D28701  N
292  05 00181  CDCB02  N         CALL     DSPLODC                       PUT DC-- IN DISPLAY
293  05 00184  C3F301  N         ORIF1    XWRD,DGNODSPL,EQ,X'DC00'
     05 00187  1100DC  A
     05 0018A  2A6BFC  N
     05 0018D  CD0000  N
     05 00190  C29A01  N
294  05 00193  AF      A         CFLG     SEROACT                       EXIT TECH REP STATE
     05 00194  3249F4  A
295  05 00197  C3F301  N         ELSE1
296  05 0019A  2600    A         MVI      H,0
297  05 0019C  CD0000  N         CALL     4BCD1B1N                      CONVERT TO BINARY
298  05 0019F  7D      A         IF1      XBYT,L,GE,LSTOKEY+1
     05 001A0  FE25    A
     05 001A2  DAA801  N
299  05 001A5  C3C101  N         ORIF1    XBYT,A,LT,1STONKEY
     05 001A8  FE0A    A
     05 001AA  D2B101  N
300  05 001AD  3F      A             CMC
301  05 001AE  C3C101  N         ORIF1    XBYT,A,GE,1STOKEY
     05 001B1  FE14    A
     05 001B3  DABC01  N
302  05 001B6  D604    A             SUI      1STOKEY-LSTONKEY+1
303  05 001B8  3F      A             CMC
304  05 001B9  C3C101  N         ORIF1    XBYT,A,GE,LSTONKEY+1
     05 001BC  FE10    A
305                                 ENDIF
306  05 001C1  DACA01  N         IF1      CC,C,C
307  05 001C4  CDAE02  N             CALL     DSPLOERR                BAD ENTRY BLINK DISPLAY
308  05 001C7  C3F301  N         ELSE1
309  05 001CA  D609    A             SUI      9
310  05 001CC  47      A             MOV      B,A
311  05 001CD  CD7103  N             CALL     NVTBOCK                 IS THIS ENTRY DISCLOSED YET
312  05 001D0  CAE101  N             IF1      CC,Z,C                  CLEAR IF NOT DISCLOSED
313  05 001D3  2E2B    A             ANDIF1   1BIT,SERVICE#,F
     05 001D5  CD0000  N
     05 001D8  DAE101  N
314  05 001DB  CDAE02  N                 CALL     DSPLOERR            NO,SHOW ERROR
315  05 001DE  C3F301  N             ELSE1
316  05 001E1  78      A                 MOV      A,B
317  05 001E2  324EFA  N                 STA      DGNONUM             USE NEW PROGRAM NUMBER
318  05 001E5  CDEE02  N                 CALL     DSPLOCLR            BLANK THE DISPLAY
319  05 001E8  2121FC  A                 SFBIT,P  8NODIAG
     05 001EB  3E02    A
     05 001ED  B6      A
     05 001EE  77      A
320  05 001EF  AF      A                 XRA      A
321  05 001F0  326EFB  N                 STA      FALTOPTR            'CAUSES 'FC' TO BE DISP PRG 20
322                                *                                   TO INDICATE PROGRAM ACTIVE'
323                                     ENDIF
324                                 ENDIF
325                             ENDIF
326  05 001F3  C9      A        RET
```

TABLE XIV

```
473                                *
474                                *    ROUTINE TO DETERMINE IF DIAGNOSTIC PROGRAM HAS BEEN DISCLOSED BY
475                                *    THE TECH-REP BY SEARCHING NV BYTE FOR ENABLE
476                                *
477  05 00371  FE06    A  NVTBOCK  IF1      XBYT,A,LE,LSTONKEY-1STONKEY+1 IS IT DISCLOSURE RANGE
     05 00373  DA7903  N
     05 00376  C28503  N
478  05 00379  CD8603  N            CALL     NVOMASK                 BUILD MASK BASED ON A REG
479  05 0037C  E5      A            PUSH     H                       SAVE MASK
480  05 0037D  CD0000  N            RNVBYT   TRPODSCL                GET DISCLOSED INFO
     05 00380  5F      A
     05 00381  E3      A
481  05 00382  E1      A            POP      H
482  05 00383  A4      A            MODBYT   A,AND,H                 IS MASK BIT FOUND IN DISCLOSURE
483  05 00384  94      A            MODBYT   A,SUB,H                 BYTE
484                                ENDIF
485                                *
486                                *    ZERO CC IS CLEARED IF PROGRAM IS NOT DISCLOSED
487                                *
488  05 00385  C9      A        RET
```

TABLE XV

```
1236                                  *
1237                                  *        PROGRESSIVE DISCLOSURE DIAGNOSTIC PROGRAM USED BY THE TECH-REP
1238                                  *        TO GIVE ADVANCED OPERATORS ADDITIONAL DIAGNOSTIC CAPABILITY
1239                                  *
1240  05 00971   2A68FC   N   VALID033 LHLD     DGNODSPL                    WHAT IS IN DISPLAY
1241  05 00974   7C       A           IF:      VBYT,H,Z                    IS DISPLAY GT 99
      05 00975   A7       A
      05 00976   C29A09   N
1242  05 00979   7D       A           ANDIF:   XBYT,L,GE,1STONKEY+6
      05 0097A   FE10     A
      05 0097C   DA9A09   N
1243  05 0097F   FE16     A           ANDIF:   XBYT,A,LT,LSTONKEY+7
      05 00981   D29A09   N
1244  05 00984   D60F     A               SUI      15                      CONVERT TO BINARY AND SUB 9
1245  05 00986   47       A               MOV      B,A
1246  05 00987   CD8603   N               CALL     NVOMASK                 BUILD MASK FOR ENABLING
1247  05 0098A   E5       A               PUSH     H                       OR DISABLING REQUESTED PRG
1248  05 0098B   CD0000   N               RNVBYT   TRPODSCL
      05 0098E   5F       A
      05 0098F   E3       A
1249  05 00990   E1       A               POP      H                       H HAS MASK
1250  05 00991   6F       A               MOV      L,A
1251  05 00992   AF       A               XRA      A
1252  05 00993   3D       A               DCR      A                       CLEAR ZERO CONDITION CODE
1253  05 00994   3234F4   A               MODFLG   KYBD5INH                INHIBIT KEYBOARD ENTRY
1254  05 00997   C39E09   N           ELSE:
1255  05 0099A   CDAE02   N               CALL     DSPLOERR                BAD NUMBER BLINK DISPLAY
1256  05 0099D   AF       A               XRA      A                       SET ZERO CONDITION CODE
1257                                  ENDIF
1258  05 0099E   C9       A           RET
1259                                  *
1260                                  *        PROGRESSIVE DISCLOSURE BACKGROUND PROGRAM
1261                                  *
1262  05 0099F   3A2AF4   A   DGNOT033 IF:      FLG,RCALLODG,T              IS RECALL REQUESTED
      05 009A2   07       A
      05 009A3   D2D109   N
1263  05 009A6   CD7109   N               CALL     VALID033
1264  05 009A9   CACE09   N               IF:      CC,Z,C                  CLEAR IF GOOD NUMBER
1265  05 009AC   2E0D     A                   IF:      IBIT,RECALL#,T
      05 009AE   CD0000   N
      05 009B1   D2CB09   N
1266  05 009B4   78       A                       MOV      A,B
1267  05 009B5   CD7103   N                       CALL     NVTBOCK         CHECK IF IN TABLE
1268  05 009B8   C2C309   N                       IF:      CC,Z,S          SET IF IN TABLE
1269  05 009BB   CD0000   N                           SOBIT,S   READY*     TURN ON READY LIGHT
      05 009BE   E701     A
1270  05 009C0   C3CB09   N                       ELSE:
1271  05 009C3   CD0000   N                           SOBIT,S   JOB$ICMP   TURN ON JOB INCOMPLETE
      05 009C6   F401     A
1272                                              ENDIF
1273  05 009C8   C3CE09   N                   ELSE:
1274  05 009CB   CD6F00   N                       CALL     NOSDGN          TURN OFF READY LIGHT CLR RECALL
1275                                  *                                    FLAG
1276                                              ENDIF
1277                                          ENDIF
1278  05 009CE   C30D0A   N           ORIF:    FLG,STRTODGN,T              IS START PRINT PUSHED
      05 009D1   3A3EF4   A
      05 009D4   07       A
      05 009D5   D2F009   N
1279  05 009D8   CD7109   N               CALL     VALID033
1280  05 009DB   CAED09   N               IF:      CC,Z,C                  CLEAR IF GOOD NUMBER
1281  05 009DE   7D       A                   MOV      A,L
1282  05 009DF   B4       A                   ORA      H                   PUT NEWLY DISCLOSED PROGRAM
1283  05 009E0   325EE3   A                   WNVBYT   TRPODSCL            IN NV TABLE
      05 009E3   0F       A
      05 009E4   0F       A
      05 009E5   0F       A
      05 009E6   0F       A
      05 009E7   325FE3   A
1284  05 009EA   CDEE02   N                   CALL     DSPLOCLR            BUTTON PUSHED CLEAR DISPLAY
1285                                          ENDIF
1286  05 009ED   C30D0A   N           ORIF:    FLG,STOPODGN,T              IS STOP PRINT PUSHED
      05 009F0   3A33F4   A
      05 009F3   07       A
      05 009F4   D20D0A   N
1287  05 009F7   CD7109   N               CALL     VALID033
1288  05 009FA   CA0D0A   N               IF:      CC,Z,C                  CLEAR IF GOOD NUMBER
1289  05 009FD   7C       A                   MOV      A,H                 PUT MASK IN A
1290  05 009FE   2F       A                   CMA                          BUILD CANCEL MASK
1291  05 009FF   A5       A                   ANA      L                   CANCEL PROGRAM FROM TABLE
1292  05 00A00   325EE3   A                   WNVBYT   TRPODSCL
      05 00A03   0F       A
      05 00A04   0F       A
      05 00A05   0F       A
      05 00A06   0F       A
      05 00A07   325FE3   A
1293  05 00A0A   CDEE02   N                   CALL     DSPLOCLR            BUTTON PUSHED CLEAR DISPLAY
1294                                          ENDIF
1295                                      ENDIF
1296  05 00A0D   CD9100   N           CALL     CLROCK
1297  05 00A10   C9       A           RET
```

TABLE XVI

```
231                                   ***********************************************************************
232                                   * TECH REP DIGIT INPUT ROUTINE IS CALLED BY SWITCH SCAN IN THE TECH REP STATE  *
233                                   * WHEN A NUMERIC KEY IS PUSHED ON THE PROGRAMMER KEYBOARD. THIS ROUTINE LOADS  *
234                                   * A NUMBER INTO DGNODSPL WORD                                                  *
235                                   ***********************************************************************
```

```
05 000F1   0F        A   DIGIT@TR RRC                                  RECOVER NUMBER FROM SWITCH SCAN
05 000F2   D637      A            SUI      55
05 000F4   5F        A            MOV      E,A
05 000F5   1600      A            MVI      D,0
05 000F7   3A34F4    A            IF:      FLG,KYBD5INH,F              IS THE ENTRY INHIBITED
05 000FA   07        A
05 000FB   DA4001    N
05 000FE   2A6BFC    N                LHLD     DGNODSPL                GET PREVIOUS VALUE
05 00101   7C        A                MOV      A,H
05 00102   29        A                DAD      H
05 00103   29        A                DAD      H
05 00104   29        A                DAD      H
05 00105   29        A                DAD      H
05 00106   19        A                DAD      D                       MULTIPLY PREVIOUS VALUE BY 10
05 00107   FEDC      A                IF:      XBYT,A,NE,X'DC'         MERGE NEW UNITS DIGIT
05 00109   CA2301    N                                                 IS IT DIAGNOSTIC PROGRAM ENTRY
05 0010C   FEFC      A                ANDIF:   XBYT,A,NE,X'FC'         NO-IS IT PROG 20 OR 22 ENTRY
05 0010E   CA2301    N
05 00111   CD0000    N                    CALL     DIGOFIX             NO-JUST PLAIN OLD ENTRY
05 00114   47        A                    MOV      B,A                 SAVE DIGIT FIX RESULT
05 00115   FE0F      A                    IF:      XBYT,A,EQ,X'0F'     IS DISPLAY FULL
05 00117   C21F01    N
05 0011A   3E80      A                        SFLG     KYBD5INH        INHIBIT FURTHER ENTRY
05 0011C   3234F4    A
                                          ENDIF
05 0011F   78        A                    MOV      A,B
05 00120   C33601    N                ELSE:
05 00123   67        A                    MOV      H,A                 PUT BACK 'DC' OR 'FC'
05 00124   7D        A                    IF:      XBYT,L,GE,X'10'
05 00125   FE10      A
05 00127   DA3401    N
05 0012A   3E80      A                        SFLG     KYBD5INH        INHIBIT FURTHER ENTRY
05 0012C   3234F4    A
05 0012F   3E0F      A                        MVI      A,X'0F'         ALL DIGITS ON
05 00131   C33601    N                    ELSE:
05 00134   3E0D      A                        MVI      A,X'0D'         TENS DIGIT BLANK
                                          ENDIF
                                      ENDIF
05 00136   226BFC    N                SHLD     DGNODSPL                UPDATE MEMORY
05 00139   326DFC    N                STA      DGODIGIT                UPDATE MEMORY
05 0013C   AF        A                CFLG     DSPL@1ST                UPDATE DISPLAY
05 0013D   329AF4    A
                                  ENDIF
05 00140   C9        A            RET
```

TABLE XVII

```
05 002CF   3A34F4    A   DGNOT@13 IF:      FLG,KYBD5INH,F              1ST TIME FOR DIAG #13
05 002D2   07        A
05 002D3   DAE302    N
05 002D6   3E80      A                SFLG     KYBD5INH                SET ONE TIME(INHIBIT KEYBOARD)
05 002D8   3234F4    A
05 002DB   3E01      A                MVI      A,1
05 002DD   3283FA    N                STA      OUTPNTR                 INITIALIZE PNTR TO LAST GAP TIM
05 002E0   C30B03    N            ORIF:     FLG,RCALL@DG,T              DISPLAY SELECT SWITCH PUSHED
05 002E3   3A2AF4    A
05 002E6   07        A
05 002E7   D2F602    N
05 002EA   AF        A                CFLG     RCALL@DG                ACKNOWLEDGE PUSH
05 002EB   322AF4    A
05 002EE   3E09      A                MVI      A,TABLNGTH              FETCH TABLE SIZE
05 002F0   CD1E03    N                CALL     ADH@DINC                UPDATE DISPLAY
05 002F3   C30B03    N            ORIF:     FLG,STRT@DGN,T              START PRINT PUSHED
05 002F6   3A3EF4    A
05 002F9   07        A
05 002FA   D20B03    N
05 002FD   AF        A                CFLG     STRT@DGN                ACKNOWLEDGE PUSH
05 002FE   323EF4    A
05 00301   3A83FA    N                LDA      OUTPNTR                 FETCH CURRENT GAP TIME IDENTIFI
05 00304   3D        A                DCR      A                       MOV ID TO NEXT GAP TIME PAIR
05 00305   CA0B03    N                IF:      CC,Z,C                  NOT AT LAST GAP TIME
05 00308   CD1E03    N                    CALL     ADH@DINC            UPDATE DISPLAY
                                      ENDIF
                                  ENDIF
05 0030B   C9        A            RET
```

TABLE XVIII

```
                                 *
                                 *        THE FOLLOWING TABLE DEFINES THE DISPLAYED GAP TIMES
                                 *                THE GAP TIME IS DEFINED AS:
                                 *                (ARGUMENT(2)*ARGUMENT(1))X10MS
                                 *                *NOTE:CODE GENERATED IS NOT NECESSARILY IN
                                 *                      THE SAME ORDER AS THE ARGUMENTS*
                                 *                      (SEE ORDITBL PROC DEFINITION)
                                 *

                                 ADHOROMT,TABO2 ORDITBL   ADH@CPDC,ADHRL3DC,);      1ST GAP TIME
                                                ADHRL3DC,ADH@L4DC,);                2ND GAP TIME
                                                ADH@L4DC,ADHRT3DC,);                3RD GAP TIME
                                                ADHRT3DC,ADH@T4DC,);                4TH GAP TIME
                                                ADH@SFDC,ADHFL3DC,);                5TH GAP TIME
                                                ADHFL3DC,ADH@T2DC,);                6TH GAP TIME
                                                ADH@T2DC,ADHFT3DC,);                7TH GAP TIME
                                                ADH@T1DC,ADH@L1DC,);                8TH GAP TIME
```

```
538  05 0030C   CA   A                    ADH@SFDC,ADH@L2DC          9TH GAP TIME
     05 0030D   C8   A
     05 0030E   C7   A
     05 0030F   C6   A
     05 00310   C5   A
     05 00311   C3   A
     05 00312   C2   A
     05 00313   C1   A
     05 00314   C0   A
     05 00315   C4   A
     05 00316   C9   A
     05 00317   C6   A
     05 00318   C5   A
     05 00319   C4   A
     05 0031A   C2   A
     05 0031B   C1   A
     05 0031C   C0   A
     05 0031D   BF   A
```

TABLE XIX

```
540  05 0031E   3283FA   N  ADH@DINC STA     @UTPNTR                    UPDATE IDENTIFIER
541  05 00321   CD0000   N          STIMR    DSPL@TIM,510,ADH@DSPL      UPDATE DISPLAY IN .5SEC
     05 00324   4A       A
     05 00325   33       A
     05 00326   3103     N
542  05 00328   CD0000   N          CALL     DSPL@CLR                   BLANK THE DISPLAY
543  05 0032B   3E80     A          SFLG     KYBD5INH                   RE-INHIBIT KEYBOARD
     05 0032D   3234F4   A
544  05 00330   C9       A          RET

546  05 00331   3A83FA   N  ADH@DSPL LDA     @UTPNTR                    FETCH IDENTIFIER
547  05 00334   2A78FB   N          LHLD     TAB@STRT                   SET PNTR TO START OF CONTROL TA
548                                 *                                   (MINUS ONE)
549  05 00337   1600     A          MVI      D,0
550  05 00339   5F       A          MOV      E,A                        SET PAIR TO ID OFFSET
551  05 0033A   19       A          DAD      D                          OFFSET PNTR TO CURRENT ID
552  05 0033B   46       A          MOV      B,M                        SAV PRIOR DIAG CNTR OFFSET
553  05 0033C   1E09     A          MVI      E,TABLNGTH
554  05 0033E   19       A          DAD      D
555  05 0033F   6E       A          MOV      L,M                        MOV PNTR TO 2ND PART OF CONTRL
556  05 00340   26FC     A          MVI      H,H@ADDR                   FETCH SUBSEQUENT DIAG CNTR OFFS
557  05 00342   7E       A          MOV      A,M                        MOV PNTR TO SUBSEQUENT DIAG CNT
558  05 00343   68       A          MOV      L,B                        FETCH SUBSEQUENT DC TIME
559  05 00344   96       A          SUB      M                          MOV PNTR TO PRIOR DIAG CNTR
560  05 00345   CD0000   N          CALL     BINRIBCD                   CALCULATE GAP TIME
561  05 00348   29       A          DAD      H                          CONVERT TO BCD
562  05 00349   29       A          DAD      H
563  05 0034A   29       A          DAD      H                          ADD TRAILING ZERO(MULTIPLY BY T
564  05 0034B   29       A          DAD      H
565  05 0034C   CD0000   N          CALL     DSPL@HL                    PUT GAP TIME IN DISPLAY
566  05 0034F   216DFC   N          LXI      H,DG@DIGIT                 SET PNTR TO DIGIT DISPLAY ENABL
567  05 00352   3E01     A          MVI      A,D0
568  05 00354   B6       A          ORA      M
569  05 00355   77       A          MOV      M,A                        ENABLE ZERO GAP TIME
570  05 00356   C9       A          RET
```

TABLE XX

```
423  05 001CE   3A3EF4   A  DGN@T@28 IF:      FLG,STRT@DGN,T             START PRINT PUSHED
     05 001D1   07       A
     05 001D2   D21502   N
424  05 001D5   AF       A              CFLG      STRT@DGN               ACKNOWLEDGE PUSH
     05 001D6   323EF4   A
425  05 001D9   3A05F4   A              IF:       FLG,ADDR@ACT,T         ADH CLEARED
     05 001DC   07       A
     05 001DD   D21202   N
426  05 001E0   3A08F4   A              ANDIF:    FLG,ADH@MSEL,T         RE-SELECTED
     05 001E3   07       A
     05 001E4   D21202   N
427  05 001E7   3A8BF7   A              ANDIF:    FLG,ADH@NMOV,T         AND READY
     05 001EA   07       A
     05 001EB   D21202   N
428  05 001EE   AF       A                  CFLG      ADDR@ACT           RESET SEQUENCE
     05 001EF   3205F4   A
429  05 001F2   2F       A                  CMA
430  05 001F3   3234F4   A                  MODFLG    KYBD5INH           INHIBIT KEYBOARD
431  05 001F6   2A6BFC   N                  LHLD      DGN@DSPL           FETCH GAP TIME IDENTIFIER
432  05 001F9   7C       A                  IF:       VBYT,H,Z
     05 001FA   A7       A
     05 001FB   C20F02   N
433  05 001FE   7D       A                  ANDIF:    XBYT,L,LT,TABLNGTH+1  IDENTIFIER IN RANGE
     05 001FF   FE0A     A
     05 00201   D20F02   N
434  05 00204   3283FA   N                      STA       @UTPNTR        SAV IDENTIFIER OFFSET
435  05 00207   3EFF     A                      MVI       A,X'FF'        FETCH 'SET' MASK
436  05 00209   CD8602   N                      CALL      CYCLSTRT       START ADH RECYCLING
437  05 0020C   C31202   N                  ELSE:                        IDENTIFIER OUT OF RANGE
438  05 0020F   CD0000   N                      CALL      DSPL@ERR
439                                         ENDIF
440                                     ENDIF
441  05 00212   C38502   N          ORIF:     FLG,STOP@DGN,T             STOP PRINT PUSHED
     05 00215   3A33F4   A
     05 00218   07       A
     05 00219   D22D02   N
442  05 0021C   AF       A              CFLG      STOP@DGN               ACKNOWLEDGE PUSH
     05 0021D   3233F4   A
```

```
443  05 00220  2F        A          CMA
444  05 00221  3205F4    A          MODFLG    ADDR@ACT                INDICATE ADH CLEARED
445  05 00224  CDCB00    N          CALL      ADH@CLR                 ABORT(CLEAR) ADH
446  05 00227  CD0000    N          CALL      DSPL@CLR                CLEAR DISPLAY
447  05 0022A  C38502    N       ORIF:     FLG,CLR@DGN,T             CLEAR SWITCH PUSHED
     05 0022D  3A16F4    A
     05 00230  07        A
     05 00231  D23E02    N
448  05 00234  AF        A          CFLG      CLR@DGN                 ACKNOWLEDGE PUSH
     05 00235  3216F4    A
449  05 00238  CD9D00    N          CALL      ADH@MULT                SELECT ADH
450  05 0023B  C38502    N       ORIF:     FLG,RCALL@DG,T            DISPLAY SELECT PUSHED
     05 0023E  3A2AF4    A
     05 00241  07        A
     05 00242  D25902    N
451  05 00245  AF        A          CFLG      RCALL@DG                ACKNOWLEDGE PUSH
     05 00246  322AF4    A
452  05 00249  2F        A          CMA
453  05 0024A  3234F4    A          MODFLG    KYBD5INH                INHIBIT THE KEYBOARD
454  05 0024D  3A83FA    N          LDA       OUTPNTR                 FETCH LAST IDENTIFIER
455  05 00250  2600      A          MVI       H,0
456  05 00252  6F        A          MOV       L,A
457  05 00253  CD0000    N          CALL      DSPL@HL                 DISPLAY LAST IDENTIFIER
458  05 00256  C38502    N       ELSE:                               NO BUTTONS PUSHED
459  05 00259  CD9602    N          CALL      LMP@UPDT                UPDATE JOB*ICMP & READY* LAMPS
460  05 0025C  3A07F4    A          IF:       FLG,ADH@JOBR,T          ADH CYCLE STARTED
     05 0025F  07        A
     05 00260  D28502    N
461  05 00263  3A83FA    N                LDA       OUTPNTR            FETCH CURRENT IDENTIFIER
462  05 00266  3D        A                DCR       A
463  05 00267  FA8502    N                IF:       CC,S,C             ID NOT ZERO
464  05 0026A  2A78FB    N                    LHLD      TAB@STRT       FETCH START OF CONTROL TABLE
465  05 0026D  111200    A                    LXI       D,TABLNGTH+2   SET OFFSET TO END OF CONTROL TA
466  05 00270  47        A                    MOV       B,A            SAV ID OFFSET
467  05 00271  7B        A                    MOV       A,E            MOV OFFSET TO SUBSEQUENT DIAGNO
468  05 00272  90        A                    SUB       B              COUNTER OF CURRENT GAP TIME PAI
469  05 00273  5F        A                    MOV       E,A
470  05 00274  19        A                    DAD       D              MOV PNTR TO SUBSEQUENT CNTR IN
471  05 00275  6E        A                    MOV       L,M            SET PNTR TO ACTUAL
472  05 00276  26FC      A                    MVI       H,HOADDR       SUBSEQUENT COUNTER
473  05 00278  3A84FA    N                    LDA       ADH@DGNL       FETCH LAST VALUE OF COUNTER
474  05 0027B  BE        A                    IF:       XBYT,A,NE,M    HAS THERE BEEN A CHANGE
     05 0027C  CA8502    N
475  05 0027F  3284FA    N                        STA       ADH@DGNL   SAV NEW COUNTER VALUE
476  05 00282  CD3103    N                        CALL      ADH@DSPL   CALC & DISPLAY NEW GAP TIME
477                                             ENDIF
478                                         ENDIF
479                                     ENDIF
480                                 ENDIF
481  05 00285  C9        A          RET
```

TABLE XXI

```
385  05 0015F  3A3EF4    A  DGNOT029 IF:       FLG,STRT@DGN,T        START PRINT PUSHED
     05 00162  07        A
     05 00163  D2A101    N
386  05 00166  AF        A          CFLG      STRT@DGN                ACKNOWLEDGE PUSH
     05 00167  323EF4    A
387  05 0016A  3A05F4    A          IF:       FLG,ADDR@ACT,T          ADH READY TO START  (SELECTED)
     05 0016D  07        A
     05 0016E  D29E01    N
388  05 00171  3A8BF7    A          ANDIF:    FLG,ADH@NHOV,T          AND NO JAM PENDING
     05 00174  07        A
     05 00175  D29E01    N
389  05 00178  AF        A              CFLG      ADDR@ACT            CLEAR READY TILL NEXT SEQUENCE
     05 00179  3205F4    A
390  05 0017C  11B1F4    A              LXIFLG    D,ADH@2981          SET PNTR TO 1ST HLT FLAG
391  05 0017F  2A6BFC    N              LHLD      DGN@DSPL            FETCH STATION CODE
392  05 00182  2D        A              DCR       L                   JUSTIFY STATION CODE OFFSET
393  05 00183  7C        A              MOV       A,H
394  05 00184  B7        A              ORA       A                   CHECK MSBYT OF STATION CODE
395  05 00185  C29B01    N              IF:       CC,Z,S              MSBYT OF CODE ZERO
396  05 00188  7D        A              ANDIF:    XBYT,L,LT,MAX@CNT+1 LSBYT OF CODE IN RANGE(>0&<MAXC
     05 00189  FE05      A
     05 0018B  D29B01    N
397  05 0018E  19        A                  DAD       D               SET PNTR TO PROPER FLAG
398  05 0018F  3EFF      A                  MVI       A,X'FF'         FETCH 'SET' MASK
399  05 00191  77        A                  MOV       M,A             SET HLT FLAG
400  05 00192  3234F4    A                  MODFLG    KYBD5INH        INHIBIT KEYBOARD
401  05 00195  CD8602    N                  CALL      CYCLSTRT        START ADH RECYCLING
402  05 00198  C39E01    N              ELSE:                         STATION CODE OUT OF RANGE
403  05 0019B  CD0000    N                  CALL      DSPL@ERR        START BLINKING THE DISPLAY
404                                     ENDIF
405                                 ENDIF
406  05 0019E  C3C901    N       ORIF:     FLG,STOP@DGN,T            STOP PRINT PUSHED
     05 001A1  3A33F4    A
     05 001A4  07        A
     05 001A5  D2B901    N
407  05 001A8  AF        A          CFLG      STOP@DGN                ACKNOWLEDGE PUSH
     05 001A9  3233F4    A
408  05 001AC  2F        A          CMA
409  05 001AD  3205F4    A          MODFLG    ADDR@ACT                INDICATE ADH READY FOR CYCLE (S
410  05 001B0  CDCB00    N          CALL      ADH@CLR                 CANCELL OLD CYCLE
411  05 001B3  CD4800    N          CALL      ADH@SGNL                RE-SELECT ADH
412  05 001B6  C3C901    N       ORIF:     FLG,CLR@DGN,T             CLEAR SWITCH PUSHED
     05 001B9  3A16F4    A
     05 001BC  07        A
     05 001BD  D2C601    N
413  05 001C0  CD0000    N          CALL      DSPL@CLR                CLEAR THE DISPLAY
414  05 001C3  C3C901    N       ELSE:                               UPDATE FRONT PANEL LIGHTS
```

```
415   05 001C6   CD9602   N                CALL     LMP&UPDT                UPDATE J&B&ICMP & READY& LAMPS
416                                   ENDIF
417   05 001C9   C9       A            RET

419   05 001CA   CDCB00   N   ADH29EPL CALL     ADH&CLR                     CLEAR ADH
420   05 001CD   C9       A            RET
```

TABLE XXII

```
854   05 00546   3AB0F4   A   ADH&CTRL IF:      FLG,ADH9SELC,T              ADH SELECTED
      05 00549   07       A
      05 0054A   D2E805   N
855   05 0054D   CDA004   N                CALL     SEN&READ                CHECK ADH INPUT SENS&RS
856   05 00550   CAE505   N                IF:      CC,Z,C                  CHANGE STATE IF SENS&R CHANGE
857   05 00553   57       A                    M&V      D,A                 SAVE CHANGE MASK IN D REG
858   05 00554   A0       A                    ANA      B                   FIND LEAD EDGES
859   05 00555   5F       A                    M&V      E,A                 SAVE LEAD EDGES IN E REG
860   05 00556   2F       A                    CMA
861   05 00557   A2       A                    ANA      D                   FIND TRAIL EDGES
862   05 00558   21B9FC   N                    LXI      H,TEDGINH           SET PNTR T& TEDG INHIBIT MASK
863   05 0055B   A6       A                    ANA      M                   MASK &UT INHIBITED SENS&RS
864   05 0055C   CA9E05   N                    IF:      CC,Z,C              ANY TRAIL EDGES THIS READ
865   05 0055F   57       A                        M&V      D,A             SAVE TRAIL EDGES IN D REG
866   05 00560   23       A                        INX      H               M&V PNTR T& TEDG BYPASS MASK
867   05 00561   A6       A                        ANA      M               MASK &UT INDETERMINENT TRAIL ED
868   05 00562   47       A                        M&V      B,A             SAVE VALID TRAIL EDGES
869   05 00563   23       A                        INX      H               M&V PNTR T& TRAIL EDGE EXPECTED
870   05 00564   7E       A                        M&V      A,M             FETCH EXPECTED TRAIL EDGES
871   05 00565   2F       A                        CMA
872   05 00566   A0       A                        ANA      B               C&MPARE ACTUAL AND EXPECTED TRA
873   05 00567   C29605   N                        IF:      CC,Z,S          N& UNEXPECTED TRAIL EDGES
874   05 0056A   B2       A                            &RA      D           REST&RE TRAIL EDG BYE/SET CC F&
875   05 0056B   1600     A                            M&VI     D,0         CLR CASE BRANCH TABLE P&INTER
876
877   05 0056D   17       A                            REPEAT
878   05 0056E   D28E05   N                                RAL
879   05 00571   D5       A                                IF:      CC,C,S
880   05 00572   F5       A                                    PUSH     D
881   05 00573   7A       A                                    PUSH     PSW
      05 00574   118C05   N                                    CASE:    VBYT,D
      05 00577   FE08     A
      05 00579   CD0000   N
882   05 0057C   0108     N                                        C,0     TEDGFD&F FEED-&FF TRAIL EDGE R&UT
883   05 0057E   C408     N                                        C,1     TEDGWAIT WAIT TRAIL EDGE R&UTINE
884   05 00580   F308     N                                        C,2     TEDGRET RETURN TRAIL EDGE R&UTINE
885   05 00582   EE05     N                                        C,3     SPARE SPARE P&SITI&N
886   05 00584   0208     N                                        C,4     TEDGEXIT EXIT TRAIL EDGE R&UTINE
887   05 00586   3A09     N                                        C,5     TEDGKICK KICK TRAIL EDGE R&UTINE
888   05 00588   EE05     N                                        C,6     SPARE SPARE P&SITI&N
889   05 0058A   5409     N                                        C,7     TEDGIEMP INPUT EMPTY TRAIL EDGE R
890
891   05 0058C   F1       A                                    ENDCASE
892   05 0058D   D1       A                                    P&P      PSW
893                                                            P&P      D
894   05 0058E   14       A                                ENDIF
895   05 0058F   B7       A                                INR      D       INCREMENT CASE TABLE P&INTER
896   05 00590   C26D05   N                                &RA      A       CHECK F&R ADDITI&NAL TRAIL EDGE
897   05 00593   C39E05   N                            UNTIL:   CC,Z,S      L&&P UNTIL N& M&RE TRAIL EDGES
898   05 00596   2134FD   A                        ELSE:
899   05 00599   B6       A                            LXIFBYT  H,ADH11     SET PNTR T& PRIMARY FAULT BYTE
900   05 0059A   77       A                            &RA      M           SAVE INVALID TRAIL EDGES IN FAU
901   05 0059B   CDA309   N                            M&V      M,A
902                                                  CALL     ADH&ABRT     AB&RT ADH
903                                                ENDIF
904   05 0059E   78       A                    ENDIF
905   05 0059F   21BCFC   N                    M&V      A,E
906   05 005A2   A6       A                    LXI      H,LEDGINH           SET PNTR T& LEAD EDGE INHIBIT M
907   05 005A3   CAE505   N                    ANA      M                   MASK &UT INHIBITED SENS&RS
908   05 005A6   5F       A                    IF:      CC,Z,C              LEAD EDGES THIS READ
909   05 005A7   23       A                        M&V      E,A             SAVE VALID LEAD EDGES
910   05 005A8   A6       A                        INX      H               M&V PNTR T& LEAD EDGE BYPASS MA
911   05 005A9   47       A                        ANA      M               MASK &UT INDETERMINENT LEAD EDG
912   05 005AA   23       A                        M&V      B,A             SAVE VALID LEAD EDGES IN B-REG
913   05 005AB   7E       A                        INX      H               M&V PNTR T& LEAD EDGE EXPECTED
914   05 005AC   2F       A                        M&V      A,M             FETCH EXPECTED LEAD EDGES
915   05 005AD   A0       A                        CMA
916   05 005AE   CABC05   N                        ANA      B               C&MPARE ACTUAL WITH EXPECTED LE
917   05 005B1   2134FD   A                        IF:      CC,Z,C
918   05 005B4   B6       A                            LXIFBYT  H,ADH11     SET PNTR T& PRIMARY FAULT BYTE
919   05 005B5   77       A                            &RA      M           SAVE INVALID LEAD EDGES
920   05 005B6   CDA309   N                            M&V      M,A
921   05 005B9   C3E505   N                            CALL     ADH&ABRT    AB&RT ADH
922   05 005BC   B3       A                        ELSE:
923   05 005BD   1600     A                            &RA      E           FETCH LEAD EDGES (IF ANY)
924                                                  M&VI     D,0         SET P&INTER T& ZER&
925   05 005BF   17       A                            REPEAT
926   05 005C0   D2E005   N                                RAL
927   05 005C3   5F       A                                IF:      CC,C,S
928   05 005C4   D5       A                                    M&V      E,A SAVE LEAD EDGE BYTE
929   05 005C5   7A       A                                    PUSH     D
      05 005C6   11DE05   N                                    CASE:    VBYT,D
      05 005C9   FE08     A
      05 005CB   CD0000   N
930   05 005CE   0008     N                                        C,0     LEDGFD&F FEED-&FF LEAD EDGE R&UTI
931   05 005D0   5D07     N                                        C,1     LEDGWAIT WAIT LEAD EDGE R&UTINE
932   05 005D2   AF07     N                                        C,2     LEDGRET RETURN LEAD EDGE R&UTINE
```

```
933   05 005D4   EE05    N                                  C,3        SPARE SPARE POSITION
934   05 00506   B206    N                                  C,4        LEDGEXIT EXIT LEAD EDGE ROUTINE
935   05 005D8   9207    N                                  C,5        LEDGKICK KICK LEAD EDGE ROUTINE
936   05 005DA   EE05    N                                  C,6        SPARE SPARE POSITION
937   05 005DC   CB07    N                                  C,7        LEDGIEMP INPUT EMPTY LEAD EDGE RO
938
939   05 005DE   D1      A                              ENDCASE
940   05 005DF   7B      A                              POP       D
941                                                     MOV       A,E   RESTORE LEAD EDGE BYTE
942   05 005E0   14      A                          ENDIF
943   05 005E1   B7      A                          INR       D
944   05 005E2   C2BF05  N                          ORA       A
945                                           UNTIL!    CC,Z,S          LOOP UNTIL NO MORE LEAD EDGES
946                                       ENDIF
947                                   ENDIF
948                               ENDIF
949   05 005E5   C3ED05  N      ELSE!                                  ADH NOT SELECTED
      05 005E8   3E80    A          SFLG      ADHONMOV                INDICATE NO ADH PROBLEMS
      05 005EA   328BF7  A
950                               ENDIF
951   05 005ED   C9      A      RET


953   05 005EE   C9      A  SPARE  RET                                DUMMY ROUTINE FOR CASE TABLES
```

TABLE XXIII

```
1082                          *      ************************************
1083                          *      *                                  *
1084                          *      *  LEDGEXIT:ROUTINE CALLED WHEN LEAD  *
1085                          *      *    EDGE IS DETECTED AT EXIT SENSOR  *
1086                          *      *    IF PAPER IS MOVING FORWARD THE   *
1087                          *      *    WAIT SENSOR IS ENABLED,THE FEED  *
1088                          *      *    COUNTER IS PULSED,AND THE MISFEED *
1089                          *      *    AND TO LONG OVER EXIT TIMING SEQ *
1090                          *      *    ARE STARTED. THE SLOW WAIT TO EXIT*
1091                          *      *    TIMING SEQUENCE IS STOPPED.      *
1092                          *      *    IF MOVING REVERSE,ORIGINALS FLASH *
1093                          *      *    ED IS UPDATED,SLOW-OFF FAULT SEQ *
1094                          *      *    IS STOPPED,SLOW EXIT TO RETURN SEQ*
1095                          *      *    IS STARTED AND THE PATTERS ARE   *
1096                          *      *    TURNED ON                        *
1097                          *      *                                     *
1098                          *      ************************************

1100  05 006B2   3A04F4  A  LEDGEXIT IF!      FLG,ADHOFORW,T            DOCUMENT MOVING FORWARD
      05 006B5   07      A
      05 006B6   D22007  N
1101  05 006B9   3A81F4  A              IF!       FLG,ADHO2901,F       NO DIAGNOSTIC ABORT PENDING
      05 006BC   07      A
      05 006BD   DA1607  N
1102  05 006C0   21EEFF  A                  SOBIT     ADH*WT           ENABLE WAIT SENSOR
      05 006C3   3E02    A
      05 006C5   F3      A
      05 006C6   B6      A
      05 006C7   77      A
      05 006C8   FB      A
1103  05 006C9   21E8FF  A                  SOBIT     ADH*FDCT         START FEED COUNT PULSE
      05 006CC   3E04    A
      05 006CE   F3      A
      05 006CF   B6      A
      05 006D0   77      A
      05 006D1   FB      A
1104  05 006D2   2A60FB  N                  LHLD      TLTOAOFD
1105  05 006D5   CD0000  N                  CALL      BCDOINC          INCREMENT SOFTWARE FEED COUNTER
1106  05 006D8   2260FB  N                  SHLD      TLTOAOFD
1107  05 006DB   CD0000  N                  CTIMR     ADHOO            STOP SLOW WAIT TO EXIT
      05 006DE   00      A
1108  05 006DF   CD0000  N                  CTIMR     ADHO6            STOP SLOW OUT FAULT TIMER
      05 006E2   06      A
1109  05 006E3   CD0000  N                  STIMR     ADHO1,350,EXITOFLT  START TO LONG OVER EXIT SEQ OF
      05 006E6   01      A
      05 006E7   23      A
      05 006E8   E109    N
1110  05 006EA   CD0000  N                  STIMR     ADHO2,800,MISSFEED  START MISFEED SEQUENCE OF 800MS
      05 006ED   02      A
      05 006EE   50      A
      05 006EF   2D0A    N
1111  05 006F1   CD0000  N                  STIMR     ADHO3,200,MULTFEED  ALLOW 200MS TO CLEAR WAIT SENSO
      05 006F4   03      A
      05 006F5   14      A
      05 006F6   850A    N
1112  05 006F8   3A50FD  N                  DIAGOCT   ADHFL30C         SAVE LEDG EXIT(FORWARD PATH) TI
      05 006FB   32C5FC  N
1113  05 006FE   21BAFC  N                  LXI       H,TEDGMASK       SET PNTR TO TRAIL EDGE MASK
1114  05 00701   3EFB    A                  MVI       A,ADHOL3FM
1115  05 00703   A6      A                  ANA       M                BYPASS TRAIL EDGE AT KICK
1116  05 00704   77      A                  MOV       M,A
1117  05 00705   23      A                  INX       H                MOV PNTR TO EXPECTED TRAIL EDGE
1118  05 00706   3640    A                  MVI       M,ADHOL3F        EXPECTED TRAIL EDGE AT WAIT
1119  05 00708   2189FC  N                  LXI       H,TEDGINH
1120  05 00709   3E44    A                  MVI       A,WAIT&21KICKO1
1121  05 0070D   B6      A                  ORA       M                ENABLE TRAIL EDGES AT WAIT & KI
1122  05 0070E   77      A                  MOV       M,A              (CANCEL HOLE BYPASS)
1123  05 0070F   AF      A                  XRA       A
1124  05 00710   328EFC  N                  STA       LEDGEXPT         CANCEL EXPECTED LEAD EDGE AT EX
1125  05 00713   C31D07  N              ELSE!                          VALID HALT FLAG SET
1126  05 00716   AF      A                  CFLG      ADHO2901         CLEAN UP HALT FLAG
      05 00717   3281F4  A
1127  05 0071A   CDA309  N                  CALL      ADHOABRT         STOP ORIGINAL
```

```
1128                                        ENDIF
1129                                  *          DOCUEMENT MOVING ON REVERSE PATH
1130   05 0071D   C35C07   N          ORIF:      FLG,ADH02985,F                NO ABORT PENDING FOR REVERSE
       05 00720   3A85F4   A
       05 00723   07       A
       05 00724   DA5507   N
1131   05 00727   21F7FF   A              SOBIT     ADH*PATT                  START PATTERS
       05 0072A   3E08     A
       05 0072C   F3       A
       05 0072D   B6       A
       05 0072E   77       A
       05 0072F   FB       A
1132   05 00730   CD0000   N              CTIMR     ADH04                     STOP SLOW-OFF SEQUENCE
       05 00733   04       A
1133   05 00734   CD0000   N              STIMR     ADH05,300,EXTORET         START EXIT TO RETURN SEQ OF 300
       05 00737   05       A
       05 00738   1E       A
       05 00739   B00A     N
1134   05 0073B   CD0000   N              STIMR     ADH01,350,REXTOFLT        ALLOW 350MS TO CLEAR EXIT SENSO
       05 0073E   01       A
       05 0073F   23       A
       05 00740   DFCA     N
1135   05 00742   3A50FD   N              DIAGOCT   ADHRL3DC                  SAVE LEDG EXIT(REVERSE PATH) TI
       05 00745   32C0FC   N
1136   05 00748   3E20     A              MVI       A,ADHOL3R
1137   05 0074A   32BEFC   N              STA       LEDGEXPT                  EXPECT LEAD EDGE AT RETURN
1138   05 0074D   3E08     A              MVI       A,EXITO3
1139   05 0074F   32BBFC   N              STA       TEDGEXPT                  EXPECT TRAIL EDGE AT EXIT
1140   05 00752   C35C07   N          ELSE:                                   STOP DOCUEMENT ON REVERSE PATH
1141   05 00755   AF       A              CFLG      ADH02985                  CLEAN UP HALT FLAG
       05 00756   32B5F4   A
1142   05 00759   CDA309   N              CALL      ADHOABRT                  HALT ADH
1143                                    ENDIF
1144   05 0075C   C9       A            RET
```

Figure 40A:
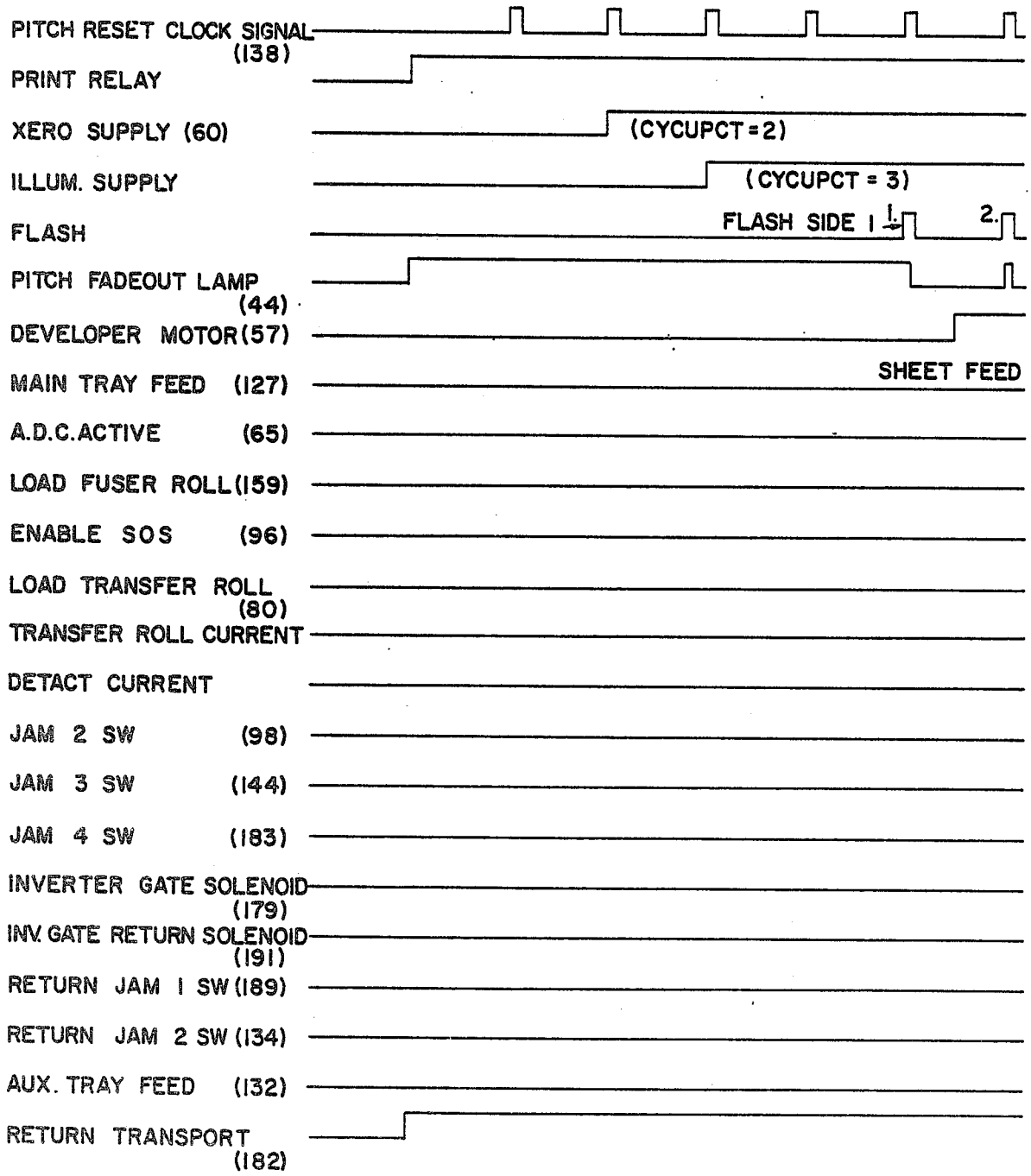
FIGS. 40*a*, 40*b*, 40*c* comprise a timing chart of the principal operating components of the host machine in an exemplary copy run.
Figure 40B:
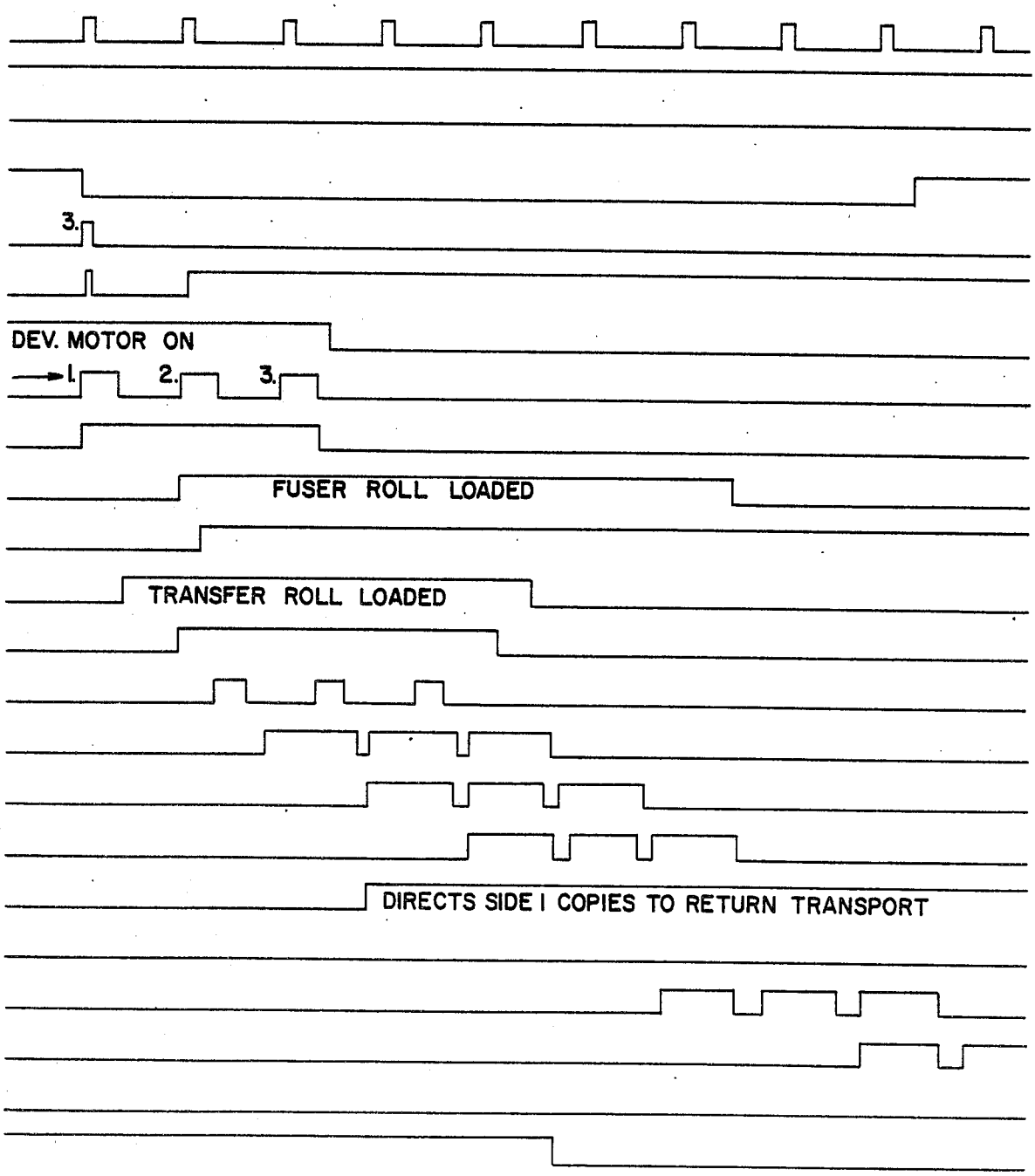
Figure 40C:
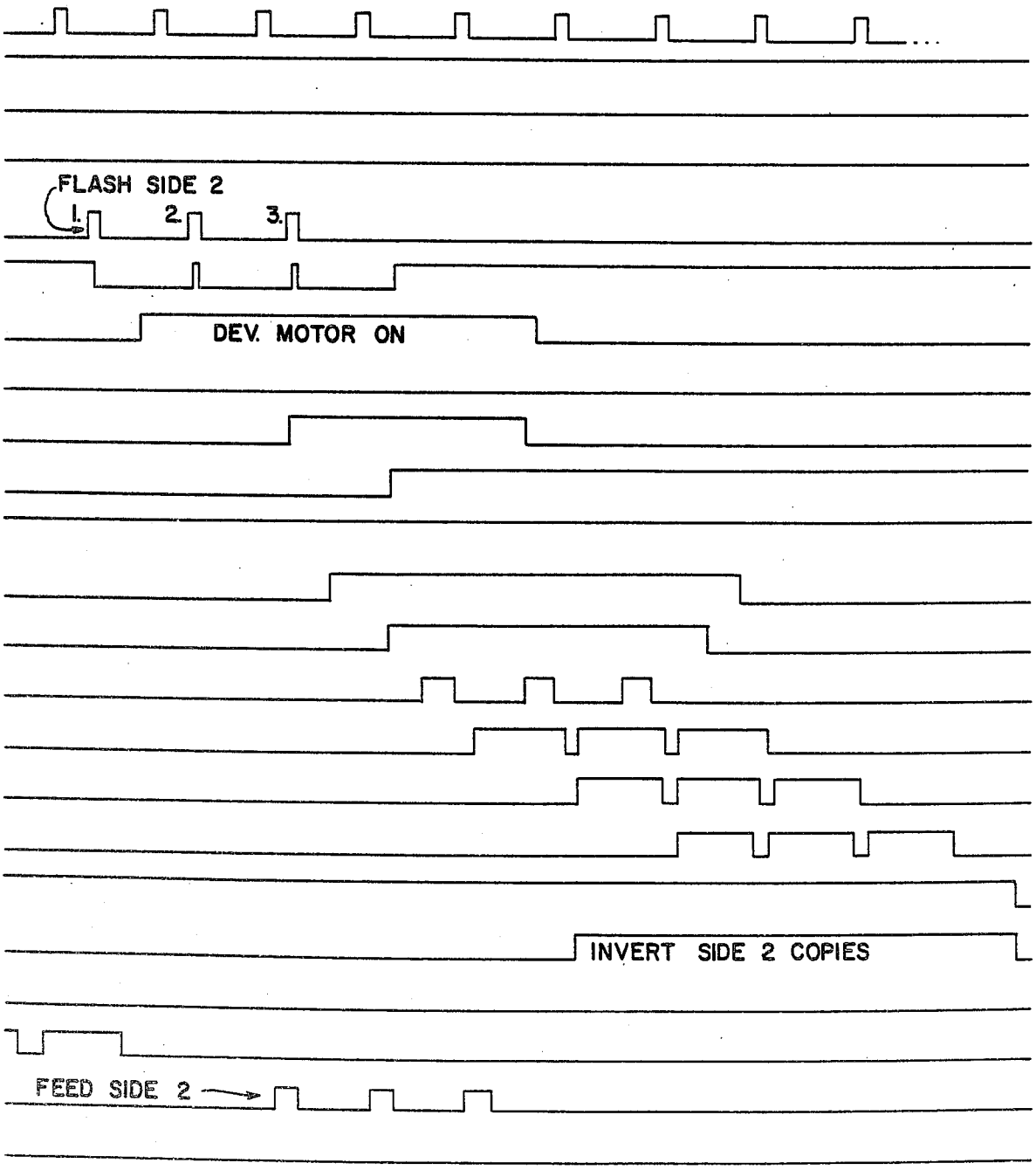

Referring particularly to the timing chart shown in FIG. 40, an exemplary copy run wherein three copies of each of two simplex or one-sided originals in duplex mode is made. Referring to FIG. 32, the appropriate button of copy selector 808 is set for the number of copies desired, i.e. 3 and document handler button 822, sorter select button 825 and two sided (duplex) button 811 depressed. The originals, in this case, two simplex or one-sided originals are loaded into tray 233 of document handler 16 (FIG. 14) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

Figure 41:
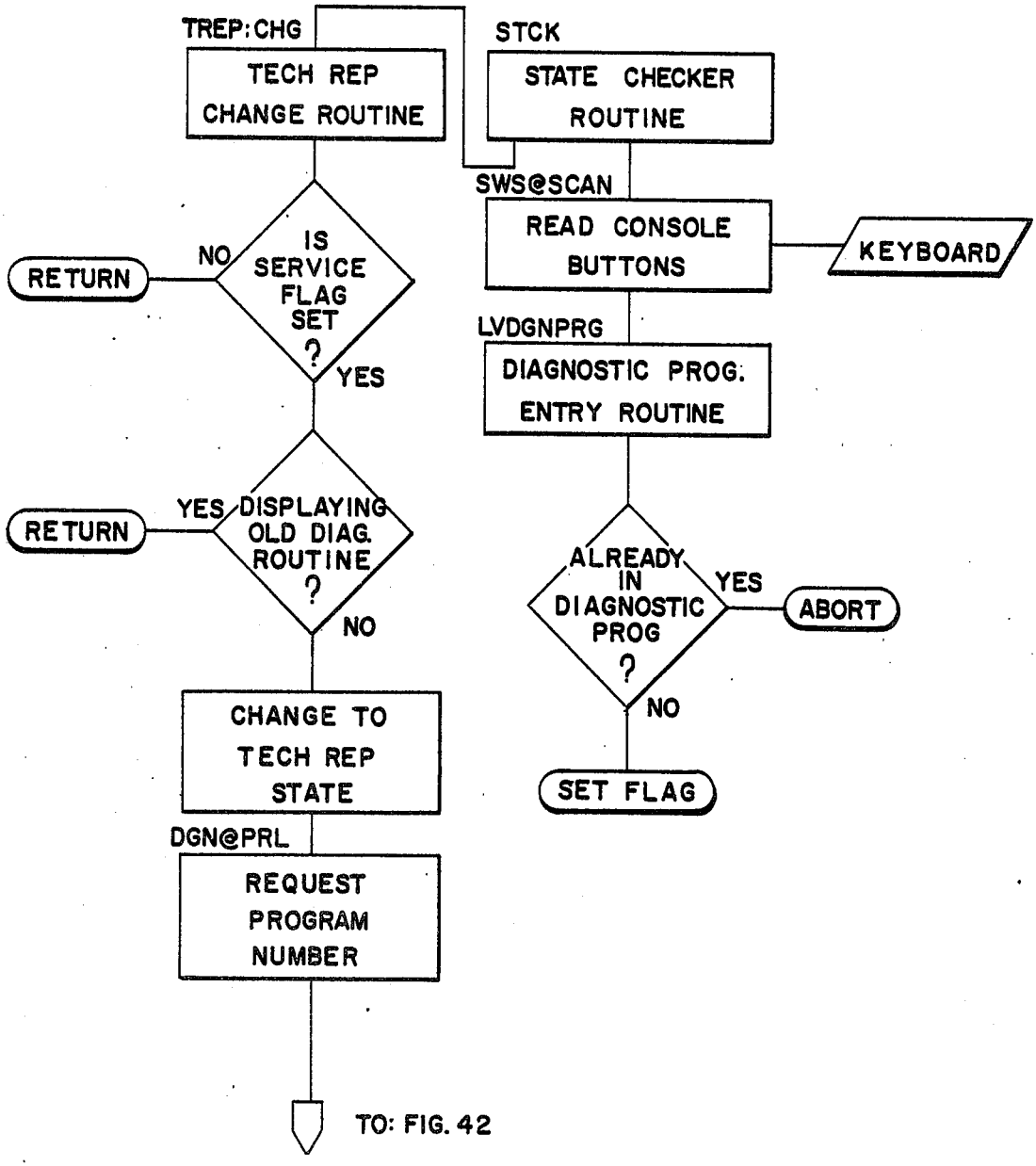
FIGS. 41–43 are flow charts which illustrate the sequence of events for entering the machine into a diagnostic program, as well as determining whether the user has access to the particular program requested.

During the run, the first original is advanced onto platen 35 by document handler 16 where, as seen in FIG. 41, three exposures (1ST FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 (referred to as an inverter gate in the tables) to return transport 182 and carried to auxiliary tray 102. The image bearing sheets entering tray 102 are aligned by edge pattern 187 in preparation for refeeding thereof.

Following delivery of the last copy sheet to auxiliary tray 102, the document handler 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship from auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into an output receptacle such as sorter 14 where, in this example, the sheets are placed in successive ones of the first three trays 212 of either the upper or lower arrays 210, 211 respectively depending on the disposition of deflector 220.

DIAGNOSTICS

In addition to the copy control program (background and foreground routines described above), the reproduction machine of the present invention includes several diagnostic programs stored in ROM memory 545 to aid the user or service personnel to maintain the reliability of the machine. Some of the programs are more complex than others, with the most complex programs bearing significant meaning only to trained service personnel. Accordingly, the machine is programmed or conditioned to prohibit the casual user from accessing the most complex routines. However, some of the programs of lesser complexity can be useful to the trained user depending upon the extent of her familiarity with the machine. Accordingly, the machine of the present invention has the capability of permitting the service personnel to progressively disclose more complex diagnostic programs to the user as her training correspondingly increases, while at the same time reserving the most complex programs for use only by the service personnel.

Figure 42:
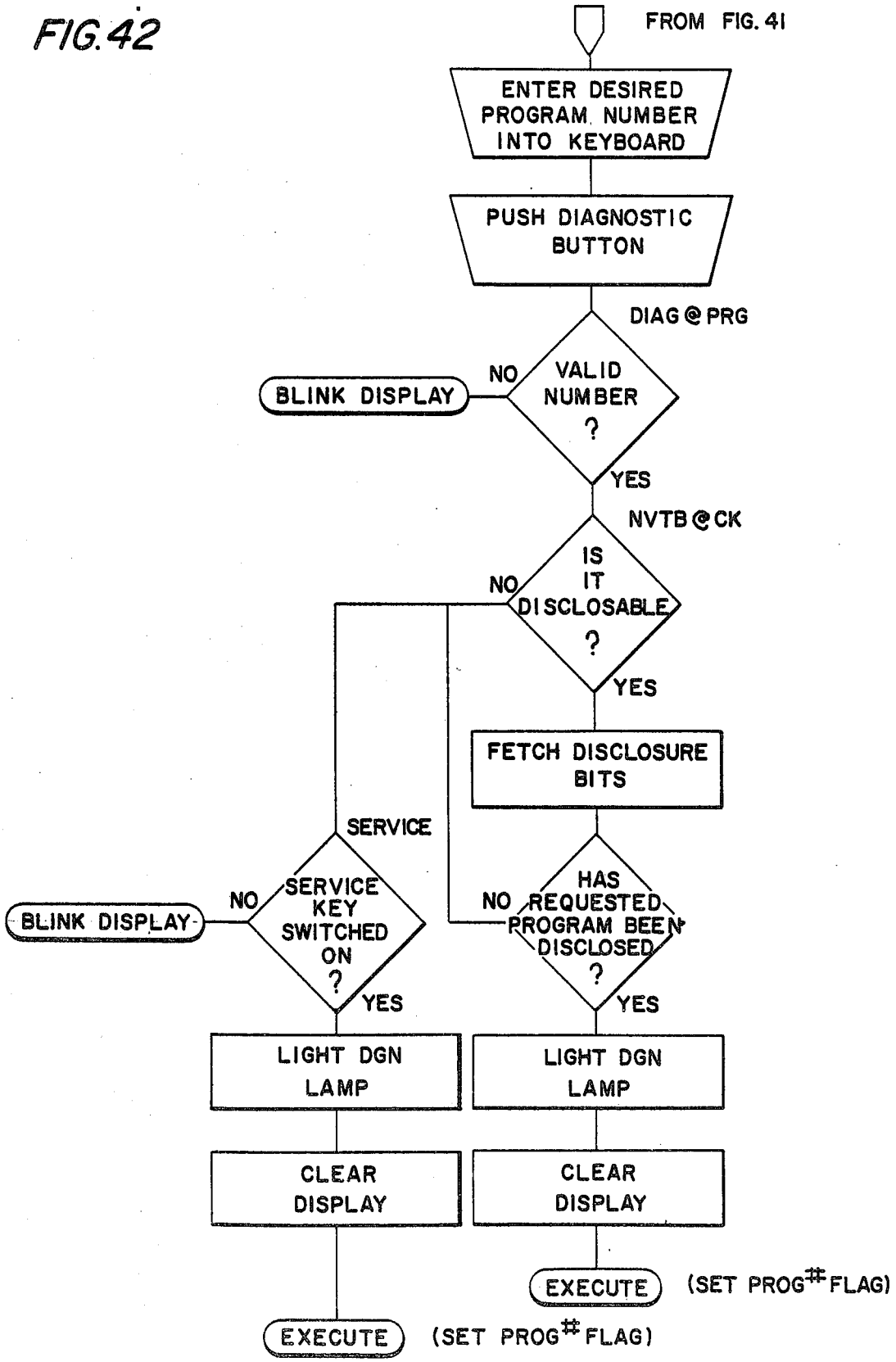

Referring now to FIGS. 41 and 42, along with the illustration of the operator console as shown in FIG. 32, the operating routine for selecting a desired diagnostic program will be explained. It will be remembered that the machine is normally under the control of the background or State Checker (STCK) routine shown in Table I. This routine periodically calls a Switch Scan routine (SWS SCAN) reproduced in Table XI. To enter a diagnostic program, the operator presses diagnostic console button 801 which is read by the Switch Scan routine thereby causing it to call a Diagnostic Program Entry routine (LVDGNPRG of Table XII). This routine checks to see if there is an active diagnostic program in progress. If so, it causes the operating program to cease. Normally, there will not be another diagnostic program running. Consequently, a service flag (SER@ ACT) will be set indicating that the user desires to enter a diagnostic program.

The State Checker routine is periodically calling the Tech Rep Change (TREP:CHG) subroutine which monitors the computer memory to determine whether the service flag has been set. If it has been set and there is no diagnostic routine information being displayed, the State Checker routine will change to the Tech Rep state (also shown in Table I). This routine, in turn, will periodically call the Diagnostic Prologue (DGN PRL) routine also shown in Table XII which puts a "dC" in the console display 230 thereby requesting that the operator enter the two digit code corresponding to the diagnostic program desired. After doing so, the diagnostics button 801 is then again pushed which, in turn, is picked up by the diagnostic program routine (DIAG PRG of Table XIII). This routine determines whether the numbers entered to the display 230 correspond to valid diagnostic program numbers. For example, if numbers 10 - 36 are valid diagnostic programs and a number 52 was pushed, it would not be a valid number, with this program indicating such an error by blinking the display 230.

If it is a valid number, a Nonvolatile Memory Table Check routine (NVT@CK) shown in Table XIV is called. This routine first checks to determine whether the requested program number is disclosable, i.e., whether this particular routine can be accessed by an operator other than the service personnel. For example, assume that program numbers 10–15 can be, but need not be, disclosed to the user, with the remaining programs being reserved for the service personnel. Then, if the requested program number is within the 10–15 range this routine will check particular addresses in the nonvolatile memory 610 to determine whether the service personnel has stored this number in the memory, i.e. disclosed the program to the user. If it has been disclosed, the display 230 is cleared and the light on the console above the diagnostic button 801 is turned on indicating that the machine is now under the control of the diagnostic program desired.

On the other hand, if it was determined that the requested program was not disclosable to the user, the controller makes another check to determine whether the service key 828 has been switched on or off via the SWITCH SCAN routine and, periodically called subroutines SERVICE and KEY@OFF of Table XII. Normally, only the service personnel possesses this key. When the key is turned on, all of the diagnostic program routines are accessible. However, if the requested program number has not been disclosed to the user nor has the serice key been switched on, the display 230 will be caused to blink thereby indicating the error. Conversely, if the program is accessible, the program number flag is set signalling the controller to execute the requested program.

Figure 43A:
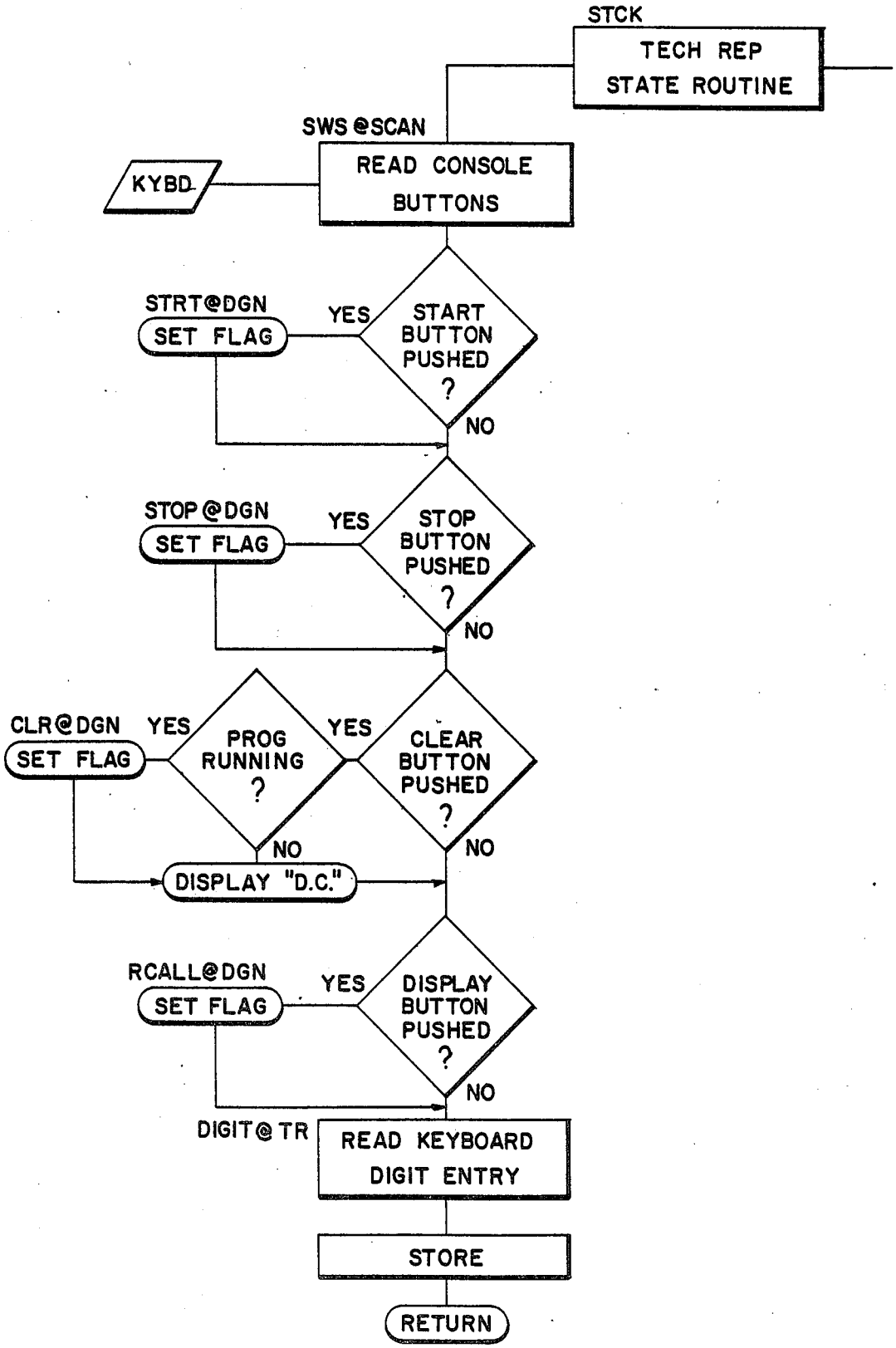
Figure 43B:
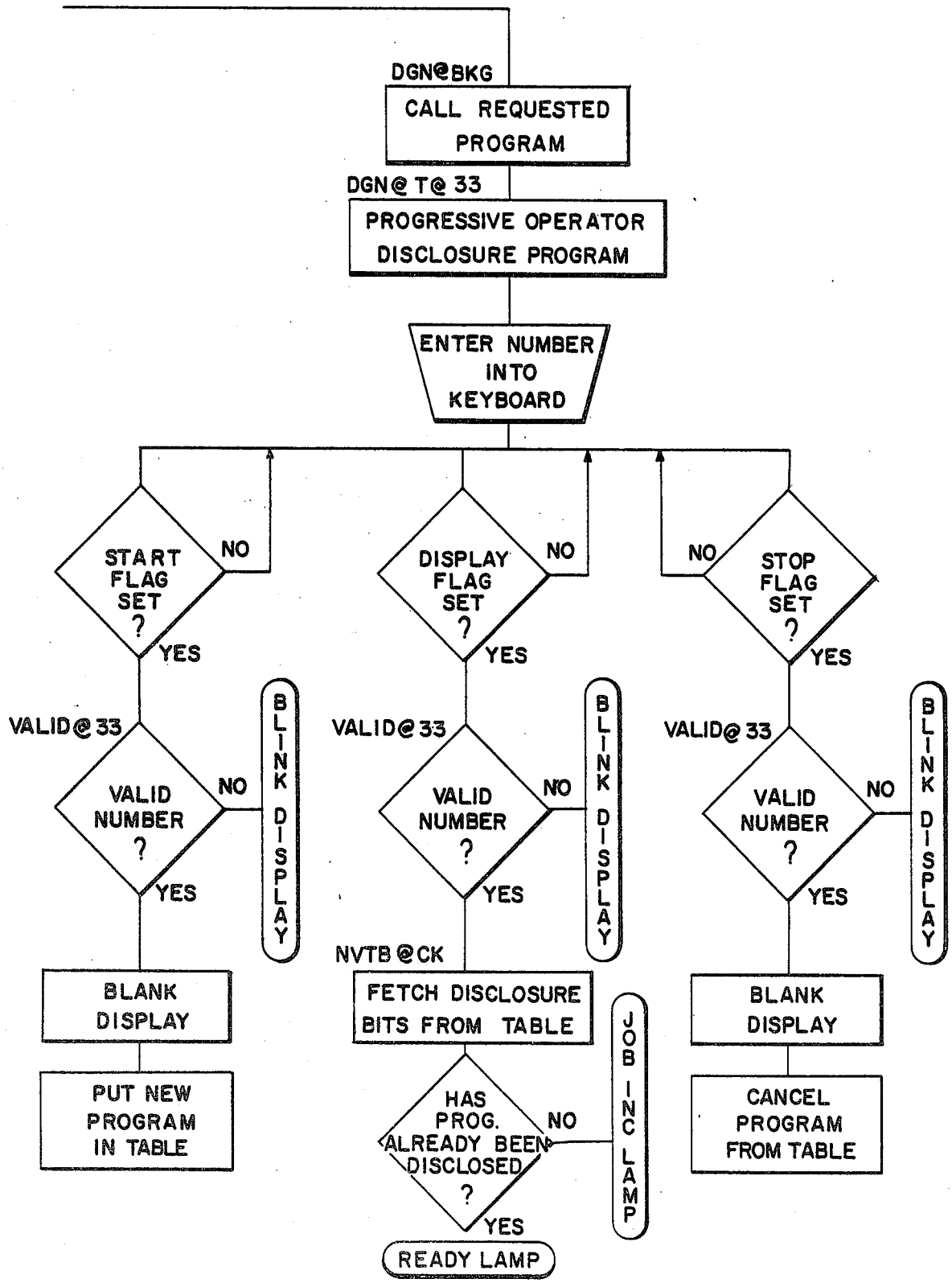

Referring to FIG. 43, in order to disclose more complex programs to the user as he becomes more familiar with the machine, the service personnel utilizes the Progressive Operator Disclosure Program (DGN@T@33) shown in Table XV. This program is not disclosable to the user and can be accessed only by the service personnel through the use of his service key. With the switch 828 turned on, the program is entered in the manner set forth above. To determine whether a particular program has already been disclosed, he enters the program number into keyboard 808 and pushes the Display button 809. The Switch Scan routine (SW@SCAN) reads the various console buttons to determine whether they have been pushed, and, in this case, sets a flag, RCALL@DGN, indicating that the Display button 809 has been pushed. Similarly, another routine (DIGIT@TR of Table XVI) reads the numbers entered in the keyboard 808 and stores them in a register or memory location for further use.

The Disclosure program (DGN@T@33) causes the controller to read the Display flag and calls a subroutine (VALID@33) which, in turn, checks the entered number to determine whether it is within a predetermined range. If it is not a valid number, the display 230 will blink indicating that the number does not correspond to a designated program number. If this test is passed, the controller 500 fetches the disclosure bits in a table in the non-volatile memory 610, via routine NTB@CK, such bits having been previously placed in dedicated locations therein by the service personnel.

As described above, this routine interrogates the memory to determine whether a bit or coded signal for the requested routine has been stored in the memory thereby indicating that it has already been disclosed. If it has been disclosed, one of the console lamps 830 (READY) will be turned on. If it has not been disclosed, another lamp (JOB INCOMPLETE) is lit. Accordingly, the service personnel can determine whether a particular program has already been disclosed to the user.

If he wishes to disclose a new program, he merely enters the number into keyboard 808 and presses Start button 805. If it is a valid number, it will be stored in memory 610 so that the user can now access the disclosed program. Conversely, if he wishes to cancel a program already disclosed, the stop button 806 is pushed instead. This removes the entered program number from memory 610 so that only the service personnel can access the diagnostic program. By storing the disclosed program access code in the non-volatile memory 610, it is insured that the code will not be lost in the event of a power failure, etc.

Figure 44:
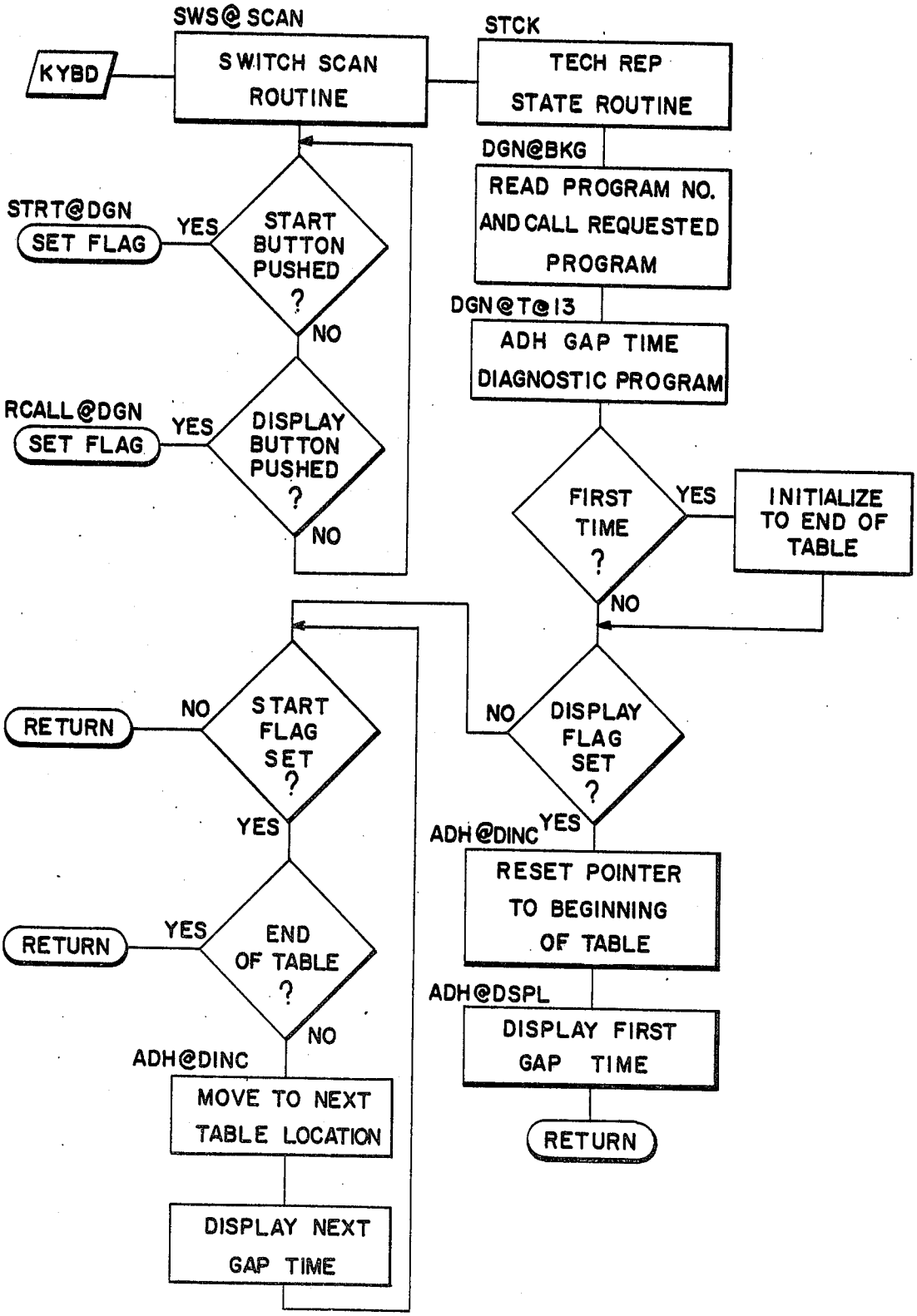
FIG. 44 is a flow chart which illustrates the operation of a diagnostic program for displaying document travel times in the document handler.

Referring now to FIGS. 44 and 14, a diagnostic program for the automatic document handler (ADH) 16 will be described. Document handler 16 includes four paper path sensors hereinafter referred to as the kick sensor 246, the wait sensor 280, the exit sensor 281, and the return sensor 282. As the original documents 2 cycle through the ADH as previously described, each sensor senses the leading and trailing edge of the document. For example, if the photocell sensor goes from light to dark, then it is sensing a leading edge. However, if the sensor goes from dark to light it is sensing a trailing edge. Each of the sensors are coupled to a free running global counter or timer, referred to as a diagnostic counter, DIAG@CT, in the tables. The diagnostic counter can be any of a variety of known counting devices which provide electrical representations of time. In the preferred embodiment, it is a specified register which is periodically incremented by pulses from the real time clock signal 670.

When each sensor senses a leading or trailing edge of the docment 2, the controller reads the time of the diagnostic counter and stores it in a specified address in the RAM memory 546. These times are accessed by the ADH Gap Time Diagnostic program (DGN@T@13) shown in Table XVII. This routine reads the addresses of the stored times from the Gap Time Table shown in TABLE XVIII. The Gap Time Table defines a plurality of stations or gap times, i.e. the time it takes for a document to travel between various preselected sensors. For example, one gap time may be the time it takes the leading edge of the document to travel from the exit sensor 281 to the return sensor 282. In such case, when the exit sensor 281 senses a leading edge of a document, it will read the diagnostic counter and store that time in the memory (see, e.g. Lead Edge Exit routine (LEDGEXIT) of Table XXIII). Similarly, when the return sensor 282 senses the document, it also will store that time in the memory. Consequently, to read that gap time, a pointer, e.g. an index register, is set to the particular address of the Gap Time Table which, in turn, contains the addresses in RAM memory 546 of these two times. One time is then subtracted from the other to determine the particular gap time, i.e. the time of document travel between these sensors. It should be realized that a particular "gaps" defined in the Gap Time Table can be changed if desired.

Referring now especially to FIG. 44, the ADH Gap Time Diagnostic (DGN@T@13) program is entered in the usual manner as previously described to determine if this program has been disclosed to the user. If so, the program checks to determine whether this is the first time that this particular program has been requested. If it is the first time, the pointer is initialized by setting it to the end of the Gap Time Table. The routine then checks to see if the display flag (RCALL@DGN) has been set by the operator pushing the display select button 809 on console 800. If this button has been pushed, the switch scan routine will set a flag (RCALL@DGN) which is tested by the Diagnostic routine. If it has been set, the pointer will be decremented by the ADH Display Decrementing routine (ADH@DINC) shown in Table XIX. This will cause display 230 to blank for approximately one-half second in order to permit the viewer to distinguish between the gap time about to be displayed and an old gap time that may be currently displayed. Then the gap time identified by the pointer (or identifier as sometimes referred to in the tables) is calculated and displayed in the display 230 via the ADH display routine (ADH@DSPL) which is also shown in Table XIX. Accordingly, the first gap time of the previous document run will appear in the display. The operator or service personnel can compare this gap time with standard times and make necessary adjustments to the machine, if required, thereby insuring proper synchronism with the machine processor.

In order to display the next gap time the operator pushes start button 805. This sets the start flag (STRT@DGN) which is picked up by the Diagnostic program. It will check if the pointer is set at the end of the table. If not, the pointer is moved to the next table location and the next gap time is calculated and displayed in the display 230 as previously described. In order to display the next gap time the start button 805 is again pushed and the next gap time is analogously displayed. This operation occurs until the pointer reaches the end of the table.

Figure 45A:
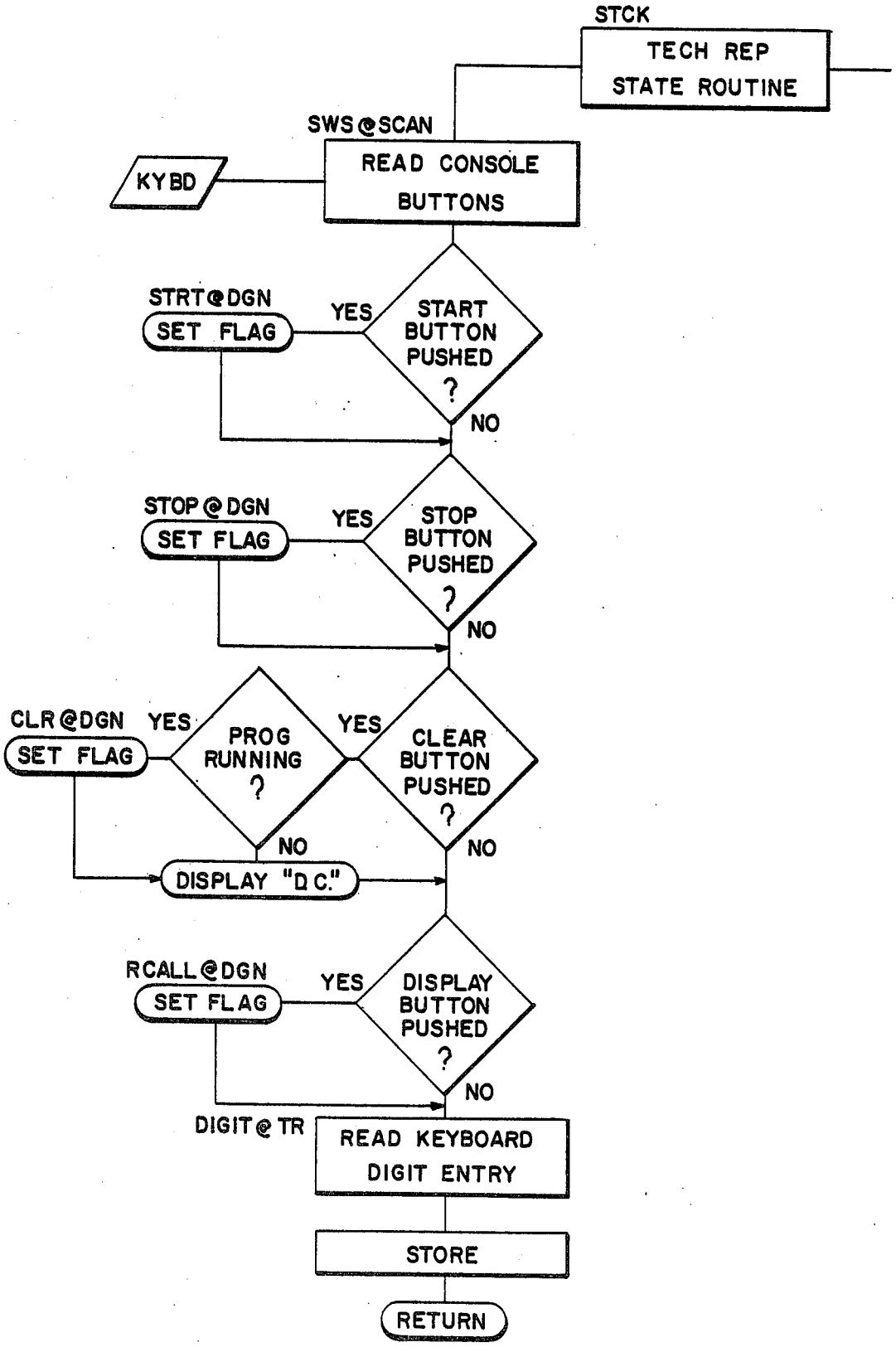
FIG. 45 is a flow chart which illustrates the operation of a diagnostic program for continuously cycling documents through the document handler and, if desired, displaying successive document travel times between various stations therein.
Figure 45B:
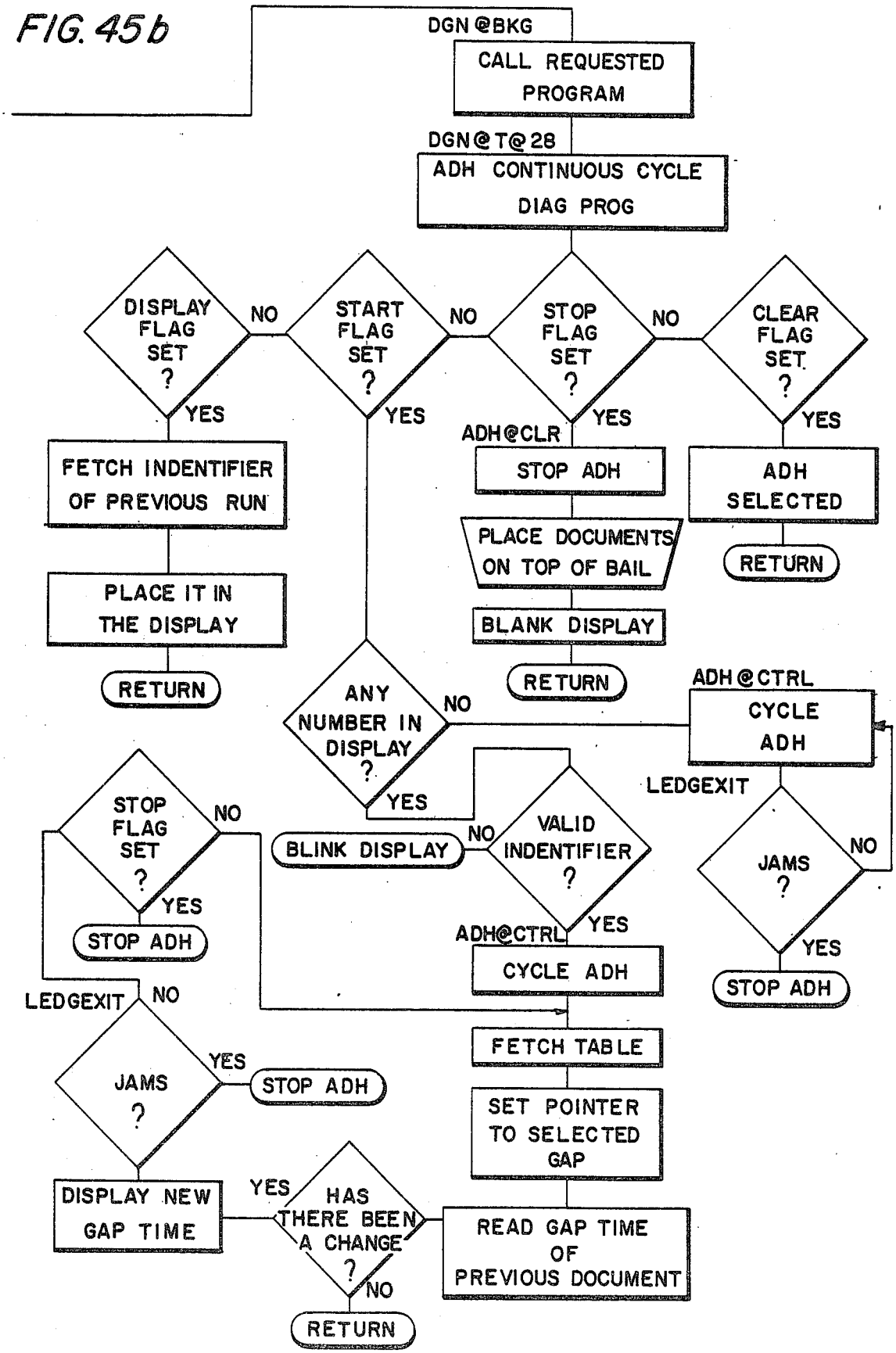

The previous routine provides the ability to check the gap times of an earlier run during normal ADH operation. However, in some instances it is desirable to activate or cycle the ADH without making copies in order to check for potential problem areas. The ADH Continuous Cycle Diagnostic program (DVN T 28 as shown in Table XX) provides this ability. It should be noted that due to the complexity of this routine,it is not disclosable to the casual operator and can be accessed only by the service personnel by switching the service key 828 on. As illustrated in FIG. 45, this routine interacts not only with the start button 805 and display select button 809 as in the previous routine, but also with the clear button 817, stop button 806 and keyboard 808. Pushing each of these buttons will set a specific flag as previously discussed.

By pushing the stop button 805, the ADH will come to a stop and display 230 will blank. At this time the operator should place the test documents on top of separator or bail bar 235 as shown in FIG. 14. After this is done, the clear button 817 is pushed thereby selecting and preparing the document handler 16 for continuously cycling original documents through the ADH paper paths.

The operator then decides whether he wishes to display gap times as the documents cycle through the ADH. If so, he enters the desired gap time code number into the keyboard 808. If he wishes to display the same gap time as previously requested, for example, as requested in the ADH Gap Time program (DGN@T@13) previously described, then the display button 809 is pushed which automatically places that gap time number into the display 230. The start button 805 is then pushed. If there is no number in the display the ADH begins to continuously cycle the documents 2 through the paper path under the control of the ADH Control routine (ADH@CTRL) shown in Table XXII. If any jam occurs, as sensed by the sensors 246, 280, 281, and 282 (see, e.g. the Lead Edge Exit routine of Table XXIII) the ADH will be automatically stopped thereby by permitting the user to identify the potential problem areas.

If a number has been entered into the display indicating that it is desired to display selected gap times, the program checks to see if the entered digits correspond to a valid gap time identifier. It will be remembered that there are several gap times in the Gap Time Table which can be displayed. If it is valid identifier, the ADH begins to cycle. The gap time table is then fetched and the pointer is set to the selected gap time desired to be displayed. It will be remembered that the table will contain the times of the previous document run, as these times are being continually updated every time a document travels through the ADH. Therefore, the program will read the gap time of the previous document and compare it with the new gap time of each document as it cycles through the ADH. It will then compare the two gap times to determine if there has been a change. If so, it will display the new gap time. This sequence of events continues until the stop button 806 is pushed. Hence, this routine provides the ability to continually display the gap times for each document as it travels through the document handler 16. By visually monitoring the display 230 the service personnel can readily determine whether there is an undesirable fluctuation in the gap times for the various documents. To display and monitor a different gap time, a new number is entered into keyboard 808 and the same sequence as described above is followed.

It should be noted that while the above programs are utilized to access stored times as documents 2 travel through the document handler 16, they can be also utilized for accessing times of copy sheets 3 as they travel along the paper path from paper tray 100 to sorter 14 or output tray 195. In such case, the sensors disposed along this paper path would operate in the same manner as the sensors in document handler 16.

Figure 46A:
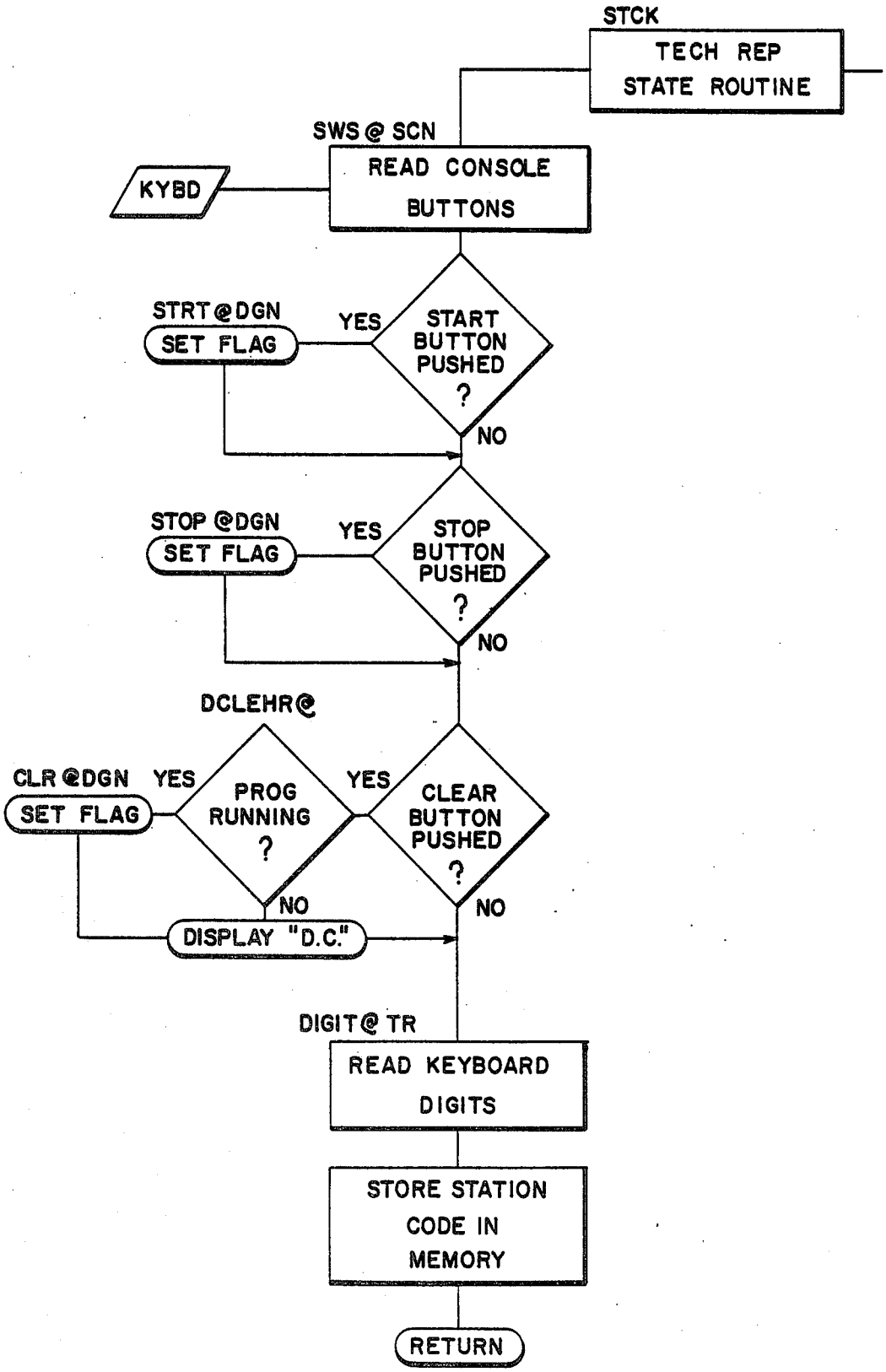
FIG. 46 is a flow chart which illustrates the operation of a diagnostic program which automatically moves documents to preselected stations in the document handler to check for proper alignment.
Figure 46B:
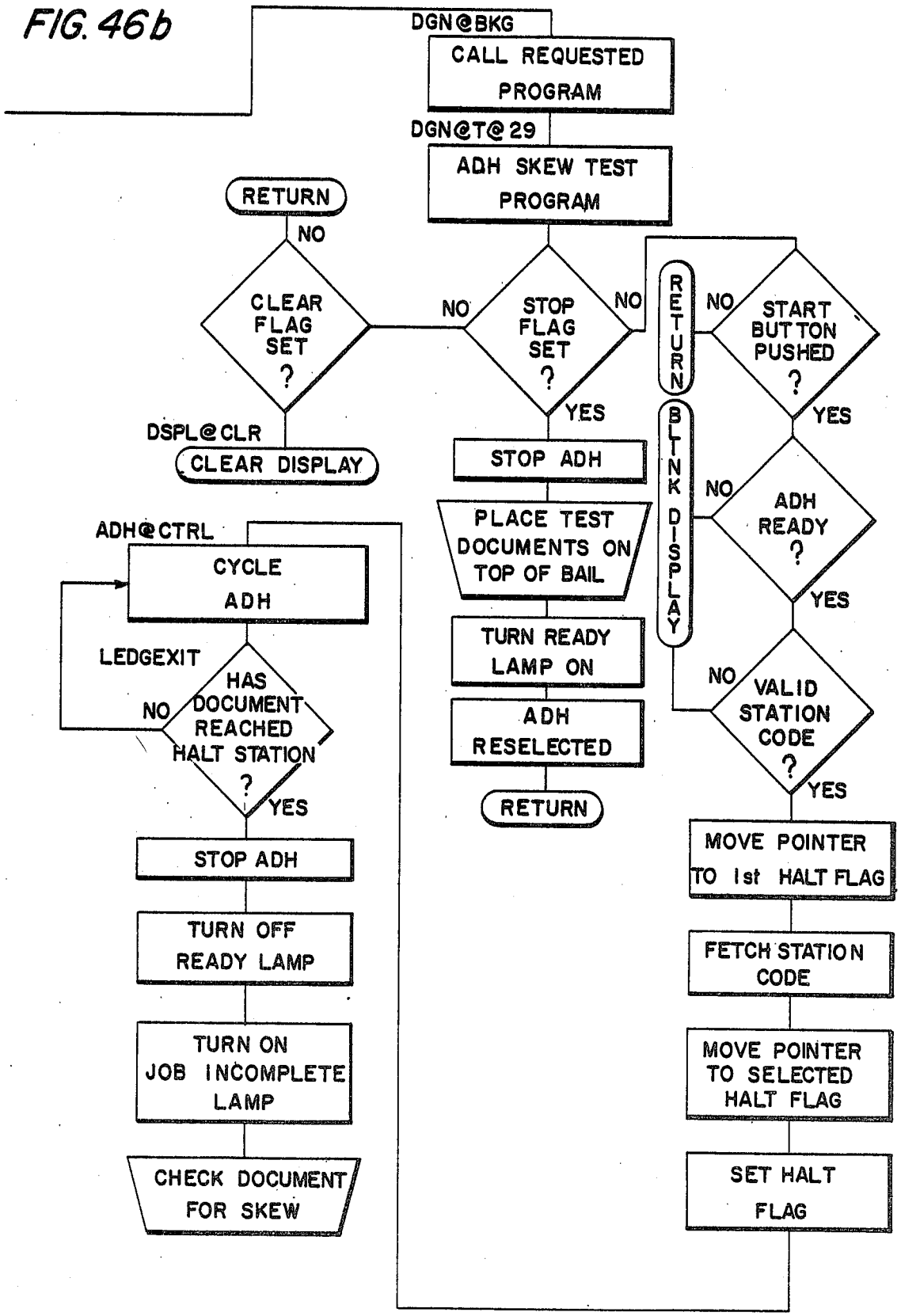

Document misalignment is often a potential source of problems in the document handler 16, often leading to a jam condition. The ADH skew Test program (DGN@T@29) as shown in Table XXI is utilized to check for proper document alignment. Again this routine is entered in the manner as previously described. Referring to FIG. 46, by pushing the stop button 806, document handler 16 will come to a halt permitting the operator to clear the documents from the ADH 16 and place the test documents on top of bail bar 235. When the appropriate covers (not shown) are closed, an appropriate console light 830 will be activated to indicate that the ADH has been reselected and is ready for further operation.

The operator then enters a one digit station code into the keyboard 808. The station code corresponds to selected stations in document handler 16. For example, station code number 1 corresponds to the station in the document handler with the leading edge of the document 2 underneath exit sensor 281 on its forward path towards platen 35. Other station codes for other stations are defined in a similar manner. In the preferred embodiment there are 5 valid station codes. As previously described, the digit read routine (DIGIT@TR) will read the enter digit and store it in a specified memory location. When the start button 805 is pushed, the controller will read that memory location and determine whether that is a valid station code, i.e. in this embodiment whether the digit entered is between the numbers 1 and 5. If so, the controller checks to make sure that there are no jams pending in the document handler 16 and that it is ready to be cycled again. If neither of the above tests are met, the display 230 is blinked to indicate the error. If the tests are met, a software pointer such as described previously, is moved to the address of the first of 5 halt flags which are stored in RAM memory 546. The halt flags correspond to sensors 246, 280, 281 and 282. The controller combines the address of the first halt flag with the station code entered to move the pointer to the halt flag corresponding to the selected station. The correct halt flag is then set.

After the appropriate halt flag has been set, the document handler 16 is then cycled, moving the test documents 2 from paper tray 233 throughout the paper path cycle under the control of the ADH control routine (ADH@CTRL) of Table XXII. When the arrival of the document 2 is detected by sensors 246, 280, 281, 282, the controller checks to see if its corresponding halt flag is set. If so, the ADH is stopped. For example, when a document passes underneath sensor 281 on its forward path to platen 35, the Lead Edge Exit routine (TABLE XXIII) checks to see if its corresponding halt flag (ADH@29@1) is set. If so, the ADH is stopped.

After the document handler 16 has been stopped with the document 2 at the selected station, appropriate indicator lamps 830 on the console 800 are turned on to indicate that the operator may now check for document alignment. By entering new codes into the keyboard 808 the ADH can be recycled to bring the document to another station for inspection. Accordingly, this routine provides the service personnel with the ability to visually check the documents for skew at various locations throughout the document handler 16 thereby insuring proper operation.

Therefore, while this invention has been described in connection with particular examples thereof, no limitation is intended thereby except as defined in the appended claims.

What is claimed is:

1. In a reproduction machine for making copies from original documents, said machine including at least one paper path through which sheets of paper are transported to various locations in the machine, wherein the improvement comprises:

a first and a second sensor disposed along said paper path for detecting the presence of the paper sheets as they travel through the paper path;

a counter for providing electrical representations of time;

a memory for storing the electrical representations of time generated by said counter;

means for continually updating the memory to store the electrical representations of time on said counter each time a sheet of paper is detected by the first and second sensors;

means for selectively accessing the stored electrical representations of time associated with the sensors; and, means for displaying the electrical representations of sheet travel time between the sensors.

2. In a reproduction machine for making copies from original documents, said machine including a document handler for transporting said documents between an input tray and an exposure platen at which images therefrom are produced, the improvement comprising:

a first and a second sensor disposed along the paper path in the document handler for detecting the presence of the documents as they travel between the tray and platen;

counter means for providing electrical representations of time;

memory means for storing the electrical representations of times generated by the counter;

means for continually updating the memory to store the electrical representations of time of the counter each time a document is detected by the sensors;

means for calculating the electrical representations of document travel time between the sensors; and, means for displaying the selected electrical representations of document travel time.

3. The improvement of claim 2 wherein said memory means includes dedicated locations for storing the electrical representations of time associated with each sensor; and means for selectively accessing the times stored in the memory means thereby permitting calculation of the document travel times between different sensors.

4. The improvement of claim 3 which further comprises:

an operator console having a plurality of input selection devices and a visual indicator; and, means for displaying on the console visual indicator selected document travel times in response to selection of appropriate console input devices by the user.

5. The improvement of claim 4 which further comprises:

means for continuously cycling the documents between the input tray and platen without making copies therefrom.

6. The improvement of claim 5 which further comprises:

means for comparing the document travel times between the sensors as each document is cycled through the document handler; and means for displaying the latest document travel time if different from the earlier time.

7. A method of monitoring and displaying the time it takes for a sheet of paper to travel between various locations along a paper path in a reproduction machine, with the presence of said sheets being detected by sensors in said locations, said machine including an operator console with a visual indicator and an input selection device, said machine having a plurality of components interacting in a timed relationship to form copies from original documents, with said component actuation being under the control of a programmable controller normally instructed by a copy control program stored in a memory, said method comprising:

providing a counter which provides electrical representations of time;

reading the time on the counter every time a sheet is detected by the sensors;

storing those times in specified memory locations;

storing at least one different program in the memory for controlling machine components for diagnostic purposes;

accessing said diagnostic program from the memory for instructing said controller;

activating said console selection device to access two of the stored times corresponding to the beginning and end portions of the paper path defined by two sensors;

subtracting the beginning time from the ending time thereby calculating the document travel time between the two sensors; and displaying on the console visual indicator the travel time between the two sensors.

8. The method of claim 7 wherein travel times between different sensors are sequentially displayed by each activation of the console selection device.

9. A method of testing an automatic document handler for proper operation, said document handler having an associated display and normally cooperating with other components in a reproduction machine to make copies, said method comprising:

circulating a first document through the document handler without making copies;

displaying a representation of the time it takes for the document to travel between two selected locations in the document handler;

circulating a second document through the document handler without making copies;

determining the travel time of the second document between said two selected locations;

comparing the representations of travel time of the two documents between the two selected locations; and displaying the representations of travel time of the second document if different from the first document.

* * * * *